US011445871B2

(12) United States Patent
Conrad

(10) Patent No.: US 11,445,871 B2
(45) **Date of Patent: *Sep. 20, 2022**

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 670 days.

This patent is subject to a terminal disclaimer.

(21) Appl. No.: 16/440,590

(22) Filed: Jun. 13, 2019

(65) Prior Publication Data

US 2019/0290082 A1 Sep. 26, 2019

Related U.S. Application Data

(63) Continuation-in-part of application No. 16/270,693, filed on Feb. 8, 2019, now Pat. No. 11,202,539, and (Continued)

(51) Int. Cl.

| | |
|---|---|
| ***A47L 9/16*** | (2006.01) |
| ***A47L 5/24*** | (2006.01) |
| ***A47L 9/12*** | (2006.01) |
| ***A47L 9/10*** | (2006.01) |
| ***A47L 5/28*** | (2006.01) |
| ***A47L 9/28*** | (2006.01) |

(Continued)

(52) U.S. Cl.

CPC ..... *A47L 5/24* (2013.01); *A47L 5/225* (2013.01); *A47L 5/28* (2013.01); *A47L 9/106* (2013.01); *A47L 9/122* (2013.01); *A47L 9/165* (2013.01); *A47L 9/1666* (2013.01); *A47L 9/1683* (2013.01); *A47L 9/1691* (2013.01); *A47L 9/22* (2013.01); *A47L 9/2868* (2013.01); *A47L 9/322* (2013.01)

(58) Field of Classification Search

CPC ... A47L 5/24; A47L 5/225; A47L 5/28; A47L 9/106; A47L 9/122; A47L 9/165; A47L 9/1666; A47L 9/1683; A47L 9/1691; A47L 9/22; A47L 9/2868; A47L 9/322

See application file for complete search history.

(56) References Cited

U.S. PATENT DOCUMENTS

| | | | |
|---|---|---|---|
| 4,260,401 | A | 4/1981 | Truhan et al. |
| 5,268,845 | A | 12/1993 | Startup et al. |

(Continued)

FOREIGN PATENT DOCUMENTS

| | | | |
|---|---|---|---|
| CA | 2420497 | C | 6/2011 |
| CN | 2647434 | Y | 10/2004 |

(Continued)

OTHER PUBLICATIONS

English machine translation of JP2011160820A, published on Aug. 25, 2011.

(Continued)

*Primary Examiner* — David Redding

(74) *Attorney, Agent, or Firm* — Philip C. Mendes da Costa; Bereskin & Parr LLP/S.E.N.C.R.L., s.r.l.

(57) ABSTRACT

A surface cleaning apparatus has a cyclone chamber. The cyclone chamber has an air inlet at a first end and an air outlet at an opposed end. A screen member extends from the air inlet to the air outlet at the opposed end.

12 Claims, 88 Drawing Sheets

Related U.S. Application Data a continuation-in-part of application No. 16/156,006, filed on Oct. 10, 2018, now Pat. No. 10,478,030, which is a continuation of application No. 15/095,941, filed on Apr. 11, 2016, now Pat. No. 10,258,208, which is a continuation of application No. 15/088,876, filed on Apr. 1, 2016, now Pat. No. 10,219,662, which is a continuation of application No. 14/822,211, filed on Aug. 10, 2015, now Pat. No. 9,888,817.

(60) Provisional application No. 62/093,189, filed on Dec. 17, 2014.

(51) Int. Cl.

| | |
|---|---|
| ***A47L 5/22*** | (2006.01) |
| ***A47L 9/32*** | (2006.01) |
| ***A47L 9/22*** | (2006.01) |

(56) References Cited

U.S. PATENT DOCUMENTS

| | | | |
|---|---|---|---|
| 5,402,059 | A | 3/1995 | Bittar |
| 5,694,029 | A | 12/1997 | Hayes et al. |
| 5,742,153 | A | 4/1998 | McEachern et al. |
| 5,798,633 | A | 8/1998 | Larsen et al. |
| 5,831,420 | A | 11/1998 | Myers |
| 6,031,357 | A | 2/2000 | Yano et al. |
| 6,081,104 | A | 6/2000 | Kern |
| 6,090,184 | A | 7/2000 | Cartellone |
| 6,195,835 | B1 | 3/2001 | Song et al. |
| 6,307,358 | B1 | 10/2001 | Conrad |
| 6,311,366 | B1 | 11/2001 | Sepke et al. |
| 6,457,205 | B1 | 10/2002 | Conrad |
| 6,547,856 | B2 | 4/2003 | Cartellone |
| 6,647,587 | B1 | 11/2003 | Ohara et al. |
| 6,890,375 | B2 | 5/2005 | Huber |
| 6,891,355 | B2 | 5/2005 | Kemahan |
| 6,909,266 | B2 | 6/2005 | Kemahan et al. |
| 7,135,051 | B2 | 11/2006 | Baldinger et al. |
| 7,159,270 | B2 | 1/2007 | Genoa et al. |
| 7,163,568 | B2 | 1/2007 | Sepke et al. |
| 7,171,724 | B2 | 2/2007 | Follegot et al. |
| 7,291,193 | B2 | 11/2007 | Oh et al. |
| 7,370,387 | B2 | 5/2008 | Walker et al. |
| 7,381,248 | B2 | 6/2008 | Kim et al. |
| 7,615,089 | B2 | 11/2009 | Oh |
| 7,645,309 | B2 | 1/2010 | Jeong et al. |
| 7,731,769 | B2 | 6/2010 | Min |
| 7,757,344 | B2 | 7/2010 | Min et al. |
| 8,152,877 | B2 | 4/2012 | Greene |
| 8,167,964 | B2 | 5/2012 | Wai |
| 8,225,456 | B2 | 7/2012 | Hkan et al. |
| 8,959,707 | B2 | 2/2015 | Maeda et al. |
| 9,034,067 | B2 | 5/2015 | Chen |
| 2001/0048295 | A1 | 12/2001 | Joch |
| 2002/0073663 | A1 | 6/2002 | Sepke et al. |
| 2002/0178701 | A1 | 12/2002 | Oh et al. |
| 2003/0173940 | A1 | 9/2003 | Dosani et al. |
| 2003/0200622 | A1 | 10/2003 | Park et al. |
| 2004/0051510 | A1 | 3/2004 | Saggini et al. |
| 2004/0095118 | A1 | 5/2004 | Kemahan |
| 2006/0037291 | A1 | 2/2006 | Oh et al. |
| 2006/0042039 | A1 | 3/2006 | McDowell et al. |
| 2006/0156508 | A1 | 7/2006 | Khalil |
| 2006/0236663 | A1 | 10/2006 | Oh |
| 2007/0200540 | A1 | 8/2007 | Hashimoto et al. |
| 2007/0209519 | A1 | 9/2007 | Conrad |
| 2007/0226946 | A1 | 10/2007 | Best |
| 2008/0040883 | A1 | 2/2008 | Beskow et al. |
| 2008/0134460 | A1 | 6/2008 | Conrad |
| 2008/0191675 | A1 | 8/2008 | Besser et al. |
| 2008/0244858 | A1 | 10/2008 | Shaver et al. |
| 2010/0083833 | A1 | 4/2010 | Morphey |
| 2010/0132319 | A1 | 6/2010 | Ashbee et al. |
| 2010/0175217 | A1 | 7/2010 | Conrad |
| 2010/0175219 | A1 | 7/2010 | Soen et al. |
| 2010/0229321 | A1 | 9/2010 | Dyson et al. |
| 2010/0242209 | A1 | 9/2010 | Beskow et al. |
| 2011/0289719 | A1 | 12/2011 | Han et al. |
| 2012/0222259 | A1 | 9/2012 | Conrad |
| 2016/0113459 | A1 | 4/2016 | Song |
| 2017/0008014 | A1 | 1/2017 | Van Wolferen et al. |
| 2017/0079494 | A1 | 3/2017 | Conrad |
| 2018/0325339 | A1 | 11/2018 | Conrad |

FOREIGN PATENT DOCUMENTS

| | | | |
|---|---|---|---|
| CN | 1969739 | A | 5/2007 |
| CN | 201082150 | Y | 7/2008 |
| CN | 201529088 | U | 7/2010 |
| CN | 102670134 | B | 10/2014 |
| CN | 106551654 | A | 4/2017 |
| EP | 1714703 | A2 | 10/2006 |
| EP | 2064981 | A1 | 3/2009 |
| EP | 2915473 | B1 | 1/2018 |
| FR | 2940901 | A1 | 7/2010 |
| GB | 2375980 | B | 8/2003 |
| GB | 2449484 | B | 4/2009 |
| JP | 2010227287 | A | 10/2010 |
| JP | 2011160820 | A | 8/2011 |
| JP | 51026273 | B2 | 1/2013 |
| KR | 100709418 | B1 | 4/2007 |
| WO | 95/22190 | A1 | 8/1995 |
| WO | 03/034566 | A1 | 4/2003 |
| WO | 03/090596 | A1 | 11/2003 |
| WO | 2004041054 | A1 | 5/2004 |
| WO | 2007136675 | A2 | 11/2007 |
| WO | 2008070962 | A1 | 6/2008 |
| WO | 2008145960 | A2 | 12/2008 |

OTHER PUBLICATIONS

English machine translation of JP2010227287, published on Oct. 14, 2010.

English machine translation of CN 1969739, published on May 30, 2007.

English machine translation of CN201082150, published on Jul. 9, 2008.

English machine translation of CN106551654, published on Apr. 5, 2017.

English machine translation of the Abstract, CN201529088, published on Jul. 21, 2010.

English machine translation of CN102670134B, published on Oct. 1, 2014.

English machine translation of KR100709418B1, published on Apr. 12, 2007.

English machine translation of JP510262273, published on Jan. 23, 2013.

English machine translation of CN2647434, published on Oct. 13, 2004.

English machine translation of FR2940901, published on Jul. 16, 2010.

21532a
21180a
21536a
21160a
21168a
21160b
21180b
21536b
21180b1
21532b
21180b2

21532c
21180c
21536c
21160c
21180d2
21532d
21180d1
21536d
21160d 21180e
21160e
21168e
21532e
21536e
21160f
21180f1
21532f
21536f
21180f2

21532g
21180g
21536g
21160g 21532h
21180h1
21536h
21160h
21180h2

21532i
21168i
21160i
21180i
21536i
21180j2
21160j
21536j
21532j
21180j1

21532k
21180k
21160k
21536k 21532l
21180l1
21536l
21160l

21180l2

SURFACE CLEANING APPARATUS

CROSS REFERENCE TO RELATED APPLICATIONS

This application is a continuation-in-part of U.S. patent application Ser. No. 16/270,693, filed on Feb. 8, 2019 which is a continuation of U.S. patent application Ser. No. 15/095,941, filed on Apr. 11, 2016, now issued as U.S. Pat. No. 10,258,208, each of which is incorporated herein in its entirety by reference. This application is also a continuation-in-part of U.S. patent application Ser. No. 16/156,006 filed on Oct. 10, 2018, which is a continuation of U.S. patent application Ser. No. 15/088,876 filed on Apr. 1, 2016, now issued as U.S. Pat. No. 10,219,662, which is a continuation of U.S. patent application Ser. No. 14/822,211, filed Aug. 10, 2015, now issued as U.S. Pat. No. 9,888,817, which claimed priority from U.S. Provisional Patent Application No. 62/093,189, filed Dec. 17, 2014, the entirety of each which are hereby incorporated by reference.

FIELD

The specification relates to surface cleaning apparatus. In a preferred embodiment, the surface cleaning apparatus comprises a portable surface cleaning apparatus, such as a hand vacuum cleaner.

Introduction

The following is not an admission that anything discussed below is part of the prior art or part of the common general knowledge of a person skilled in the art.

Various types of surface cleaning apparatus are known. Surface cleaning apparatus include vacuum cleaners. Currently, a vacuum cleaner typically uses at least one cyclonic cleaning stage. More recently, cyclonic hand vacuum cleaners have been developed. See for example, U.S. Pat. No. 7,931,716 and US 2010/0229328. Each of these discloses a hand vacuum cleaner which includes a cyclonic cleaning stage. U.S. Pat. No. 7,931,716 discloses a cyclonic cleaning stage utilizing two cyclonic cleaning stages wherein both cyclonic stages have cyclone axis of rotation that extends vertically. US 2010/0229328 discloses a cyclonic hand vacuum cleaner wherein the cyclone axis of rotation extends horizontally and is co-axial with the suction motor. In addition, hand carriable cyclonic vacuum cleaners are also known (see U.S. Pat. Nos. 8,146,201 and 8,549,703).

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In accordance with one aspect of this disclosure, a surface cleaning apparatus has a cyclone chamber and a porous member through which air travels as it exits the cyclone chamber (i.e., the porous member is at the interface of the cyclone chamber and the cyclone chamber outlet conduit). The porous member may be a screen or shroud and may be referred to herein as a screen member. The cyclone chamber has an air inlet at the first end and an air outlet at the opposed second end. The screen member, which may be tapered, may extend from the second end (the air outlet end) to the first end (the air inlet end). If the cyclone air inlet is provided inside the cyclone chamber, then the screen member may extend to a position adjacent (e.g., within 0.01, 0.05, 0.1 or 0.125 inches) of the end of the tangential inlet closest to the outlet end of the cyclone chamber. If the cyclone air inlet is external to the cyclone chamber and terminates at an inlet port in the cyclone chamber sidewall located at the first end of the cyclone chamber, then the screen member may extend to a position adjacent (e.g., within 0.01, 0.05, 0.1 or 0.125 inches) of the first end of the cyclone chamber or, alternately, adjacent (e.g., within 0.01, 0.05, 0.1 or 0.125 inches) the end of the inlet port closest to the outlet end of the cyclone chamber. An advantage of this design is that the surface area of the screen member may be increased while providing a cyclone with good separation efficiency. A tapered screen member may reduce the volume of dirt that is collected on the portion of the screen member located at the inlet end of the cyclone chamber as there may be a larger gap between the screen member and the cyclone chamber sidewall near to the cyclone chamber inlet. This may encourage larger dirt and debris to be collected at the inlet end of the cyclone chamber.

In accordance with this embodiment, there is provided a surface cleaning apparatus comprising an air flow path extending from a dirty air inlet to a clean air outlet with a cyclone and a suction motor positioned in the air flow path, the cyclone comprising:

(a) a cyclone chamber having a longitudinally extending cyclone axis of rotation, a first end, an opposed end spaced apart in a longitudinal axial direction from the first end, a tangential air inlet located at the first end, a cyclone air outlet located at the opposed end, a dirt outlet and a tapered screen member; and, (b) a dirt collection chamber exterior to the cyclone chamber and in communication with the cyclone chamber via the dirt outlet, the dirt collection chamber extending around at least 50% of an outer perimeter of the cyclone chamber, wherein the tangential inlet has an inlet width extending in the longitudinal axial direction from a first side to a second side spaced apart in a longitudinal axial direction from the first side wherein the second side of the tangential inlet is axially inwardly closer (e.g., rearwardly) to the opposed end than the first side of the tangential inlet is to the opposed end, and wherein the screen member has an outlet end located at the opposed end of the cyclone chamber and extends to distal screen end located adjacent the second side of the tangential inlet, the screen member tapers from the outlet end of the screen member to the distal screen end.

In some embodiments, the dirt collection chamber may extend around at least 75% of the outer perimeter of the cyclone chamber.

In some embodiments, the dirt collection chamber may extend around at least 85% of the outer perimeter of the cyclone chamber.

In some embodiments, the dirt collection chamber may be annular.

In some embodiments, the dirt collection chamber may comprise first and second discrete dirt collection chambers, and the cyclone chamber dirt outlet may comprise first and second dirt outlets, each of the first and second discrete dirt collection chambers may extend part way around the outer perimeter of the cyclone chamber, the first discrete dirt collection chamber is in communication with the cyclone chamber via the first dirt outlet and the second discrete dirt collection chamber is in communication with the cyclone chamber via the second dirt outlet.

In some embodiments, the tangential air inlet may comprise a conduit located interior the cyclone chamber.

In some embodiments, the distal end of the screen member may terminate 0.01-0.75 inches axially inwardly from the second side of the tangential inlet.

In some embodiments, the distal end of the screen member may terminate 0.05-0.375 inches axially inwardly from the second side of the tangential inlet.

In some embodiments, the distal end of the screen member terminates axially outwardly (e.g., forwardly) from the second side of the tangential inlet and a portion of the screen axially outwardly of the second side of the tangential inlet is solid.

In some embodiments, the screen member may have a non-porous portion at the opposed end of the cyclone chamber and the dirt outlet may be located radially outwardly of the non-porous portion.

In some embodiments, the second side of the tangential inlet may comprise a wall that is generally located in a plane that is transverse to the longitudinal axis.

In some embodiments, the second side of the tangential inlet may be a wall that is located in a plane that is generally transverse to the longitudinal axis.

In some embodiments, the cyclone chamber may have a cyclone chamber sidewall extending from the first end of the cyclone chamber to the dirt outlet and the cyclone chamber sidewall may have a radial width and the radial width narrows at a location between the second side of the tangential inlet and the opposed end of the cyclone chamber.

In accordance with this aspect, there is also provided a surface cleaning apparatus comprising an air flow path extending from a dirty air inlet to a clean air outlet with a cyclone and a suction motor positioned in the air flow path, the cyclone comprising:

(a) a cyclone chamber having a longitudinally extending cyclone axis of rotation, a first end, an opposed end spaced apart in a longitudinal axial direction from the first end, a tangential air inlet located at the first end, a cyclone air outlet located at the opposed end, a dirt outlet and a tapered screen member, the tangential air inlet terminating at an inlet port provided on a longitudinally extending sidewall of the cyclone chamber; and, (b) a dirt collection chamber exterior to the cyclone chamber and in communication with the cyclone chamber via the dirt outlet, the dirt collection chamber extending around at least 50% of an outer perimeter of the cyclone chamber, wherein the screen member has an outlet end located at the opposed end of the cyclone chamber and extends to distal screen end located adjacent the first end of the cyclone chamber, the screen member tapers from the outlet end of the screen member to the distal screen end.

In some embodiments, the dirt collection chamber may extend around at least 75% of the outer perimeter of the cyclone chamber.

In some embodiments, the dirt collection chamber may extend around at least 85% of the outer perimeter of the cyclone chamber.

In some embodiments, the dirt collection chamber may be annular.

In some embodiments, the dirt collection chamber may comprise first and second discrete dirt collection chambers, and the cyclone chamber dirt outlet may comprise first and second dirt outlets, each of the first and second discrete dirt collection chambers may extend part way around the outer perimeter of the cyclone chamber, the first discrete dirt collection chamber is in communication with the cyclone chamber via the first dirt outlet and the second discrete dirt collection chamber is in communication with the cyclone chamber via the second dirt outlet.

In some embodiments, the distal end of the screen member may terminate 0.01-0.75 inches from the first end of the cyclone chamber.

In some embodiments, the distal end of the screen member may terminate 0.05-0.375 inches from the first end of the cyclone chamber.

In some embodiments, the screen member may have a non-porous portion at the opposed end of the cyclone chamber and the dirt outlet is located radially outwardly of the non-porous portion.

In another aspect of this disclosure, a surface cleaning apparatus is provided with a cyclone chamber which has a dirt outlet provided by a port or opening in the cyclone chamber sidewall at a location between the first and second ends of the cyclone chamber sidewall. The port may extend part way or all the way around the cyclone chamber sidewall. This may encourage finer dirt to in the dirt collection chamber regardless of the orientation of the surface cleaning apparatus, while coarser dirt collects in the cyclone chamber.

In accordance with this aspect, there is provided a surface cleaning apparatus comprising an air flow path extending from a dirty air inlet to a clean air outlet with a cyclone and a suction motor positioned in the air flow path, the cyclone comprising:

(a) a cyclone chamber having a longitudinally extending cyclone axis of rotation, a first end, an opposed end spaced apart in a longitudinal axial direction from the first end, a cyclone chamber sidewall, a cyclone air inlet located at the first end, a cyclone air outlet located at the opposed end, a dirt outlet and a screen member; and, (b) a dirt collection chamber exterior to the cyclone chamber and in communication with the cyclone chamber via the dirt outlet, wherein the cyclone chamber sidewall has a first end and a second end spaced apart in a longitudinal axial direction from the first end of the sidewall, wherein the dirt outlet is provided between the first and second ends of the sidewall.

In some embodiments, the second end of the sidewall may be located at the opposed end of the cyclone chamber.

In some embodiments, the screen member may have a porous portion and the dirt outlet is located radially outwardly of the porous portion.

In some embodiments, the cyclone chamber sidewall may have a radial width and the radial width may narrow at a location between the first end and the opposed end of the cyclone chamber.

In some embodiments, the cyclone air inlet may be a tangential inlet having an inlet width extending in the longitudinal axial direction from a first side to a second side spaced apart in the longitudinal axial direction from the first side wherein the second side of the tangential inlet maybe closer to the opposed end of the cyclone chamber than the first side of the tangential inlet is to the opposed end, and the radial width may narrow at a location between the second side of the tangential inlet and the opposed end of the cyclone chamber.

In some embodiments, at least one of the first end of the cyclone chamber and the opposed end of the cyclone chamber maybe an openable end of the cyclone chamber that is moveable between a closed position and an open position and a portion of the sidewall is moveable with the openable end of the cyclone chamber.

In some embodiments, the first end may be the openable end, a first portion of the sidewall may extend from the first end to the dirt outlet and the first portion may be moveable with the first end of the cyclone chamber.

In some embodiments, a second portion of the sidewall may extend from the opposed end to the dirt outlet and the second portion may be secured to a radial outer wall of the dirt collection chamber.

In some embodiments, the opposed end may be the openable end, a second portion of the sidewall may extend from the opposed end to the dirt outlet and the second portion and the screen member may be moveable with the opposed end of the cyclone chamber.

In some embodiments, a first portion of the sidewall may extend from the first end to the dirt outlet and the first portion may be secured to a radial outer wall of the dirt collection chamber.

In some embodiments, the dirt collection chamber may extend around at least a portion of an outer perimeter of the cyclone chamber and the cyclone chamber may be eccentrically positioned with respect to the dirt collection chamber.

In some embodiments, the dirt collection chamber may extend around at least 85% of the outer perimeter of the cyclone chamber.

In some embodiments, the dirt collection chamber may be annular.

In some embodiments, the dirt collection chamber may comprise first and second discrete dirt collection chambers, and the cyclone chamber dirt outlet may comprise first and second dirt outlets, each of the first and second discrete dirt collection chambers may extend part way around the outer perimeter of the cyclone chamber, the first discrete dirt collection chamber is in communication with the cyclone chamber via the first dirt outlet and the second discrete dirt collection chamber is in communication with the cyclone chamber via the second dirt outlet.

In some embodiments, the dirt collection chamber may have a radial outer wall and the radial outer wall is non-circular.

In some embodiments, the cyclone air inlet may be a tangential inlet having a conduit portion interior the cyclone chamber and the screen member may have an outlet end located at the opposed end of the cyclone chamber and the screen member may extend to distal screen end located adjacent an axially inner side of the inlet conduit.

In some embodiments, the distal end of the screen member may terminate 0.01-0.75 inches axially inwardly from the second side of the tangential inlet.

In some embodiments, the distal end of the screen member terminates axially outwardly (e.g., forwardly) from the second side of the tangential inlet and a portion of the screen axially outwardly of the second side of the tangential inlet is solid.

In some embodiments, the cyclone air inlet may be a tangential air inlet terminating at an inlet port provided on the cyclone chamber sidewall and the screen member may have an outlet end located at the opposed end of the cyclone chamber and the screen member may extend to distal screen end located adjacent the first end of the cyclone chamber.

In some embodiments, the distal end of the screen member may terminate 0.01-0.75 inches from the first end of the cyclone chamber.

In another aspect of this disclosure, a surface cleaning apparatus is provided with a cyclone chamber and a dirt collection chamber exterior to the cyclone chamber. The cyclone chamber has an inlet end and an axially spaced apart (opposed) outlet end. The dirt collection chamber has a downstream end spaced axially inward from the outlet end of the cyclone chamber. The cyclone chamber has a dirt outlet provided by a port or opening in the cyclone chamber sidewall. The port may extend part way or all the way around the cyclone chamber sidewall. This may encourage finer dirt to in the dirt collection chamber regardless of the orientation of the surface cleaning apparatus, while coarser dirt collects in the cyclone chamber.

In accordance with this aspect, there is provided a surface cleaning apparatus comprising an air flow path extending from a dirty air inlet to a clean air outlet with a cyclone and a suction motor positioned in the air flow path, the cyclone comprising:

(a) a cyclone chamber having a longitudinally extending cyclone axis of rotation, a first end, an opposed end spaced apart in a longitudinal axial direction from the first end, a cyclone chamber sidewall, a cyclone air inlet located at the first end, a cyclone air outlet located at the opposed end, a dirt outlet and a screen member; and, (b) a dirt collection chamber exterior to the cyclone chamber and in communication with the cyclone chamber via the dirt outlet, wherein the dirt collection chamber has first and second axially opposed ends, the second end of the dirt collection chamber is located closer to the opposed end of the cyclone chamber than the first end of the dirt collection chamber is to the opposed end of the cyclone chamber and the second end of the dirt collection chamber has a second end wall that is spaced axially inwardly from the opposed end of the cyclone chamber.

In some embodiments, the first end of the dirt collection chamber may be located at the first end of the cyclone chamber.

In some embodiments, the screen member may have a porous portion and the dirt outlet is located radially outwardly of the porous portion.

In some embodiments, the cyclone chamber sidewall may have a radial width and the radial width widens at the second end of the dirt collection chamber.

In some embodiments, the cyclone air inlet may be a tangential inlet having an inlet width extending in the longitudinal axial direction from a first side to a second side spaced apart in the longitudinal axial direction from the first side wherein the second side of the tangential inlet may be closer to the opposed end of the cyclone chamber than the first side of the tangential inlet is to the opposed end, and the radial width may widen at a location between the second side of the tangential inlet and the opposed end of the cyclone chamber.

In some embodiments, the first end of the cyclone chamber may be an openable end of the cyclone chamber that is moveable between a closed position and an open position and a portion of the sidewall may be moveable with the openable end of the cyclone chamber.

In some embodiments, a first portion of the sidewall may extend from the first end to the dirt outlet and the first portion may be moveable with the first end of the cyclone chamber.

In some embodiments, the second end wall may be secured to the cyclone chamber sidewall.

In some embodiments, the second end wall may extend in a plane that is generally transverse to the longitudinal axis.

In some embodiments, the second end wall may extend from the cyclone chamber sidewall inwardly and longitudinally towards the first end of the cyclone chamber.

In some embodiments, the dirt collection chamber may extend around at least a portion of an outer perimeter of the cyclone chamber and the cyclone chamber may be eccentrically positioned with respect to the dirt collection chamber.

In some embodiments, the dirt collection chamber may extend around at least 85% of the outer perimeter of the cyclone chamber.

In some embodiments, the dirt collection chamber may be annular.

In some embodiments, the dirt collection chamber may comprise first and second discrete dirt collection chambers, and the cyclone chamber dirt outlet may comprise first and second dirt outlets, each of the first and second discrete dirt collection chambers may extend part way around the outer perimeter of the cyclone chamber, the first discrete dirt collection chamber is in communication with the cyclone chamber via the first dirt outlet and the second discrete dirt collection chamber is in communication with the cyclone chamber via the second dirt outlet.

In some embodiments, the dirt collection chamber may have a radial outer wall and the radial outer wall is non-circular.

In some embodiments, the cyclone air inlet may be a tangential inlet having a conduit portion interior the cyclone chamber and the screen member may have an outlet end located at the opposed end of the cyclone chamber and the screen member may extend to distal screen end located adjacent an axially inner side of the inlet conduit.

In some embodiments, the distal end of the screen member may terminate 0.01-0.75 inches from the second side of the tangential inlet.

In some embodiments, the cyclone air inlet may be a tangential air inlet terminating at an inlet port provided on the cyclone chamber sidewall and the screen member may have an outlet end located at the opposed end of the cyclone chamber and the screen member may extend to distal screen end located adjacent the first end of the cyclone chamber.

In some embodiments, the distal end of the screen member may terminate 0.01-0.75 inches from the first end of the cyclone chamber.

In an aspect of this disclosure, a surface cleaning apparatus may be provided with a cyclone chamber having a screen member and a dirt collection chamber exterior to the cyclone chamber with a dirt outlet of the cyclone chamber positioned in an upstream end wall of the dirt collection chamber. This may help prevent separated dirt from becoming re-entrained in the air swirling in the cyclone chamber.

In accordance with this aspect, there is provided a surface cleaning apparatus comprising an air flow path extending from a dirty air inlet to a clean air outlet with a cyclone and a suction motor positioned in the air flow path, the cyclone comprising:

(a) a cyclone chamber having a longitudinally extending cyclone axis of rotation, a first end, an opposed end spaced apart in a longitudinal axial direction from the first end, a cyclone chamber sidewall, a cyclone air inlet located at the first end, a cyclone air outlet located at the opposed end, a dirt outlet and a screen member; and, (b) a dirt collection chamber exterior to the cyclone chamber and in communication with the cyclone chamber via the dirt outlet, wherein the dirt collection chamber has first and second axially opposed ends, the second end of the dirt collection chamber is located closer to the opposed end of the cyclone chamber than the first end of the dirt collection chamber is to the opposed end of the cyclone chamber and the first end of the dirt collection chamber has a first end wall that is spaced axially inwardly from the opposed end of the cyclone chamber, and the dirt outlet is provided in the first end wall.

In some embodiments, the dirt outlet may be provided between a radial outer end of the first end wall and the cyclone chamber sidewall.

In some embodiments, the screen member may have a non-porous portion at the opposed end of the cyclone chamber and the dirt collection chamber may be located radially outwardly of the non-porous portion.

In some embodiments, the screen member may have a non-porous portion at the opposed end of the cyclone chamber and the dirt outlet may be located radially outwardly of the non-porous portion.

In some embodiments, the opposed end of the cyclone chamber may be an openable end of the cyclone chamber that is moveable between a closed position and an open position and the first end wall may be moveable with the openable end of the cyclone chamber.

In some embodiments, the screen member may be moveable with the opposed end of the cyclone chamber.

In some embodiments, the screen member may have a porous portion and the porous portion is secured to the cyclone chamber sidewall.

In some embodiments, the dirt collection chamber may extend around at least a portion of the screen member and the dirt outlet may be provided at an axially inward end of all portions of the dirt collection chamber.

In some embodiments, the dirt collection chamber may extend around at least 85% of the screen member.

In some embodiments, the dirt collection chamber may extend around at least a portion of the screen member and the dirt outlet may be provided at an axially inward end of all portions of the dirt collection chamber.

In some embodiments, the dirt collection chamber may be annular.

In some embodiments, the dirt collection chamber may comprise first and second discrete dirt collection chambers, and the cyclone chamber dirt outlet may comprise first and second dirt outlets, each of the first and second discrete dirt collection chambers may extend part way around the outer perimeter of the screen member, the first discrete dirt collection chamber is in communication with the cyclone chamber via the first dirt outlet and the second discrete dirt collection chamber is in communication with the cyclone chamber via the second dirt outlet.

In some embodiments, the dirt collection chamber may have a radial outer wall and the radial outer wall is non-circular.

In some embodiments, the cyclone air inlet may be a tangential inlet having a conduit portion interior the cyclone chamber and the screen member may have an outlet end located at the opposed end of the cyclone chamber and the screen member may extend to distal screen end located adjacent an axially inner side of the inlet conduit.

In some embodiments, the distal end of the screen member may terminate 0.01-0.75 inches from the second side of the tangential inlet.

In some embodiments, the distal end of the screen member may terminate 0.05-0.375 inches from the second side of the tangential inlet.

In some embodiments, the cyclone air inlet may be a tangential air inlet terminating at an inlet port provided on the cyclone chamber sidewall and the screen member may have an outlet end located at the opposed end of the cyclone chamber and the screen member may extend to distal screen end located adjacent the first end of the cyclone chamber.

In some embodiments, the distal end of the screen member may terminate 0.01-0.75 inches from the first end of the cyclone chamber.

In some embodiments, the distal end of the screen member may terminate 0.05-0.375 inches from the second side of the tangential inlet.

It will be appreciated that the aspects and embodiments may be used in any combination or sub-combination.

DRAWINGS

The drawings included herewith are for illustrating various examples of articles, methods, and apparatuses of the teaching of the present specification and are not intended to limit the scope of what is taught in any way.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

Referring to FIGS. 1-13, 26 and 35A-35C, an example embodiment of a surface cleaning apparatus 100 is shown. The following is a general discussion of this embodiment which provides a basis for understanding each of the features which is discussed herein. As discussed in detail subsequently, each of the features may be used in other embodiments.

Figure 13:
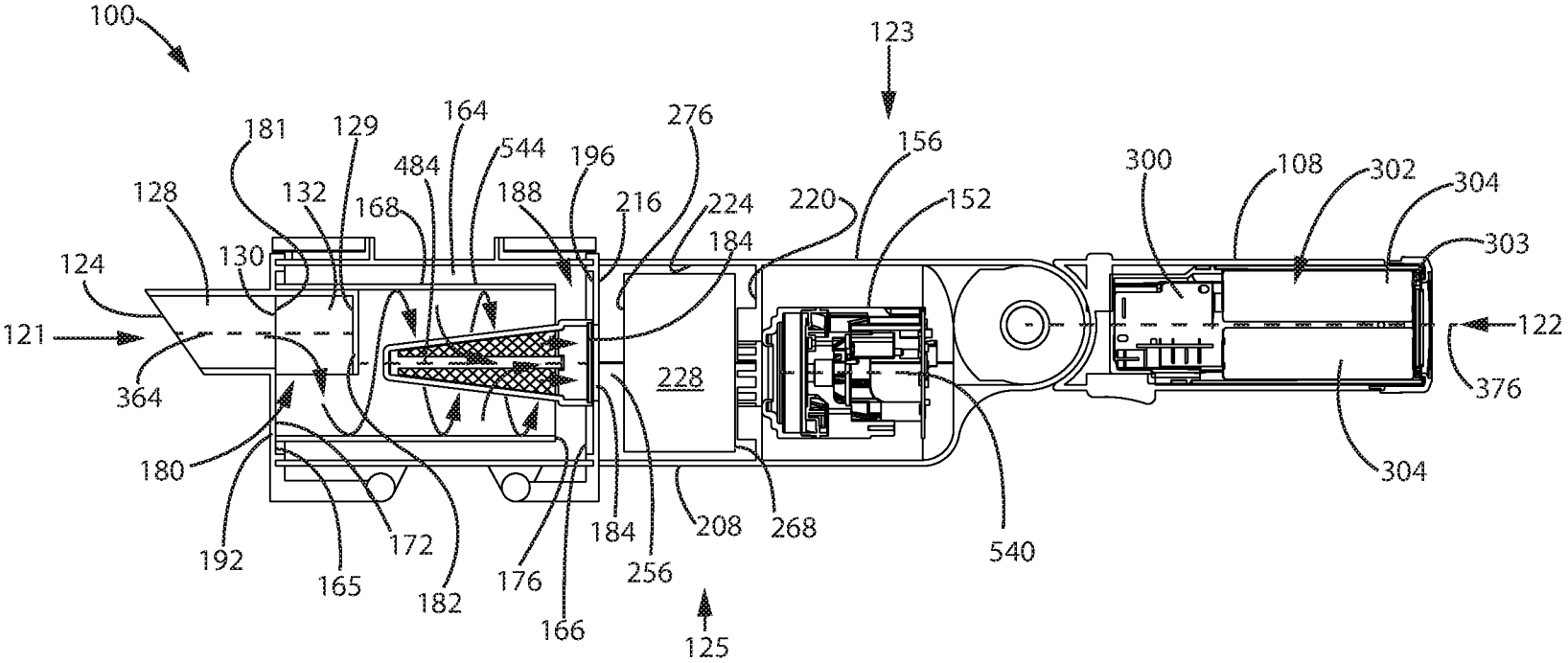
FIG. 13 is a sectional view of the surface cleaning apparatus of FIG. 1 taken along line 13-13 in FIG. 1.
Figure 13B:
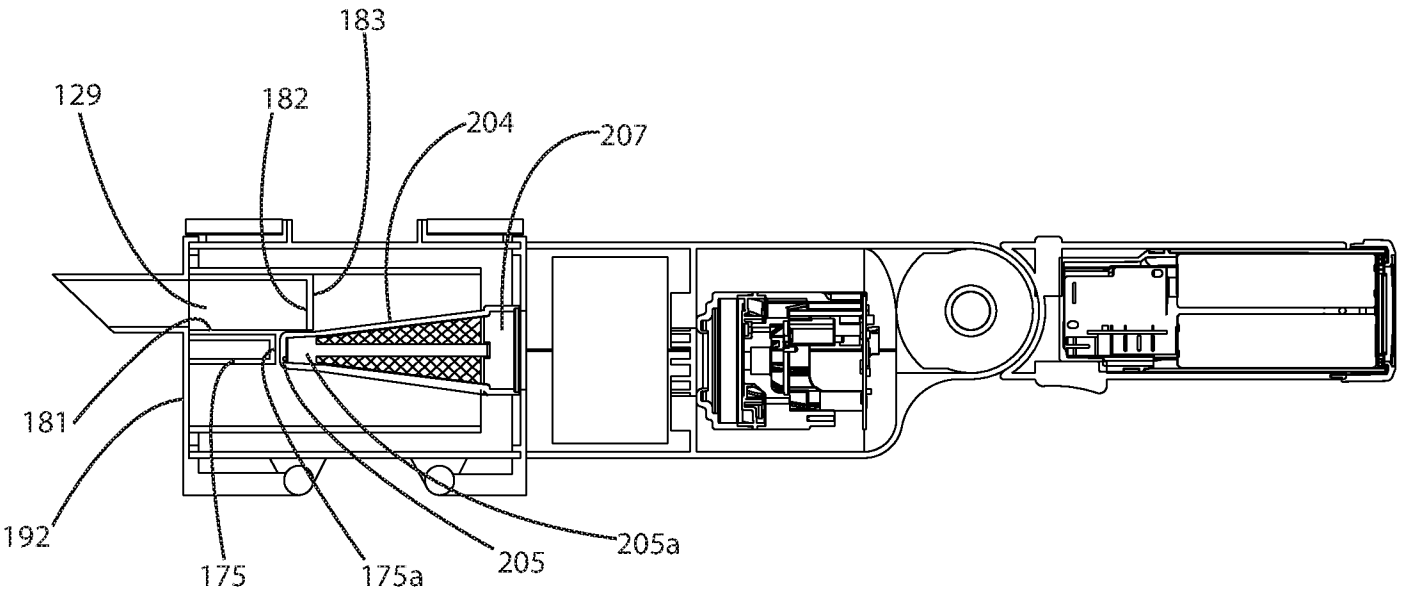
FIG. 13B is a cross-sectional view of an alternate surface cleaning apparatus.
Figure 13C:
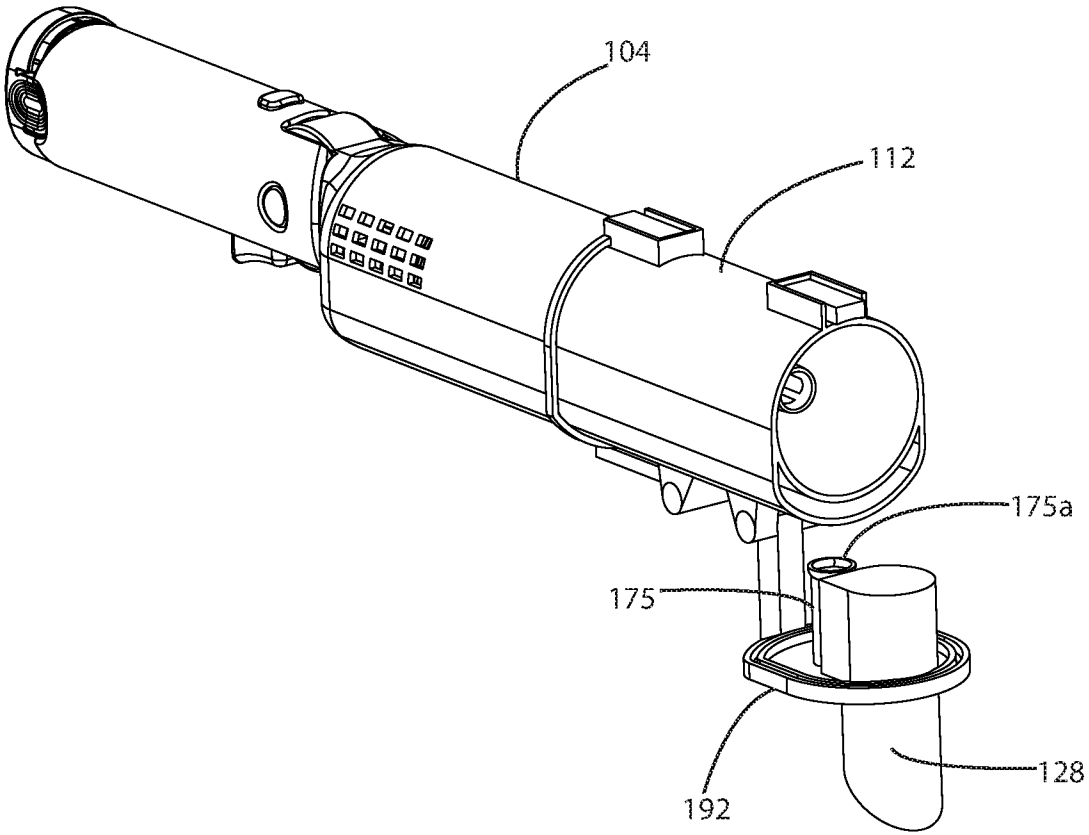
FIG. 13C is a perspective view of the surface cleaning apparatus of FIG. 13B.
Figure 14:
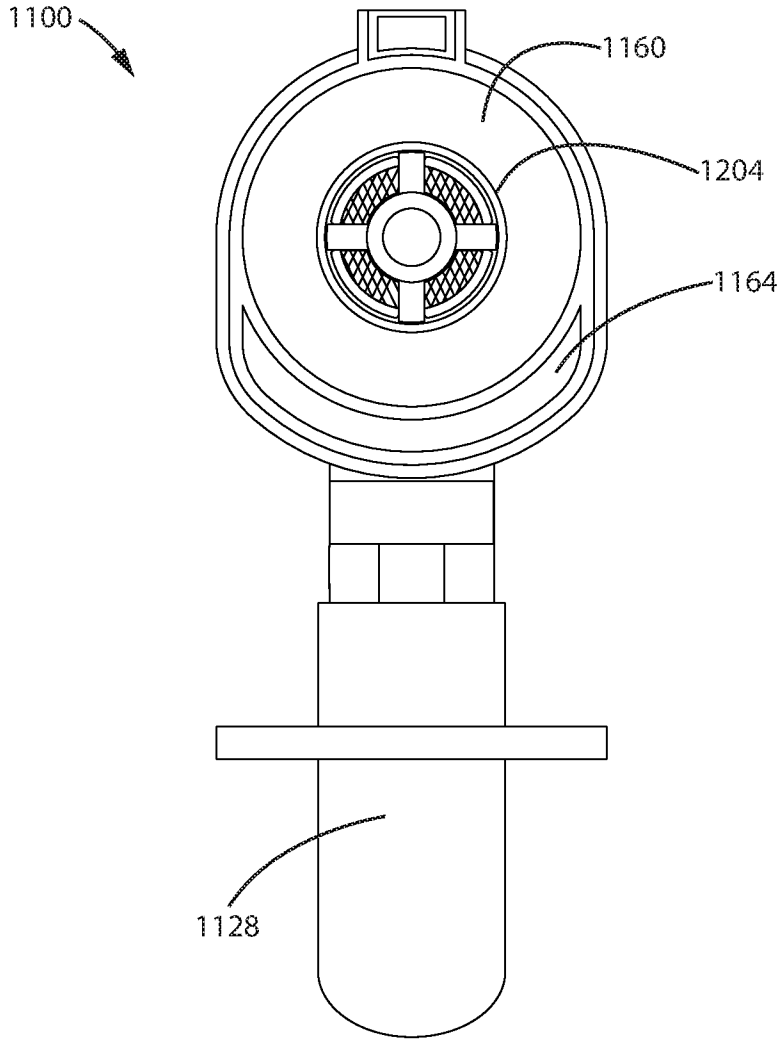
FIG. 14 is a front view of another example surface cleaning apparatus in accordance with at least one embodiment with a front door in an open position.

In FIG. 14 and following, similar components of the surface cleaning apparatus have been indicated using reference characters with additional digits in front of the three digit reference characters used in FIGS. 1-13. Accordingly, for example, in FIG. 14, the reference characters are increased by 1000 with respect to surface cleaning apparatus 100.

In the embodiment illustrated, the surface cleaning apparatus 100 is a hand-held vacuum cleaner, which is commonly referred to as a "hand vacuum cleaner" or a "handvac". As used herein and in the claims, a hand-held vacuum cleaner or hand vacuum cleaner or handvac is a vacuum cleaner that can be operated one-handedly to clean a surface while its weight is held by the same one hand. This is contrasted with upright and canister vacuum cleaners, the weight of which is supported by a surface (e.g. floor below) during use. Optionally, surface cleaning apparatus 100 could be removably mountable on a base so as to form, for example, an upright vacuum cleaner, a canister vacuum cleaner, a stick vac, a wet-dry vacuum cleaner and the like. Alternately, the cyclone design could be used in any other surface cleaning apparatus such as an upright vacuum cleaner wherein the cyclone is provided in the upright section or wherein the cyclone could be the upright section that is pivotally mounted to a surface cleaning head (see for example FIGS. 80 and 81).

Power can be supplied to the surface cleaning apparatus 100 by an electrical cord (not shown) that can be connected to a standard wall electrical outlet. Alternatively, or in addition, the power source for the surface cleaning apparatus can be an onboard energy storage device 302, including, for example, one or more batteries 304 (see FIG. 13).

As exemplified in FIGS. 1-13, the surface cleaning apparatus 100 may comprise a main body 104 having a handle 108, an air treatment member 112 connected to the main body 104, a dirty air inlet 116, a clean air outlet 120, and an air flow path extending between the inlet 116 and outlet 120. Surface cleaning apparatus 100 includes a front end 121, a rear end 122, an upper end 123, and a bottom 125. In the embodiment shown, the dirty air inlet 116 is at the front end 121. As exemplified, dirty air inlet 116 is the inlet end 124 of an inlet passage 128. Dirty air inlet 116 may be positioned forward of air treatment member 112 as shown. Optionally, the inlet end 124 can be used as a nozzle to directly clean a surface. Alternatively, the inlet end 124 can be connected or directly connected to the downstream end of any suitable accessory tool such as a rigid air flow conduit (e.g. wand, crevice tool, mini brush or the like) for example or to a wand that forms part of a stick vac as exemplified in FIG. 79).

From the dirty air inlet 116, the air flow path may extend through an air treatment member 112. The air treatment member 112 may be any suitable member that can treat the air in a desired manner, including, for example, removing dirt particles and debris from the air. In the illustrated example, the air treatment member is a cyclone unit 112.

Figure 3:
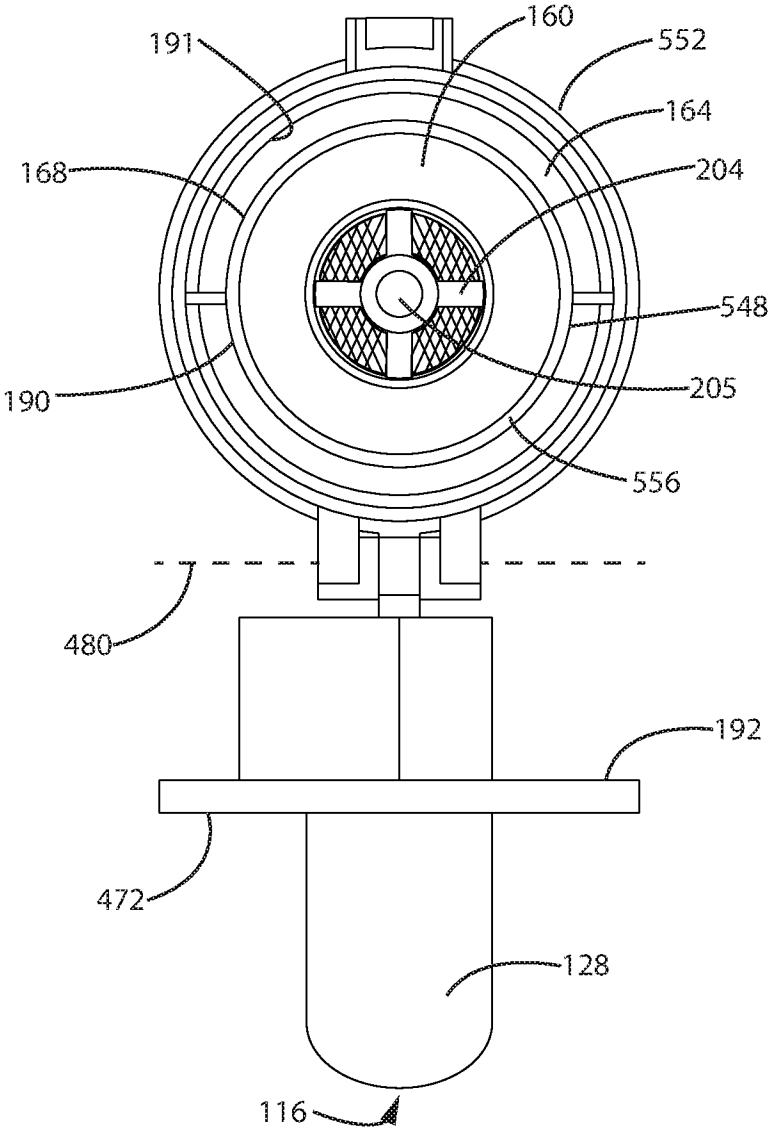
FIG. 3 is a front view of the surface cleaning apparatus of FIG. 1 with a front wall of the cyclone unit in an open position.

Cyclone unit 112 may include one or a plurality of cyclones for separating dirt from the air flow, and one or a plurality of dirt collection regions for receiving dirt separated in the cyclone(s). As exemplified in FIGS. 3, 4, 12 and 13, cyclone unit 112 includes a cyclone or cyclone chamber 160 and an external dirt collection chamber 164. The cyclone 160 and dirt collection chamber 164 may be of any configuration suitable for separating dirt from an air stream and collecting the separated dirt, respectively. For example, it will be appreciated that in some embodiments the dirt collection area may share an outer wall with the cyclone chamber, e.g., a dirt collection area may be provided at a longitudinal end of the cyclone chamber (see e.g. FIGS. 40-42 and 60-62). Alternatively or in addition, in some embodiments the cyclone unit 112 may include a dirt collection area 164 exterior to the cyclone chamber 160 as shown in FIG. 3 for example.

Cyclone 160 may be oriented in any direction. For example, when surface cleaning apparatus 100 is positioned with bottom 125 on a horizontal surface, cyclone axis of rotation 484 may be oriented horizontally as exemplified, vertically, or at any angle between horizontal and vertical.

Figure 12:
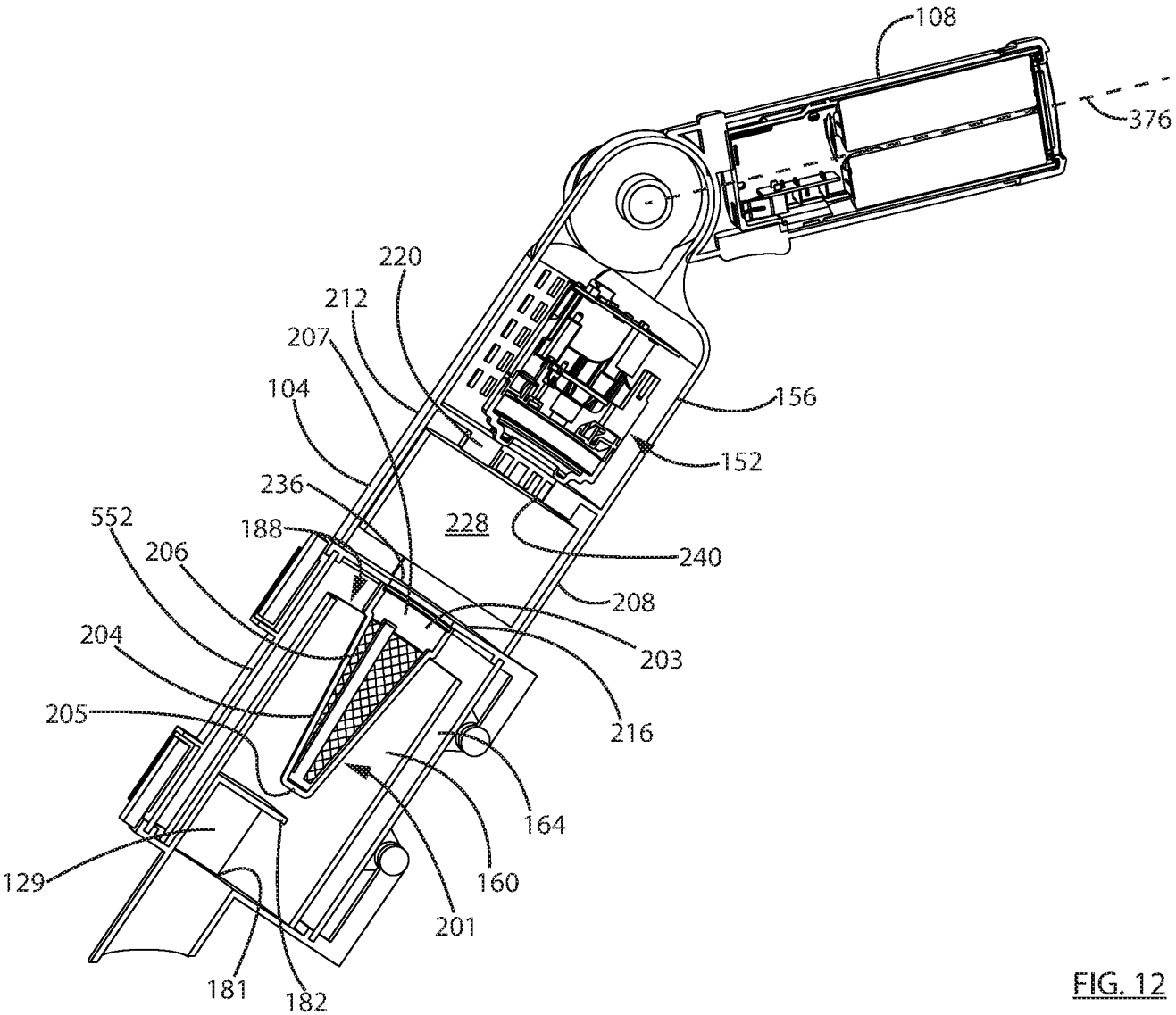
FIG. 12 is a perspective sectional view of the surface cleaning apparatus of FIG. 1 taken along line 13-13 in FIG. 1 with the handle in the second use position.

As also exemplified in FIGS. 12 and 13, a suction motor and fan assembly 152 may be mounted within a motor housing portion 156 of the main body 104. In this configuration, the suction motor and fan assembly 152 is downstream from the cyclone unit 112, and the clean air outlet 120 is downstream from the suction motor and fan assembly 152.

The suction motor and fan assembly 152 may be oriented in any direction. For example, when surface cleaning apparatus 100 is positioned with bottom 125 on a horizontal surface, suction motor axis of rotation 540 may be oriented horizontally as exemplified, vertically, or at any angle between horizontal and vertical.

Figure 25:
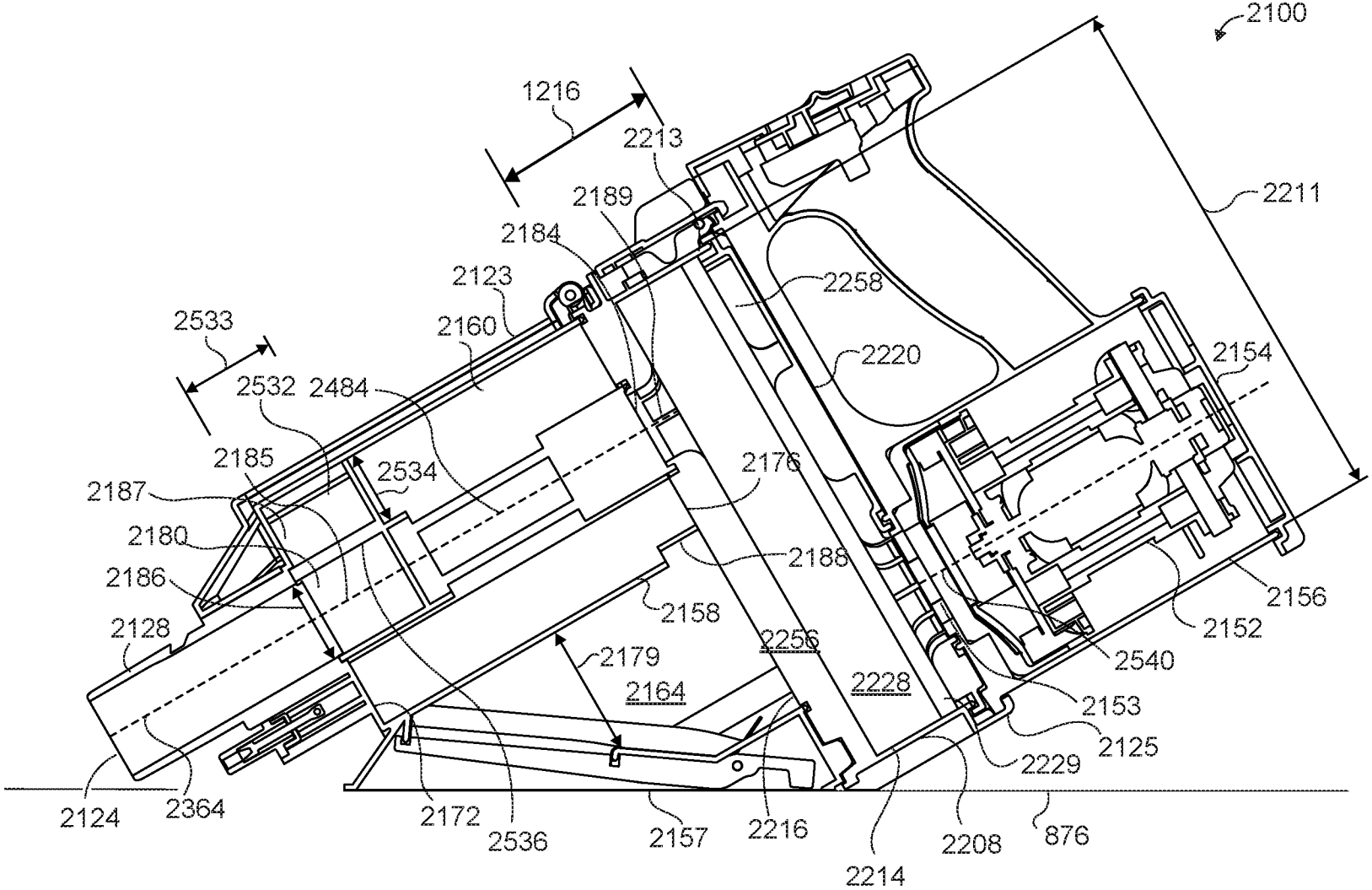
FIG. 25 is a cross-sectional view taken along line 25-25 in FIG. 24.

As exemplified in FIG. 13, in some embodiments the axis of rotation 540 of the suction motor may be generally parallel to the cyclone axis of rotation 484 and/or the inlet conduit axis 364 (see also FIG. 25 for example). An advantage of this design is that the air may travel generally rearwardly from the cyclone air outlet 184 to the suction motor air inlet, thereby reducing the backpressure through this portion of the vacuum cleaner 100 due to a reduction in the number of bends in the air flow path.

In the example illustrated, the axis of rotation of the suction motor 540 and the cyclone axis of rotation 484 can be aligned (co-axial). This may further reduce the number of bends in the airflow path.

Alternately, as shown for example in FIG. 25 the suction motor axis of rotation 2540 may be positioned below cyclone axis of rotation 2484. This may provide surface cleaning apparatus 2100 with a relatively lower center of gravity for greater stability when surface cleaning apparatus 2100 is positioned with bottom 2125 below upper end 2123.

As exemplified in FIG. 25, handvac inlet 2180 is shown positioned at a front end 2172 of cyclone chamber 2160, and outlet 2184 is shown positioned at a rear end 2176 of cyclone chamber 2160. Inlet 2180 may have an inlet axis 2185 that is parallel to the outlet axis 2189 of air outlet 2184. In the illustrated embodiment, inlet axis 2185 is co-axial with outlet axis 2189.

Optionally, the suction motor axis 2540 may be parallel to or co-axial with axis 2185, 2189. Accordingly, air may travel in a generally uniform direction through the components of the handvac.

As exemplified in FIG. 25, handvac inlet nozzle 2128 may extend in length from an upstream nozzle end 2124 rearwardly along a nozzle axis 2364, handvac cyclone chamber 2160 may extend from an air inlet 2180 along a cyclone axis 2484 to an air outlet 2184, and handvac suction motor 2152 may extend from a motor inlet 2153 along a motor axis 2540 to a motor outlet 2154.

In some embodiments, two or more of nozzle axis 2364, cyclone axis 2484, and motor axis 2540 may be parallel and optionally co-axial. For example, in the illustrated embodiment, nozzle axis 2364, cyclone axis 2484, and motor axis 2540 are parallel. In some embodiments, two or more of nozzle axis 2364, cyclone axis 2484, and motor axis 2540 may be co-axial. For example, in the illustrated embodiment, nozzle axis 2364 and cyclone axis 2484 are co-axial. In other embodiments, nozzle axis 2364, cyclone axis 2484, and motor axis 2540 may all be co-axial.

Optionally, one or more pre-motor filters may be placed in the air flow path between the air treatment member and the suction motor and fan assembly. Alternatively, or in addition, one or more post-motor filters may be provided downstream from the suction motor and fan assembly.

As exemplified in FIGS. 12 and 13, main body 104 is shown including a pre-motor filter housing portion 208 that is positioned in the air flow path downstream of cyclone unit 112. Pre-motor filter housing 208 may be of any construction known in the vacuum cleaner art. As exemplified, filter housing 208 may be bounded by one or more walls, which may be integral with or discrete from the main body exterior walls 212. In the example shown, the walls of filter housing portion 208 are integral with the walls of the motor housing portion 156. Alternatively, the filter housing portion 208 may be formed separately from the motor housing portion 156.

Turning to FIG. 13, pre-motor filter housing 208 is shown including a filter housing first wall 216 axially opposite a filter housing second wall 220, and a filter housing sidewall 224 that extends in the direction of the cyclone axis of rotation between the optional first and second walls 216 and 220. It will be appreciated one of first wall 216 and second wall 220 may be in the form of ribs to hold the filter in place. In some embodiments, the filter housing sidewall 224 may be defined in whole or in part by main body exterior walls 212. In the illustrated example, filter housing sidewall 224 is defined by the main body exterior walls 212, which may provide a more compact design for surface cleaning apparatus 100. Alternatively, filter housing sidewall 224 may be discrete from main body exterior walls 212, which may provide enhanced sound insulation for air passing through the pre-motor filter housing 208.

Referring to FIGS. 12 and 13, one or more filters made of or comprising a porous filter media may be positioned within the pre-motor filter housing 208 to filter particles remaining in the air flow exiting the cyclone air outlet 184, before the air flow passes through the suction motor and fan assembly 152. In the illustrated embodiments, pre-motor filter housing 208 contains a pre-motor filter 228. The pre-motor filter 228 may be of any suitable configuration and formed from any suitable materials. For example, the pre-motor filter 228 can be made of porous media such as foam, felt, or filter paper. In some embodiments, the pre-motor filter housing 208 may contain multiple filters, such as an upstream filter and a downstream filter. For example, a foam pre-motor filter may be provided upstream of a felt pre-motor filter.

Pre-motor filter housing 208 may include a filter housing air inlet and a filter housing air outlet of any suitable design and arrangement within the housing 208. In the illustrated embodiment, pre-motor filter housing 208 includes a filter housing air inlet 236 formed in filter housing first wall 216, and a filter housing air outlet 240 formed in filter housing second wall 220.

Still referring to FIG. 13, pre-motor filter housing 208 may promote the air flow to broadly distribute across the pre-motor filter 228 inside. This allows the collected dust particles to be more evenly distributed throughout pre-motor filter 228 instead of concentrating in a narrow air flow path. An advantage of this design is that the pre-motor filter 228 will have a greater effective dirt capacity, which allows the pre-motor filter to be cleaned or replaced less frequently. To this end, pre-motor filter housing 208 may have any structure suitable for broadly distributing the air flow across pre-motor filter 228. For example, pre-motor filter housing 208 may provide an upstream header 256 (as shown), a downstream header, or both. Header 256 may be provided by spacing the pre-motor filter(s) from the filter housing end walls 216 and 220 respectively.

In the example illustrated in FIG. 13, the pre-motor filter air inlet 236 and air outlet 240 are generally aligned. This may promote a generally linear airflow through the pre-motor filter housing 208. As shown, the pre-motor filter air inlet 236 and air outlet 240 are generally aligned with the cyclone axis of rotation 484 and the suction motor axis of rotation 540. This may further reduce the number of bends in the air flow passage through the surface cleaning apparatus 100 and thereby reduce backpressure.

Alternately, the pre-motor filter air inlet 236 and/or air outlet 240 may not be aligned with either or both of the cyclone axis of rotation 484 and suction motor axis of rotation 540. In some cases, the pre-motor filter air inlet 236 and air outlet 240 may be offset relative to one another.

For example, in an embodiment in which the suction motor axis of rotation 2540 is positioned below the cyclone axis of rotation 2484, the pre-motor filter air inlet 2236 may be axially offset from the pre-motor filter air outlet 2240 as shown in FIG. 25. In the illustrated example, the filter housing air inlet 2236 is located above and spaced apart from filter housing air outlet 2240. An advantage of this design is that one or both of the filter housing headers may be used to change to elevation at which the air travels rearwardly with without using a conduit with bends. For example, air may travel generally rearwardly (linearly) into the pre-motor filter housing and air may travel generally rearwardly (linearly) out of the pre-motor filter housing, but at a lower elevation.

As shown in FIG. 25, handvac 2100 has a pre-motor filter chamber 2208 containing pre-motor filters 2228 and 2229, and a suction motor housing 2156 containing suction motor 2152. The airflow path from inlet nozzle 2128 to clean air outlet 2120 may extend downstream from cyclone bin assembly 2112 to pre-motor filter chamber 2208 to suction motor housing 2156. That is, cyclone bin assembly 2120, pre-motor filter chamber 2208, and suction motor housing 2156 may be positioned in the airflow path with pre-motor filter chamber 2208 downstream of cyclone bin assembly 2160 and suction motor housing 2156 downstream of pre-motor filter chamber 2208.

In the illustrated example, pre-motor filter chamber 2208 has a height 2211 between an upper end 2213 to a lower end 2214 in the direction of pre-motor filter axis 560, and has a depth 1216 between front wall 2216 and rear wall 2220. As exemplified in FIG. 25, in some embodiments, cyclone axis 2484 and motor axis 2540 may be parallel and vertically offset as shown. For example, each of cyclone axis 2484 and motor axis 2540 may intersect pre-motor filter chamber 2208 as shown. As exemplified in FIG. 25, in some embodiments, outlet axis 2189 of cyclone chamber outlet 2184 and, motor inlet axis of motor inlet 2153 may be parallel and vertically offset. For example, each of outlet axis 2189 and motor inlet axis 2540 may intersect pre-motor filter chamber 2208 as shown.

In some embodiments, cyclone chamber outlet 2184 discharges air from cyclone chamber 2160 into pre-motor filter chamber 2208, and pre-motor filter chamber 2208 discharges air into motor inlet 2153. For example, cyclone chamber outlet 2184 may be positioned at the threshold between cyclone chamber 2160 and pre-motor filter chamber 2208, and motor inlet 2153 may be positioned at the threshold between pre-motor filter chamber 2208 and suction motor housing 2156. In alternative embodiments, one or more conduits (not shown) may separate pre-motor filter chamber 2208 from cyclone chamber outlet 2184 and/or motor inlet 2153.

As exemplified in FIG. 25, pre-motor filter chamber 2208 has a length between a front end 2216 and a rear end 2220. As shown, pre-motor filter chamber 2208 may hold pre-motor filters 2229 and 2229 in the airflow path between cyclone chamber outlet 2184 and motor inlet 2153 for filtering residual dirt particles remaining in the airflow. In some embodiments, pre-motor filter chamber 2208 may hold pre-motor filters 2228 and 2229 in spaced apart relation to front and rear ends 2216 and 2220. An upstream plenum or header 2256 may be provided in the space between upstream pre-motor filter 2228 and front end 2216. A downstream plenum or header 2258 may be provided in the space between downstream pre-motor filter 2229 and rear end 2220. Air entering upstream plenum 2256 from cyclone bin assembly 2160 may distribute across the surface area of pre-motor filter 2228 for traversing filters 2228 and 2229 to downstream plenum 2258.

As exemplified in FIG. 25, cyclone chamber outlet 2184 may direct air into an upper portion of upstream plenum 2256. For example, cyclone chamber outlet 2184 may be connected to pre-motor filter chamber 2208 proximate upper end 2213. In the illustrated embodiment, motor inlet 2153 may receive air from a lower portion of downstream plenum 2258. For example, motor inlet 2153 may be connected to pre-motor filter chamber 2208 proximate lower end 2214. Accordingly, pre-motor filter chamber 2208 may be used to redirect the air from transversely to the cyclone and motor axis without requiring conduits having bends therein.

In some embodiments, pre-motor filter housing 208 may include spacing members positioned to hold the pre-motor filter(s) away from the filter housing end walls 216 and 220. For example, referring to FIGS. 12 and 13, filter housing second wall 220 may include upstanding ribs that hold the downstream side 268 of pre-motor filter 228 spaced apart from filter housing second wall 220 to allow air exiting pre-motor filter 228 to flow laterally between pre-motor filter 228 and filter housing second wall 220, to filter housing air outlet 240. Filter housing first wall 216 may also include upstanding ribs that hold the upstream side 276 of pre-motor filter 228 spaced apart from filter housing first wall 216 to allow air to flow laterally between pre-motor filter 228 and filter housing first wall 216 before penetrating pre-motor filter 228.

Cyclone with a Unidirectional Flow of Air

The following is a description of a cyclone with a unidirectional flow of air that may be used by itself in any surface cleaning apparatus or in any combination or sub-combination with any other feature or features disclosed including the cyclone chamber inlet, the cyclone chamber screen member, the dirt collection chamber, the cyclone chamber dirt outlet, the cyclone chamber sidewall, the openable cyclone unit, the second stage cyclone, the mountable surface cleaning apparatus, and the driving handle.

In accordance with this aspect a cyclone comprises a cyclone with a unidirectional flow of air or a "uniflow" cyclone, wherein the air travels in a single direction from a location at which air enters the cyclone chamber to the location at which the air exits the cyclone chamber as the air cyclones within the cyclone chamber. As discussed in more detail, the uniflow cyclone may be horizontally disposed as opposed to being vertically disposed which is typical in the art. In other words, when held by hand and used to clean a surface, the axis of the cyclone chamber may be closer to horizontal than vertical.

In accordance with this aspect, the cyclone air inlet may be at the front end and the cyclone air outlet may be at the rear end. An advantage of this design is that the cyclone inlet may be used to redirect the air from the inlet passage 124 to the cyclone chamber and the air may exit the cyclone and travel linearly to the pre-motor filter. Accordingly, dirty air may travel from the dirty air inlet to the pre-motor filter without passing through any bends, thereby reducing the backpressure created by flow through the vacuum cleaner.

FIGS. 12 and 13 exemplify a cyclone unit including these aspects. In this embodiment, at least a portion of the tangential air inlet is provided inside the cyclone chamber. Accordingly, the axis of the air inlet conduit (passage axis 364) may be co-axial with the cyclone axis. As exemplified, cyclone 160 comprises a cyclone sidewall 168 extending axially from a cyclone first end 172 (e.g. front end comprising first end wall 192) to a cyclone second end 176 (e.g. rear end comprising second end wall 196), a cyclone air inlet 180 which enters cyclone 160 at a front portion of sidewall 168, a cyclone air outlet 184 provided in cyclone second end wall 196, and a cyclone dirt outlet 188. Cyclone sidewall 168 includes an upper wall portion 169 and a lower wall portion 171. As exemplified in FIG. 13, dirty air may enter cyclone 160 tangentially at cyclone air inlet 180, and swirl (e.g. move cyclonically) through cyclone 160 to separate dirt from the air flow, and then exit cyclone 160 through cyclone air outlet 184. The separated dirt may be collected within an internal dirt collection area and/or a dirt collection chamber exterior to the cyclone 160.

As exemplified, a screen member or vortex finder 204 may extend axially between cyclone first and second ends 172 and 176. Vortex finder 204 may have any configuration known in the art. For example, vortex finder 204 may be connected to cyclone second end wall 196 and extend axially towards cyclone first end 172. Vortex finder 204 may surround cyclone air outlet 184, so that air exiting cyclone 160 travels downstream through vortex finder 204 to cyclone air outlet 184. Vortex finder 204 may include filter media 206 (e.g. a mesh screen) to capture large dirt particles (e.g. hair and coarse dust) that remains in the air flow exiting cyclone 160, and may be referred to herein as a screen member.

Figure 54:
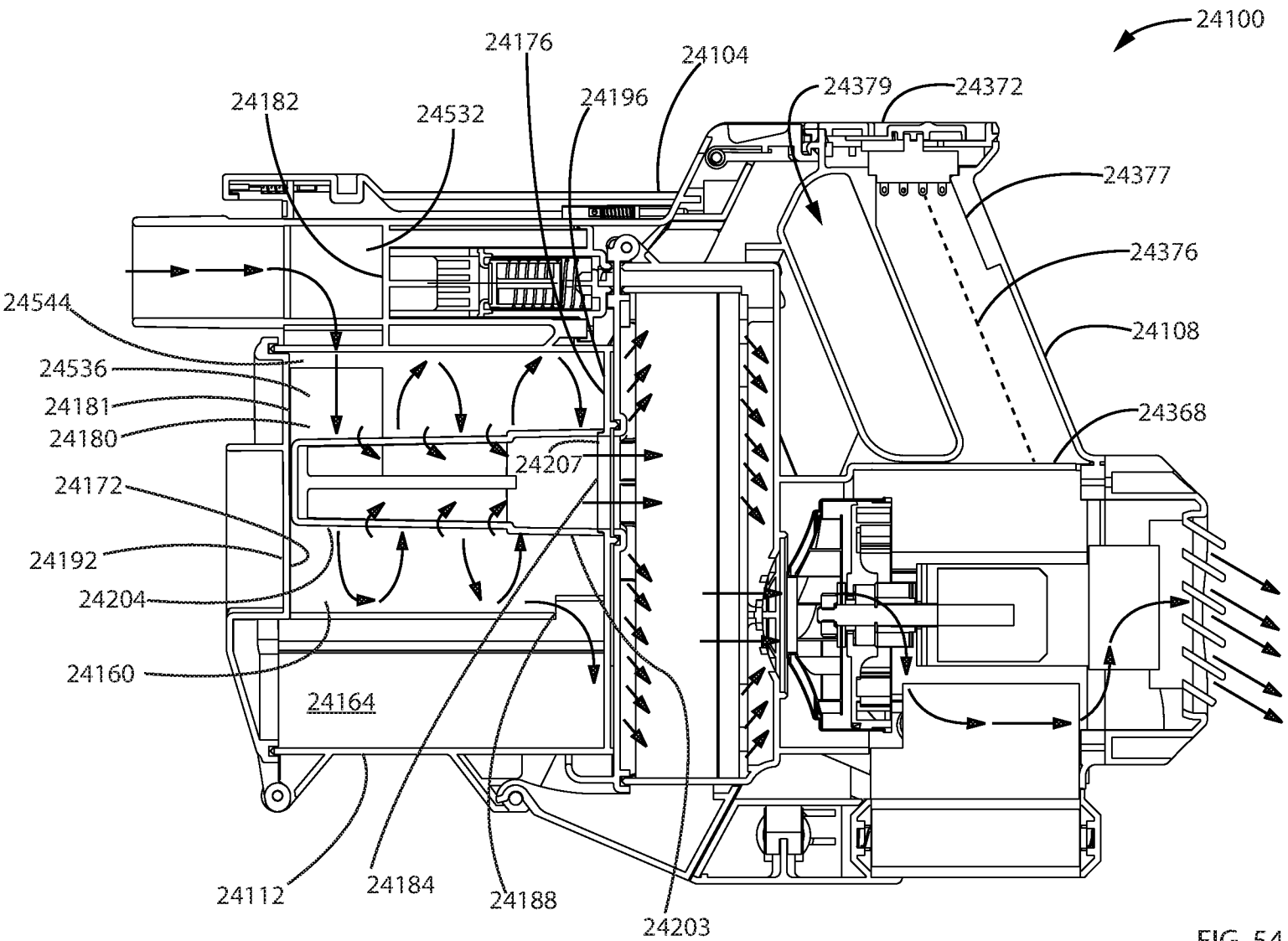
FIG. 54 is a cross-sectional view taken along line 54-54 in FIG. 51, showing an air flow path.

FIG. 54 illustrates another example of a cyclone unit 24112 having a cyclone chamber 24160 with a unidirectional flow of air. In this embodiment, the tangential air inlet is exterior to the cyclone chamber and the cyclone chamber sidewall has an inlet port that is at the downstream end of the tangential air inlet. As exemplified in FIG. 54, cyclone 24160 comprises a cyclone sidewall 24168 extending axially from a cyclone first end 24172 (e.g. front end comprising first end wall 24192) to a cyclone second end 24176 (e.g. rear end comprising second end wall 24196), a cyclone air inlet 24180 which enters cyclone 24160 at a front portion of sidewall 24168, a cyclone air outlet 24184 provided in cyclone second end wall 24196, and a cyclone dirt outlet 24188. Cyclone sidewall 24168 includes an upper wall portion 24169 and a lower wall portion 24171. As exemplified in FIG. 54, dirty air may enter cyclone 24160 tangentially at cyclone air inlet 24180 (which is an opening or port in the sidewall 24168), and swirl (e.g. move cyclonically) through cyclone 24160 to separate dirt from the air flow, and then exit cyclone 24160 through cyclone air outlet.

In the example shown in FIG. 54, the separated dirt may be collected within dirt collection chamber 24164 exterior to the cyclone 24160. A cyclone dirt outlet 24188 is provided in the lower wall portion 24171 of the cyclone sidewall 24168 at the cyclone second end 24176. The cyclone dirt outlet 24188 can thus be positioned at the downstream end of the cyclone chamber 24160, which may reduce or prevent dirt from the dirt collection chamber 24164 becoming re-entrained in the air swirling within cyclone chamber 24160.

Cyclone Chamber Inlet

The following is a description of a cyclone chamber inlet that may be used by itself in any surface cleaning apparatus or in any combination or sub-combination with any other feature or features disclosed including the uniflow cyclone, the cyclone chamber screen member, the dirt collection chamber, the cyclone chamber dirt outlet, the cyclone chamber sidewall, the openable cyclone unit, the second stage cyclone, the mountable surface cleaning apparatus, and the driving handle.

Figure 23:
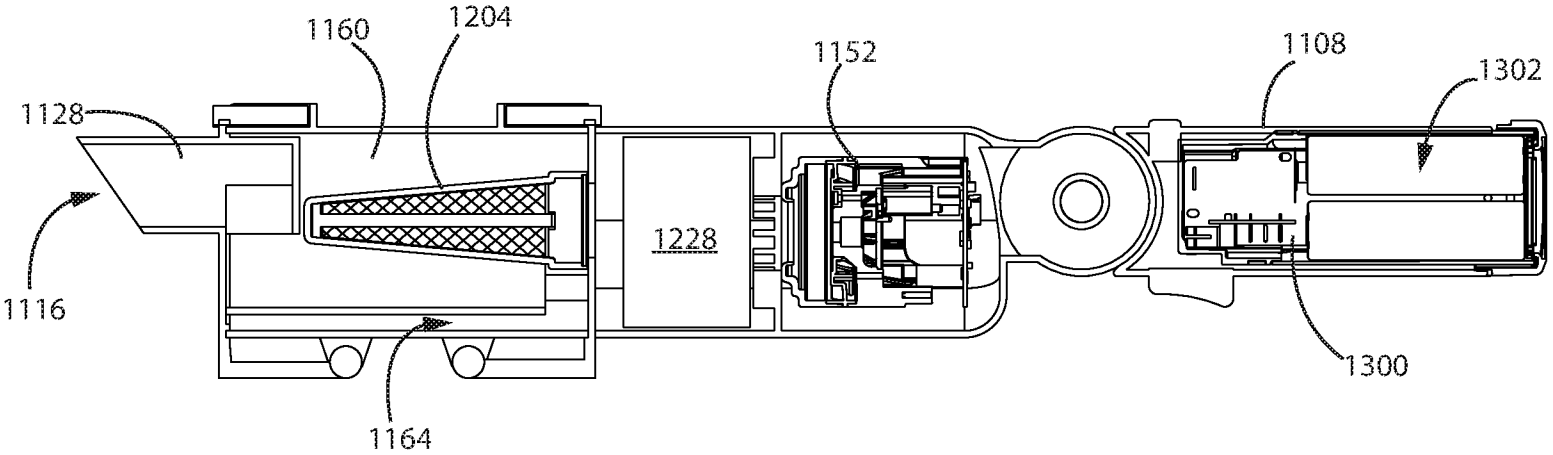
FIG. 23 is a sectional view of the surface cleaning apparatus of FIG. 14 along line 23-23 in FIG. 21.
Figure 23B:
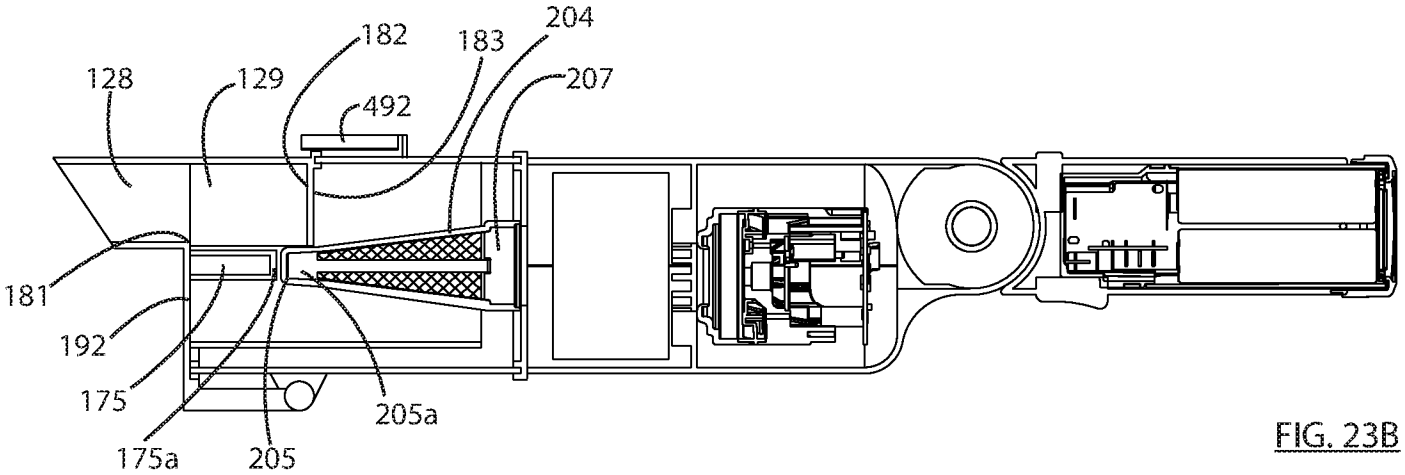
FIG. 23B is a cross-sectional view of an alternate surface cleaning apparatus with the cyclone unit in a closed position.
Figure 23C:
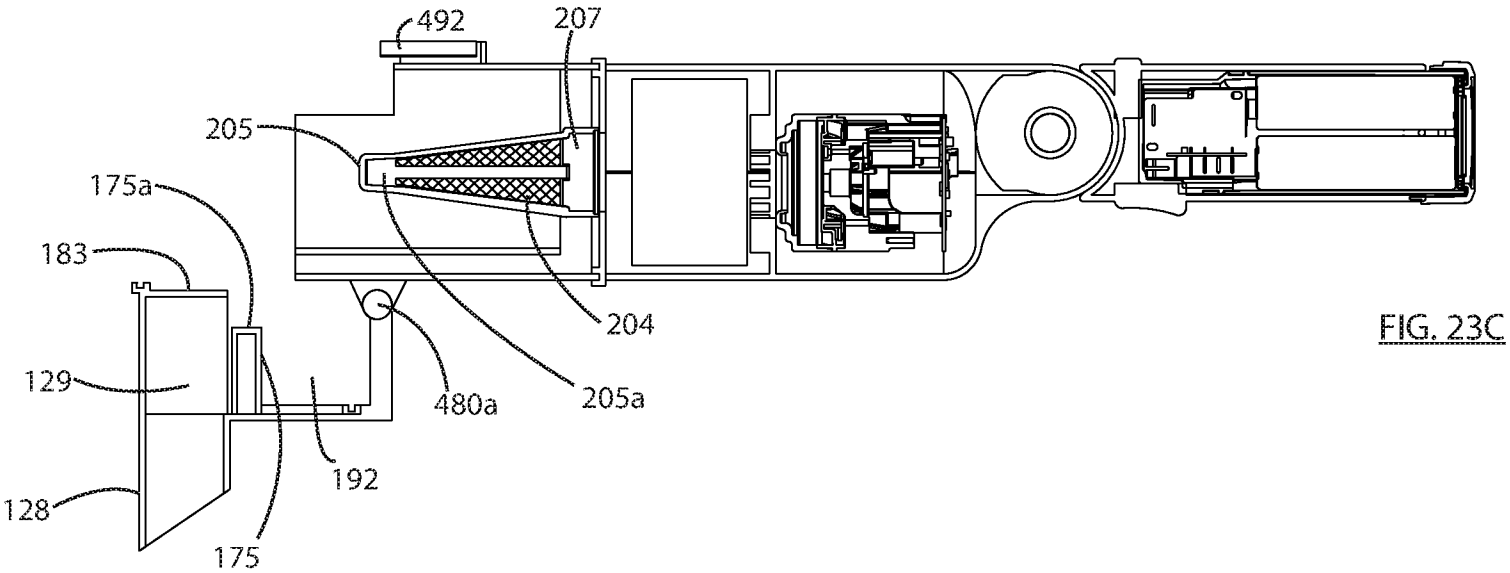
FIG. 23C is a cross-sectional view of the alternate surface cleaning apparatus of FIG. 23B with the cyclone unit in an open position.
Figure 23D:
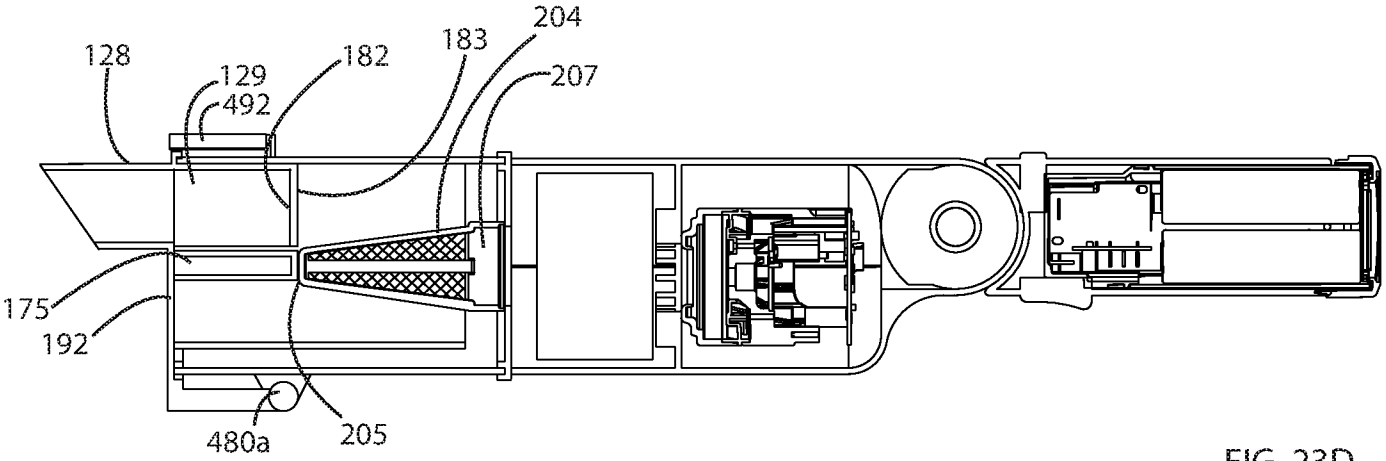
FIG. 23D is a cross-sectional view of an alternate surface cleaning apparatus with the cyclone unit in a closed position.
Figure 23E:
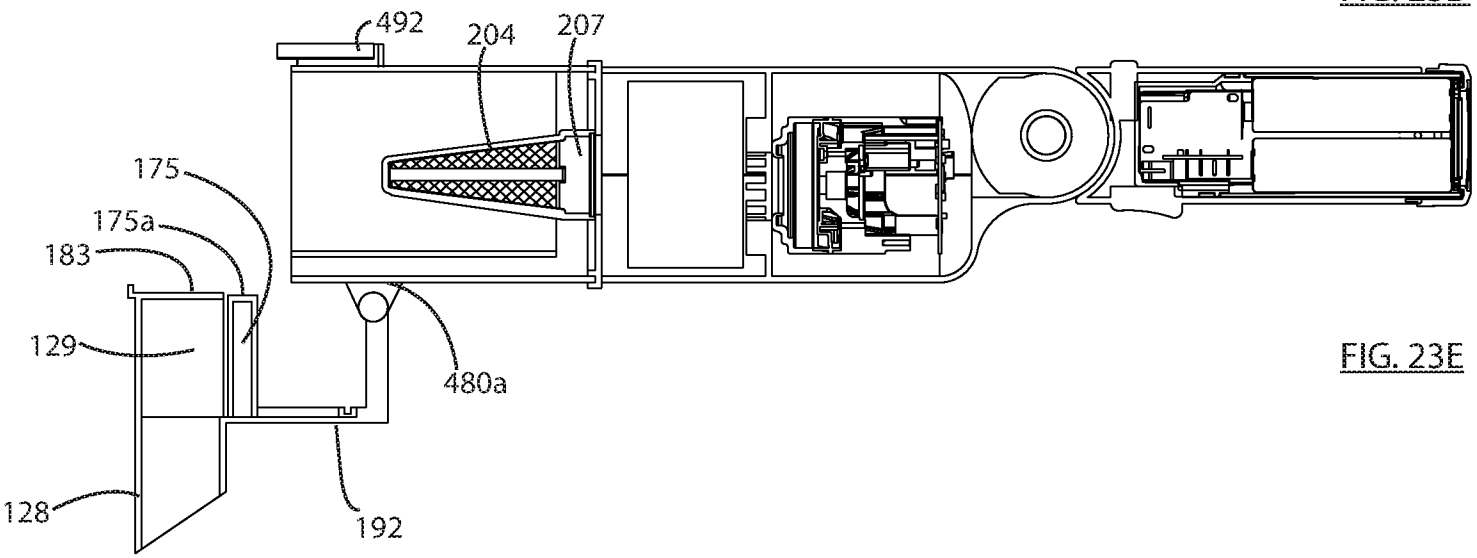
FIG. 23E is a cross-sectional view of the alternate surface cleaning apparatus of FIG. 23D with the cyclone unit in an open position.

In some embodiments described herein, the cyclone unit may be provided with a cyclone air inlet that is positioned and constructed in any manner suitable for directing air tangentially into cyclone 160. In some embodiments, as exemplified in FIG. 13, the cyclone air inlet may be located inside the cyclone chamber. In some embodiments, the cyclone air inlet may be at the outer periphery of the cyclone chamber (e.g., it may be located off center at the cyclone chamber sidewall as exemplified in FIGS. 13 and 23) or it may be located centrally (e.g., co-axial with the cyclone chamber as exemplified in FIGS. 60 and 61). In other embodiments, as exemplified in FIG. 54, a tangential cyclone air inlet may be located external to the cyclone chamber and terminate at a port or opening in the cyclone chamber sidewall In the example shown in FIG. 13, the cyclone chamber 160 has an internal tangential air inlet 180. The air inlet 180 has an inlet width that extends between a first inlet side 181 and a second inlet side 182. In the example illustrated, the first inlet side 181 and second inlet side 182 are spaced apart in a longitudinal axial direction generally parallel to the cyclone axis of rotation 484. The second inlet side 182, or downstream inlet side, is positioned closer to the cyclone second end 176 than the first inlet side 182.

The air inlet passage 128 can extend between the dirty air inlet 116 and the second inlet side 182. The air inlet passage 128 may have an upstream portion 131 that extends from dirty air inlet 116 along passage axis 364. As shown in FIG. 13, the air inlet axis 364 may be generally parallel to the cyclone axis of rotation 464. Alternately, the air inlet axis and cyclone axis of rotation may be provided with an alternate orientation.

As shown in FIG. 25, handvac cyclone chamber 2160 includes an air inlet 2180 and an air outlet 2184. As shown, air inlet 2180 may include an inlet axis 2185 which is parallel to cyclone axis 2484. Air inlet 2180 may have a circular section transverse to axis 2185 with an inlet diameter 2186, and may terminate at a rectangular port in the cyclone chamber sidewall that has a side dimension or height 2186. Preferably, the cross-sectional area of air inlet 2180 is approximately equal to the cross-sectional area of inlet nozzle 2128. Preferably, the cross-sectional area of air inlet 2180 is between 80%-125% of the cross-sectional area of the inlet nozzle 2128, more preferably 90%-120%, and most preferably 100%-115%.

Figure 55:
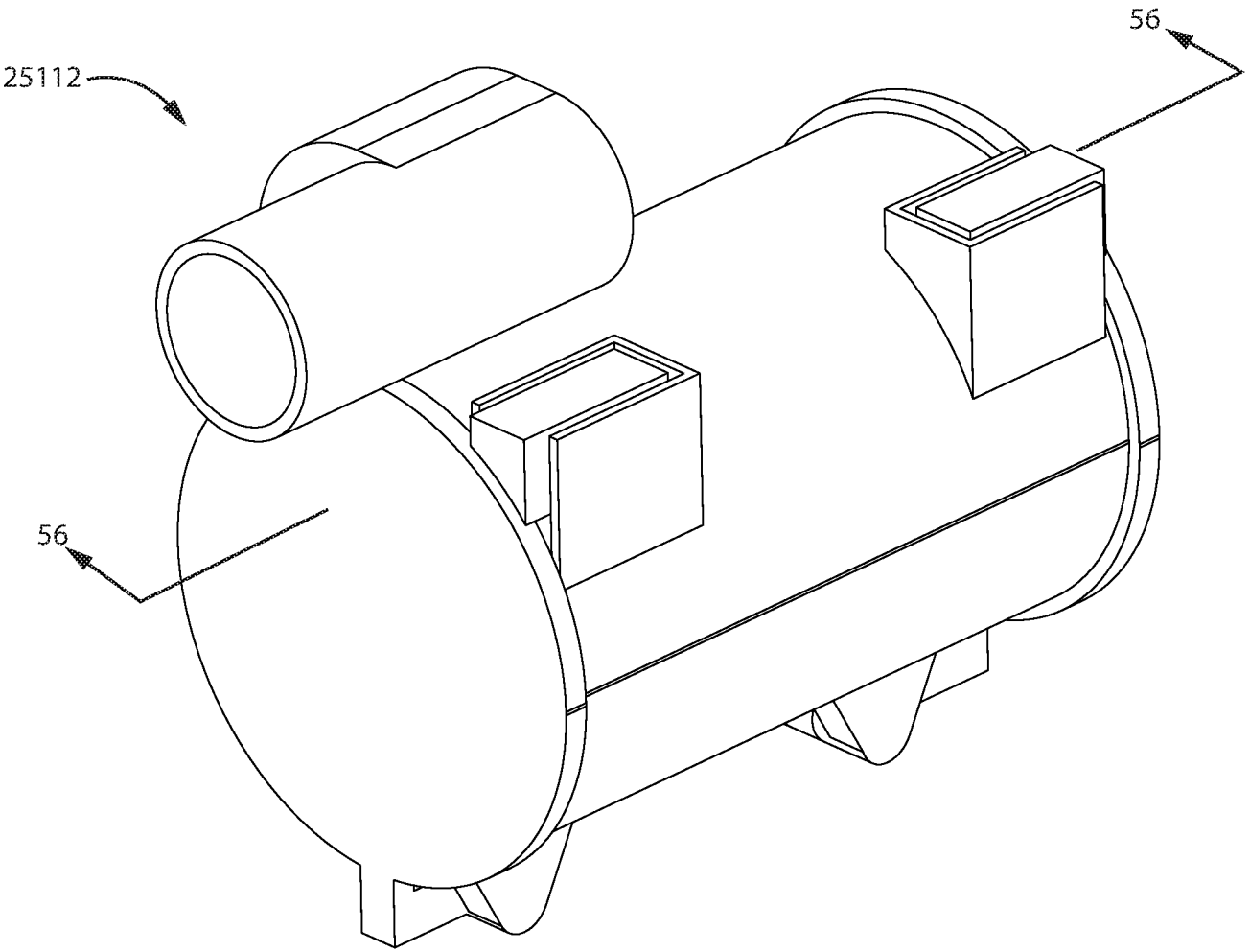
FIG. 55 is a perspective view of an example cyclone unit in accordance with at least one embodiment.

Preferably, inlet 2180 is in fluid communication with an upstream end 2532 of an inlet passage 2187. Inlet passage 2187 may redirect the axial flow through inlet 2128 to a tangential flow so that when the air enters the cyclone chamber 2160, the air will travel in a cyclonic motion. Inlet passage 2187 may extend from upstream passage end 2532 to downstream passage end 2536 across an arcuate angular extent (see also FIGS. 51 and 55). Preferably the angular extent is between 45 and 300°, more preferably between 60 and 250°, and most preferably between 90 and 200°.

Returning to FIG. 25, inlet passage 2187 is shown having a width 2533, and a height 2534. In some embodiments, the cross-sectional area of inlet passage 2187 may be approximately equal to the cross-sectional area of air inlet 2180. Preferably, the cross-sectional area of inlet passage 2187 is between 80%-125% of the cross-sectional area of the inlet 2180, more preferably 90%-120%, and most preferably 100%-115%.

Figure 48B:
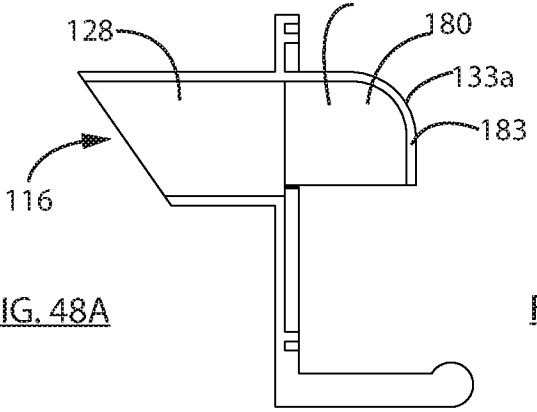
FIGS. 48A-48E illustrate an example of a cyclone unit inlet in accordance with at least one embodiment.
Figure 48A:
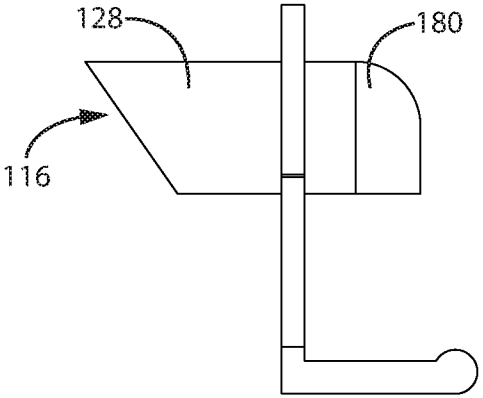
Figure 48D:
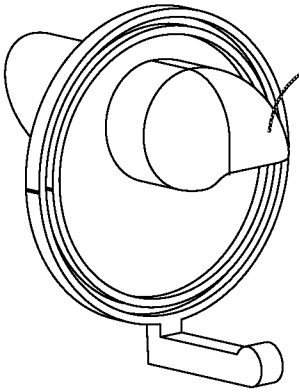
Figure 48C:
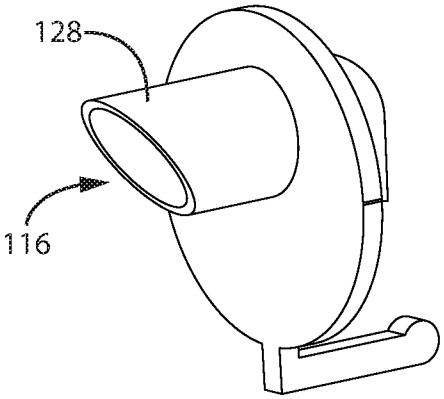
Figure 48E:
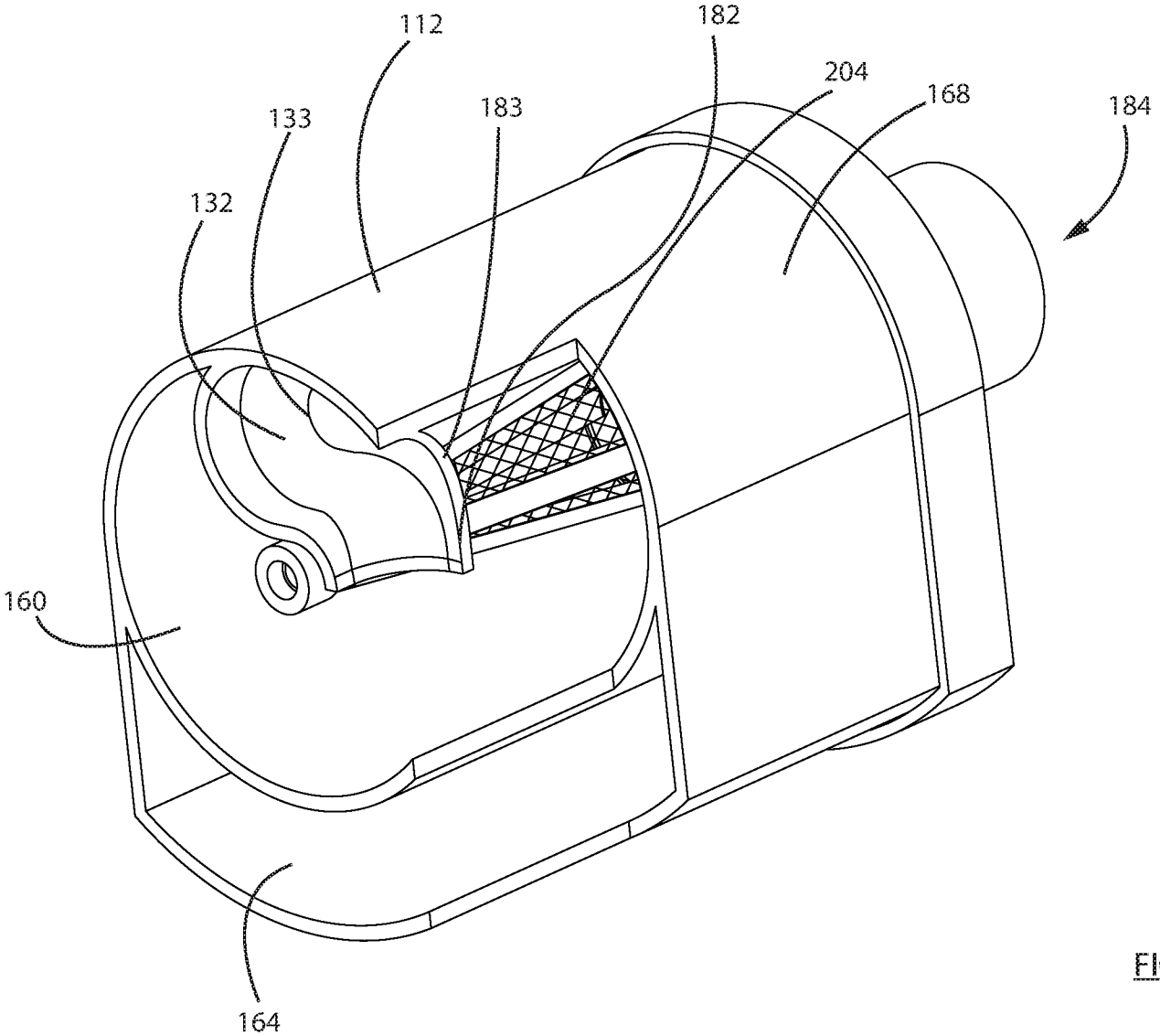
Figure 49B:
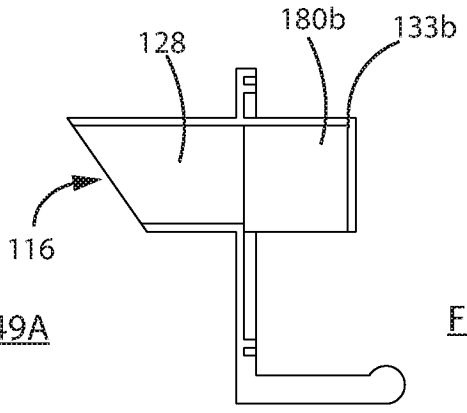
FIGS. 49A-49D illustrate another example of a cyclone unit inlet in accordance with at least one embodiment.
Figure 49A:
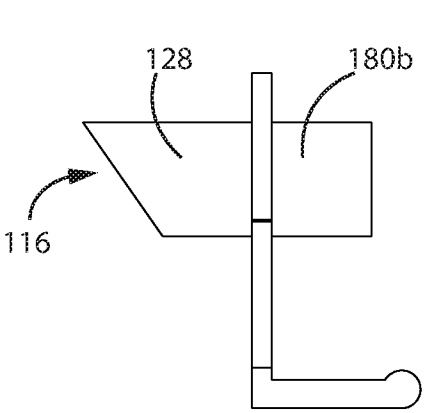
Figure 49C:
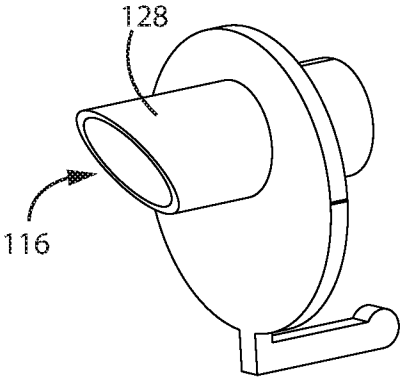
Figure 49D:
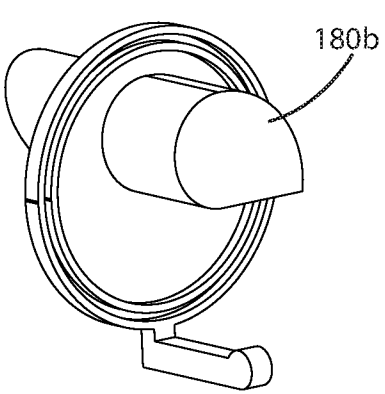
Figure 50B:
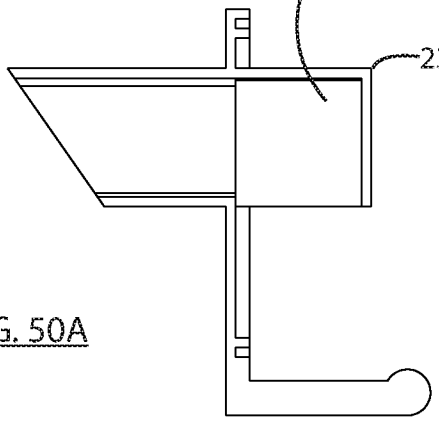
FIGS. 50A-50D illustrate another example of a cyclone unit inlet in accordance with at least one embodiment.
Figure 50A:
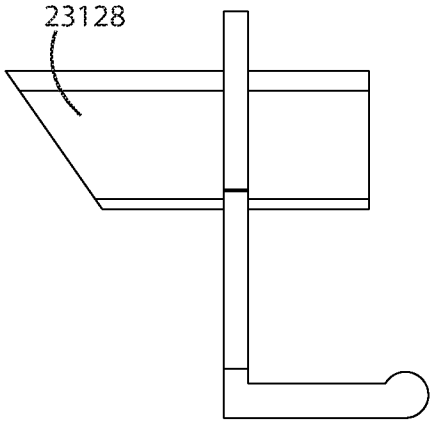
Figure 50D:
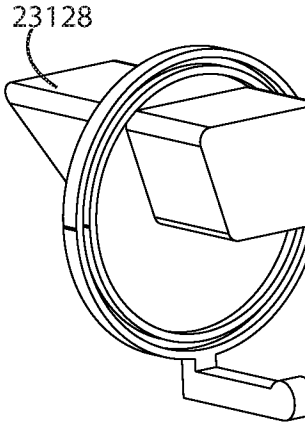
Figure 50C:
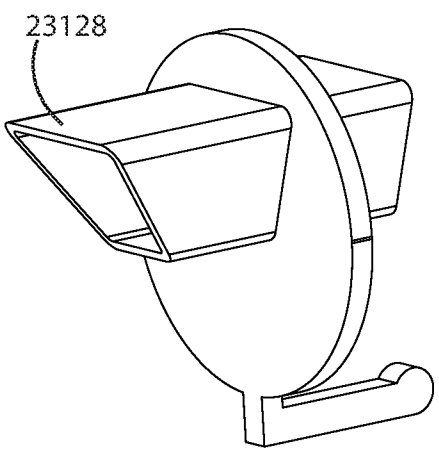

Returning to FIG. 13, the inlet passage 128 can also include a downstream portion 132 that extends to the cyclone air inlet 180 in a direction generally transverse to the cyclone axis 364. Air entering the surface cleaning apparatus 100 can pass through the air inlet passage 128 and to the cyclone air inlet 180. In some embodiments, the sidewall of the air inlet passage 128 can include a transition region or elbow 133 (see for example FIG. 48B) between the upstream portion 131 and the downstream portion 132. The transition region 133 can redirect air that is travelling along the air inlet axis 364 to travel through the tangential air inlet 180 in a plane transverse to the air inlet axis 364.

In some embodiments, the upstream portion 131 of the air inlet passage 128 can extend substantially linearly from the dirty air inlet to the downstream portion 132. The transition region 133 can then provide an elbow that turns the air about 90 degrees to the inlet of the tangential air inlet 180. This may promote an improved flow pattern and separation efficiency through the cyclone unit 112.

As shown, the transition region 133 may include a rounded elbow. As illustrated in FIGS. 48B-48E, the transition region 133 nonetheless defines a 90 degree turn while the inner surface of the transition region 133*a* is rounded (e.g., it may be concave). This may reduce backpressure in the air flow passage.

Alternately, the transition region 133*b* may have a substantially straight inner elbow that forms a 90 degree turn in the air inlet passage 128*b* as shown in FIGS. 49A-49D. This may encourage dirt or debris to separate from the air as it enters the cyclone chamber 160.

As exemplified, air may exit cyclone air outlet 184 in a flow direction that is generally parallel to the suction motor axis of rotation 540. This may reduce the number of bends in the air flow passage in this section of the surface cleaning apparatus 100.

In the example illustrated in FIG. 13, the air inlet axis 384, cyclone axis 383 and suction motor axis of rotation 540 are all parallel. This may encourage linear air flow through the surface cleaning apparatus and provide improved air flow efficiency.

It will be appreciated that in other embodiments, only some of these axes may be parallel. For example, only the air inlet axis 364 and the cyclone axis of rotation 484 may be parallel.

Alternately, the air inlet axis 364, cyclone axis of rotation 484 and suction motor axis of rotation 540 may have any suitable alignment relative to one another.

Alternately, in some embodiments the air inlet passage axis 364 may be oriented transverse to the cyclone axis 484 (e.g. with the cyclone vertically oriented). In some such embodiments, the transition region may be omitted. For instance, the air inlet passage 128 may then be axially aligned with, and parallel to, the cyclone air inlet 180. This may assist in reducing backpressure through the surface cleaning apparatus 100, by reducing the number of bends in the airflow passage.

Returning to the example shown in FIG. 13, dirty air may enter cyclone 160 tangentially at cyclone air inlet 180 (which extends into the cyclone chamber 160 from the upper portion 169 of the cyclone sidewall 168), and swirl (e.g. move cyclonically) through cyclone 160 to separate dirt from the air flow, and then exit cyclone 160 through cyclone air outlet 184.

If a tangential inlet is used, then air may enter the cyclone chamber as a band that substantially maintains its form as it swirls around the cyclone chamber. To ensure that dirt and debris is sufficiently separated from the swirling air, each band of air entering the cyclone chamber optionally completes a minimum number of revolutions around the cyclone chamber, e.g. 3 or 4 revolutions. Depending on the density of dirt entrained in the air entering the dirty air inlet, the number of revolutions around the cyclone chamber 160 needed to separate dirt from the air in the cyclone chamber 160 may vary. The tangential cyclone air inlet 180 enables the air entering the cyclone chamber 160 to define the bands circulating within the cyclone chamber 160, which allows the surface cleaning apparatus to clean air with differing dirt densities.

As shown in the example of FIGS. 12 and 13, the cyclone air inlet 180 includes a conduit 129 that extends into, and is located interior to, the cyclone chamber 160. The conduit 129 can define the downstream portion 132 of the air inlet passage 128 that directs air to flow tangentially into the cyclone chamber 160. This may allow the air inlet passage 128 to be axially aligned with a portion of the cyclone chamber 160 (e.g. the air inlet axis 364 may extend through cyclone chamber 160). This may promote a more compact design for the surface cleaning apparatus, for instance with the width of the surface cleaning apparatus may be limited only by the width of the cyclone unit 112 and/or suction motor and fan assembly 152. In the example shown, a projection of the air inlet passage 128 is contained entirely within the perimeter of the cyclone unit 112 (i.e. within the outer wall 552 of the cyclone unit 112).

The second side 182 of the air inlet 180 can include a wall 183 positioned in the cyclone chamber 160. The wall 183 can be positioned in a plane that extends transverse or perpendicular to the longitudinal cyclone axis 484 (see for example FIG. 60) or at an angle thereto (see for example FIGS. 61 and 62). The wall 183 may define the axially inner end of the tangential inlet.

Figure 60:
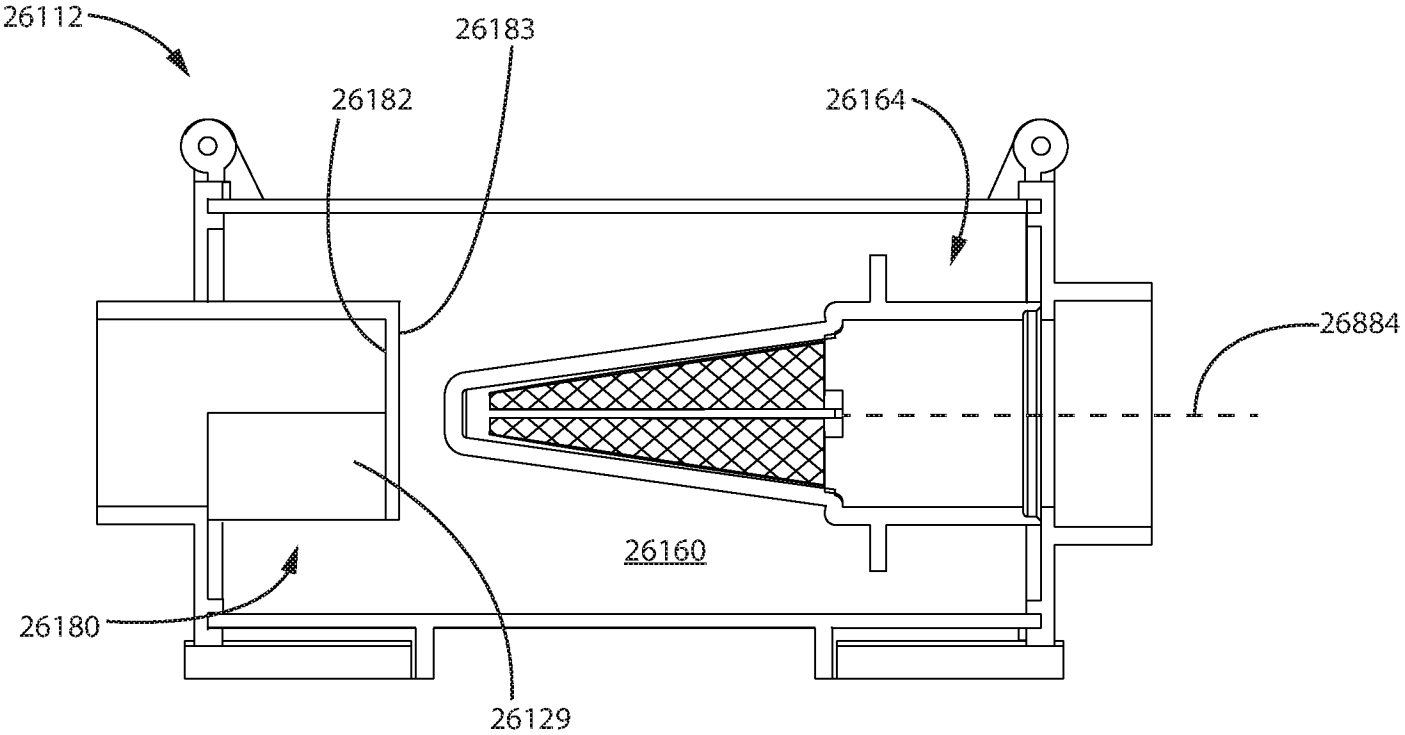
FIG. 60 is a cross-sectional view of an example cyclone chamber in accordance with at least one embodiment.

FIG. 60 illustrates another example of a cyclone unit 26112 having a cyclone air inlet 26180 that includes a conduit 26129 that extends into, and is located interior to, the cyclone chamber 26160. In this example, the dirt collection chamber 26164 is formed internally within the cyclone chamber 26160. The dirt collection chamber 26164 is formed at the second end of the cyclone chamber 26160. This may promote a more compact design for the surface cleaning apparatus, for instance with the width of the cyclone unit limited only by the width of the cyclone chamber 26160.

In the example shown in FIG. 60, the second or axially inner side 26182 of the air inlet 26180 is defined by a wall 26183 that extends into the cyclone chamber 26160 along a plane that extends transverse or perpendicular to the longitudinal cyclone axis 26484.

Figure 61:
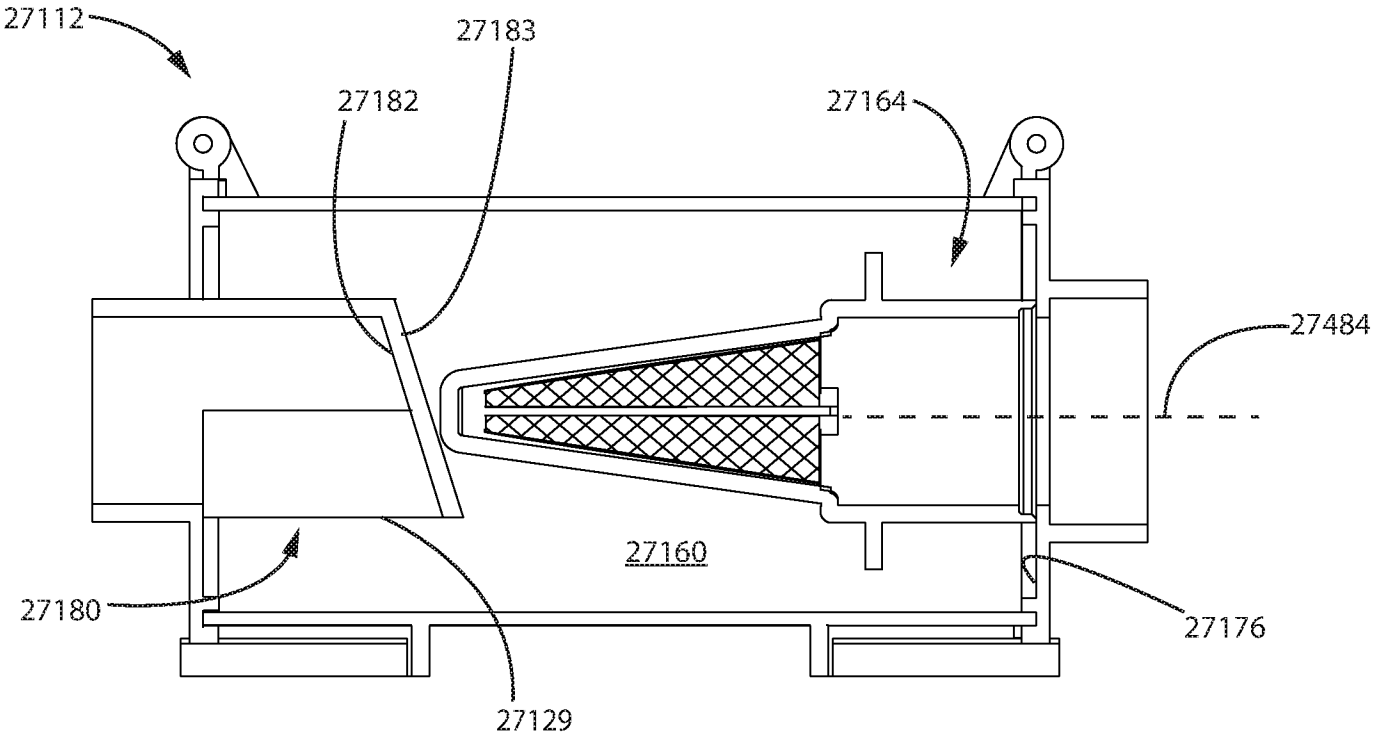
FIG. 61 is a cross-sectional view of another example cyclone chamber in accordance with at least one embodiment.

FIG. 61 illustrates another example of a cyclone unit 27112 having a cyclone air inlet 27180 that includes a conduit 27129 that extends into, and is located interior to, the cyclone chamber 27160. Similar to cyclone unit 26112, the dirt collection chamber 27164 is formed internally at the second end 27176 the cyclone chamber 27160. The dirt collection chamber 27164 is formed at the second end of the cyclone chamber 27160.

In the example shown in FIG. 61, the second side 27182 of the air inlet 27180 is defined by a wall 27183 that extends into the cyclone chamber 27160. Unlike cyclone unit 26122, the wall 27183 extends into cyclone chamber 27160 at a non-perpendicular angle to the longitudinal cyclone axis 27484. This may reduce the angle of the bend in the air flow passage, which may reduce backpressure through this section of the surface cleaning apparatus.

Figure 62:
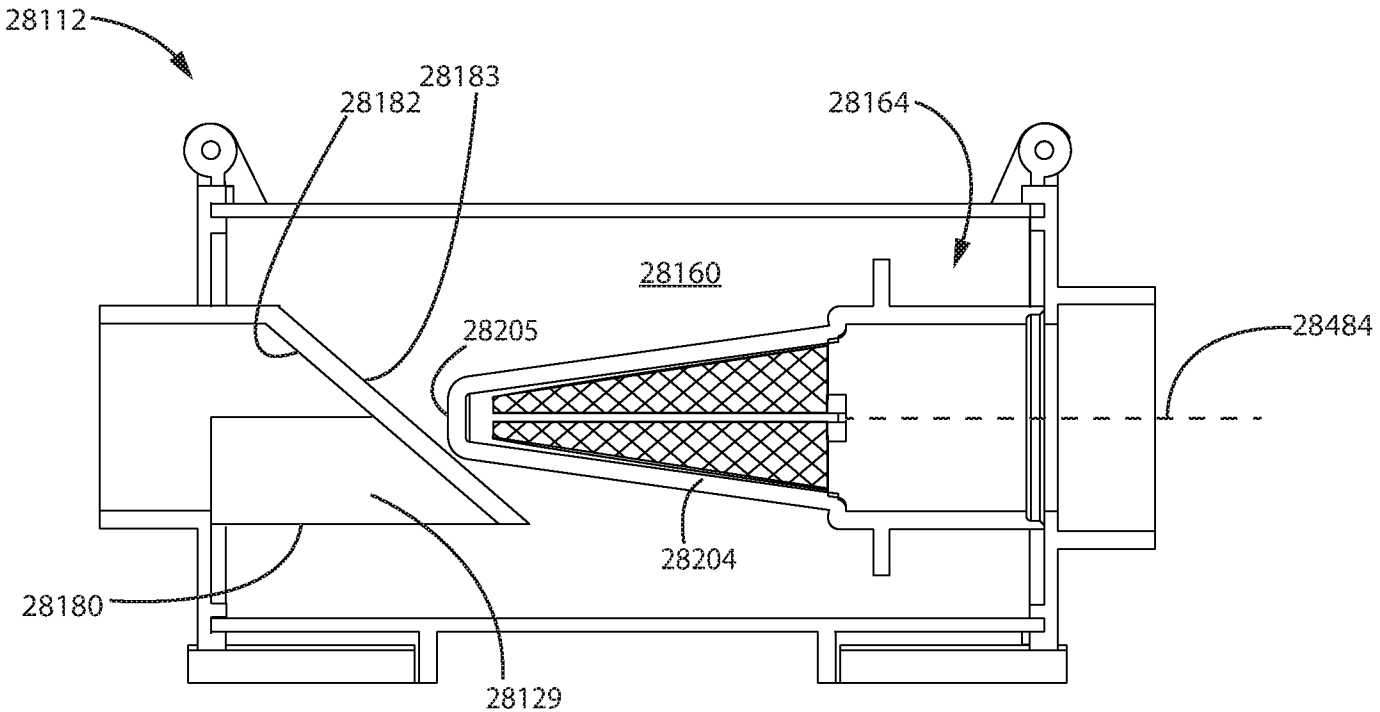
FIG. 62 is a cross-sectional view of an example cyclone chamber in accordance with at least one embodiment.

FIG. 62 illustrates another example of a cyclone unit 28112 having a cyclone air inlet 28180 that includes a conduit 28129 that extends into, and is located interior to, the cyclone chamber 28160. Similar to cyclone units 26112 and 27112, the dirt collection chamber 28164 is formed internally at the second end 28176 the cyclone chamber 28160. The dirt collection chamber 28164 is formed at the second end of the cyclone chamber 28160.

In the example shown in FIG. 62, the second side 28182 of the air inlet 28180 is defined by a wall 28183 that extends into the cyclone chamber 28160. Similar to cyclone unit 27122, the wall 28183 extends into cyclone chamber 28160 at a non-perpendicular angle to the longitudinal cyclone axis 28484. In cyclone unit 28112, the wall 28183 extends in a direction closer to the longitudinal axis 2848. As a result, a portion of the wall 28183 may extend beyond the first end 28205 of the vortex finder 28204.

Alternately, the cyclone air inlet may terminate at an inlet port in the sidewall of the cyclone chamber. This may provide additional volume for air to circulate within the cyclone chamber. This may allow the vortex finder to extend through a greater portion of the cyclone chamber, and in some cases the vortex finder may even to the first or inlet end of the cyclone chamber.

Referring to FIGS. 51-54, shown therein is an example of a surface cleaning apparatus 24100 in which the cyclone air inlet 24180 terminates at a cyclone inlet port 24134 formed in the sidewall 24168 of the cyclone chamber 24160. In the example illustrated, the cyclone chamber 24160 extends longitudinally between a cyclone first end 24172 and a cyclone second end 24176. The cyclone chamber 24160 has a longitudinally extending sidewall 24168. The cyclone inlet port 24134 is a the terminal end of a tangential inlet and is an opening formed in the longitudinally extending sidewall 24168. The cyclone air inlet 24180 extends from a cyclone air inlet upstream end 24532 to a cyclone air inlet downstream end 24536. The cyclone air inlet downstream end 24536 may be oriented to direct air substantially tangentially to the inner surface of sidewall 24168.

Figure 51:
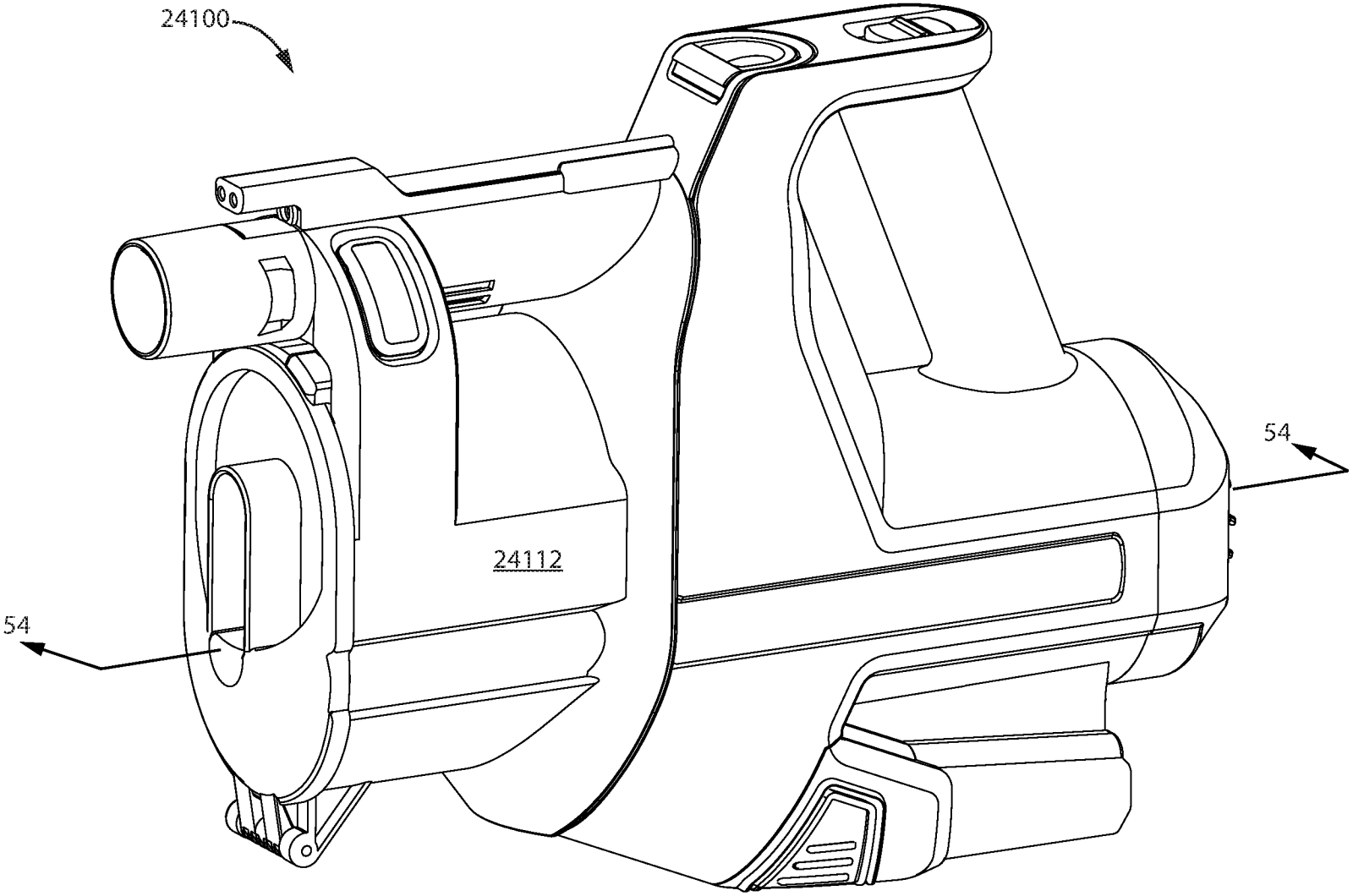
FIG. 51 is a perspective view of an example surface cleaning apparatus in accordance with at least one embodiment.
Figure 58:
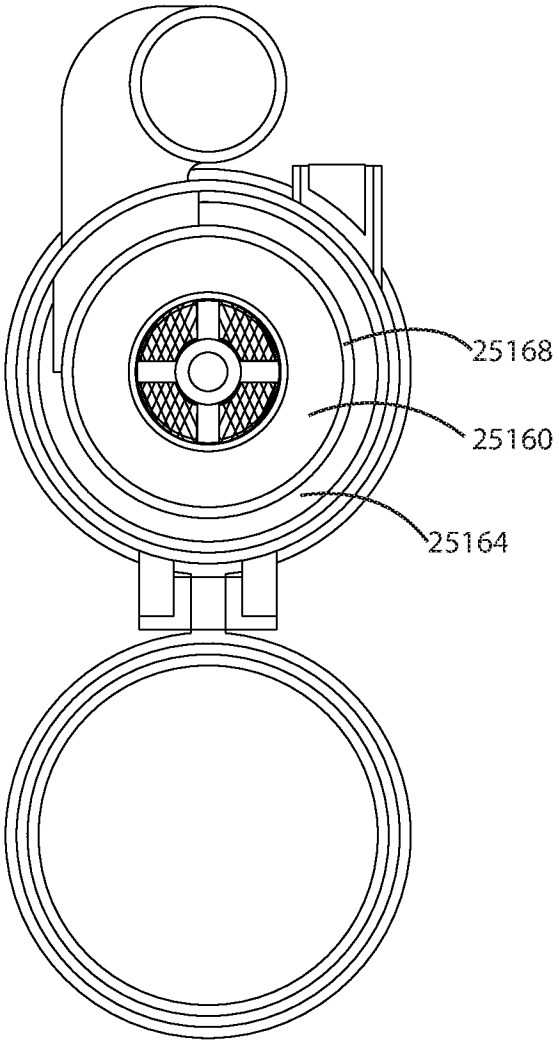
FIG. 58 is a front view of the cyclone unit of FIG. 55 with the front wall of the cyclone unit in an open position.
Figure 59:
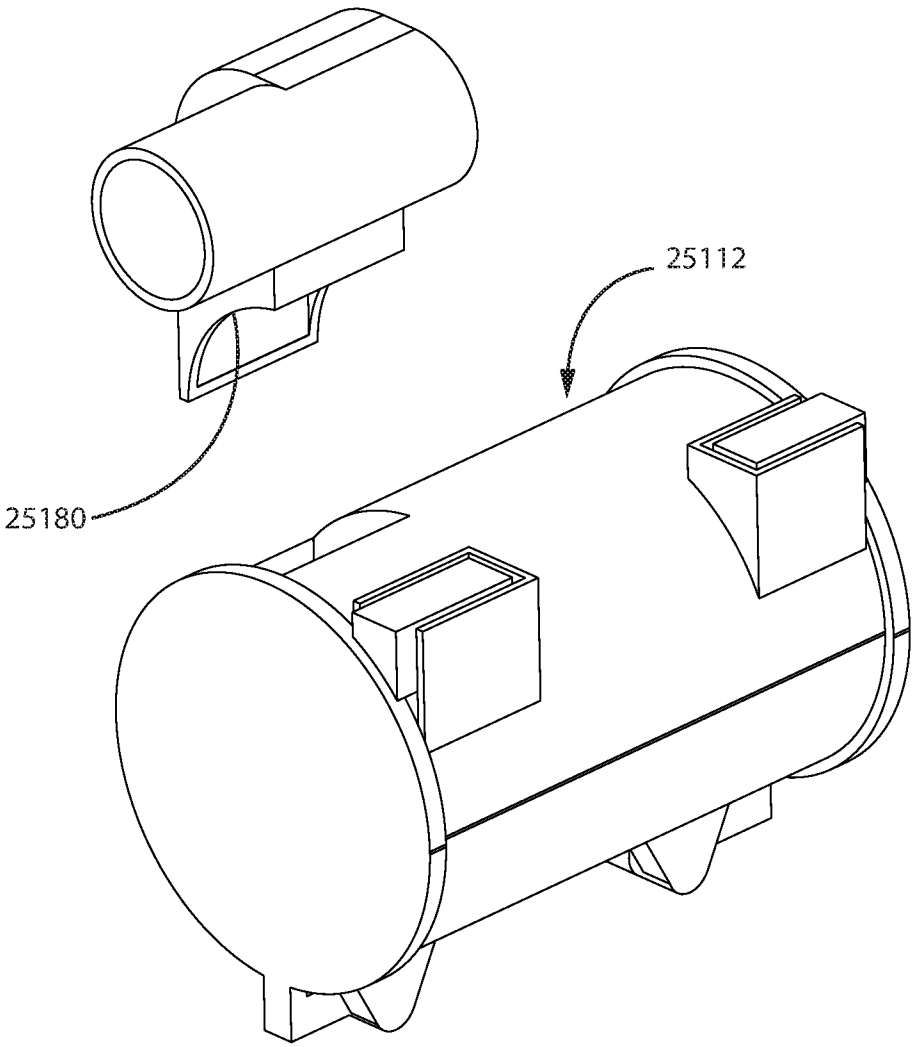
FIG. 59 is a perspective view of the cyclone unit of FIG. 55 with a cyclone inlet removed from the cyclone chamber.

In the illustrated example of FIG. 51, cyclone air inlet 24180 is formed as a curved passage 24187 extending from a cyclone air inlet upstream end 24532 to a cyclone air inlet downstream end 24536 (see also the cyclone air inlet 25180 shown in FIG. 58). The curved passage may provide a gradual change of direction for the air passing through the cyclone air inlet 24180, which may reduce backpressure through the cyclone air inlet 24180 ends at a port formed in cyclone sidewall 24168 at cyclone first end 24172. Cyclone air outlet 24184 is formed in cyclone second end wall 24196 at the cyclone second end 24176. The cyclone air inlet 24180 has an inlet width that extends between a first inlet side 24181 and a second inlet side 24182. In the example illustrated, the first inlet side 24181 and second inlet side 24182 are spaced apart in a longitudinal axial direction generally parallel to the cyclone axis of rotation 24484. The second inlet side 24182, or downstream inlet side, is positioned closer to the cyclone second end 24176 than the first inlet side 24182.

Figure 53:
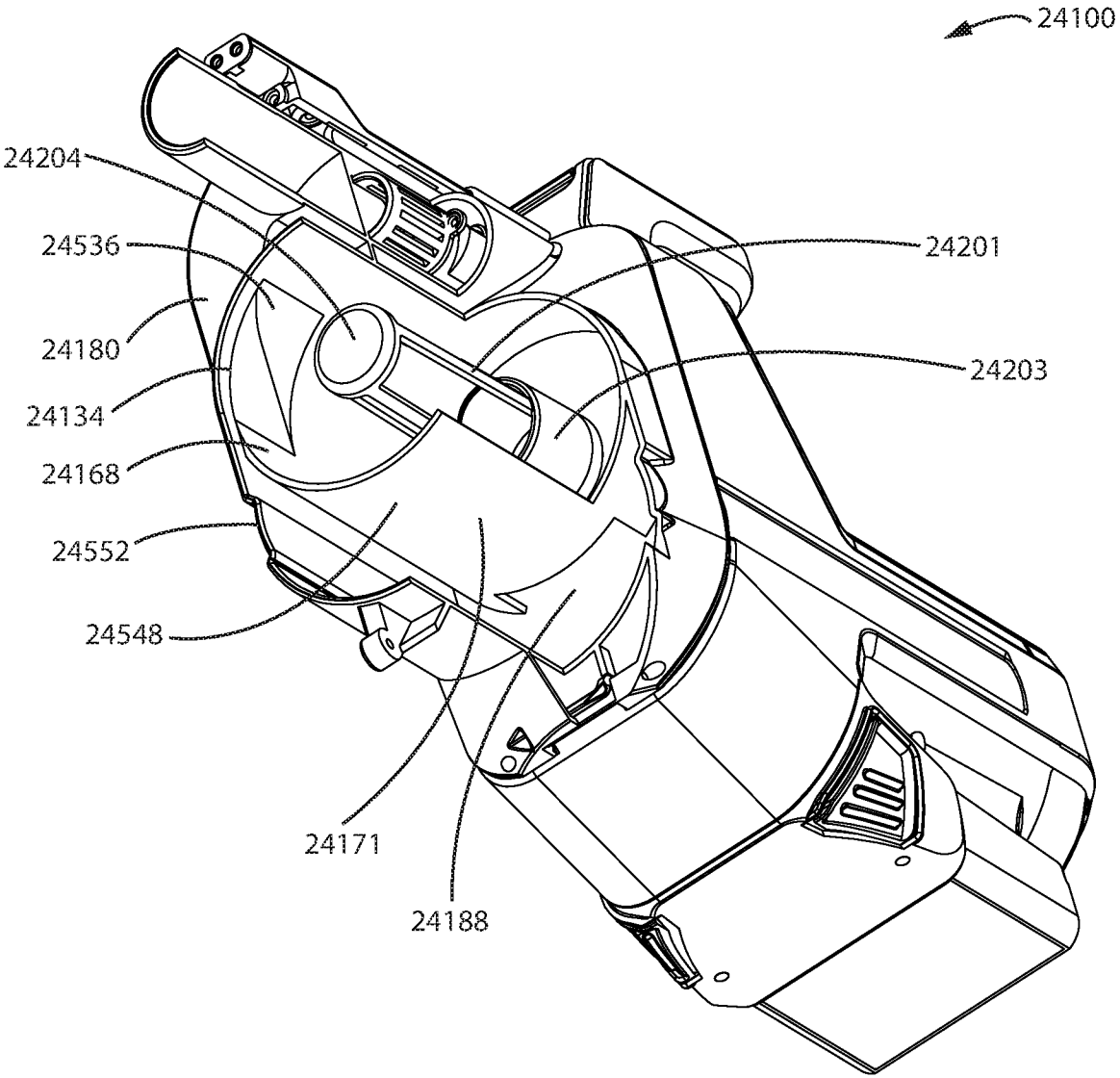
FIG. 53 is a front perspective view of the surface cleaning apparatus of FIG. 51, with a cyclone unit partially cutaway.

As exemplified, an dirt collection chamber 24164 external to the cyclone chamber 24160 is provided. As air circulates through the cyclone chamber 24160, dirt may be collected in the dirt collection chamber 24164. The cyclone chamber 24160 can be fluidly coupled to the dirt collection chamber 24164 by a dirt outlet 24188. As shown in FIGS. 53 and 54, the dirt outlet 24188 is formed as an outlet port in the cyclone chamber sidewall 24168.

In the example shown in FIGS. 51-54, the dirt collection chamber 24164 is a semi-annular dirt collection chamber that extends around a lower half of the cyclone chamber 24160. Alternately or in addition, the dirt collection chamber may extend around a greater proportion of the cyclone chamber and the dirt collection chamber may be an annular chamber surrounding the cyclone chamber.

FIGS. 55-59 illustrate another example of a cyclone unit 25112 in which the cyclone air inlet 25180 terminates at a cyclone inlet port 25134 formed in the sidewall 25168 of the cyclone chamber 25160. The cyclone unit 25112 has a longitudinally extending cyclone sidewall 25168 that extends generally parallel to the cyclone axis of rotation 25484. The cyclone inlet port 25134 may be oriented to direct air substantially tangentially to the inner surface of sidewall 25168.

The cyclone air inlet 25180 has an inlet width that extends between a first inlet side 25181 and a second inlet side 25182. In the example illustrated, the first inlet side 25181 and second inlet side 25182 are spaced apart in a longitudinal axial direction generally parallel to the cyclone axis of rotation 25484. The second inlet side 25182, or downstream inlet side, is positioned closer to the cyclone second end 25176 than the first inlet side 25182.

As shown in FIG. 58, the cyclone unit 25112 includes an annular dirt collection chamber 25164. The dirt collection chamber 25164 extends around the entirety of the cyclone chamber 25160. In this example, the dirt outlet 25188 may be provided as an annular outlet formed in the cyclone chamber sidewall 24168. It will be appreciated that the dirt outlet may extend around the same portion of the perimeter of the sidewall as the dirt collection chamber or a smaller amount of the perimeter (e.g., the dirt collection chamber may have the same or a larger angular extent than the dirt outlet).

Returning to FIG. 13, in the example shown, the cyclone air inlet 180 may be positioned at, or in, an upper portion of the sidewall 168 of the cyclone 160. An advantage of this design is that is that it inhibits dirt that may remain in cyclone chamber 160 from exiting or blocking the air inlet when the apparatus is moved to various operating angles.

As also shown in FIG. 54, cyclone air inlet 24180 may be positioned above cyclone axis of rotation 24484 and suction motor axis of rotation 24540. For example, cyclone air inlet 24180 may be positioned at an upper end 24544 of cyclone 24160. This allows gravity to assist with inhibiting dirt inside cyclone 24160 from blocking or exiting cyclone air inlet 24180. This is because at least a portion of the cyclone 24160 will be positioned below the cyclone air inlet 24180 when apparatus 24100 is held at various operating angles, so that the dirt inside will tend to fall away from cyclone air inlet 24180.

It will be appreciated that if cyclone air inlet is located in the cyclone chamber and at an upper end of the cyclone chamber, then inlet passage may be located above the central longitudinal axis of cyclone. For example, as exemplified in FIGS. 1 and 13, cyclone air inlet 180 may be a tangential air inlet so that air entering the cyclone 160 will tend to rotate as the air travels axially through the cyclone 160, thereby dis-entraining dirt and debris from the air flow, before leaving the cyclone via the air outlet 184. Further, inlet passage 128 extends longitudinally between passage inlet end 124 (i.e., the dirty air inlet 116) and passage outlet end 130 along a longitudinal passage axis 364, and passage outlet end 130 communicates (e.g. is positioned upstream) of cyclone air inlet 180. Passage axis 364 may be linear, and all of the longitudinal passage axis 364 may be positioned above cyclone axis of rotation 484 when surface cleaning apparatus 100 is positioned with bottom 125 on a horizontal surface.

Figure 56:
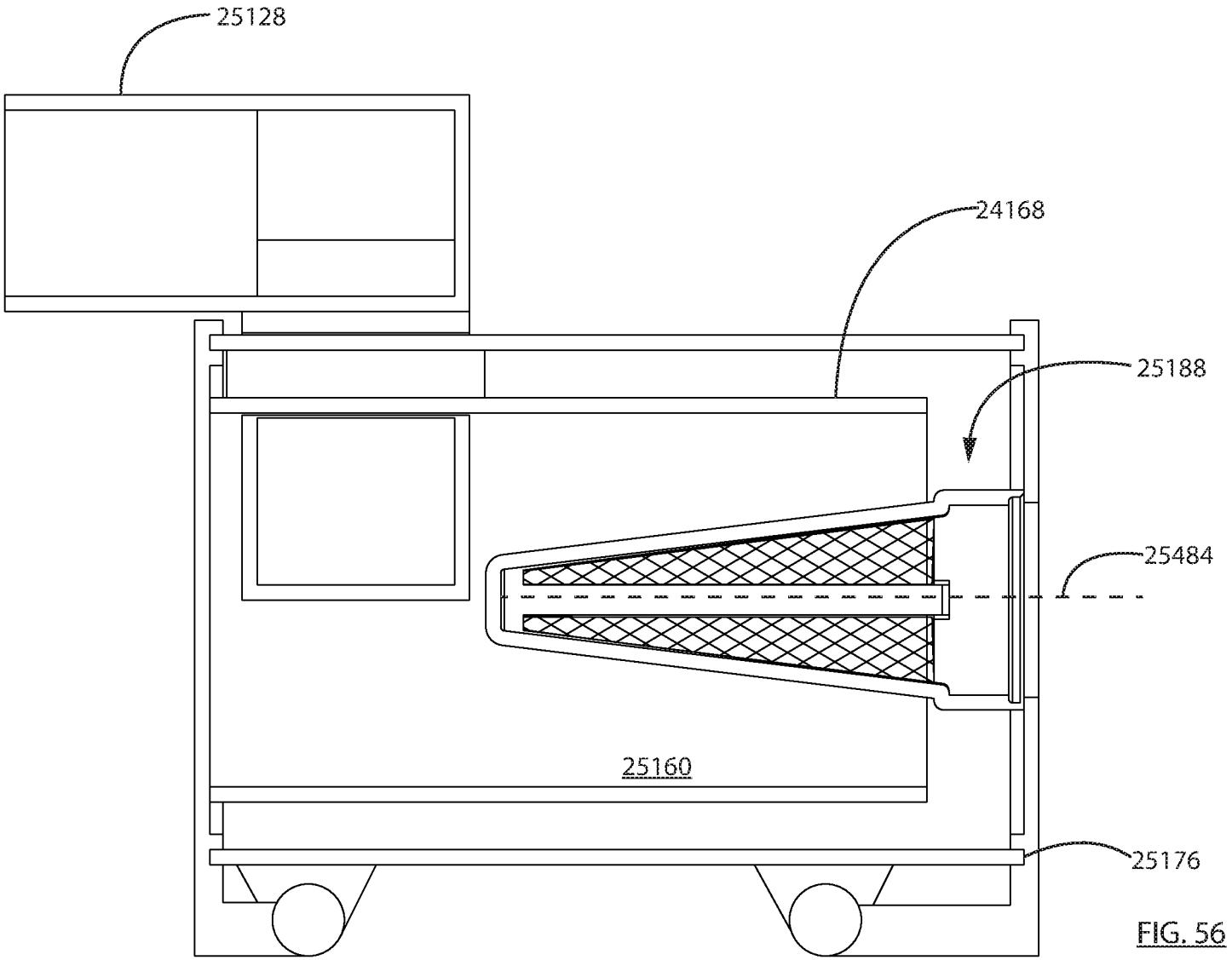
FIG. 56 is a cross-sectional view of the cyclone unit of FIG. 55 taken along line 56-56 in FIG. 55.
Figure 57:
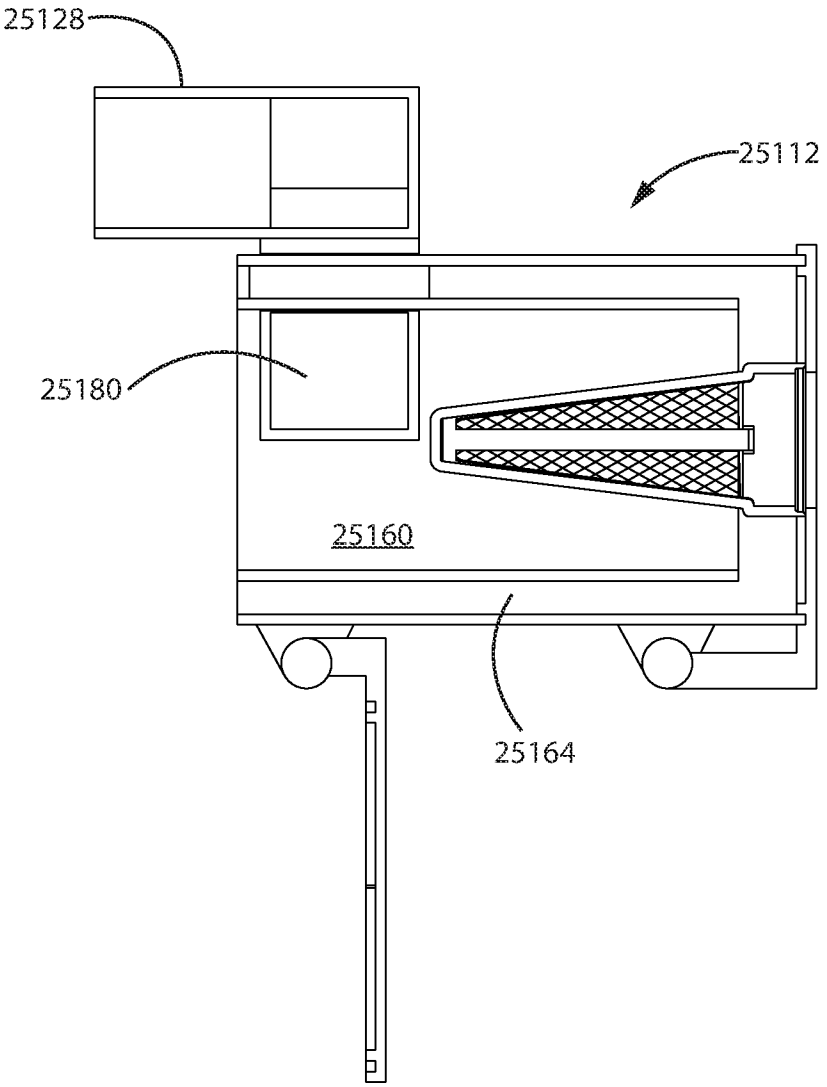
FIG. 57 is a cross-sectional view of the cyclone unit of FIG. 55 taken along line 56-56 in FIG. 55 with a front wall of the cyclone unit in an open position.

Alternately or in addition, cyclone inlet passage 128 may be located above (exterior to) cyclone 160. For example, FIGS. 51 and 56 illustrate examples of cyclone unit 24112 and 25112 respectively in which the cyclone inlet passage 24128/25128 is located above the cyclone chamber 24160/25160.

Alternately, the cyclone air inlet 180 may be positioned at any suitable location for directing air into the cyclone chamber 160.

Various configurations of cyclone inlets and cyclone inlet passages may be used by itself or with any aspect or any embodiment described herein. FIGS. 46-50 exemplify different cyclone inlets and inlet passages.

The example inlets shown in FIGS. 46A-46L are configured to use inlet passages with a circular cross-section, although inlet passages having an alternate shape in a direction transverse to the passage axis may also be used. In various examples, each of the inlet passages shown in FIGS. 46A-46L may be used with rounded transition regions, straight angle transition regions, or other types of transition elbows.

Figures 46A, 46B, 46C, 46D, 46E, 46F, 46G, 46H, 46I, 46J, 46K, 46L:
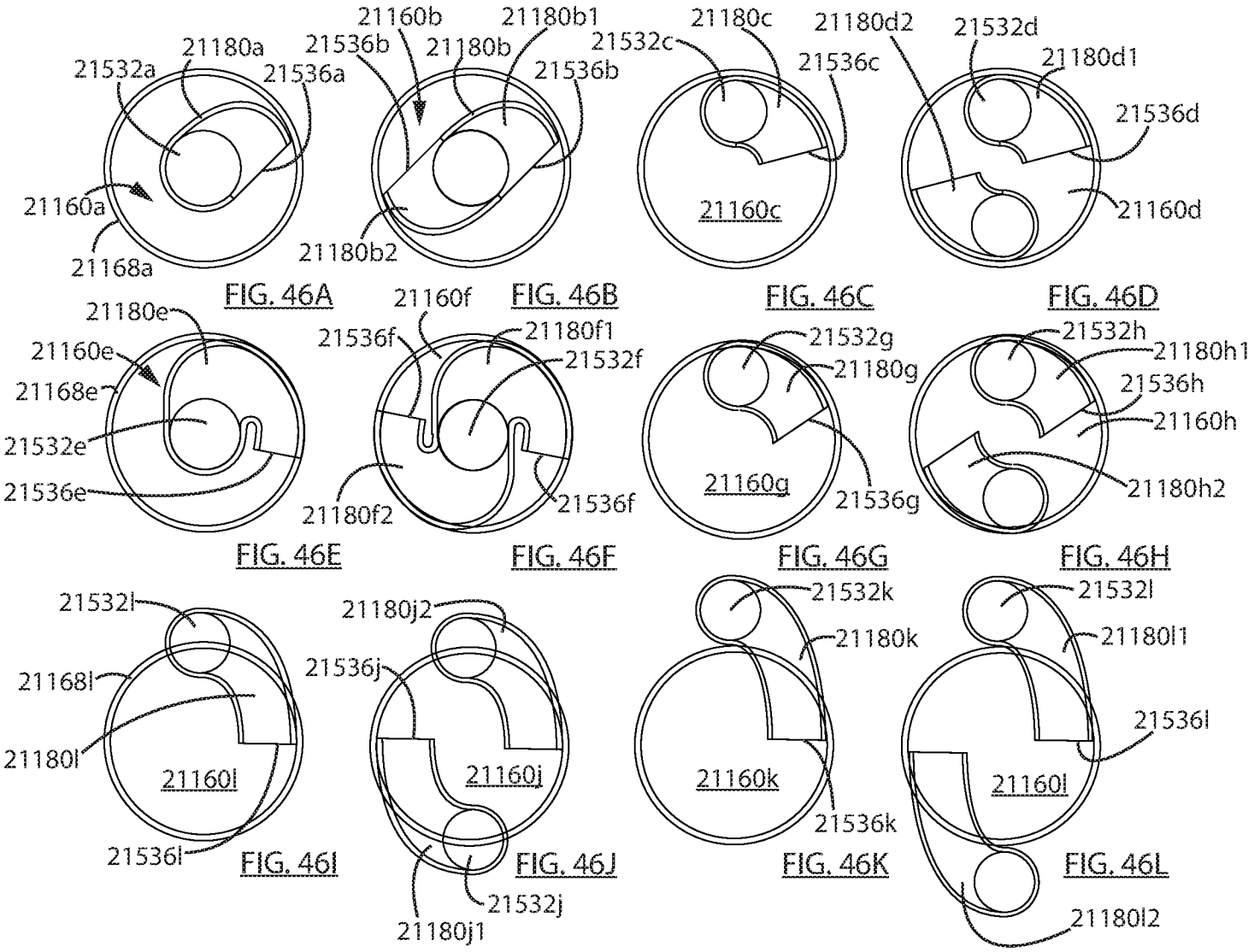
FIGS. 46A-46L illustrate various examples of cyclone unit inlets in accordance with at least one embodiment.

FIG. 46A illustrates an example of a cyclone air inlet 21180*a* that may be used with a cyclone chamber 21160*a* in some embodiments. The cyclone air inlet 21180*a* has a downstream end 21536*a* that extends into the cyclone chamber 21160*a*. The upstream end 21532*a* of the cyclone air inlet 21180*a* can be fluidly coupled to a dirty air inlet, such as dirty air inlet 116 shown in FIGS. 1-13.

As shown in FIG. 46A, the upstream end 21532*a* of the cyclone air inlet 21180*a* is substantially centrally aligned with the cyclone chamber 21160*a*. The downstream end 21536*a* of the cyclone inlet 21180*a* is radially outward of the upstream end 21532*a*.

FIG. 46B illustrates another example of a cyclone air inlet 21180*b* that may be used with a cyclone chamber 21160*b* in some embodiments. In the example shown in FIG. 46B, the cyclone air inlet 21180*b* includes a pair of separate cyclone inlets 21180*b*1 and 21180*b*2 coupled to the same upstream end 21532*b*. The downstream end 21536*b* of each cyclone inlet 21180*b* extends into the cyclone chamber 21160*b*. By providing multiple cyclone inlets 21180*b*1 and 21180*b*2, the cross-sectional area of each cyclone inlet 21180*b* may be reduced while still providing the same volume of air to cyclone chamber 21160*b*. The downstream end 21536*b* of each cyclone inlet 21180*b* may be circumferentially spaced apart around the perimeter of the cyclone chamber 21160*b*. This may provide separation between the bands of dirty air entering the cyclone chamber 21160*b*.

The upstream end 21532*b* of the cyclone air inlet 21180*b* can be fluidly coupled to a dirty air inlet, such as dirty air inlet 116 shown in FIGS. 1-13. As shown in FIG. 46B, the upstream end 21532*b* of the cyclone air inlet 21180*b* is substantially centrally aligned with the cyclone chamber 21160*b*. The downstream end 21536*b* of each cyclone inlet 21180*b* is radially outward of the upstream end 21532*b*.

FIG. 46C illustrates an example of a cyclone air inlet 21180*c* that may be used with a cyclone chamber 21160*c* in some embodiments. The cyclone air inlet 21180*c* has a downstream end 21536*c* that is located in the cyclone chamber 21160*c*. The upstream end 21532*c* of the cyclone air inlet 21180*c* can be fluidly coupled to a dirty air inlet, such as dirty air inlet 116 shown in FIGS. 1-13.

As shown in FIG. 46C, the upstream end 21532*c* and downstream end 21536*c* of the cyclone inlet 21180*c* are radially aligned relative to the cyclone chamber sidewall 21168*c*. This may reduce change in direction between the upstream end 21532*c* and downstream end 21536*c*, which may reduce backpressure through the cyclone inlet 21180*c*. The upstream end 21532*c* and downstream end 21536*c* of the cyclone inlet 21180*c* are radially outward of the center of the cyclone chamber 21160*c*.

FIG. 46D illustrates another example of cyclone air inlets 21180*d*1 and 21180*d*2 that may be used with a cyclone chamber 21160*d* in some embodiments. In the example shown in FIG. 46D, a pair of separate cyclone inlets 21180*d*1 and 21180*d*2 can be used to direct air into the cyclone chamber 21160*d*. Each cyclone inlet 21180*d*1 and 21180*d*1 has a separate upstream end 21532*d* that can be fluidly coupled to one or more dirty air inlets, such as dirty air inlet 116 shown in FIGS. 1-13.

The downstream end 21536*d* of each cyclone inlet 21180*d*1 and 21180*d*2 is located in the cyclone chamber 21160*d*. By providing multiple cyclone inlets 21180*d*1 and 21180*d*2, the cross-sectional area of each cyclone inlet 21180*d* may be reduced while still providing the same volume of air to cyclone chamber 21160*d*. The downstream end 21536*d* of each cyclone inlet 21180*d* may be circumferentially spaced apart from each other around the perimeter of the cyclone chamber 21160*d*. This may provide separation between the bands of dirty air entering the cyclone chamber 21160*d*.

As shown in FIG. 46D, the upstream end 21532*d* and downstream end 21536*d* of each cyclone inlet 21180*d*1 and 21180*d*2 are radially aligned relative to the cyclone chamber sidewall 21168*d* (e.g., a radial outer wall of each cyclone inlet 21180*d*1 and 21180*d*2 is defined by the cyclone chamber sidewall). This may reduce the change in direction between the upstream end 21532*d* and downstream end 21536*d*, which may reduce backpressure through each cyclone inlet 21180*d*. The upstream end 21532*d* and downstream end 21536*d* of each cyclone inlet 21180*d* are radially outward of the center of the cyclone chamber 21160*d*.

FIG. 46E illustrates another example of a cyclone air inlet 21180*e* that may be used with a cyclone chamber 21160*e* in some embodiments. The cyclone air inlet 21180*e* has a downstream end 21536*e* that extends into the cyclone chamber 21160*e*. The upstream end 21532*e* of the cyclone air inlet 21180*e* can be fluidly coupled to a dirty air inlet, such as dirty air inlet 116 shown in FIGS. 1-13.

As shown in FIG. 46E, the upstream end 21532*e* of the cyclone air inlet 21180*e* is substantially centrally aligned with the cyclone chamber 21160*e*. The downstream end 21536*e* of the cyclone inlet 21180*e* is radially outward of the upstream end 21532*e*. The cyclone air inlet 21180*e* is substantially similar to the cyclone air inlet 21180*a* except that the cyclone air inlet 21180*e* has a greater change of direction, and the downstream end 21536*e* is optionally aligned perpendicular to the radius of the cyclone chamber.

The cyclone air inlet 21180*e* is substantially similar to the cyclone air inlet 21180*a* except that the cyclone air inlet 21180*e* has a greater change of direction, and the downstream end 21536*e* of each cyclone air inlet 21180*e* is optionally aligned perpendicular to the radius of the cyclone chamber.

FIG. 46F illustrates another example of a cyclone air inlet 21180*f* that may be used with a cyclone chamber 21160*f* in some embodiments. In the example shown in FIG. 46F, the cyclone air inlet 21180*f* includes a pair of separate cyclone inlets 2118*f*1 and 21180*f*2 coupled to the same upstream end 21532*f*. The downstream end 21536*f* of each cyclone inlet 21180*f* is located in the cyclone chamber 21160*f*. By providing multiple cyclone inlets 21180*f*1 and 21180*f*2, the cross-sectional area of each cyclone inlet 21180*f* may be reduced while still providing the same volume of air to cyclone chamber 21160*f*. The downstream end 21536*f* of each cyclone inlet 21180*f* may be circumferentially spaced apart around the perimeter of the cyclone chamber 21160*f* from each other. This may provide separation between the bands of dirty air entering the cyclone chamber 21160*f*.

The upstream end 21532*f* of the cyclone air inlet 21180*f* can be fluidly coupled to a dirty air inlet, such as dirty air inlet 116 shown in FIGS. 1-13. As shown in FIG. 46F, the upstream end 21532*f* of the cyclone air inlet 21180*f* is substantially centrally aligned with the cyclone chamber 21160*f*. The downstream end 21536*f* of each cyclone inlet 21180*f* is radially outward of the upstream end 21532*f*.

The cyclone air inlet 21180*f* is substantially similar to the cyclone air inlet 21180*b* except that each cyclone air inlet 21180*f* has a greater change of direction, and the downstream end 21536*f* of each cyclone air inlet 21180*f* is optionally aligned perpendicular to the radius of the cyclone chamber.

FIG. 46G illustrates an example of a cyclone air inlet 21180*g* that may be used with a cyclone chamber 21160*g* in some embodiments. The cyclone air inlet 21180*g* has a downstream end 21536*g* that extends into the cyclone chamber 21160*g*. The upstream end 21532*g* of the cyclone air inlet 21180*g* can be fluidly coupled to a dirty air inlet, such as dirty air inlet 116 shown in FIGS. 1-13.

As shown in FIG. 46G, the upstream end 21532*g* and downstream end 21536*g* of the cyclone inlet 21180*g* are radially aligned relative to the cyclone chamber sidewall 21168*g*. This may reduce change in direction between the upstream end 21532*g* and downstream end 21536*g*, which may reduce backpressure through the cyclone inlet 21180*g*. The upstream end 21532*g* and downstream end 21536*g* of the cyclone inlet 21180*g* are radially outward of the center of the cyclone chamber 21160*g*.

The cyclone air inlet 21180*g* is substantially similar to the cyclone air inlet 21180*c* except that each cyclone air inlet 21180*g* has a greater radial extent, and the downstream end 21536*g* of each cyclone air inlet 21180*g* is aligned perpendicular to the radius of the cyclone chamber.

FIG. 46H illustrates another example of cyclone air inlets 21180*h*1 and 21180*h*2 that may be used with a cyclone chamber 21160*h* in some embodiments. In the example shown in FIG. 46H, a pair of separate cyclone inlets 21180*h*1 and 21180*h*2 can be used to direct air into the cyclone chamber 21160*h*. Each cyclone inlet 21180*h*1 and 21180*h*2 has a separate upstream end 21532*h* that can be fluidly coupled to one or more dirty air inlets, such as dirty air inlet 116 shown in FIGS. 1-13.

The downstream end 21536*h* of each cyclone inlet 21180*h*1 and 21180*h*2 is in the cyclone chamber 21160*h*. By providing multiple cyclone inlets 21180*h*1 and 21180*h*2, the cross-sectional area of each cyclone inlet 21180*h* may be reduced while still providing the same volume of air to cyclone chamber 21160*h*. The downstream end 21536*h* of each cyclone inlet 21180*h* may be circumferentially spaced from each other apart around the perimeter of the cyclone chamber 21160*h*. This may provide separation between the bands of dirty air entering the cyclone chamber 21160*h*.

As shown in FIG. 46H, the upstream end 21532*h* and downstream end 21536*h* of each cyclone inlet 21180*h*1 and 21180*h*2 are radially aligned relative to the cyclone chamber sidewall 21168*h*. This may reduce change in direction between the upstream end 21532*h* and downstream end 21536*h*, which may reduce backpressure through each cyclone inlet 21180*h*. The upstream end 21532*h* and downstream end 21536*h* of each cyclone inlet 21180*h* are radially outward of the center of the cyclone chamber 21160*h*.

The cyclone air inlet 21180*h* is substantially similar to the cyclone air inlet 21180*d* except that each cyclone air inlet 21180*h* has a greater radial extent, and the downstream end 21536*h* of each cyclone air inlet 21180*h* is aligned perpendicular to the radius of the cyclone chamber.

FIG. 46I illustrates another example of a cyclone air inlet 21180*i* that may be used with a cyclone chamber 21160*i* in some embodiments. The cyclone air inlet 21180*i* has a downstream end 21536*i* that is in the cyclone chamber 21160*i*. The upstream end 21532*i* of the cyclone air inlet 21180*i* can be fluidly coupled to a dirty air inlet, such as dirty air inlet 116 shown in FIGS. 1-13.

The downstream end 21536*i* of the cyclone inlet 21180*i* is radially inward of the upstream end 21532*i*. The cyclone air inlet 21180*i* is substantially similar to the cyclone air inlet 21180*a* except that a projection of the upstream end 21532*i* of the cyclone air inlet 21180*i* intersects the sidewall 21168*i* of the cyclone chamber 21160*i*.

FIG. 46J illustrates another example of cyclone air inlets 21180*j*1 and 21180*j*2 that may be used with a cyclone chamber 21160*j* in some embodiments. In the example shown in FIG. 46J, a pair of separate cyclone inlets 21180*j*1 and 21180*j*2 can be used to direct air into the cyclone chamber 21160*j*. Each cyclone inlet 21180*j*1 and 21180*j*2 has a separate upstream end 21532*j* that can be fluidly coupled to one or more dirty air inlets, such as dirty air inlet 116 shown in FIGS. 1-13.

The downstream end 21536*j* of each cyclone inlet 21180*j*1 and 21180*j*2 is in the cyclone chamber 21160*j*. By providing multiple cyclone inlets 21180*j*1 and 21180*j*2, the cross-sectional area of each cyclone inlet 21180*j* may be reduced while still providing the same volume of air to cyclone chamber 21160*j*. The downstream end 21536*h* of each cyclone inlet 21180*j* may be circumferentially spaced apart from each other around the perimeter of the cyclone chamber 21160*j*. This may provide separation between the bands of dirty air entering the cyclone chamber 21160*j*.

The downstream end 21536*j* of each cyclone inlet 21180*j* is radially inward of the upstream end 21532*j*. The cyclone air inlet 21180*j* is substantially similar to the cyclone air inlet 21180*d* except that a projection of the upstream end 21532*j* of each cyclone air inlet 21180*j* intersects the sidewall 21168*j* of the cyclone chamber 21160*j*.

FIG. 46K illustrates an example of a cyclone air inlet 21180*k* that may be used with a cyclone chamber 21160*k* in some embodiments. The cyclone air inlet 21180*k* has a downstream end 21536*k* that is in the cyclone chamber 21160*k*. The upstream end 21532*k* of the cyclone air inlet 21180*k* can be fluidly coupled to a dirty air inlet, such as dirty air inlet 116 shown in FIGS. 1-13.

The downstream end 21536*k* of the cyclone inlet 21180*k* is radially inward of the upstream end 21532*k*. The cyclone air inlet 21180*k* is substantially similar to the cyclone air inlet 21180*i* except that a projection of the upstream end 21532*k* of the cyclone air inlet 21180*k* is radially outward from the sidewall 21168*k* of the cyclone chamber 21160*k*.

FIG. 46L illustrates another example of cyclone air inlets 21180/1 and 21180/2 that may be used with a cyclone chamber 21160*l* in some embodiments. In the example shown in FIG. 46L, a pair of separate cyclone inlets 21180/1 and 21180/2 can be used to direct air into the cyclone chamber 21160*l*. Each cyclone inlet 21180/1 and 21180/2 has a separate upstream end 21532*l* that can be fluidly coupled to one or more dirty air inlets, such as dirty air inlet 116 shown in FIGS. 1-13.

The downstream end 21536*l* of each cyclone inlet 21180/1 and 21180/2 is in the cyclone chamber 21160*l*. By providing multiple cyclone inlets 21180/1 and 21180/2, the cross-sectional area of each cyclone inlet 21180*l* may be reduced while still providing the same volume of air to cyclone chamber 21160*l*. The downstream end 21536*l* of each cyclone inlet 21180*l* may be circumferentially spaced apart from each other around the perimeter of the cyclone chamber 21160*l*. This may provide separation between the bands of dirty air entering the cyclone chamber 21160*l*.

The downstream end 21536*l* of each cyclone inlet 21180*l* is radially inward of the upstream end 21532*l*. The cyclone air inlet 21180*l* is substantially similar to the cyclone air inlet 21180*j* except that a projection of the upstream end 21532*l* of each cyclone air inlet 21180*l* is radially outward of the sidewall 211681 of the cyclone chamber 21160*l*.

FIGS. 47A-47D illustrate examples of cyclone air inlets 22180 that may be used with a cyclone chamber 22160 in accordance with various embodiment. Each of the cyclone air inlets 22180*a*-22180*d* are generally similar to the cyclone air inlet 21180*a*, except that the cross-section shape of the airflow passage in a direction transverse to the direction of air flow through the cyclone air inlets 22180*a*-22180*d* is non-circular. The non-circular air inlets and air inlet passages may be used interchangeably in place of the circular air inlet passages illustrated in other embodiments herein.

Figure 47B:
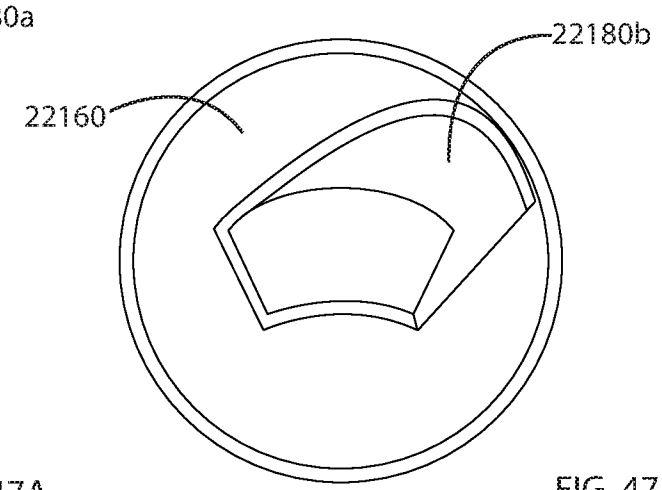
FIGS. 47A-47D illustrate various examples of cyclone unit inlets in accordance with at least one embodiment.
Figure 47A:
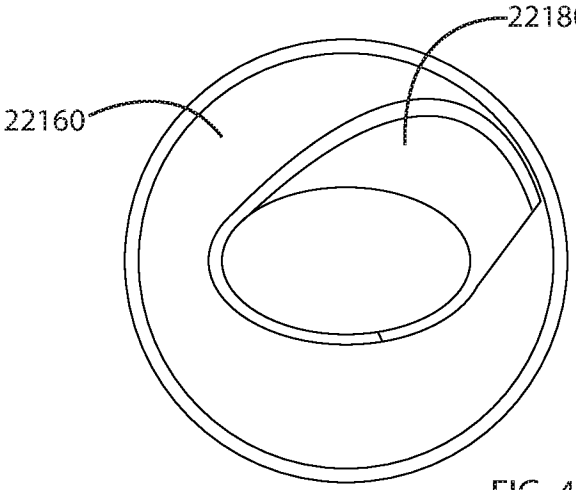
Figure 47D:
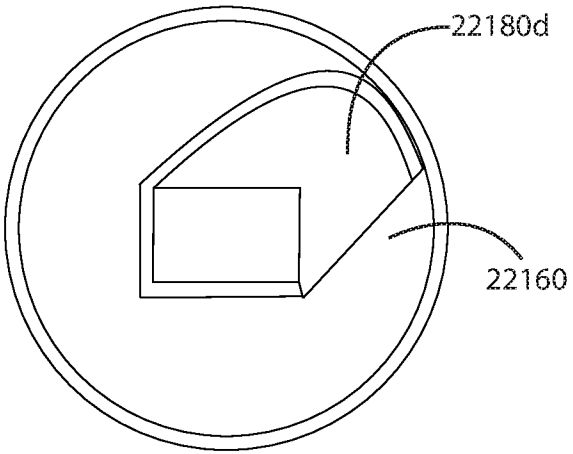
Figure 47C:
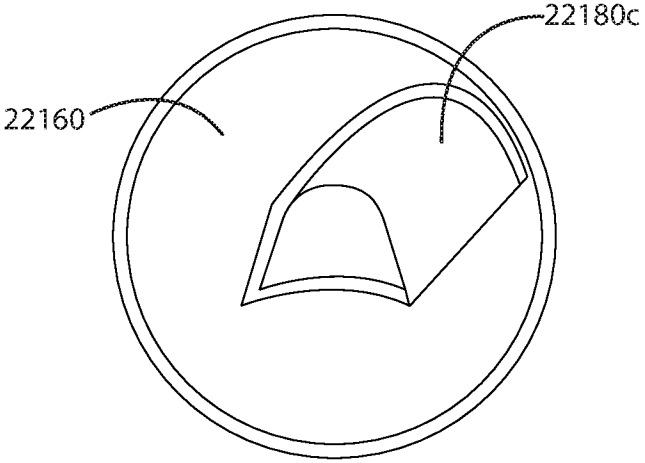

As shown in FIG. 47A, the cyclone air inlet 22180*a* may have an elliptical cross-section in some embodiments. FIG. 47B illustrates an example of a cyclone air inlet 22180*b* with an irregularly shaped cross-section. FIG. 47C illustrates an example of a cyclone air inlet 22180*c* with another irregularly shaped cross-section. FIG. 47D illustrates an example of a cyclone air inlet 22180*d* with a rectangular cross-section. It will be appreciated that various other shapes may also be used with cyclone air inlets in embodiments described herein.

FIGS. 48A-48E illustrate the configuration of an example cyclone air inlet 180*b* that may be used with surface cleaning apparatus 100. The cyclone air inlet 180*b* has a profile that generally corresponds to the cyclone air inlet 22180*g*, with a rounded elbow or transition region 133. The rounded transition region may reduce backpressure in the air flow passage. As exemplified in FIG. 48E, the rearward wall 183 of the inlet is also rounded inwardly (e.g., it may be concave).

FIGS. 50A-50D illustrate the configuration of another example cyclone air inlet 23180 that may be used with surface cleaning apparatus 100. The cyclone air inlet 23180 is generally similar to cyclone air inlet 180 except that cyclone air inlet 23180 and air flow passage 23128 have a rectangular cross-section as exemplified in FIG. 47D. In the example shown, cyclone air inlet 23180 has a straight edged elbow or transition region 23133.

Alternately or in addition, the cyclone air inlet may be an axial inlet. In such a case, a plurality of vane members may be provided to induce cyclonic flow in the cyclone chamber 160 as the air that exits the inlet passage 128.

Figure 63:
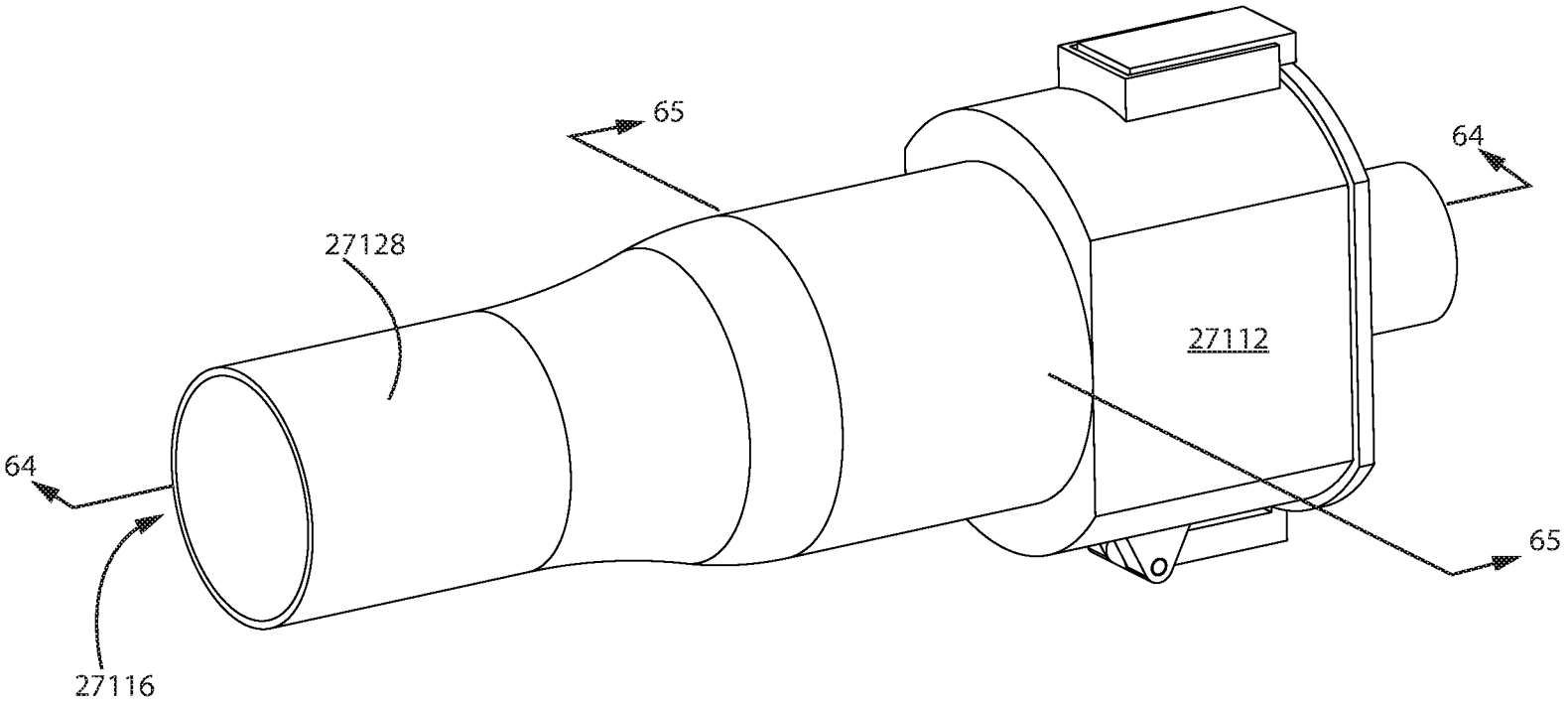
FIG. 63 is a perspective view of an example cyclone unit in accordance with at least one embodiment.
Figure 64:
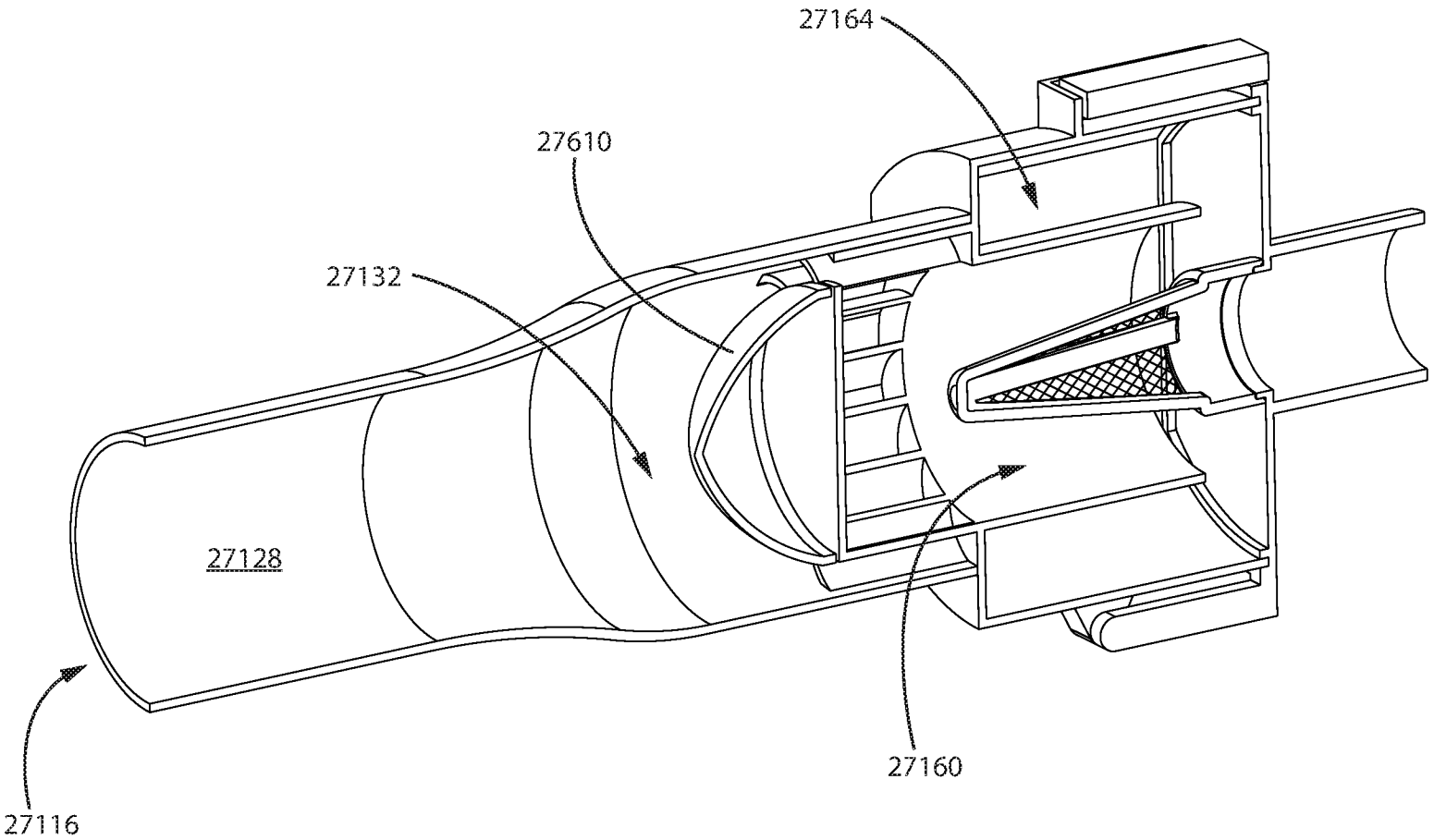
FIG. 64 is a cross-sectional view of the cyclone unit of FIG. 63 along line 64-64 in FIG. 63.
Figure 65:
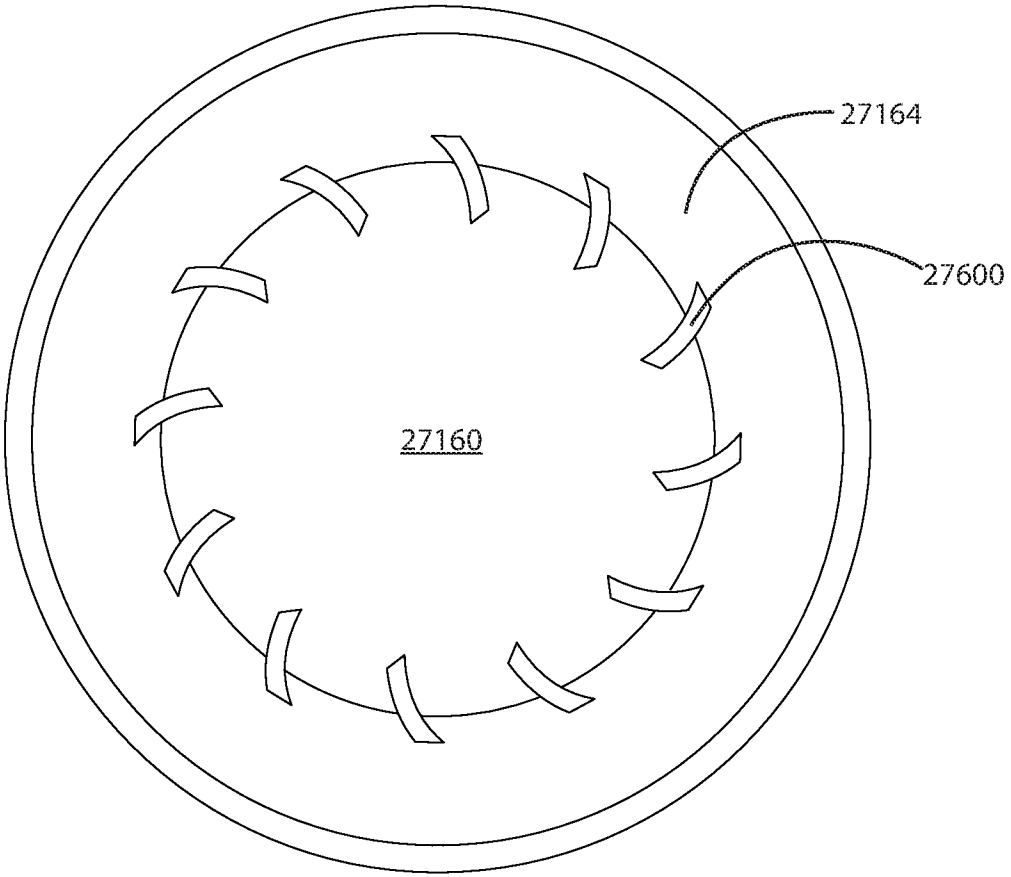
FIG. 65 is a cross-sectional view of the cyclone unit of FIG. 63 along line 65-65 in FIG. 63.

FIGS. 63-65 illustrate an example of a cyclone unit 27112 in which vane members 27600 are used to direct air flow into the cyclone chamber 27160. The vane members may be curved so that the air entering the cyclone chamber 27160 may be gradually directed towards a tangential air flow path when passing through the vanes 27160.

As shown in FIG. 64, the inlet passage is an annular passage, which optionally as exemplified, has a diameter larger than the diameter of the cyclone chamber. Accordingly, the vanes 27600 may be circumferentially spaced around the outer perimeter of the cyclone chamber first end 27172 and direct the air radially inwardly as well as inducing a cyclonic flow.

The vanes 27600 can be positioned around the entire periphery of the cyclone chamber first end 27172. This may allow air to enter the cyclone chamber 27160 around the perimeter of the cyclone chamber first end 27172. This may maximize the volume within cyclone chamber 27160 that is used to separate dirt that is entrained in the swirling air.

Air entering the dirty air inlet 27116 can travel along the air inlet passage 27128 towards the cyclone chamber 27160. A diversion member 27610 can be positioned in a downstream portion 27132 of the air inlet passage 27128. The diversion member 27610 can be configured to distribute air towards the annular portion of the air inlet passage 27128 and then to vanes 27600 that are spaced around the cyclone chamber 27160.

As shown, the diversion member 27610 has a curved or tapered profile. The diversion member 27610 may be narrower at its upstream end 27611 and then increase in width towards its downstream end 27612. This may reduce the backpressure through the air inlet passage 27128. Optionally, as exemplified, the diversion member 27160 may be curved (e.g., bullet shaped).

Alternately, the diversion member 27610 may be any suitable configuration to divert air towards all of the vanes 27600 spaced around the cyclone chamber 27160. For example, the diversion member 27610 may be flat. This may allow a more compact design of the air inlet passage 27128.

Alternately or in addition, the vanes may have a three-dimensional curvature. For example, the vanes 27160 may be curved radially as well as longitudinally. Alternately, straight or flat vanes may be used.

Figure 66:
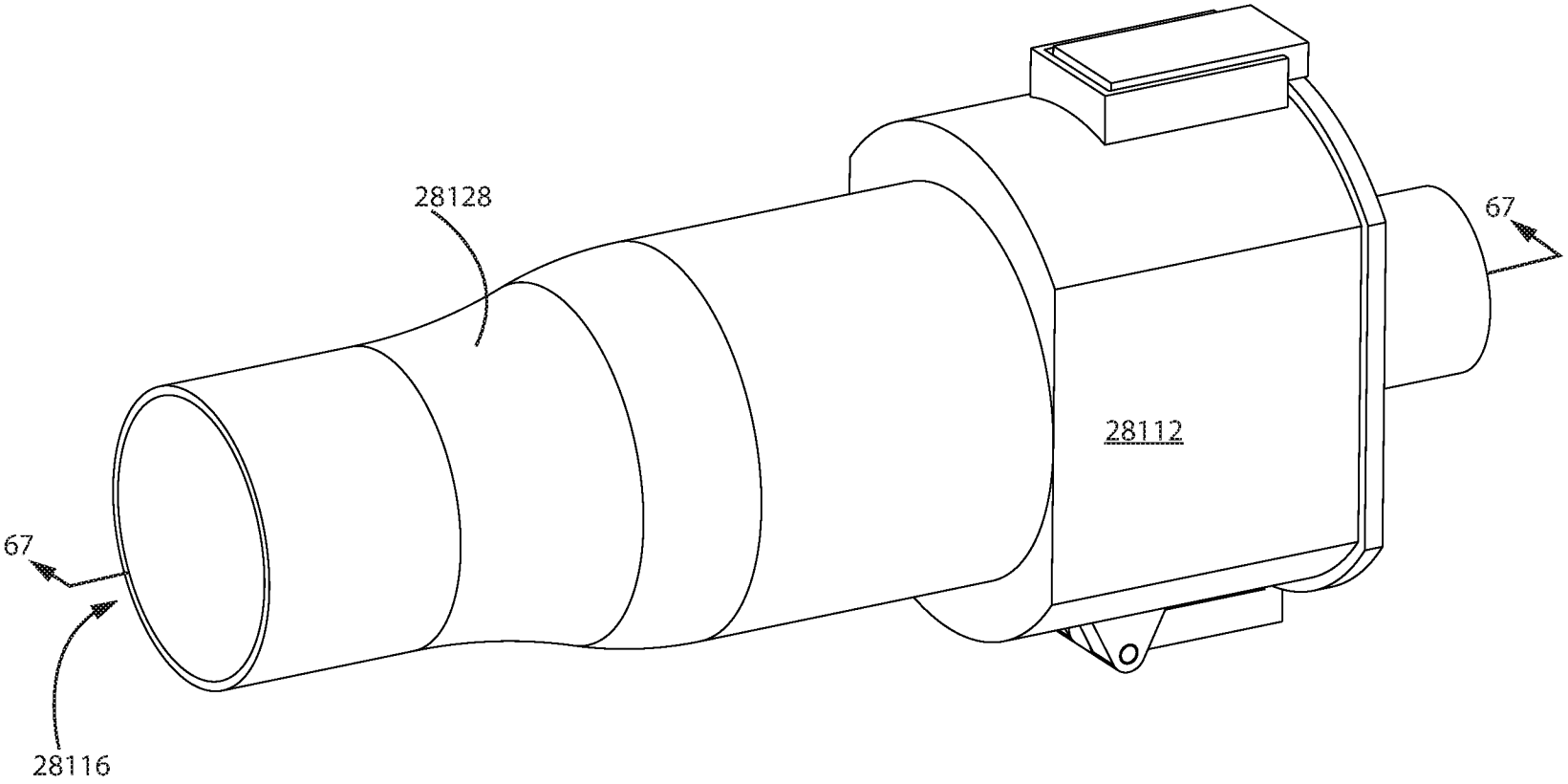
FIG. 66 is a perspective view of another example cyclone unit in accordance with at least one embodiment.
Figure 67:
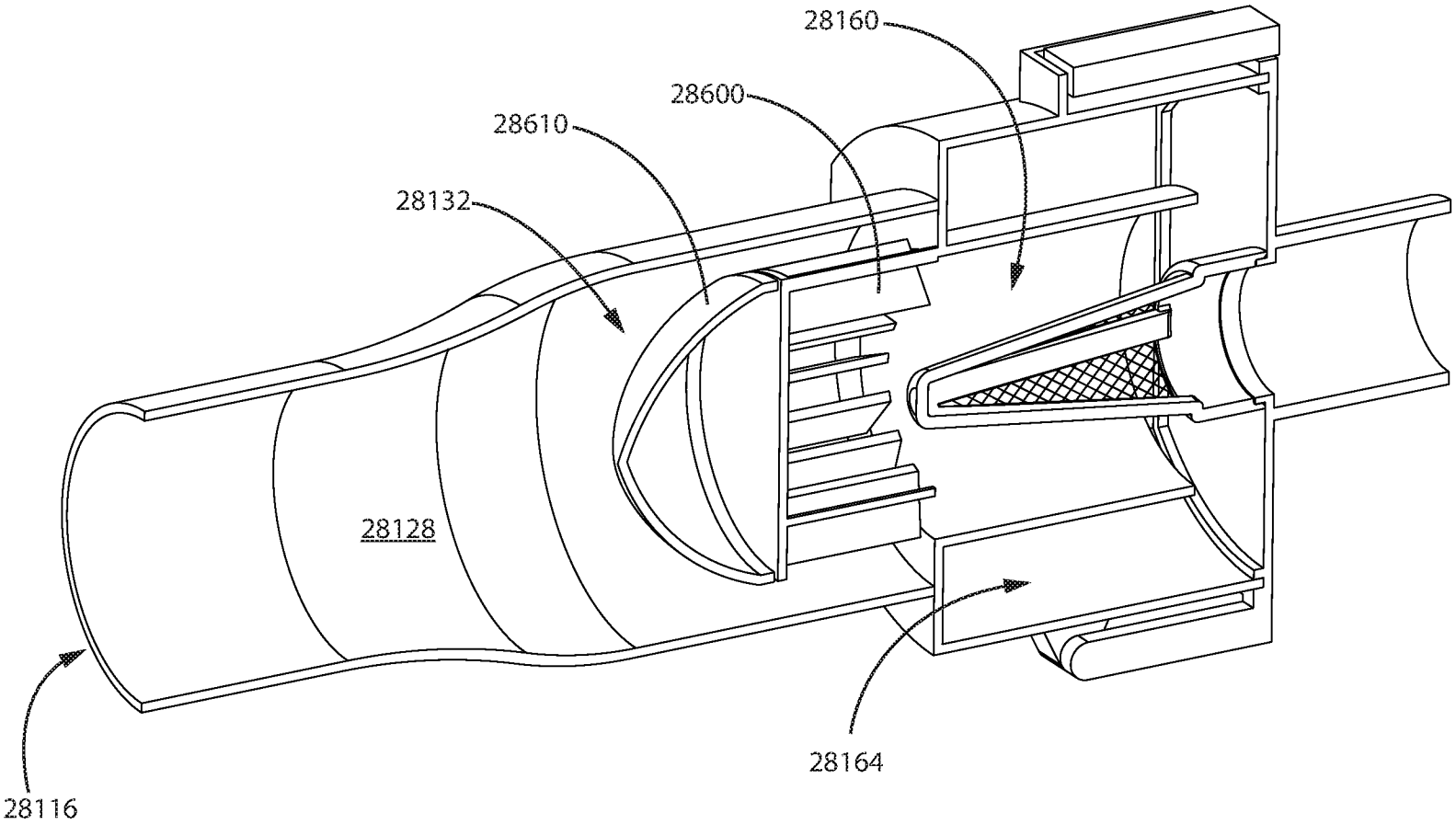
FIG. 67 is a cross-sectional view of the cyclone unit of FIG. 66 along line 67-67 in FIG. 66.

FIGS. 66-67 illustrate another example of a cyclone unit 28112 in which straight vane members 28600 are used to direct air flow into the cyclone chamber 28160. As with the embodiment shown in FIGS. 63-35, the vanes 28600 are circumferentially spaced around the first end 28172 of the cyclone chamber 28160. In this example, the outer diameter of the vanes is the same as the diameter of the cyclone chamber sidewall. Therefore, a projection of the vanes would be located in the cyclone chamber.

Air entering the dirty air inlet 28116 can travel along the air inlet passage 28128 towards the cyclone chamber 28160. A diversion member 28610 can be positioned in a downstream portion 28132 of the air inlet passage 28128. The diversion member 28610 can be configured to distribute air towards the vanes 28600 that are spaced around the cyclone chamber 28160. The air may then be directed to have a cyclonic flow in cyclone chamber 28160 by vanes 28600. As a projection of the vanes would be located in the cyclone chamber, the vanes need not direct the air inwardly.

Figure 68:
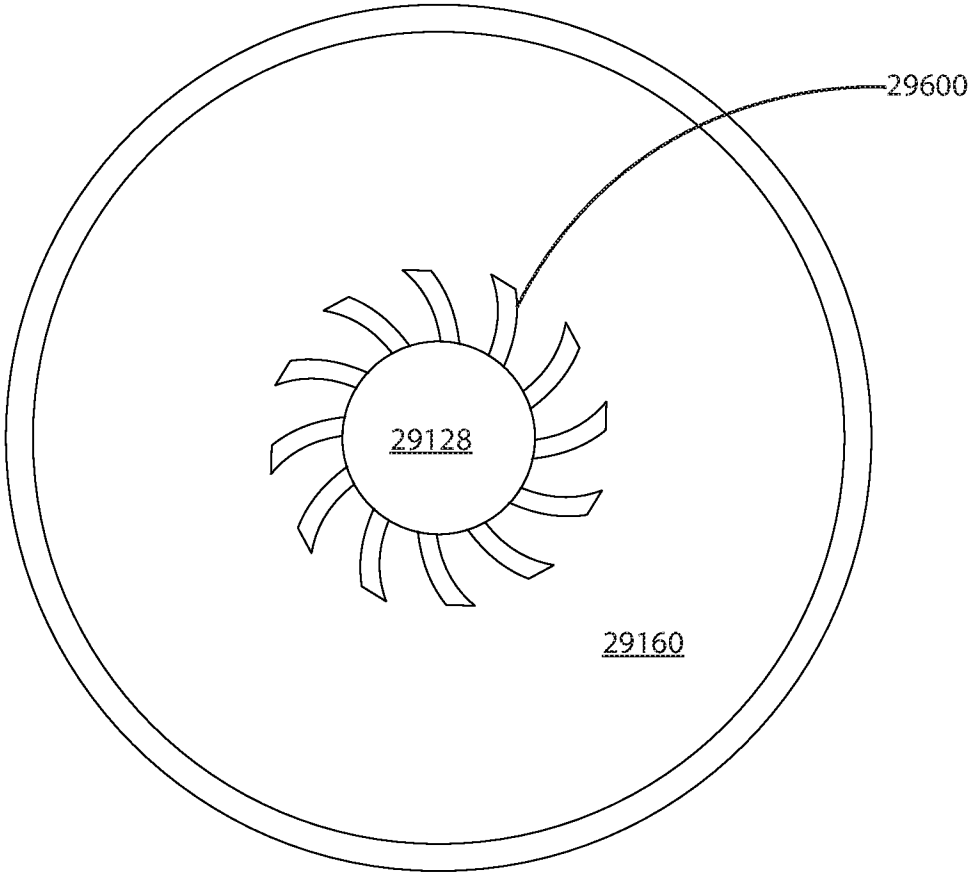
FIG. 68 is a cross-sectional view of the cyclone unit of FIG. 69 along line 68-68 in FIG. 69.
Figure 69:
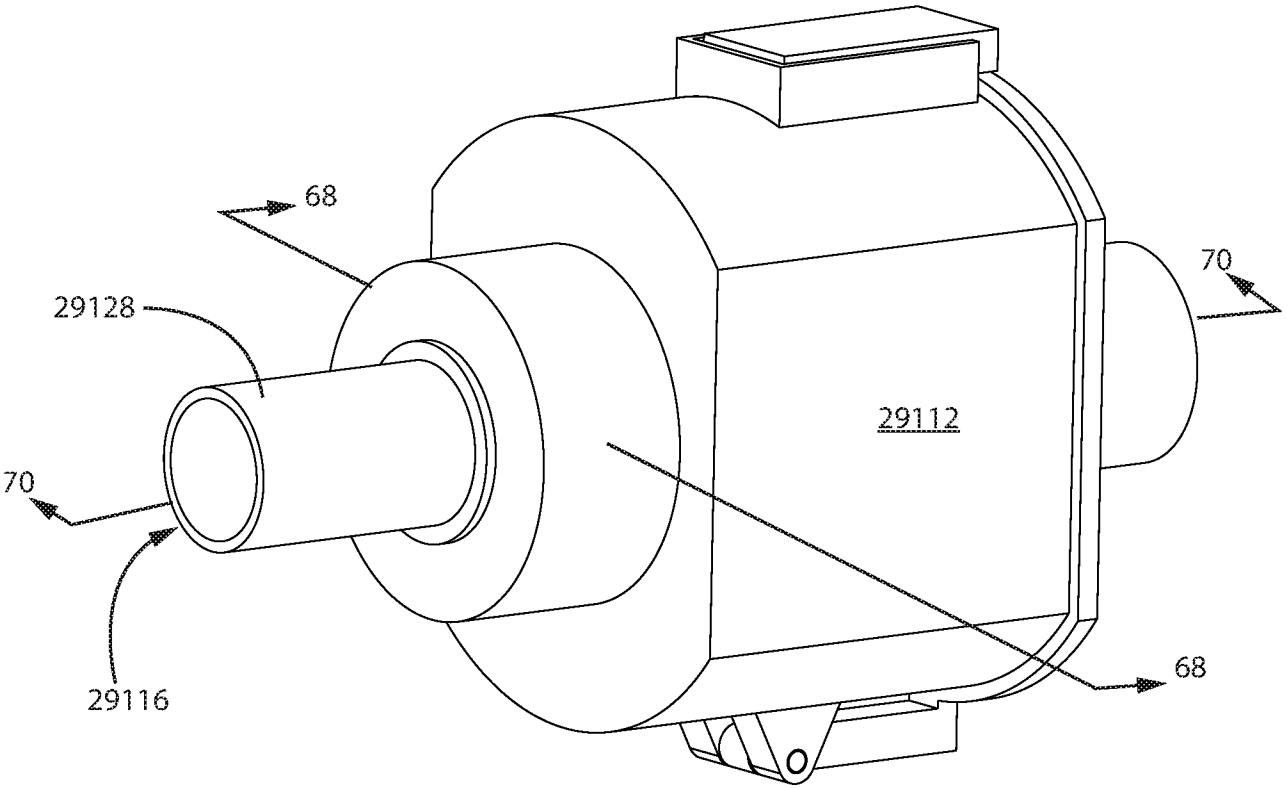
FIG. 69 is a perspective view of another example cyclone unit in accordance with at least one embodiment.
Figure 70:
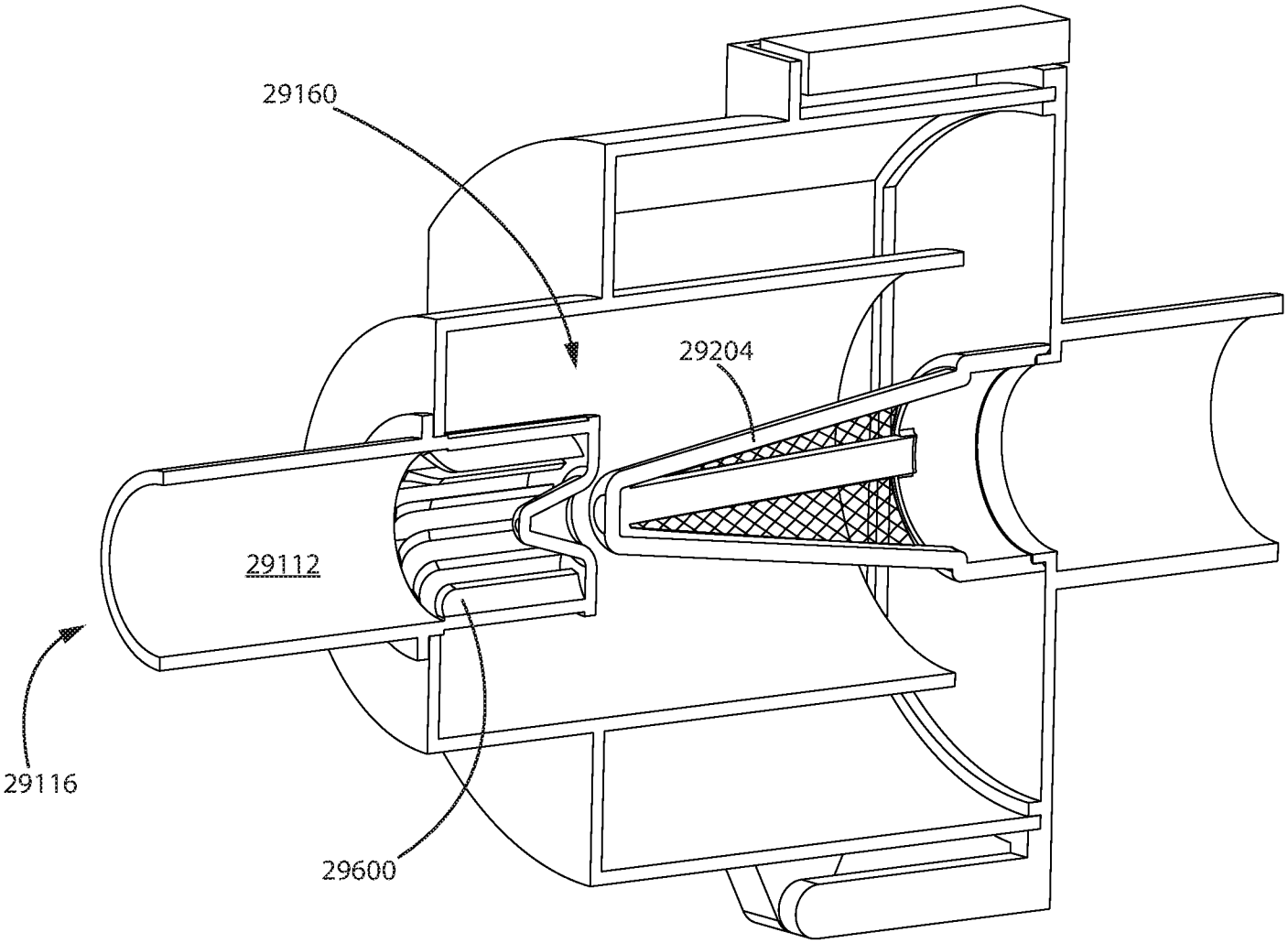
FIG. 70 is a cross-sectional view of the cyclone unit of FIG. 69 along line 70-70 in FIG. 69.

FIGS. 68-70 illustrate another example of a cyclone unit 29112 in which vane members 29600 are used to direct air flow into the cyclone chamber 29160.

As shown in FIG. 70, the vanes 29600 may be circumferentially spaced inwardly from the cyclone chamber sidewall and internal the cyclone chamber first end 27172. Accordingly, unlike the cyclone units shown in FIGS. 63-67, the vanes 29600 may be positioned to direct air radially outward into the cyclone chamber 29160. This may direct air away from the vortex finder 29204 which may reduce the volume of dirt and debris that collections on the vortex finder 29204.

The vanes 29600 can be positioned around the entire periphery of the downstream portion 29132 of the air inlet passage 29128. The vanes 29600 may direct to enter the cyclone chamber 29160 around the perimeter of the cyclone chamber first end 29172. This may maximize the volume within cyclone chamber 29160 that is used to separate dirt that is entrained in the swirling air.

Air entering the dirty air inlet 29116 can travel along the air inlet passage 29128 towards the cyclone chamber 29160. The air can then enter the cyclone chamber 29160 via the vanes 29600. A diversion member 29610 can be positioned in a downstream portion 29132 of the air inlet passage 29128. The diversion member 29610 can be configured to distribute air outwardly towards the vanes 30600 that are spaced around the diversion member 30610. The air can then be directed outwardly into the cyclone chamber 30160 by vanes 30600.

Figure 71:
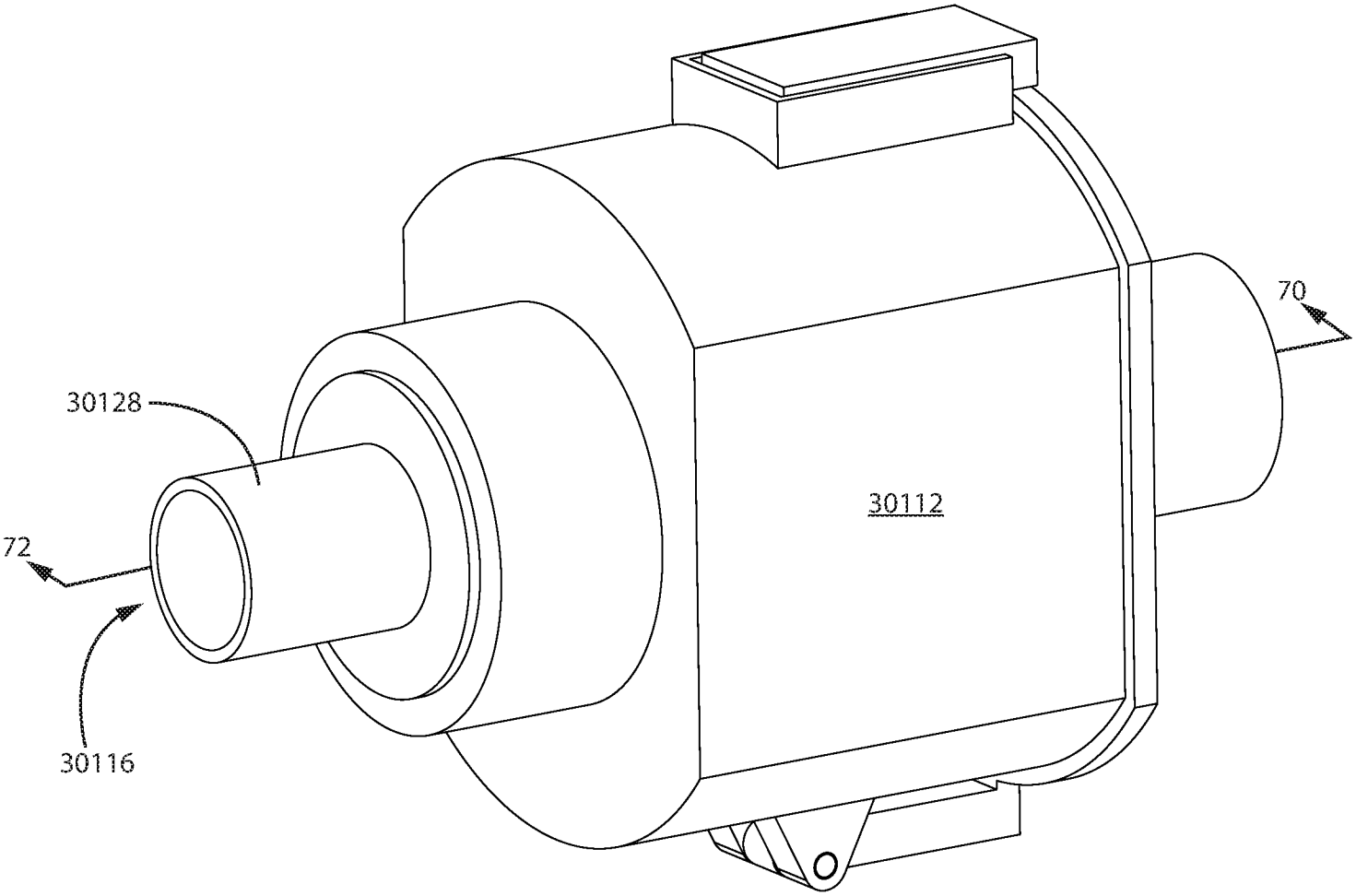
FIG. 71 is a perspective view of another example cyclone unit in accordance with at least one embodiment.
Figure 72:
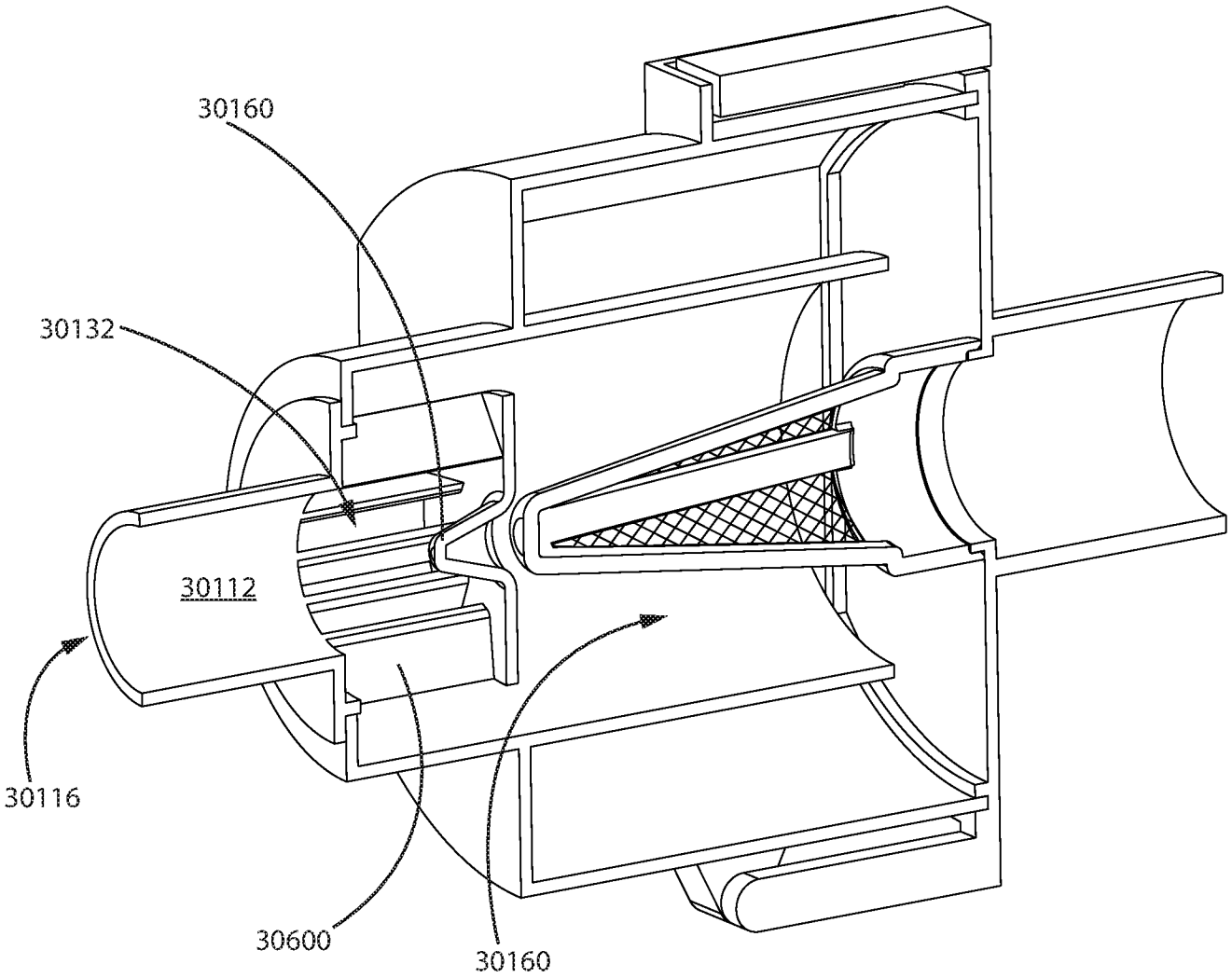
FIG. 72 is a cross-sectional view of the cyclone unit of FIG. 71 along line 72-72 in FIG. 71.

FIGS. 71-72 illustrate another example of a cyclone unit 30112 in which straight vane members 30600 are used to direct air flow into the cyclone chamber 30160. As with the embodiment shown in FIGS. 68-70, the vanes 30600 are circumferentially spaced inwardly from the cyclone chamber sidewall and internal the cyclone chamber first end 30172 of the cyclone chamber 30160. However, instead of inwardly curved vanes 29600, the vanes 30600 used with cyclone unit 30112 are straight.

Air entering the dirty air inlet 30116 can travel along the air inlet passage 30128 towards the cyclone chamber 30160. The air can then enter the cyclone chamber 30160 via the vanes 30600. A diversion member 30610 can be positioned in a downstream portion 30132 of the air inlet passage 30128. The diversion member 30610 can be configured to distribute air outwardly towards the vanes 30600 that are spaced around the diversion member 30610. The air can then be directed outwardly into the cyclone chamber 30160 by vanes 30600.

Figure 73:
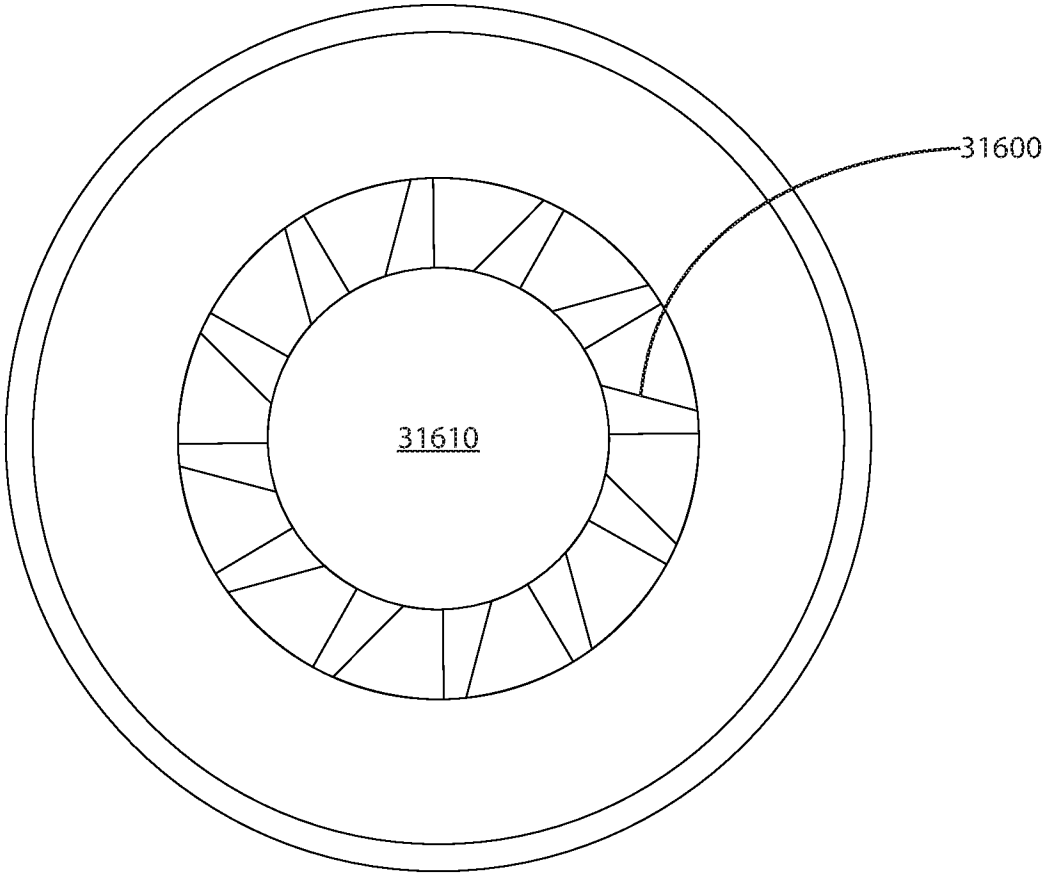
FIG. 73 is a cross-sectional view of the cyclone unit of FIG. 74 along line 73-73 in FIG. 74.
Figure 74:
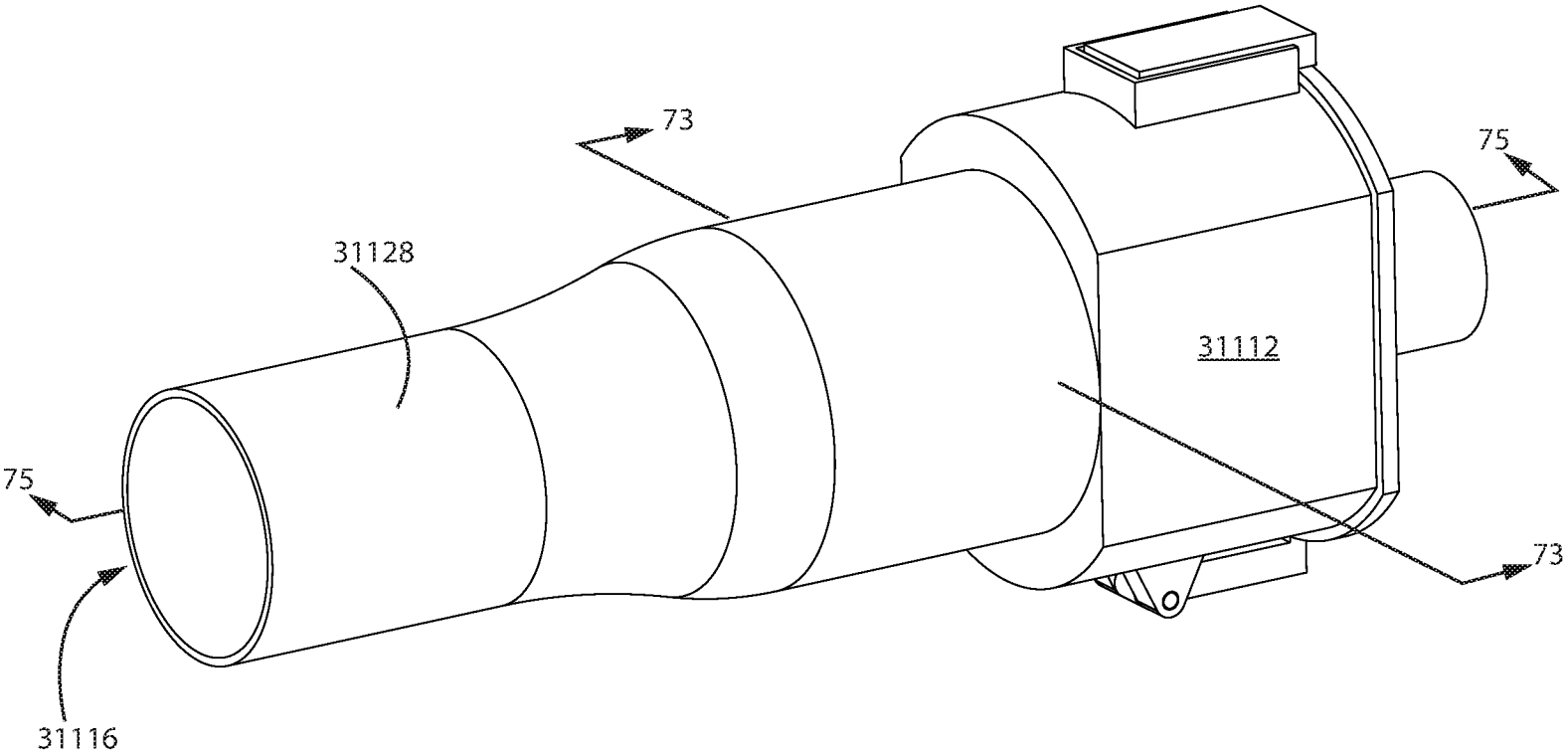
FIG. 74 is a perspective view of another example cyclone unit in accordance with at least one embodiment.
Figure 75:
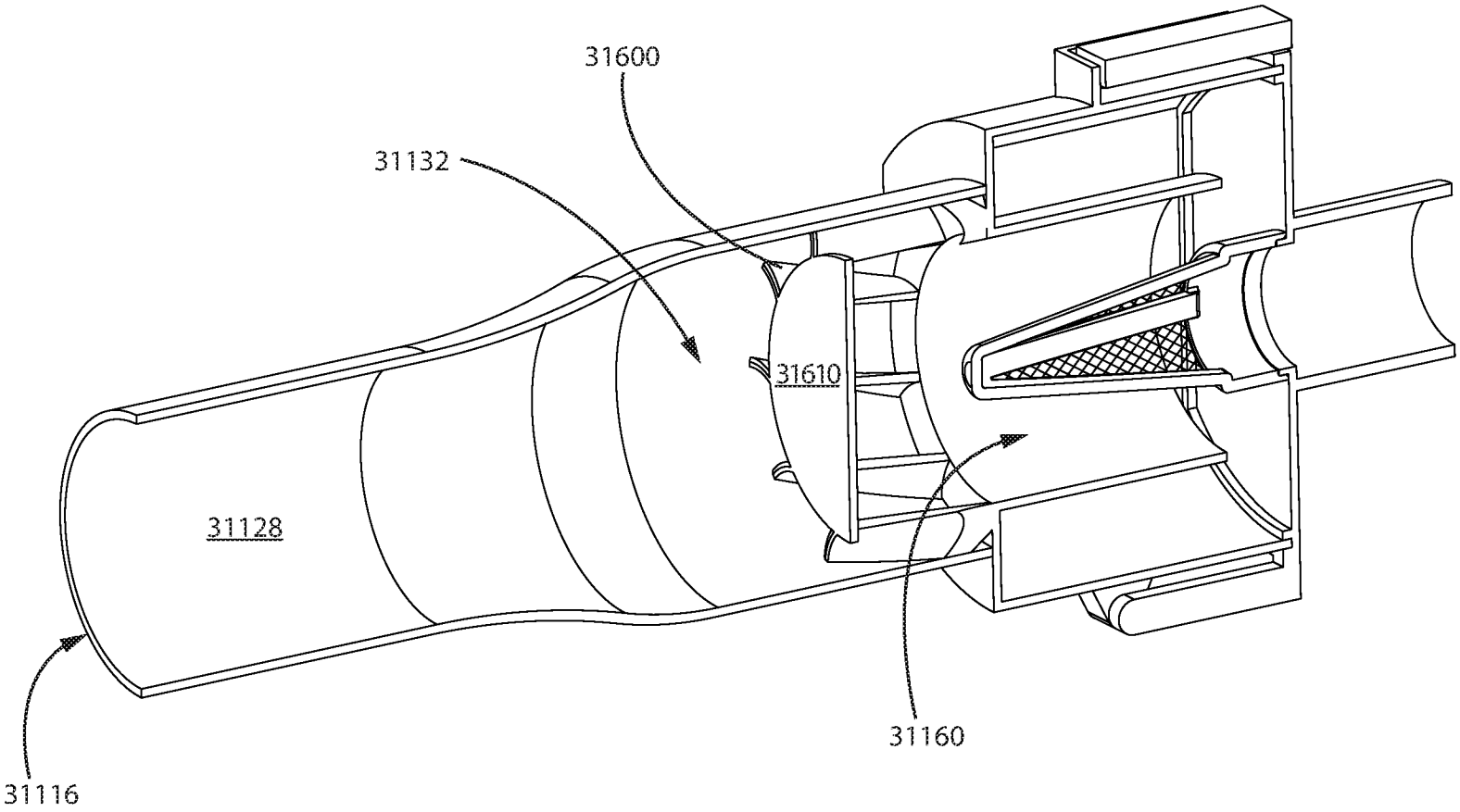
FIG. 75 is a cross-sectional view of the cyclone unit of FIG. 74 along line 75-75 in FIG. 74.

FIGS. 73-75 illustrate another example of a cyclone unit 31112 in which vane members 31600 are used to direct air flow into the cyclone chamber 31160. As with the embodiment shown in FIGS. 63-35, the vanes 31600 are circumferentially spaced around the first end 31172 of the cyclone chamber 31160. However, in addition to being inwardly curved, the vanes 31600 are also angled relative to the longitudinally extending cyclone axis. In addition, the diversion member 31610 is flattened rather than tapered or curved.

Air entering the dirty air inlet 31116 can travel along the air inlet passage 31128 towards the cyclone chamber 31160. Diversion member 31610 is positioned in a downstream portion 31132 of the air inlet passage 31128. The diversion member 31610 can be configured to distribute air towards the vanes 31600 that are spaced around the cyclone chamber 31160. The air can then be directed inwardly towards the cyclone chamber 31160 by vanes 31600.

Cyclone Chamber Screen Member

The following is a description of a cyclone chamber screen member that may be used by itself in any surface cleaning apparatus or in any combination or sub-combination with any other feature or features disclosed including the uniflow cyclone, the cyclone chamber inlet, the dirt collection chamber, the cyclone chamber dirt outlet, the cyclone chamber sidewall, the openable cyclone unit, the second stage cyclone, the mountable surface cleaning apparatus, and the driving handle.

In accordance with this aspect of the disclosure, a surface cleaning apparatus may be provided with a cyclone chamber which has a screen member that extends to the front end of the cyclone chamber.

If the cyclone air inlet is provided internal of the cyclone chamber then, as exemplified in FIG. 13, the screen member may extend to a position proximate the downstream end 182 of the cyclone inlet. Optionally the screen terminates prior to the downstream end 182 of the cyclone inlet (i.e., axially inwardly of the front end of the cyclone chamber). For example, the screen may terminate 0.01, 0.05, 0.1, 0.125 or 0.15 inches axially inwardly from the downstream end 182 of the cyclone inlet and optionally at least 0.1 inches axially inwardly from the downstream end 182 of the cyclone inlet. Alternately, as exemplified in FIGS. 13B, 13C and 23B-I, the screen member may extend to a position forward of the rear (axially inward) end of the air inlet if the portion of the screen member forward of the rear end of the inlet is non-permeable (e.g., solid).

If the cyclone air inlet is provided external to the cyclone chamber and terminates in a port in the cyclone chamber sidewall, then, as exemplified in FIG. 54, the screen member may extend to a position proximate the front end of the cyclone inlet. Optionally the screen may terminate axially inwardly of the front end of the cyclone chamber. For example, the screen may terminate 0.01, 0.05, 0.1, 0.125 or 0.15 inches axially inwardly from the front end of the cyclone chamber. In either case, the forward portion of the screen member may be porous (e.g., it may be covered with or consist of a wire screen or the like).

The gap or radial distance between the inner wall of the cyclone chamber sidewall and the outer surface of the screen member may be as small as 0.1, 0.06, 0.09, 0.125 or 0.250 inches and may be as large as 0.25, 0.375, 0.75, 1, 1.25, 1.5, 2, 3 or 6 inches.

The screen member may be tapered. Tapering the screen member may provide a larger gap between the screen member and the cyclone chamber wall near to the cyclone chamber inlet. This may encourage larger dirt and debris to be collected away from the screen member and reduce the volume of hair and other dirt that wraps around or collects on the screen member. For example, at the front tapered end, the gap may be 0.01-6, 0.06-2, 0.125-0.75 or 0.125-0.250 inches and at the rear end (outlet end) of the screen, the gap may be 0.06-3, 0.125-1.25 or 0.25-0.75 inches.

As shown in FIGS. 12 and 13, the air outlet 184 of the cyclone chamber 160 may comprise a vortex finder or conduit 204. The vortex finder 204 is optionally by a screen or filter 206 supported by a frame (e.g., a plurality of longitudinally extending ribs) or it may consist of a screen or filter. All of the vortex finder may be porous or a rear end may be non-porous. The screen 206 may trap and prevent elongate particles such as hair and other debris from exiting the cyclone chamber 160 via the air outlet 184.

As shown in FIG. 12, the vortex finder 204 extends between a vortex finder first end 205 and a vortex finder second end 207. The vortex finder second end 207 can be positioned at the second end 176 of the cyclone unit 112. The first end 205 of the vortex finder 204 is longitudinally spaced apart from the vortex finder second end 207, and the vortex finder first end 205 is closer than the vortex finder second end 207 to the cyclone first end 172.

The second end 207 of the vortex finder 204 may include an airflow outlet. As shown, the second end 207 of the vortex finder 204 defines the non-porous conduit terminating at cyclone air outlet 184.

The vortex finder 204 may include a first section 201 and a second section 203. The first section 201 may be positioned closer to the first end 205 of the vortex finder than the second section 203. The second section 203 may be positioned at the second end 207 of the vortex finder 204.

The first section 201 may be a porous section that allows airflow therethrough. As shown in FIG. 12, a screen or filter 206 can be positioned on the porous section 201 to prevent dirt and debris from passing therethrough. The second section 203 of the vortex finder 204 may be non-porous. Air may be prevented from passing through the non-porous section 203 of the vortex finder.

As shown in the example of FIGS. 12 and 13, the vortex finder 204 can be tapered. The first end 205 of the vortex finder 204 may be narrower than the second end 207. This may provide a larger cross-sectional area for air to swirl near the cyclone first end 172. The vortex finder 204 may gradually increase in width moving from the first end 205 to the second end 207. Providing greater width for the second end 207 of the vortex finder 204 provides a wider airflow conduit leading to the cyclone air outlet 184, which may improve airflow efficiency through the surface cleaning apparatus 100.

As shown in FIG. 12, the cyclone air inlet 180 can be positioned near the cyclone first end 172 and proximate to the first end 205 of the vortex finder 204. Providing the vortex finder with a reduced width near the cyclone first end 172 may provide a larger gap between the cyclone sidewall 168 and the vortex finder near the cyclone air inlet 180. This may reduce or prevent hair from wrapping around the vortex finder 204, which can simplify emptying and cleaning the cyclone chamber 160.

As air swirls through the cyclone chamber 160 towards the cyclone second end 176, dirt may be pushed radially outward away from the vortex finder 204 towards the cyclone chamber sidewall 168. Dirt and debris are then less likely to collect on, or wrap around, the vortex finder 204 even as its width increases.

Alternately, the vortex finder may not be tapered. For example, FIG. 25 illustrates an example of a cyclone unit 2112 in which the vortex finder 2204 is not tapered.

In the example shown in FIG. 12, the cyclone air inlet 180 includes a conduit 129 that extends into, and is located interior to the cyclone chamber 160. The first end 205 of the vortex finder 204 is spaced apart from the second side 182 of the air inlet 180 (see also for example FIG. 57). Accordingly, the first end 205 of the vortex finder 204 may be positioned adjacent to the second side 182 air inlet 180. For example, the first end 205 of the vortex finder 204 may terminate at about 0.01-0.75 inches from the second side 182 of the tangential air inlet 180 in some embodiments. In some embodiments, the first end 205 of the vortex finder 204 may terminate at about 0.05-0.375 inches from the second side 182 of the tangential air inlet 180. Alternately, in some embodiments, the first end 205 of the vortex finder 204 may abut the downstream wall 183 of the air inlet conduit 129.

Alternatively, for example if the cyclone air inlet terminates at a port in the cyclone chamber sidewall, the first end 205 of the vortex finder 204 may extend axially beyond the second side of the tangential air inlet 180. FIG. 54 illustrates an example of a surface cleaning apparatus 24100 in which the first end 24205 of the vortex finder 24204 extends beyond the second side 24182 of the tangential air inlet 24180.

As shown in FIG. 54, the cyclone chamber 24160 includes a vortex finder 24204. Vortex finder 24204 extends between a first vortex finder end 24205 and a second vortex finder end 24207. The second vortex finder end 24207 is positioned at the cyclone second end 24176. As exemplified in FIG. 54, the first vortex finder end 24205 may abut the first end wall 24192 of the cyclone chamber 24160. Alternately, the first vortex finder end 24205 can extend to a position proximate the first end 24172 of cyclone chamber 24160. For example, the first vortex finder end 24205 may be longitudinally spaced apart from the cyclone first end 24172. For example, the first end 24205 of the vortex finder 24204 may terminate at about 0.01-0.75 inches from the cyclone first end 24172. In some embodiments, the first end 24205 of the vortex finder 24204 may terminate at about 0.05-0.375 inches from the cyclone first end 24172.

Alternately, if the cyclone air inlet is positioned in the cyclone chamber as exemplified in FIG. 12, then as exemplified in FIGS. 13B, 13C and 23B-I, the first end 205 of the vortex finder 204 may extend axially beyond the second side of the tangential air inlet 180 if the forward portion 2045*a* is solid. In such a case, the porous portion of the screen member (e.g., the screen material itself) the may terminate 0.01, 0.05, 0.1, 0.125 or 0.15 inches axially inwardly from the downstream end 182 of the cyclone inlet and optionally at least 0.1 inches axially inwardly from the downstream end 182 of the cyclone inlet The vortex finder 204 may be secured to one or more walls of the cyclone chamber 160.

Figure 9:
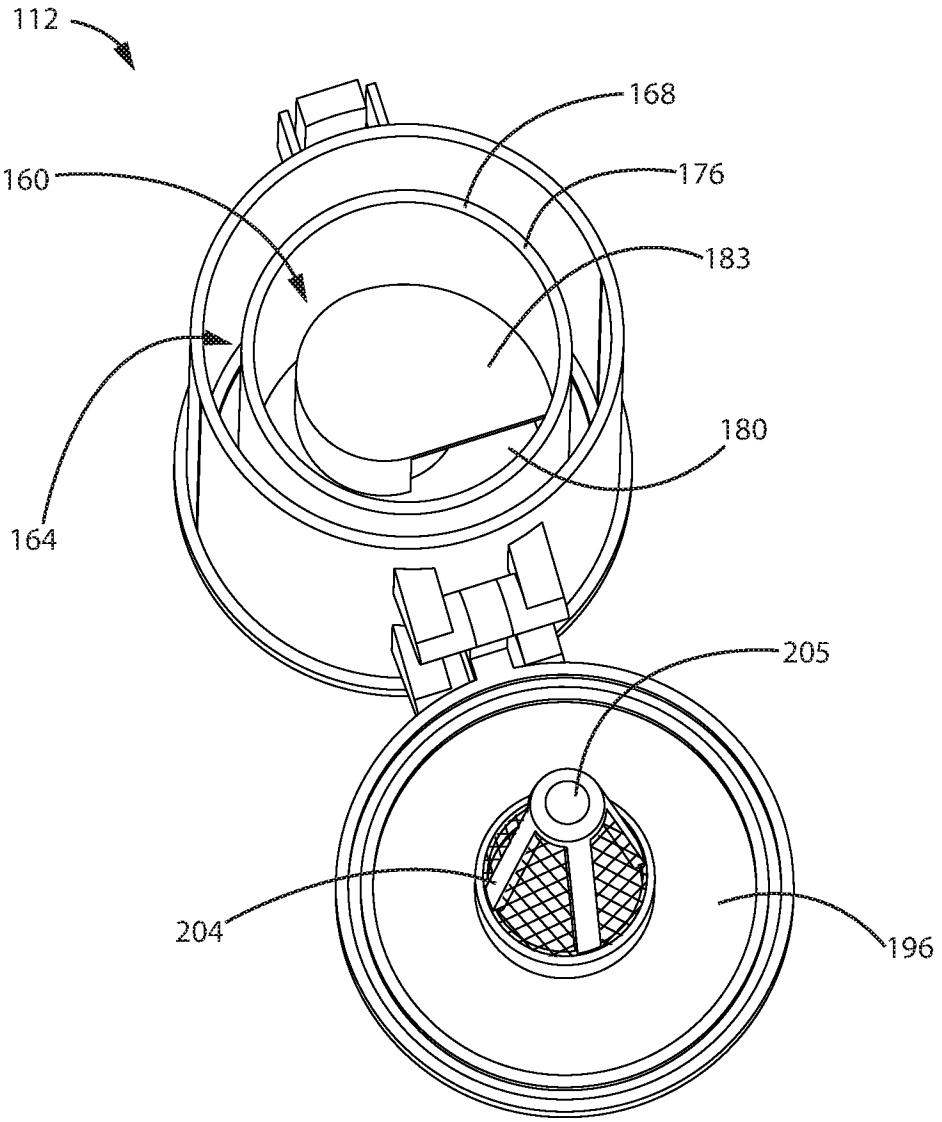
FIG. 9 is a bottom rear perspective view of the cyclone unit of FIG. 7 with the rear door in the open position.
Figure 10:
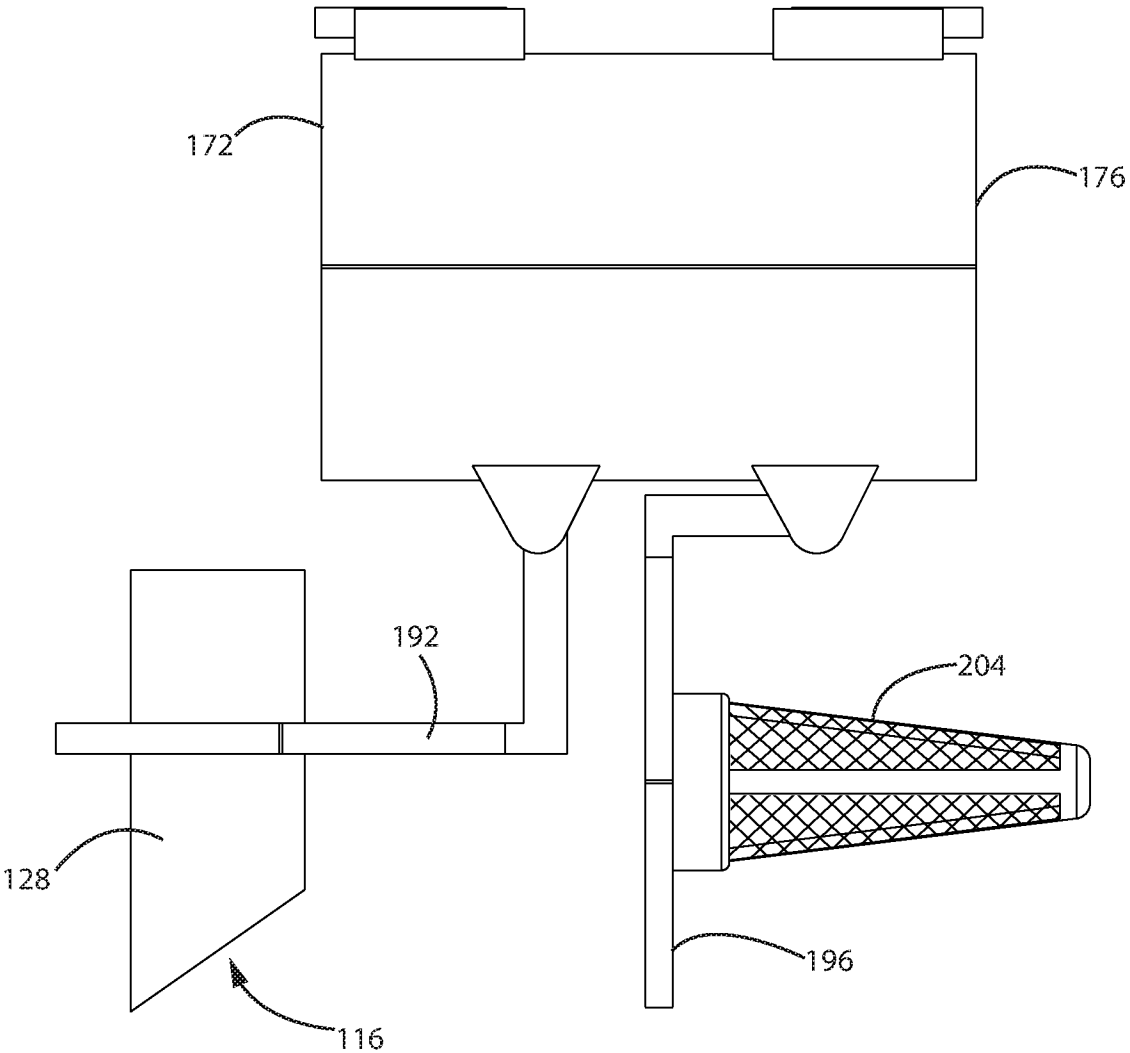
FIG. 10 is a side view of the cyclone unit of FIG. 7 with the rear door in the open position and a front door in an open position.
Figure 20:
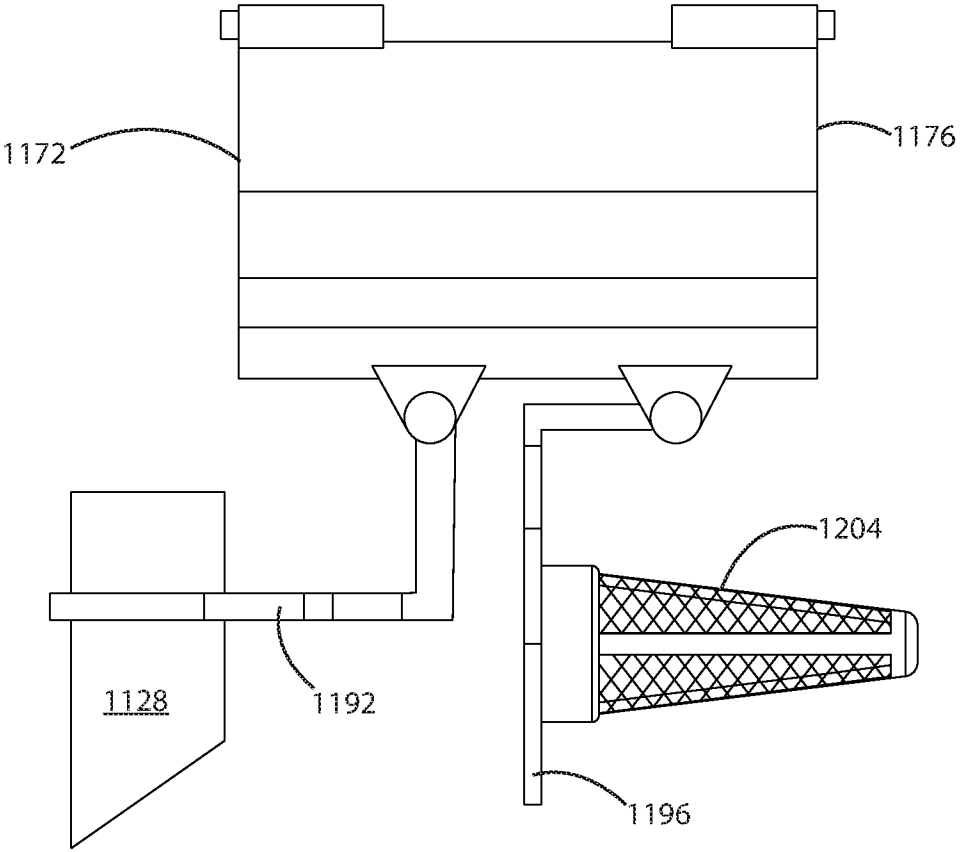
FIG. 20 is a side view of the cyclone unit of FIG. 17 with the rear door in the open position and a front door in an open position.

For example, as shown in FIG. 9, the vortex finder 204 can be mounted to the second end wall 176 of the cyclone chamber (see also vortex finder 1204 in FIG. 20). This may allow the screen member 204 to be removed from the cyclone chamber 160 along with the second end wall 176 in embodiments where the second end wall 176 is openable.

In some embodiments, the vortex finder 204 may be secured to or abut a portion of the front end of the cyclone chamber 160. For example, as exemplified in FIGS. 13B and 13C, the front end 205 of the vortex finder 204 abuts an axially inward end 175*a* of insert 175. Insert 175 may be an axially inwardly extending member which has an axially inward wall 175*a* that abuts the front end 205 of the vortex finder when the cyclone chamber 160 is closed. It may be a solid or a hollow member which is optionally closed such that air or dirt does not enter into the insert 175. It may be positioned adjacent the cyclone air inlet as exemplified or spaced radially therefrom. Alternately, or in addition, the insert may have a recess into which the front end (e.g., front portion 205*a*) is receivable. As exemplified in FIG. 13C, the insert may be mounted to the front openable door (end wall 192) and moveable therewith.

In some embodiments, the vortex finder may be secured to the sidewall of the cyclone chamber. This may ensure that the vortex finder remains with the cyclone chamber, for instance when the dirt collection chamber is being emptied or when the cyclone chamber is opened.

Figures 41A, 41B, 41C:
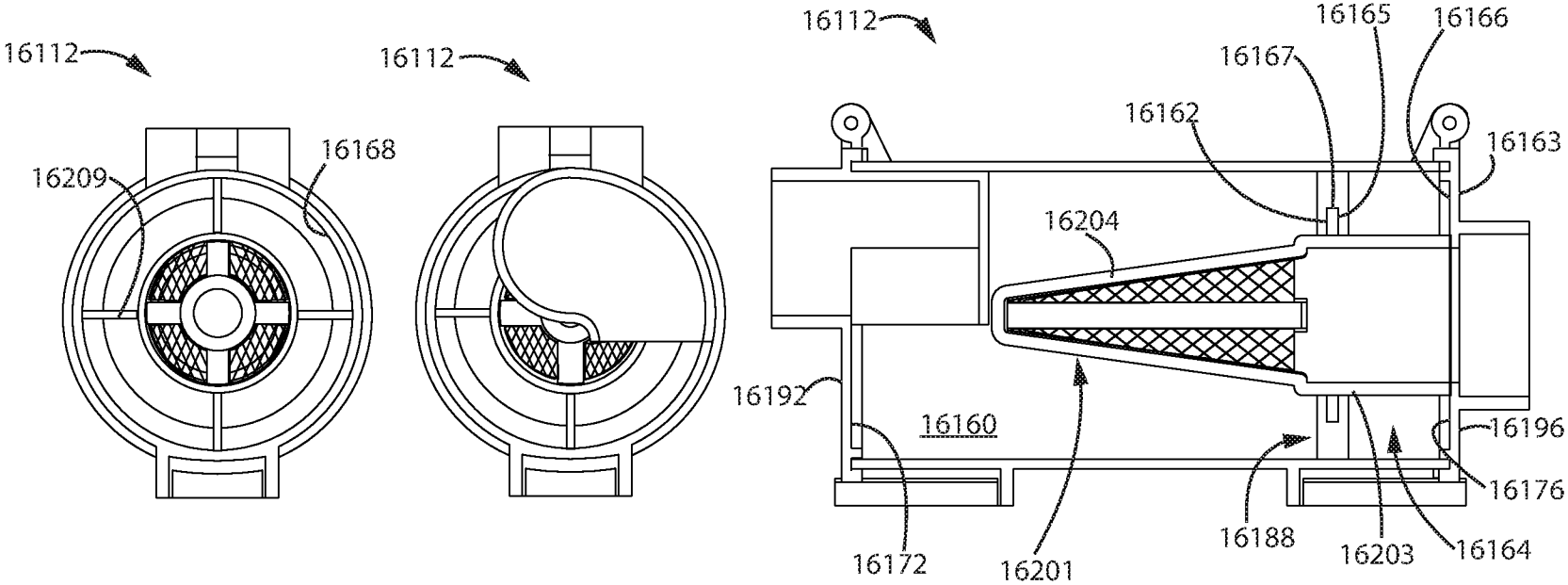
FIG. 41A is a sectional front view of another example cyclone unit in accordance with at least one embodiment.
FIG. 41B is a sectional front view of the cyclone unit of FIG. 41A including a portion of the cyclone air inlet in accordance with an embodiment.
FIG. 41C is a side sectional view of the cyclone unit of FIG. 41A.

FIGS. 41A-41C illustrate an example of a cyclone unit 16112 in which the vortex finder 16204 is mounted to the sidewall 16168 of the cyclone chamber 16160. As shown, one or more support member 16209 can be used to mount the vortex finder 16204 to the sidewall 16168.

In some embodiments, the support members 16209 can be secured to the porous section 16201 of the vortex finder 16204. Alternately, the support members may be secured to the non-porous section 16203 of the vortex finder 16204. This may ensure that the support members 16209 do not interfere with the airflow through the cyclone chamber 16160.

Figures 42A, 42B, 42C:
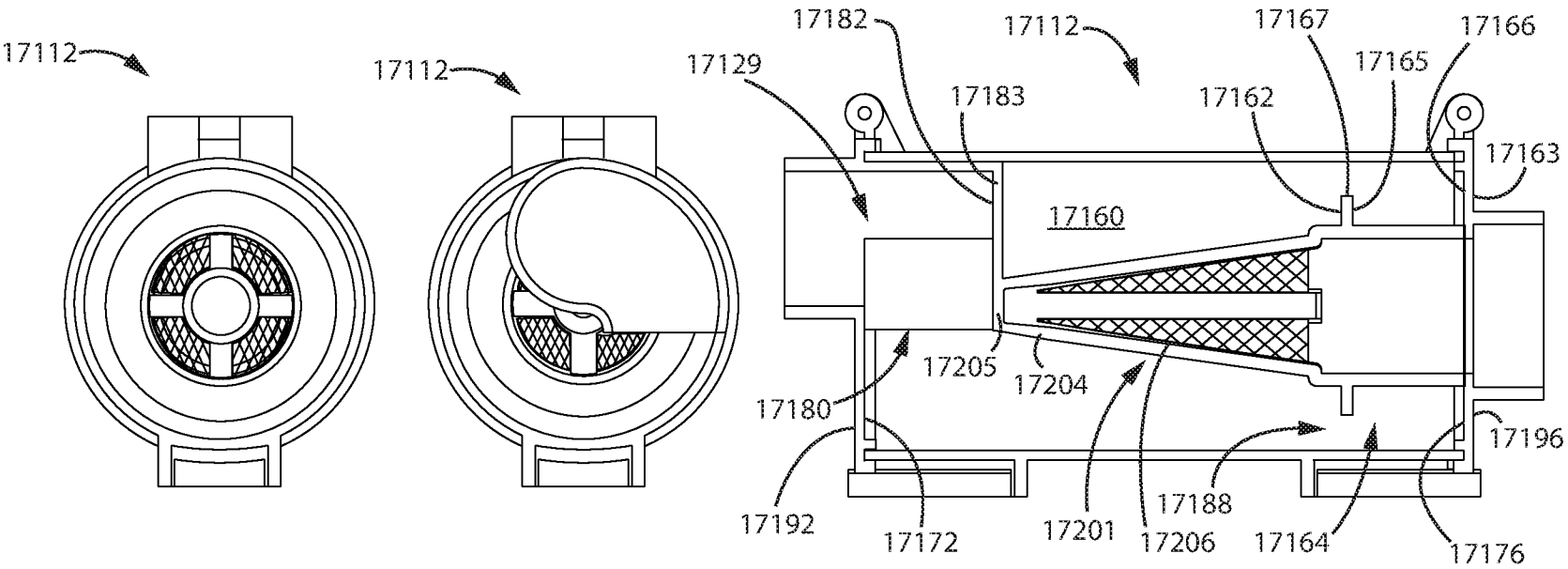
FIG. 42A is a sectional front view of another example cyclone unit in accordance with at least one embodiment.
FIG. 42B is a sectional front view of the cyclone unit of FIG. 42A including a portion of the cyclone air inlet in accordance with an embodiment.
FIG. 42C is a side sectional view of the cyclone unit of FIG. 42A.
Figure 43A:
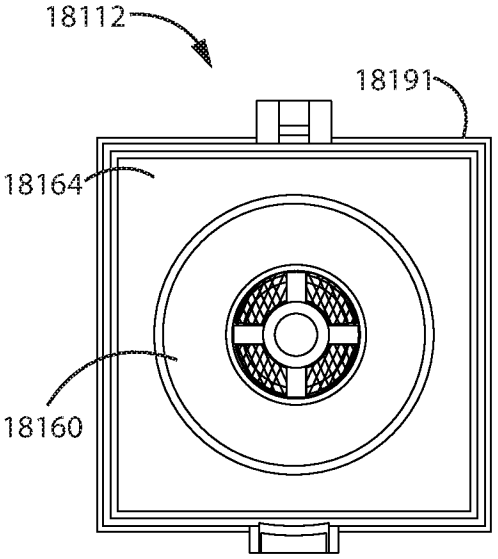
FIG. 43A is a sectional front view of another example cyclone unit in accordance with at least one embodiment.
Figure 43B:
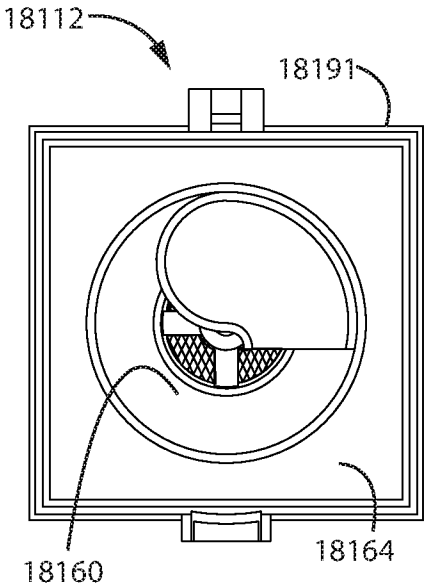
FIG. 43B is a sectional front view of the cyclone unit of FIG. 43A including a portion of the cyclone air inlet in accordance with an embodiment.
Figure 43C:
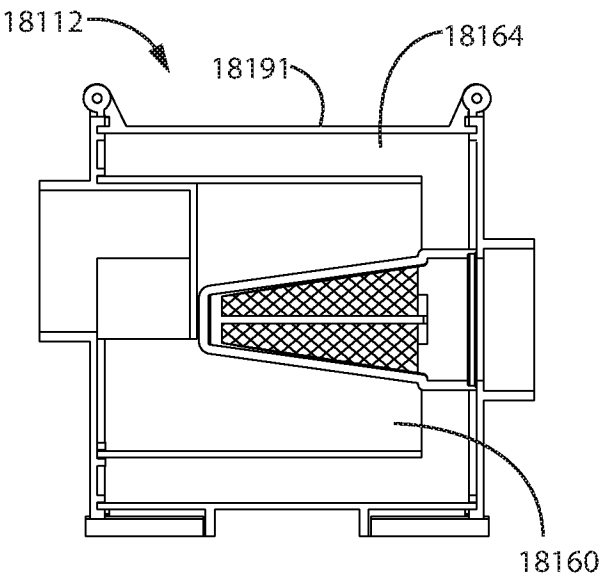
FIG. 43C is a side sectional view of the cyclone unit of FIG. 43A.
Figure 44C:
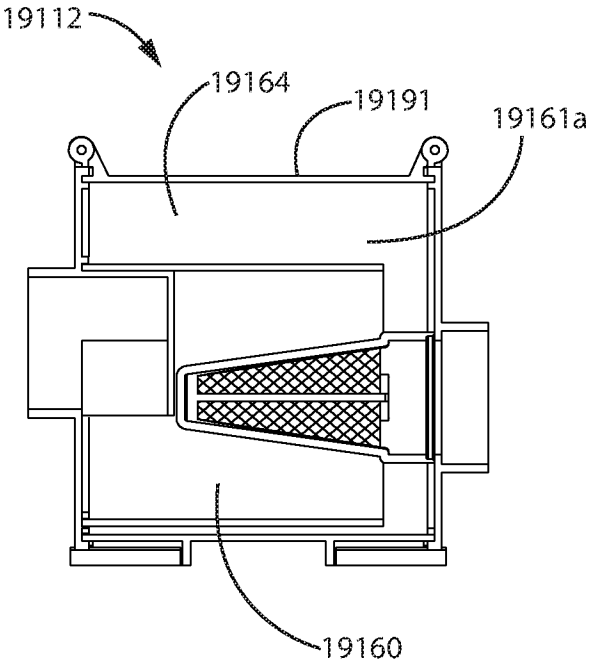
FIG. 44C is a side sectional view of the cyclone unit of FIG. 44A.
Figure 44B:
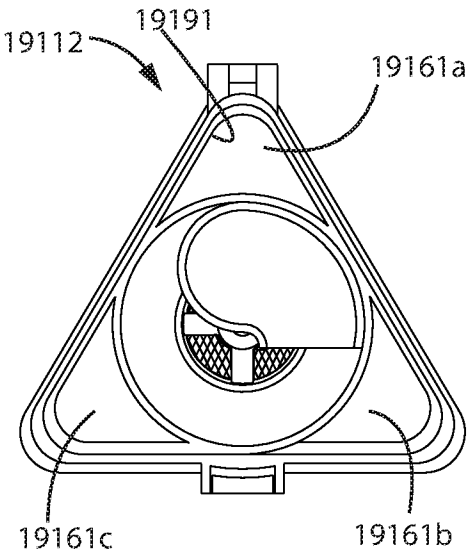
FIG. 44B is a sectional front view of the cyclone unit of FIG. 44A including a portion of the cyclone air inlet in accordance with an embodiment.
Figure 44A:
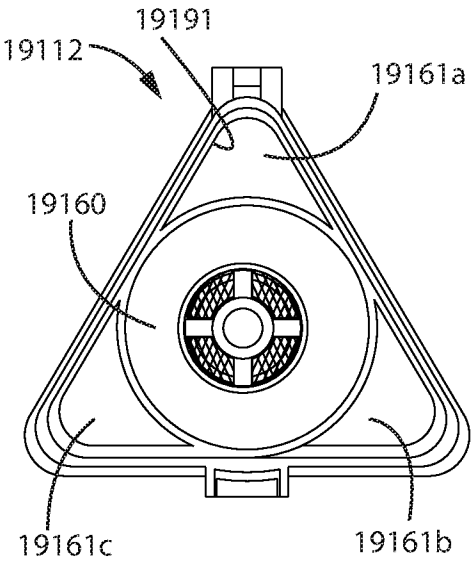
FIG. 44A is a sectional front view of another example cyclone unit in accordance with at least one embodiment.
Figure 45C:
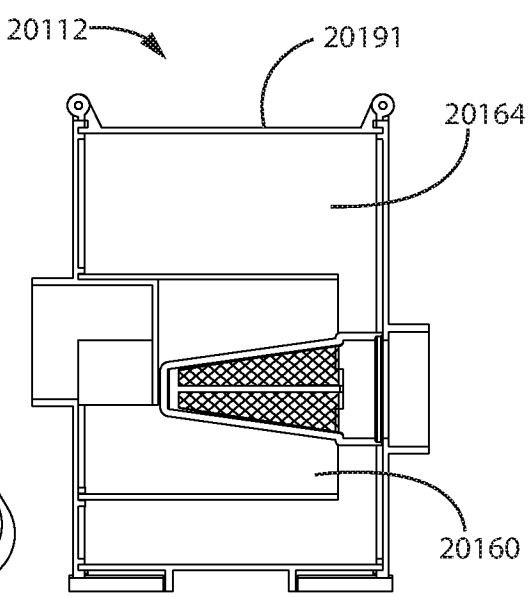
FIG. 45C is a side sectional view of the cyclone unit of FIG. 45A.
Figure 45B:
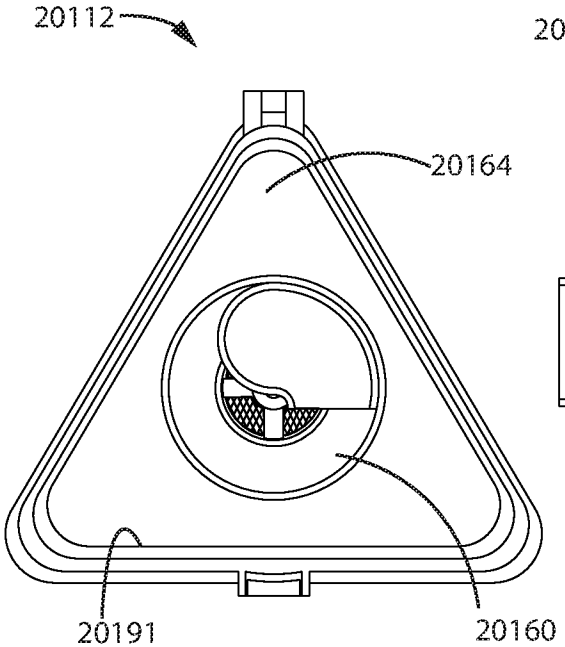
FIG. 45B is a sectional front view of the cyclone unit of FIG. 45A including a portion of the cyclone air inlet in accordance with an embodiment.
Figure 45A:
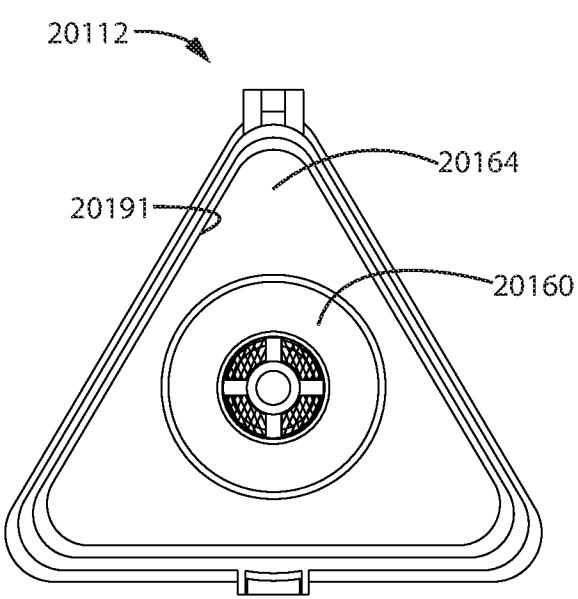
FIG. 45A is a sectional front view of another example cyclone unit in accordance with at least one embodiment.

Alternately, the vortex finder may be attached to the cyclone chamber at the first end of the cyclone chamber. For example, as shown in FIG. 42C, the first end 17205 of the vortex finder 17204 can be attached to the wall 17183 of the air inlet conduit 17128. If the first end is openable, then the vortex finder may be removed with the first end.

Dirt Collection Chamber

The following is a description of a dirt collection chamber that that may be used by itself in any surface cleaning apparatus or in any combination or sub-combination with any other feature or features disclosed including the uniflow cyclone, the cyclone chamber inlet, the cyclone chamber screen member, the cyclone chamber dirt outlet, the cyclone chamber sidewall, the openable cyclone unit, the second stage cyclone, the mountable surface cleaning apparatus, and the driving handle.

In accordance with this aspect of the disclosure, a dirt collection chamber for a cyclone chamber may be provided which is external to, and at least partially surrounds, the cyclone chamber. An advantage of this design is that it may provide increased dirt collection capacity for a surface cleaning apparatus while promoting a more compact design.

Figure 26:
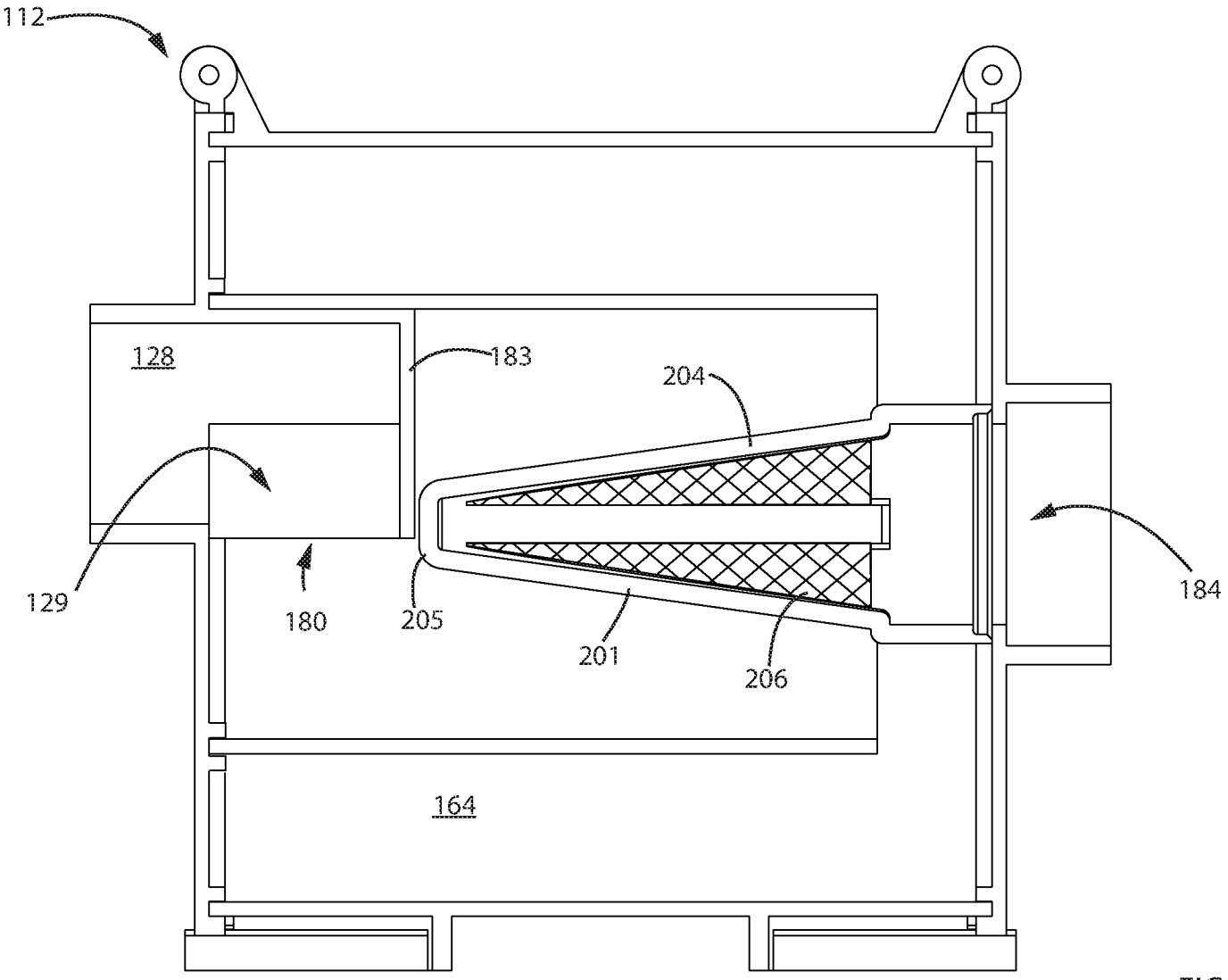
FIG. 26 is a cross-sectional view of an example cyclone unit in accordance with at least one embodiment.

In some embodiments, as exemplified in FIGS. 13 and 26, the dirt outlet 188 may be provided at the rear end or outlet end of the cyclone chamber 160 and the dirt outlet may be located radially outwardly of the non-porous section 203 of the vortex finder. In such a case, the dirt outlet 188 may be provided by the cyclone chamber sidewall terminating at a location spaced from the end wall 196 of the cyclone chamber. Accordingly, the dirt collection chamber 164 may extend essentially along the entire axial length of the cyclone chamber 160 other than the axial length of the dirt outlet 188.

Alternately, or in addition, in some embodiments, the dirt collection chamber 164 may extend along only a portion of the length of the cyclone chamber 160. Accordingly, the first or front end wall 162 of the dirt collection chamber 164 may be spaced inwardly (rearwardly) from the first or front end 172 of the cyclone chamber 160 (see for example FIGS. 33 and 34) and/or the second or rear wall 163 of the dirt collection chamber 164 may be spaced inwardly (forwardly) from the second or rear end 176 of the cyclone chamber 160 (see for example FIGS. 30, 31 and 32). Accordingly, for example, in the embodiment of FIG. 13, the first or front end wall 162 of the dirt collection chamber 164 may be spaced inwardly (rearwardly) from the first or front end 172 of the cyclone chamber 160.

In other embodiments, as exemplified in FIG. 40, the dirt collection chamber 164 may be located at the rear or second end 163 of the cyclone chamber 160 and the first or front end of the dirt collection chamber may be formed by first or front end wall 162 that extends outwardly (e.g., radially) from the non-porous section 203 of the vortex finder. In such a case, the dirt outlet 188 may be defined by a gap in the first or front end wall 162. For example, the dirt outlet 188 may be defined by a gap between the radial outer end 15167 of the first end wall 15162 and the cyclone chamber sidewall 15168.

It will be appreciated that, in any embodiment, the dirt outlet 188 need not be annular but may extend only part way around the cyclone chamber (e.g., it may have an angular extent of 300, 250, 180, 120 or 90 degrees). In any such embodiment, the cyclone chamber sidewall may be secured to one or more of the first end wall 192 (if the dirt collection chamber extends to the front end of the cyclone chamber as exemplified in FIGS. 13 and 31), the second end wall 196 (if the dirt collection chamber extends to the rear end of the cyclone chamber) and a plurality of ribs may extend between cyclone unit exterior wall 552 and the cyclone sidewall 168.

It will be appreciated that, as exemplified in FIGS. 14, 25, 36A-C, 37A-C, 39A-C and 52, in any embodiment, the dirt collection chamber 164 need not be annular but may extend only part way around the cyclone chamber (e.g., it may have an angular extent of 300, 250, 180, 120 or 90 degrees). Alternately, or in addition, the dirt collection chamber may comprise two or more discrete chambers, each of which extends only part way around the cyclone chamber (see for example FIGS. 38A-C, 44A-C).

Alternately, or in addition, the cyclone chamber need not be circular in transverse section and/or the dirt collection chamber need not be annular or have a consistent width at different locations around the perimeter of the cyclone chamber (See for example FIGS. 36A-C, 37A-C, 38A-C, 39A-C, 43A-C, 44A-C and 45A-C).

Figure 34:
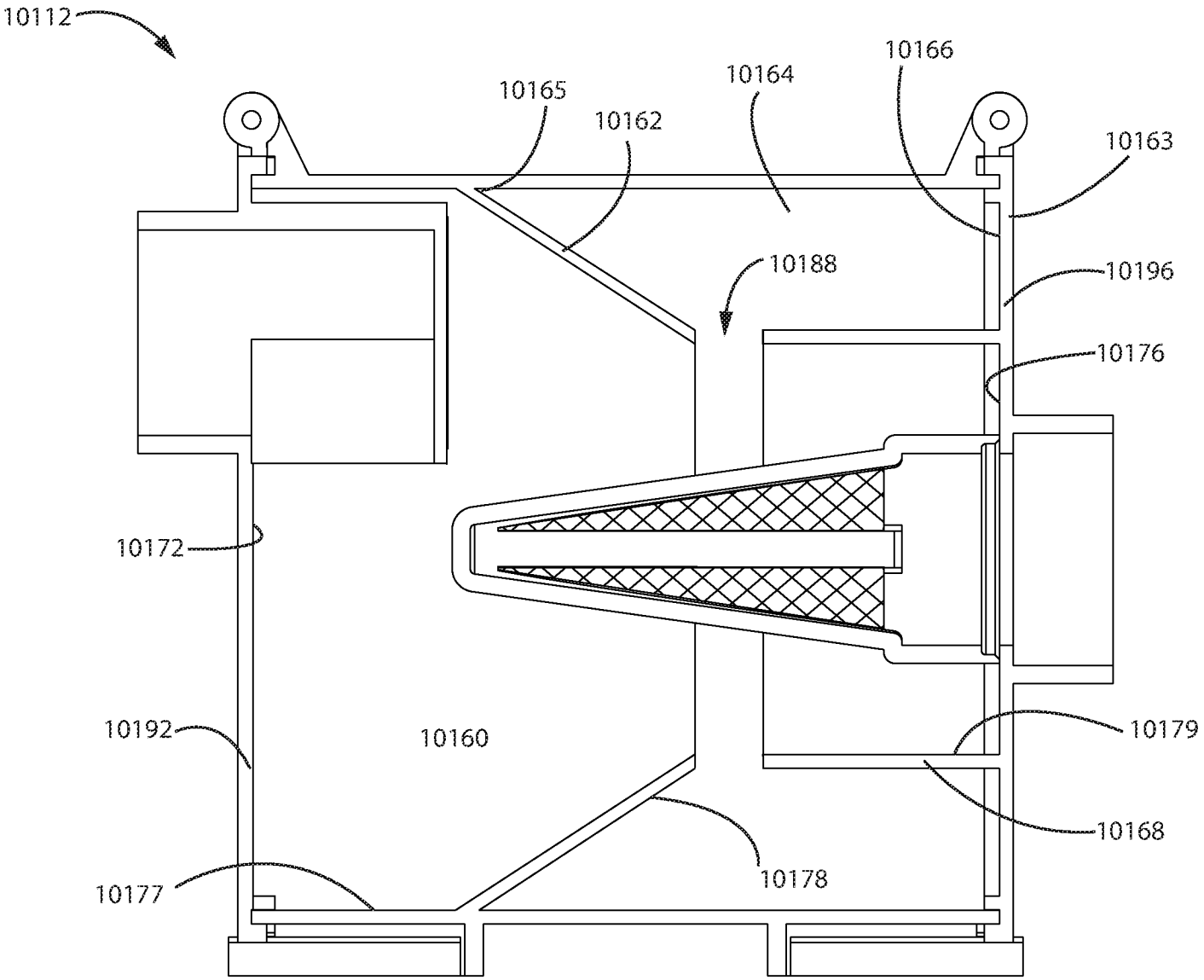
FIG. 34 is a cross-sectional view of another example cyclone unit in accordance with at least one embodiment.
Figure 35C:
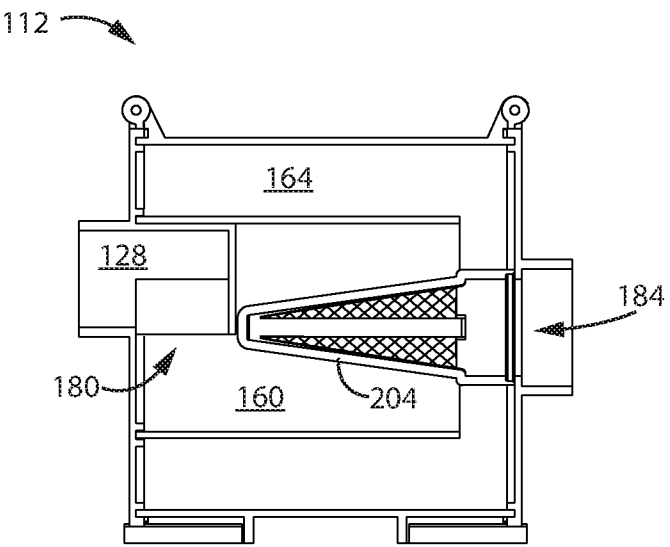
FIG. 35C is a side sectional view of the cyclone unit of FIG. 35A.
Figure 35B:
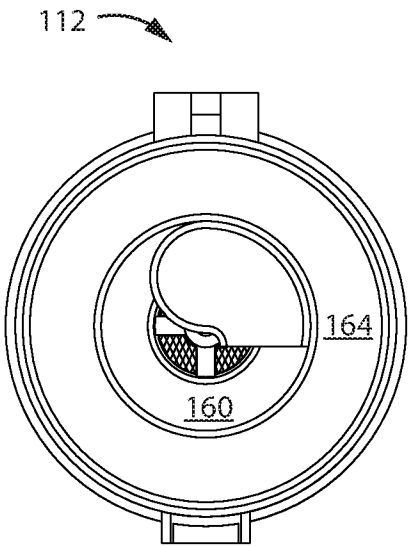
FIG. 35B is a sectional front view of the cyclone unit of FIG. 35A including a portion of the cyclone air inlet in accordance with an embodiment.
Figure 35A:
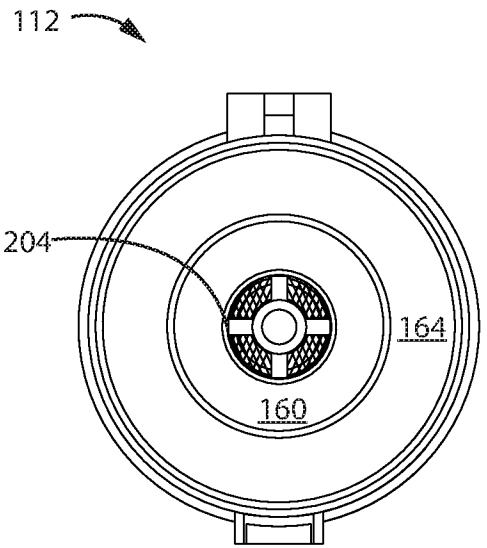
FIG. 35A is a sectional front view of another example cyclone unit in accordance with at least one embodiment.
Figures 36A, 36B, 36C:
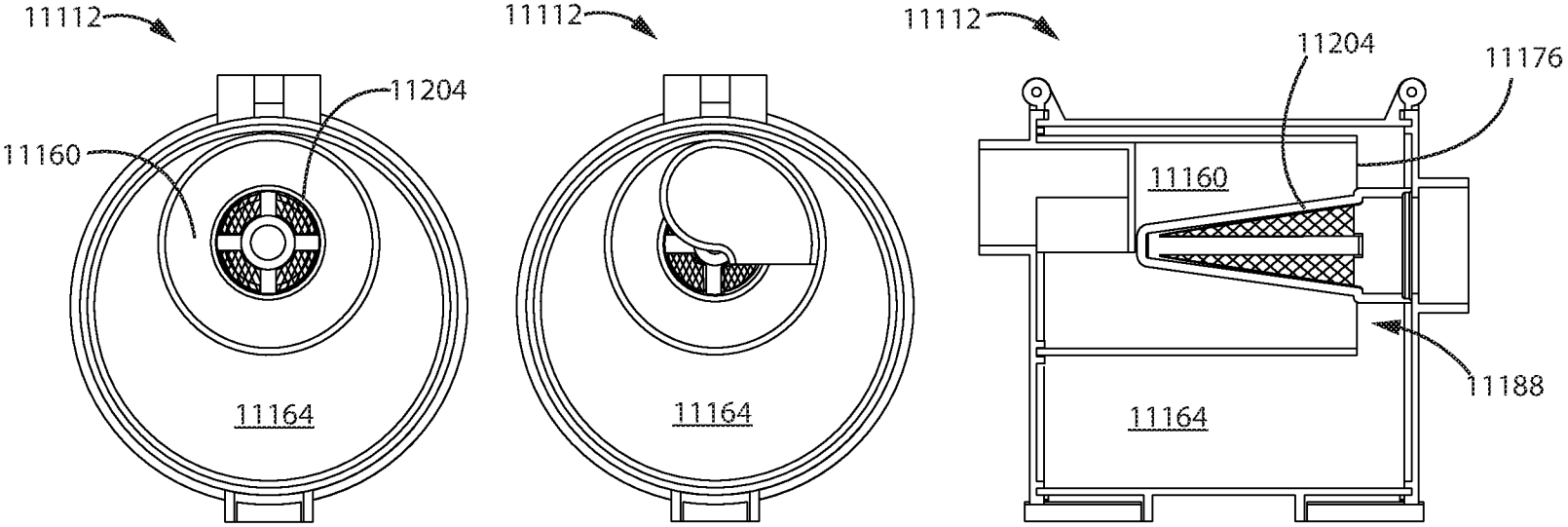
FIG. 36A is a sectional front view of another example cyclone unit in accordance with at least one embodiment.
FIG. 36B is a sectional front view of the cyclone unit of FIG. 36A including a portion of the cyclone air inlet in accordance with an embodiment.
FIG. 36C is a side sectional view of the cyclone unit of FIG. 36A.
Figure 37C:
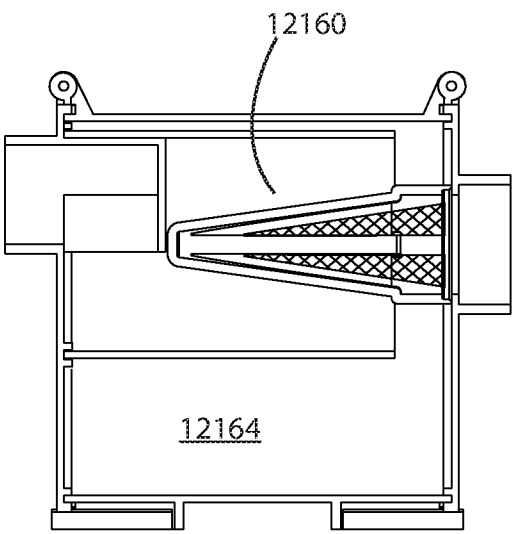
FIG. 37C is a side sectional view of the cyclone unit of FIG. 37A.
Figure 37B:
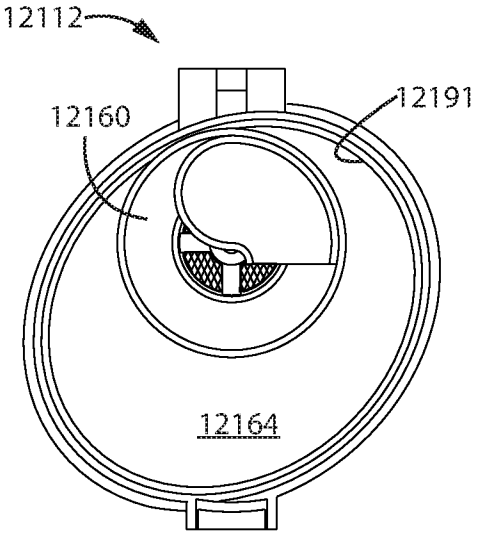
FIG. 37B is a sectional front view of the cyclone unit of FIG. 37A including a portion of the cyclone air inlet in accordance with an embodiment.
Figure 37A:
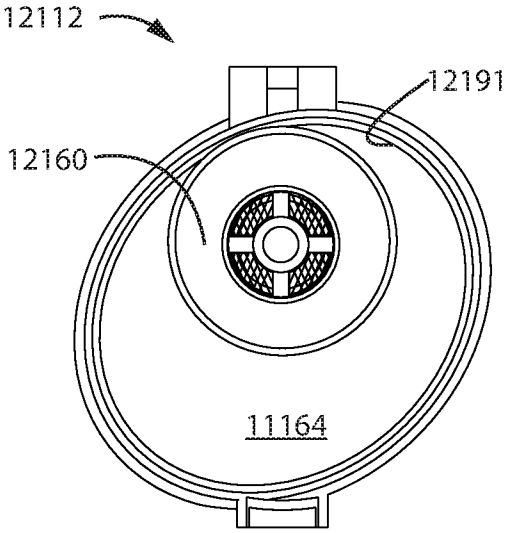
FIG. 37A is a sectional front view of another example cyclone unit in accordance with at least one embodiment.

It will be appreciated that, in any embodiment, the dirt outlet 188 need not be at an axial end of the dirt collection chamber 164 but, as exemplified in FIG. 34, may be located at an intermediate location between the first (front) end of the dirt collection chamber and a second (rear) end of the dirt collection chamber.

Figure 19:
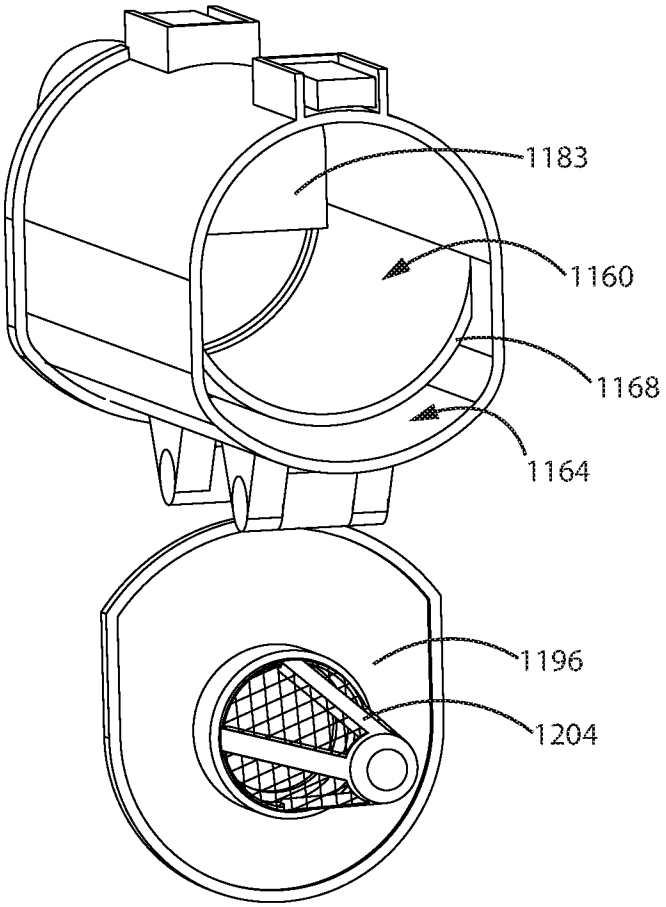
FIG. 19 is a rear perspective view of the cyclone unit of FIG. 17 with the rear door in the open position.

It will be appreciated that if an end wall of the cyclone chamber is openable, then opening the end wall of the cyclone chamber may concurrently open the same end of the dirt collection chamber. For example, the wall of the dirt collection chamber closest to the openable end wall of the cyclone chamber may be part of the openable end wall of the cyclone chamber or may be attached to the openable end wall of the cyclone chamber (see for example FIG. 19). Alternately, or in addition, the screen member (vortex finder) may be attached to the openable end wall of the cyclone chamber and moveable therewith (see for example FIG. 19) or the air inlet conduit. In such a case, the air inlet conduit may be mounted to or attached to the openable end wall and therefore, the air inlet conduit and the screen member may be moveable with the openable end wall. Alternately, the air inlet conduit and the screen member may each be attached to a different openable end wall (see for example FIG. 20).

Each of these embodiments are described in the following description of FIGS. 13, 14, 25, 30-34, 36A-C, 37A-C, 38A-C, 39A-C, 40A-C, 41A-C, 42A-C, 43A-C, 44A-c, 45A-C, 52 and 53.

As exemplified in FIG. 13, the dirt collection chamber 164 may be external to the cyclone chamber 160 and the dirt outlet 188 of the cyclone chamber 160 may be at a rear end of the cyclone chamber 160. An advantage of placing the dirt outlet 188 at the rear end of the cyclone chamber 160 is that large dirt or debris may collect within an internal dirt collection chamber of the cyclone chamber 160, while the smaller or fine debris passes to the external dirt collection chamber via the rear dirt outlet. This may increase the dirt collection capacity of the surface cleaning apparatus while providing a compact design.

As exemplified in FIG. 13, dirty air may enter cyclone 160 tangentially at cyclone air inlet 180, and swirl (e.g. move cyclonically) through cyclone 160 to separate dirt from the air flow, and then exit cyclone 160 through cyclone air outlet 184. The separated dirt may exit cyclone 160 through cyclone dirt outlet 188 and be deposited into a dirt collection chamber 164 external to the cyclone chamber 160.

The cyclone chamber 160 communicates with the dirt collection chamber 164 via dirt outlet 188. In the example illustrated, the dirt collection chamber 164 is an annular dirt collection chamber. The dirt collection chamber 164 surrounds the entirety of the cyclone chamber 160 (see e.g. FIGS. 3, 8 and 9). This may provide a large dirt collection area for the surface cleaning apparatus 100 while promoting a compact design.

In the example illustrated, the dirt outlet 188 is also provided as an annular dirt outlet that extends entirely around the cyclone chamber 160. This may encourage dirt to spread throughout the dirt collection chamber 164 and avoid clumping of dirt in particular portions of the dirt collection chamber 164. It will be appreciated that the dirt outlet 188 need not be annular but may extend only part way around the cyclone chamber (e.g., it may have an angular extend of 300, 250, 180, 120 or 90 degrees).

In the example shown, the dirt collection chamber 164 extends in an axial direction between a first collection chamber end 165 and a second collection chamber end 166. The dirt collection chamber 164 extends axially in the same direction as the cyclone chamber 160, i.e. parallel to the cyclone axis 484. As shown, the dirt collection chamber 164 is coaxially and concentrically arranged relative to the cyclone chamber 160. This may promote a compact design of the surface cleaning apparatus while still providing a reasonable dirt collection capacity.

In the example shown, the dirt collection chamber 164 and cyclone chamber 160 share a sidewall 168 (the outer surface of the cyclone chamber sidewall may be the inner surface of the dirt collection chamber). This may promote a compact design of the surface cleaning apparatus. Alternately, the dirt collection chamber 164 and cyclone chamber 160 may have separate sidewalls. Alternately, the dirt collection chamber 164 and cyclone chamber 160 may share only a portion of the sidewall 168.

In some embodiments, as exemplified in FIG. 13, the dirt collection chamber 164 may extend substantially the entire longitudinal length of the cyclone chamber 160. The dirt collection chamber first end 165 extends to the first end 172 of the cyclone chamber 160 and the second end 166 of the dirt collection chamber 164 extends to the second end 176 of the cyclone chamber 160. This may provide increased dirt collection capacity for the surface cleaning apparatus 110, reducing the frequency with which the dirt collection chamber 164 needs to be emptied or cleaned.

Alternately, the dirt collection chamber may extend for only a portion of the longitudinal length of the cyclone chamber 160. Accordingly, the dirt collection chamber may extend along only a portion of the length of the cyclone chamber and may have a dirt inlet located at any location along the cyclone chamber sidewall.

Figure 30:
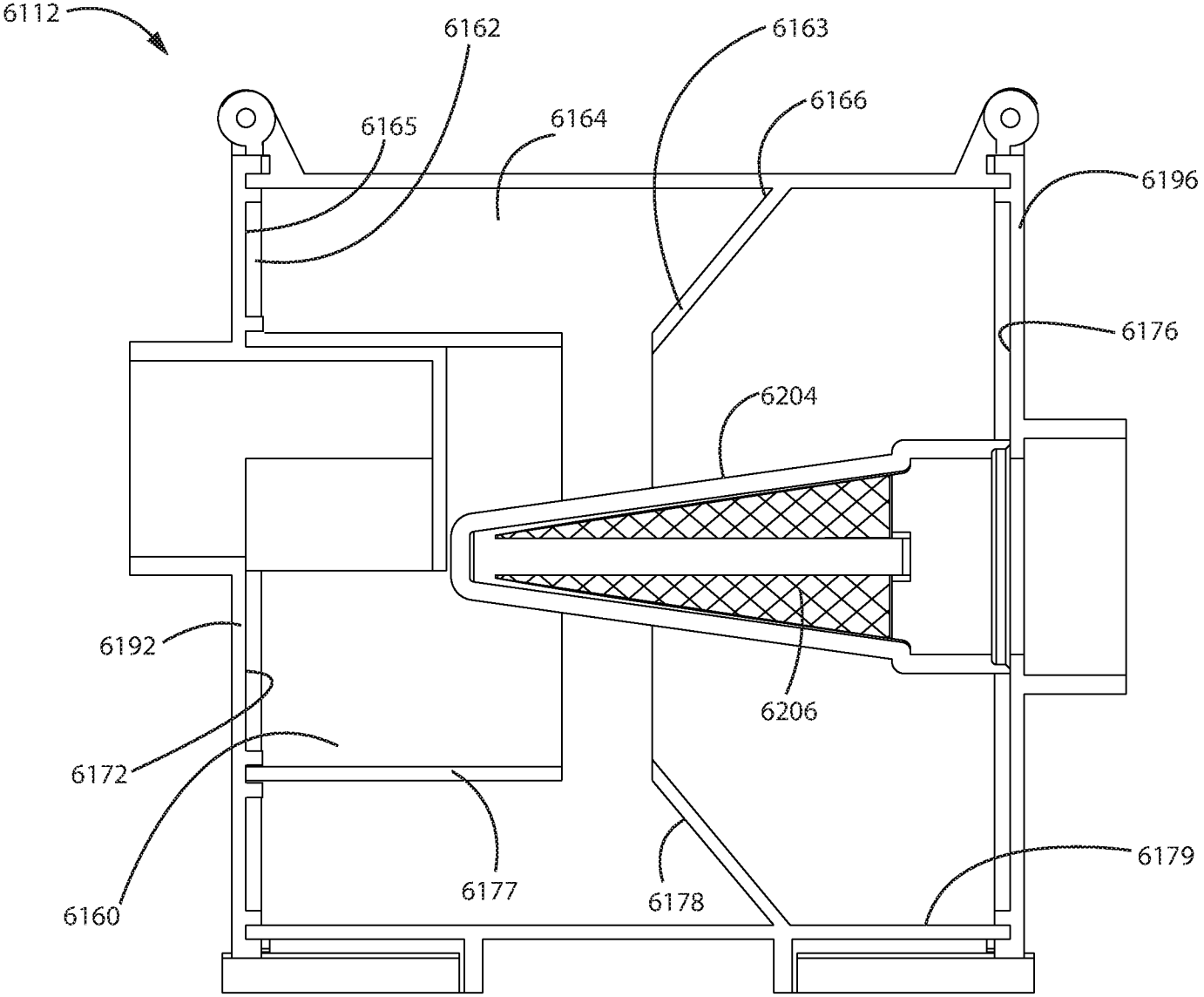
FIG. 30 is a cross-sectional view of another example cyclone unit in accordance with at least one embodiment.

FIG. 30 illustrates an example of a cyclone unit 6112 that has a dirt collection chamber 6164 external to the cyclone chamber 6160 in which the dirt collection chamber 6164 does not extend the entire length of the cyclone chamber 6160. As exemplified, the dirt collection chamber 6164 extends axially from a first end 6165 to an opposed second end 6166 wherein the second end 6166 of the dirt collection chamber 6164 is located closer to the second end 6176 of the cyclone chamber 6160 than the first end 6165 of the dirt collection chamber 6164 is to the second end 6176 of the cyclone chamber 6160.

As exemplified in FIG. 30, the first end 6165 of the dirt collection chamber 6164 may be located at the first end 6172 of the cyclone chamber 6160 or it may be located axially inwardly therefrom. If the first end 6165 of the dirt collection chamber 6164 is located at the first end 6172 of the cyclone chamber 6160, then the first end wall 6162 of the dirt collection chamber 6164 may be part of the first end wall 6192 of the cyclone chamber 6160.

In the embodiment of FIG. 30, the second end 6166 of the dirt collection chamber 6164 is located axially inward from (forwardly of) the second end 6176 of the cyclone chamber 6164. As shown, the second end 6166 of the dirt collection chamber 6164 is defined by a second end wall 6163. The second end wall 6163 is spaced apart in the axial direction from the second end wall 6196 of the cyclone chamber 6160. This may facilitate cleaning and removal of the vortex finder 6204 and/or filter 6206 separate from emptying of the dirt collection chamber 6164.

As shown in FIG. 30, the second end wall 6163 of the dirt collection chamber 6164 is angled towards the first end 6165 of the dirt collection chamber 6164.

Figure 31:
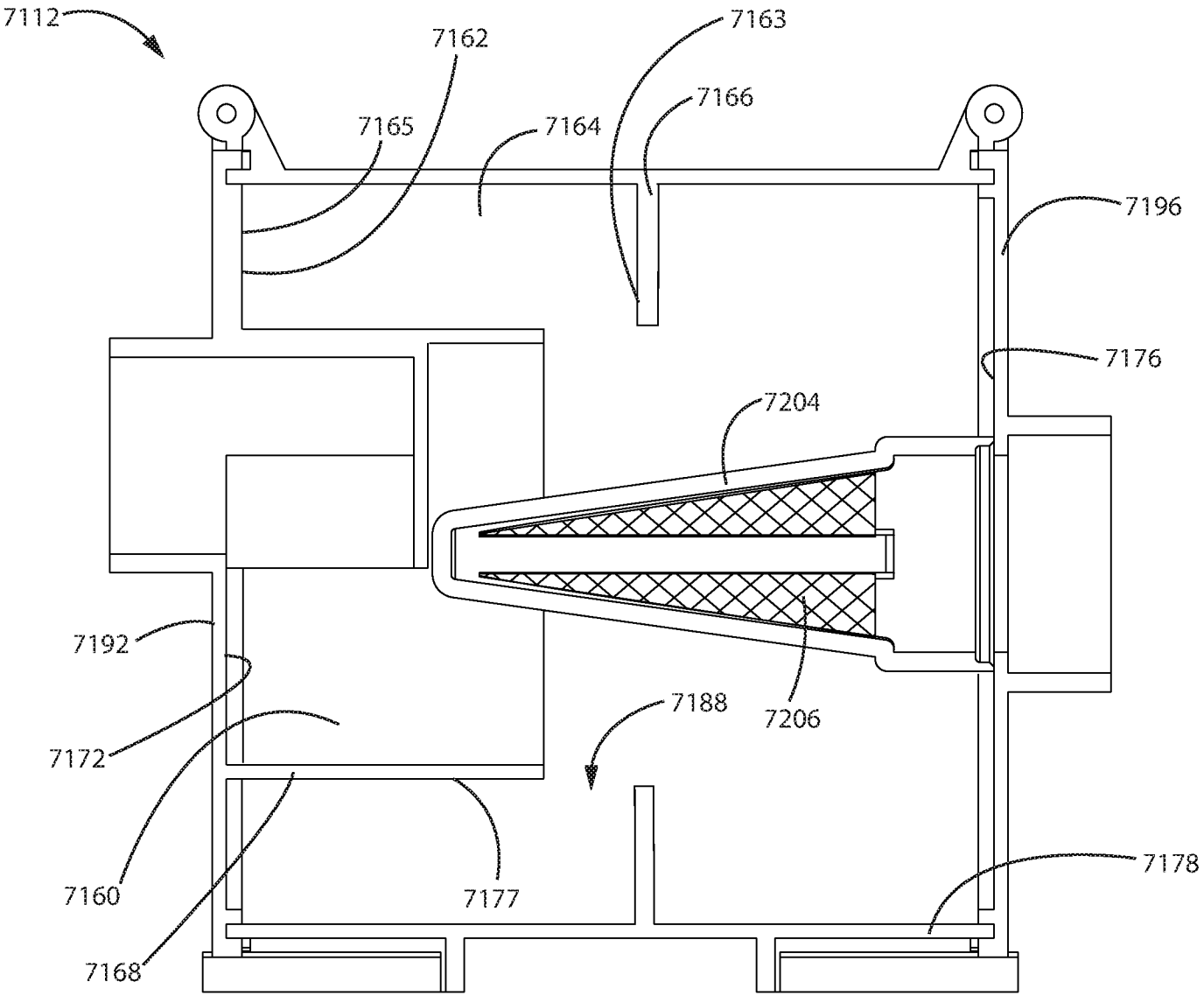
FIG. 31 is a cross-sectional view of another example cyclone unit in accordance with at least one embodiment.

FIG. 31 illustrates another example of a cyclone unit 7112 that has a dirt collection chamber 7164 external to the cyclone chamber 7160. The cyclone unit 7112 is generally similar to cyclone unit 6112 except that the second end wall 7163 of dirt collection chamber 7164 extends radially inward from the sidewall of the cyclone unit 7112 and is not angled.

The dirt collection chamber 7164 extends axially from a first end 7165 to an opposed second end 7166. The second end 7166 of the dirt collection chamber 7164 is located closer to the second end 7176 of the cyclone chamber 7160 than the first end 7165 of the dirt collection chamber 7164 is to the second end 7176 of the cyclone chamber 7160.

In the example shown in FIG. 31, the first end 7165 of the dirt collection chamber 7164 is located at the first end 7172 of the cyclone chamber 7160. In this example, the first end wall 7162 of the dirt collection chamber 7164 is integrally formed with the first end wall 7192 of the cyclone chamber 7160 (e.g., it may be the inner surface of the first end wall 7192).

The second end 7166 of the dirt collection chamber 7164 is located axially inward (forward) from the second end 7176 of the cyclone chamber 7164. As shown, the second end 7166 of the dirt collection chamber 7164 is defined by a second end wall 7163. The second end wall 7163 is spaced apart in the axial direction from the second end wall 7196 of the cyclone chamber 7160. This may facilitate cleaning and removal of the vortex finder 7204 and/or filter 7206 separate from emptying of the dirt collection chamber 7164.

Figure 32:
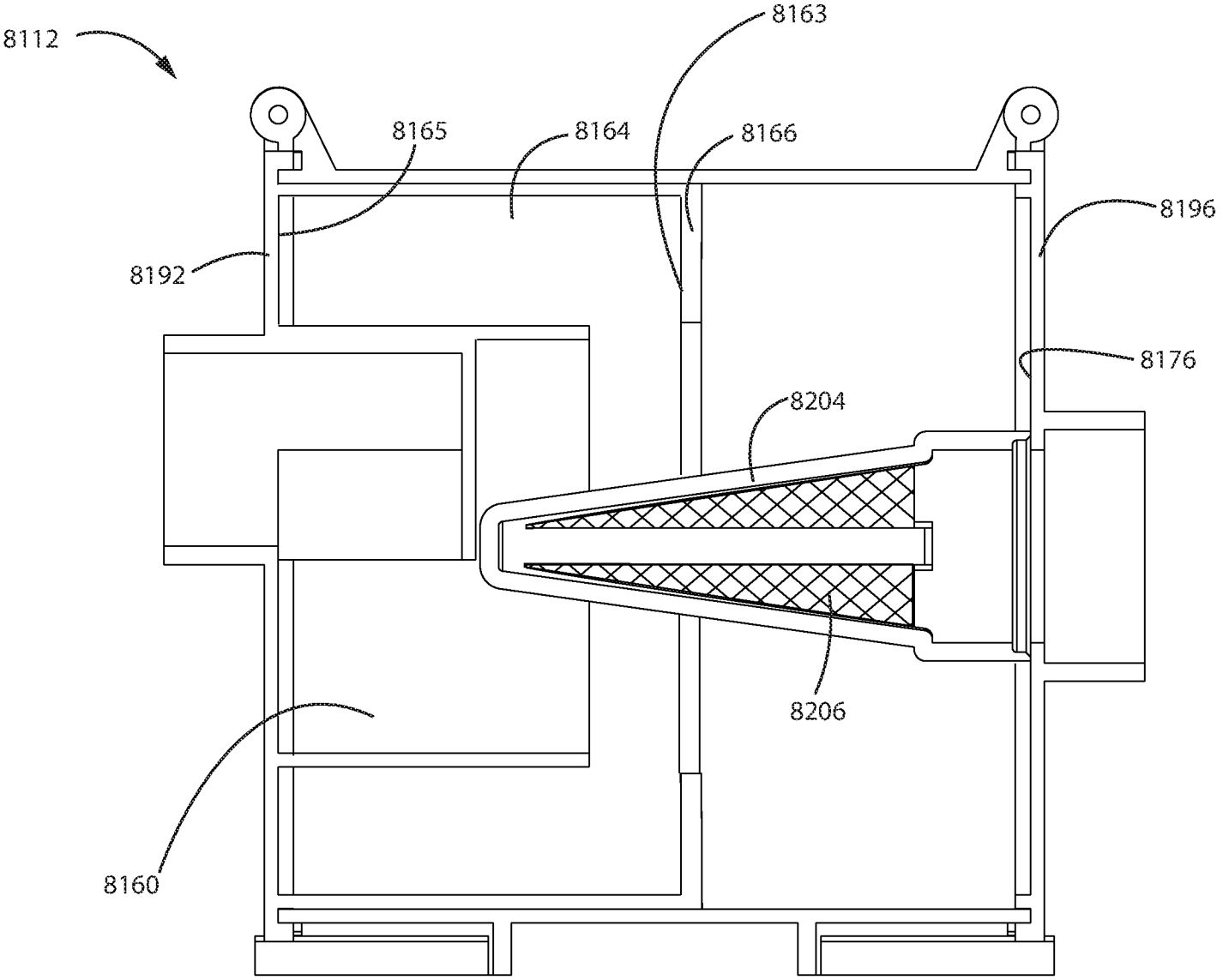
FIG. 32 is a cross-sectional view of another example cyclone unit in accordance with at least one embodiment.

FIG. 32 illustrates another example of a cyclone unit 8112 that has a dirt collection chamber 8164 external to the cyclone chamber 8160. The cyclone unit 8112 is generally similar to cyclone unit 7112 except that the dirt collection chamber 8164 (e.g., the sidewall and optionally the rear end wall) is fixed to the first end wall 8192 of the cyclone unit 8112.

In some embodiments the first end wall 8192 may be openable. Attaching the dirt collection chamber 8164 to an openable first end wall 8192 may facilitate emptying of the dirt collection chamber 8164.

The dirt collection chamber 8164 extends axially from a first end 8165 to an opposed second end 8166. The second end 8166 of the dirt collection chamber 8164 is located closer to the second end 8176 of the cyclone chamber 8160 than the first end 8165 of the dirt collection chamber 8164 is to the second end 8176 of the cyclone chamber 8160.

In the example shown in FIG. 32, the first end 8165 of the dirt collection chamber 8164 is located at the first end 8172 of the cyclone chamber 8160. In this example, the dirt collection chamber 8164 and cyclone chamber 8160 share the first end wall 8192.

The second end 8166 of the dirt collection chamber 8164 is located axially inward (forwardly) from the second end 8176 of the cyclone chamber 7164. As shown, the second end 8166 of the dirt collection chamber 8164 is defined by a second end wall 8163. The second end wall 8163 is spaced apart in the axial direction from the second end wall 8196 of the cyclone chamber 8160. This may facilitate cleaning and removal of the vortex finder 8204 and/or filter 8206 separate from emptying of the dirt collection chamber 8164.

In the examples shown in FIGS. 30-32, the second end of the dirt collection chamber is spaced axially inward from the second end of the cyclone chamber. Alternately or in addition, the first end of the dirt collection chamber may be axially spaced from the first end of the cyclone chamber.

Figure 33:
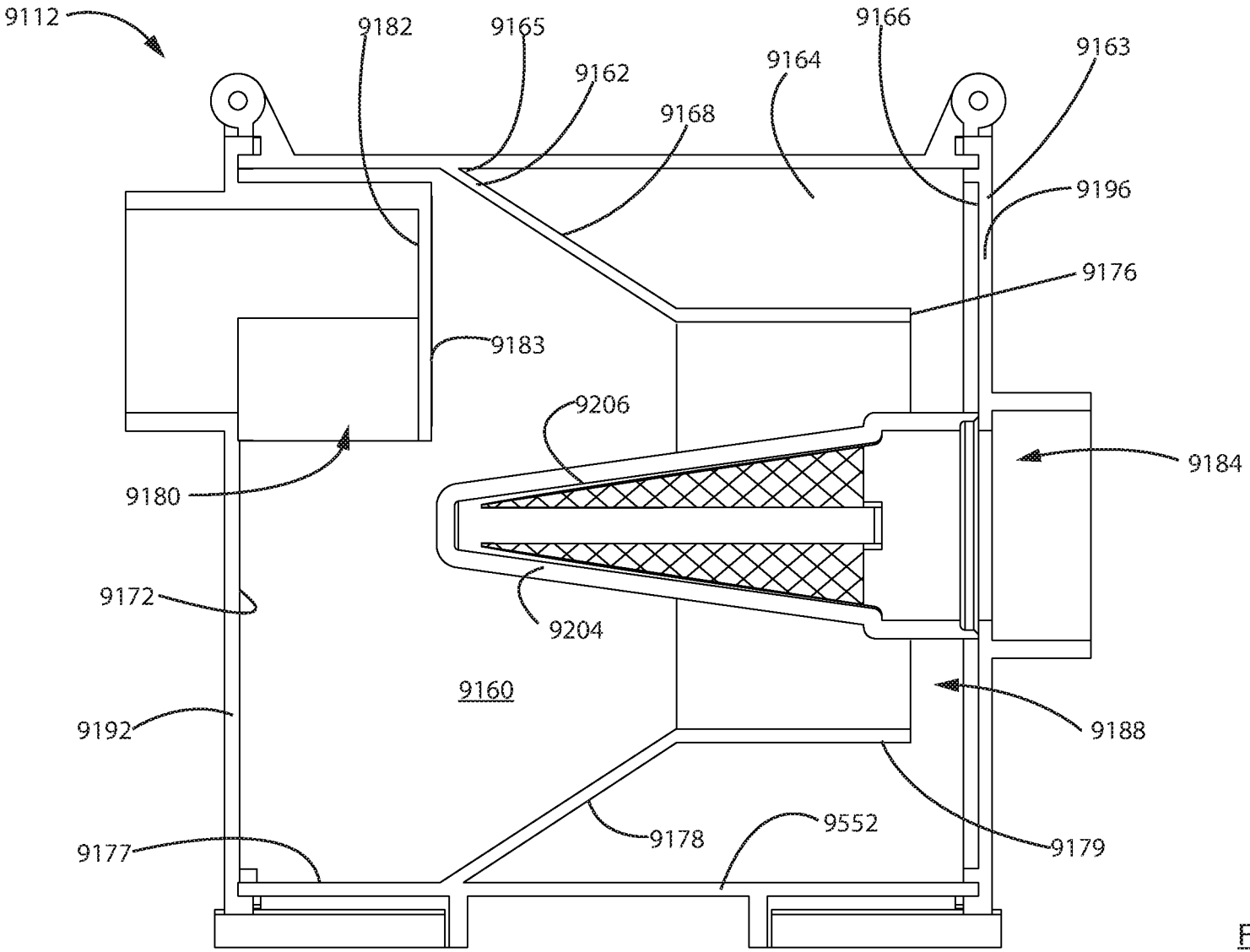
FIG. 33 is a cross-sectional view of another example cyclone unit in accordance with at least one embodiment.

FIG. 33 illustrates an example of a cyclone unit 9112 that has a dirt collection chamber 9164 external to the cyclone chamber 9160. In the example shown in FIG. 33, the first end 9162 of the dirt collection chamber 9164 is axially spaced from the first end 9172 of the cyclone chamber 9160.

As exemplified, the dirt collection chamber 9164 extends axially from a first end 9165 to an opposed second end 9166. The second end 9166 of the dirt collection chamber 9164 is located closer to the second end 9176 of the cyclone chamber 9160 than the first end 9165 of the dirt collection chamber 9164 is to the second end 9176 of the cyclone chamber 9160.

In the example shown in FIG. 33, the second end 9166 of the dirt collection chamber 9164 is located at the second end 9176 of the cyclone chamber 9160. In this example, the second end wall 9163 of the dirt collection chamber 9164 is provided by the second end wall 9196 of the cyclone chamber 9160. The cyclone chamber dirt outlet 9188 is located at the second end 9176 of the cyclone chamber 9160.

The first end 9165 of the dirt collection chamber 9164 is located axially inward from the first end 9172 of the cyclone chamber 9164. As shown, the first end 9165 of the dirt collection chamber 9164 is defined by a first end wall 9162. The first end wall 9162 is spaced apart in the axial direction from the first end wall 9192 of the cyclone chamber 9160. This may help prevent dirt from exiting the dirt collection chamber 9164 and becoming re-entrained in the air swirling through the cyclone chamber 9160.

FIG. 34 illustrates another example of a cyclone unit 10112 that has a dirt collection chamber 10164 external to the cyclone chamber 10160. The cyclone unit 10112 is generally similar to cyclone unit 9112 except that the dirt outlet 10188 is located at an intermediate location along the cyclone chamber sidewall 10168.

The dirt collection chamber 10164 extends axially from a first end 10165 to an opposed second end 10166. The second end 10166 of the dirt collection chamber 10164 is located closer to the second end 10176 of the cyclone chamber 10160 than the first end 10165 of the dirt collection chamber 10164 is to the second end 10176 of the cyclone chamber 10160.

In the example shown in FIG. 34, the second end 10166 of the dirt collection chamber 10164 is located at the second end 10176 of the cyclone chamber 10160. In this example, the second end wall 10163 of the dirt collection chamber 10164 is provided by the second end wall 10196 of the cyclone chamber 10160. The cyclone chamber dirt outlet 10188 is located midway between the first end 10172 and the second end 10176 of the cyclone chamber 10160.

The first end 10165 of the dirt collection chamber 10164 is located axially inward from the first end 10172 of the cyclone chamber 10164. As shown, the first end 10165 of the dirt collection chamber 10164 is defined by a first end wall 10162. The first end wall 10162 is spaced apart in the axial direction from the first end wall 10192 of the cyclone chamber 10160. This may provide a greater radial distance between the cyclone chamber sidewall and the screen member at the air inlet end of the cyclone chamber thereby inhibiting dirt from contacting the screen as it enters the cyclone chamber.

In some embodiments, such as the examples shown in FIGS. 30-33, the cyclone dirt outlet can be formed as an opening or gap in the sidewall of the dirt collection chamber. Alternately or in addition, as exemplified in FIG. 40C, the cyclone dirt outlet may be provided in one of the end walls of the dirt collection chamber.

Figure 40C:
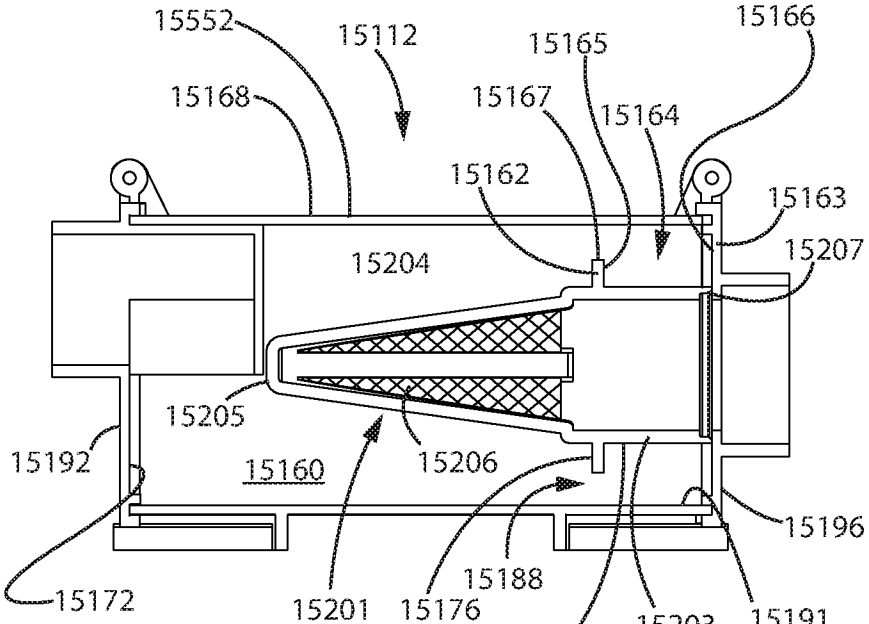
FIG. 40C is a side sectional view of the cyclone unit of FIG. 40A.
Figure 40B:
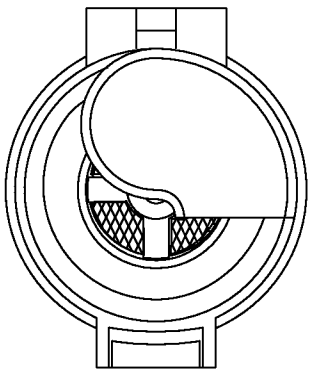
FIG. 40B is a sectional front view of the cyclone unit of FIG. 40A including a portion of the cyclone air inlet in accordance with an embodiment.
Figure 40A:
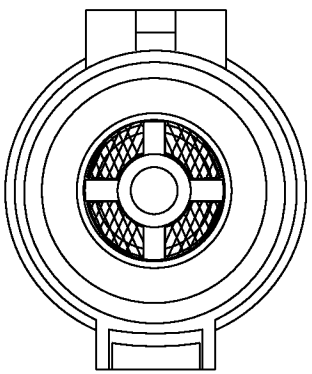
FIG. 40A is a sectional front view of another example cyclone unit in accordance with at least one embodiment.

FIG. 40C illustrates another example of a cyclone unit 15112 that has a dirt collection chamber 15164 external to the cyclone chamber 15160 and at the air outlet end of the cyclone chamber. In the example of cyclone unit 15112, the cyclone dirt outlet 15188 is provided in the first end wall 15165 of the dirt collection chamber 15164.

In the cyclone unit 15112 shown in FIG. 40C, the dirt collection chamber 15164 extends axially from a first end 15165 to an opposed second end 15166. The second end 15166 of the dirt collection chamber 15164 is located closer to the second end 15176 of the cyclone chamber 15160 than the first end 15165 of the dirt collection chamber 15164 is to the second end 15176 of the cyclone chamber 15160.

In the example shown in FIG. 40C, the second end 15166 of the dirt collection chamber 15164 is located at the second end 15176 of the cyclone chamber 15160. In this example, the second end wall 15163 of the dirt collection chamber 15164 is provided by the second end wall 15196 of the cyclone chamber 15160. However, it will be appreciated that the second end wall 15163 of the dirt collection chamber 15164 may be positioned forwardly of the second end wall 15196 of the cyclone chamber 15160.

The first end 15165 of the dirt collection chamber 15164 is located axially inward from the first end 15172 of the cyclone chamber 10164. As shown, the first end 15165 of the dirt collection chamber 15164 is defined by a first end wall 15162. The first end wall 15162 is spaced apart in the axial direction from the first end wall 15192 of the cyclone chamber 15160.

In the example shown in FIG. 40C, the first end wall 15162 is inwardly spaced from the second end wall 15196 of the cyclone chamber 15160. The cyclone chamber dirt outlet 15188 is provided in the first end wall 15126 of the dirt collection chamber 15160. The dirt outlet 15188 is provided at the axially inward first end 15165 of all portions of the dirt collection chamber. As shown, the dirt outlet 15188 is upstream of the dirt collection chamber 15160 in the direction of airflow through the cyclone chamber 15160. This may prevent dirt from exiting the dirt collection chamber 15164 and re-entering the air in the cyclone chamber 15160.

The first end wall 15162 extends from the non-porous section of the vortex finder 15204 radially outwards towards the cyclone chamber sidewall 15168. The first end wall 15162 has a radial outer end 15167 spaced apart from the vortex finder 15204. In the example illustrated, the dirt outlet 15188 is provided between the radial outer end 15167 of the first end wall 15162 and the cyclone chamber sidewall 15168. This may facilitate emptying of the dirt collection chamber 15164, for instance by allowing the first end wall 15162 of the dirt collection chamber to be removed from the cyclone chamber 15160, e.g., with the screen member.

Alternately, the first end wall 15162 may project form the cyclone chamber sidewall 15168 radially inward towards the vortex finder 15204. The dirt outlet 15188 may then be provided between a radial inward end of the first end wall 15162 and the vortex finder 15204.

It will be appreciated that in alternate embodiments, the dirt outlet may be provided midway between the cyclone chamber sidewall and the vortex finder, i.e., the dirt outlet may be located in the first end wall 15162 at a location between the cyclone chamber sidewall and the vortex finder.

It will also be appreciated that the first end wall 15162 need not extend radially by may extend outwardly at an angle to a plane transverse to the longitudinal cyclone axis (e.g. similar to wall 6178 in FIG. 30).

As shown in FIG. 40C, the vortex finder or screen member 15204 may include a first section 15201 and a second section 15203. The first section 15201 may be positioned closer to the first end 15205 of the vortex finder than the second section 15203. The second section 15203 may be positioned at the second end 15207 of the vortex finder 15204.

The first section 15201 may be a porous section that allows airflow therethrough. A screen or filter 15206 can be positioned on the porous section 15201 to prevent dirt and debris from passing therethrough. The second section 15203 of the vortex finder 15204 may be non-porous and air is prevented from passing through the non-porous section 15203 of the vortex finder.

As exemplified, the non-porous section 15203 of the vortex finder 204 can be positioned at the second end 15176 of the cyclone chamber 15160 and the dirt collection chamber 15164 can be positioned radially outward of the non-porous section 15203 and extend along part or all of the axial length of the non-porous section 15203. Accordingly, in some embodiments, the entire dirt collection chamber 15164 may be positioned axially rearward from the porous section 15201 of the vortex finder 15204. In such an embodiment, as shown in FIG. 40C, the dirt outlet 15188 is positioned axially rearward of the porous section 15203.

Alternately, a portion of the dirt collection chamber may be positioned axially rearward of the porous section and a portion may be positioned axially forward of the non-porous portion (i.e., a portion may be located radially outward of the porous portion). In such a case, the dirt outlet may be positioned radially rearward of the porous section 15201.

In the example illustrated in FIG. 40C, the vortex finder 15204 is mounted to the second end wall 15196 of the cyclone chamber 15160. Optionally, the second end wall 15196 may be openable. In such embodiments, the vortex finder 15204 is moveable along with the second end wall 15196 when the second end wall 15196 is opened.

Alternately, the vortex finder may be mounted to the sidewall of the cyclone chamber. FIG. 41C illustrates another example of a cyclone unit 16112 that has a dirt collection chamber 16164 external to the cyclone chamber 16160. The cyclone unit 16112 is generally similar to cyclone unit 15112 except that the vortex finder 16204 is mounted to the sidewall 16168 of the cyclone chamber 16160 rather than the second end wall 16163. For example, as shown in FIG. 41C, the vortex finder 16204 may be attached to the cyclone chamber sidewall 16168 by one or more support members 16209.

Mounting the vortex finder 16204 to the sidewall 16168 may ensure that the vortex finder 16204 remains within the cyclone chamber 16160 while the cyclone chamber 16160 is being cleaned, or while dirt collection chamber 16164 is being emptied. This may also provide a simplified manner of emptying the dirt collection chamber 16160 as the second end wall 16163 can be opened and dirt emptied through the open second end 16166 of the dirt collection chamber 16160.

In cyclone unit 16112, the dirt collection chamber 16164 extends axially from a first end 16165 to an opposed second end 16166. The second end 16166 of the dirt collection chamber 16164 is located closer to the second end 16176 of the cyclone chamber 16160 than the first end 16165 of the dirt collection chamber 16164 is to the second end 16176 of the cyclone chamber 16160.

In the example shown in FIG. 40C, the second end 16166 of the dirt collection chamber 16164 is located at the second end 16176 of the cyclone chamber 16160. In the example shown in FIG. 41C, the second end wall 16163 of the dirt collection chamber 16164 is provided by the second end wall 16196 of the cyclone chamber 16160.

The first end 16165 of the dirt collection chamber 16164 is located axially inward from the first end 16172 of the cyclone chamber 16164. As shown, the first end 16165 of the dirt collection chamber 16164 is defined by a first end wall 16162. The first end wall 16162 is spaced apart in the axial direction from the first end wall 16192 of the cyclone chamber 16160.

In the example shown in FIG. 41C, the first end wall 16162 is inwardly spaced from the second end wall 16196 of the cyclone chamber 16160. The cyclone chamber dirt outlet 16188 is provided in the first end wall 16126 of the dirt collection chamber 16160. The first end wall 16162 extends from the vortex finder 16204 radially outwards towards the cyclone chamber sidewall 16168. The first end wall 16162 has a radial outer end 16167 spaced apart from the vortex finder 16204. In the example illustrated, the dirt outlet 16188 is provided between the radial outer end 16167 of the first end wall 16162 and the cyclone chamber sidewall 16168.

As shown in FIG. 41C, the vortex finder or screen member 16204 may include a porous section 16201 and a non-porous section 16203. As shown, the non-porous section 16203 of the vortex finder 16204 can be positioned at the second end 16176 of the cyclone chamber 16160. The dirt collection chamber 16164 can be positioned axially rearward of the non-porous section 16203.

Alternately, the vortex finder may be mounted to the air inlet conduit that provides the cyclone air inlet. FIG. 42C illustrates another example of a cyclone unit 17112 that has a dirt collection chamber 17164 external to the cyclone chamber 17160. The cyclone unit 17112 is generally similar to cyclone units 15112 and 16112 except that the vortex finder 17204 is mounted to the air inlet conduit 17129 that defines the cyclone air inlet 17180.

As shown in FIG. 42C, the first end 17205 of the vortex finder 17204 extends to the second side 17182 of the air inlet conduit 17129. The first end 17205 of the vortex finder 17204 is attached to, and may even be integral with the air inlet conduit wall 17183. In some embodiments, this may allow the vortex finder 17204 to be removed from the cyclone chamber 17160 when the front wall 17192 is opened. This may facilitate cleaning the vortex finder 17204 and/or replacing the filter 17206.

Alternately or in addition, in accordance with this aspect of the disclosure, a dirt collection chamber for a cyclone chamber may be provided partially surrounding the cyclone chamber. For example, in some embodiments, the dirt collection may extend radially around about 50% of an outer perimeter of the cyclone chamber. In some embodiments, the dirt collection chamber extends around at least 75% of the outer perimeter of the cyclone chamber. In some embodiments, the dirt collection chamber extends around at least 85% of the outer perimeter of the cyclone chamber.

FIGS. 14-23 illustrate an example embodiment of a surface cleaning apparatus 1100. Similar components of surface cleaning apparatus 1100 have been indicated using reference characters incremented by 1000 with respect to surface cleaning apparatus 100.

Surface cleaning apparatus 1100 of FIG. 14 is generally similar to surface cleaning apparatus 100 of FIG. 13, except that the dirt collection chamber 1164 in surface cleaning apparatus 1100 only partially surrounds the cyclone chamber 1160. This may promote a more compact design for the surface cleaning apparatus 1100.

In the example shown in FIG. 14, the dirt collection chamber 1164 is positioned below the cyclone chamber 1160. This may allow gravity to assist in pulling dirt from cyclone chamber 1160 to the dirt collection chamber 1164 when the surface cleaning apparatus 1100 is in use.

Alternately or in addition, in accordance with this aspect of the disclosure, a dirt collection chamber for a cyclone chamber may be provided external to and below the cyclone chamber. An advantage of this design is that a cyclone dirt outlet may be provided in a lower portion of the cyclone chamber (e.g., cyclone dirt outlet 24188 is provided in lower wall 24171 of the cyclone chamber 24160 as shown in FIG. 53) such that dirt which remains in the cyclone chamber after termination of operation of the vacuum cleaner may fall into the dirt collection chamber when the vacuum cleaner is held with the cyclone extending horizontally and slightly upwardly. A further advantage is that the width of the vacuum cleaner may be narrower as the dirt collection chamber is not located on the lateral sides of the cyclone chamber. Accordingly, the maximum width of a handvac may be determined by the width of the suction motor housing or the width of the cyclone 24160.

Figure 52:
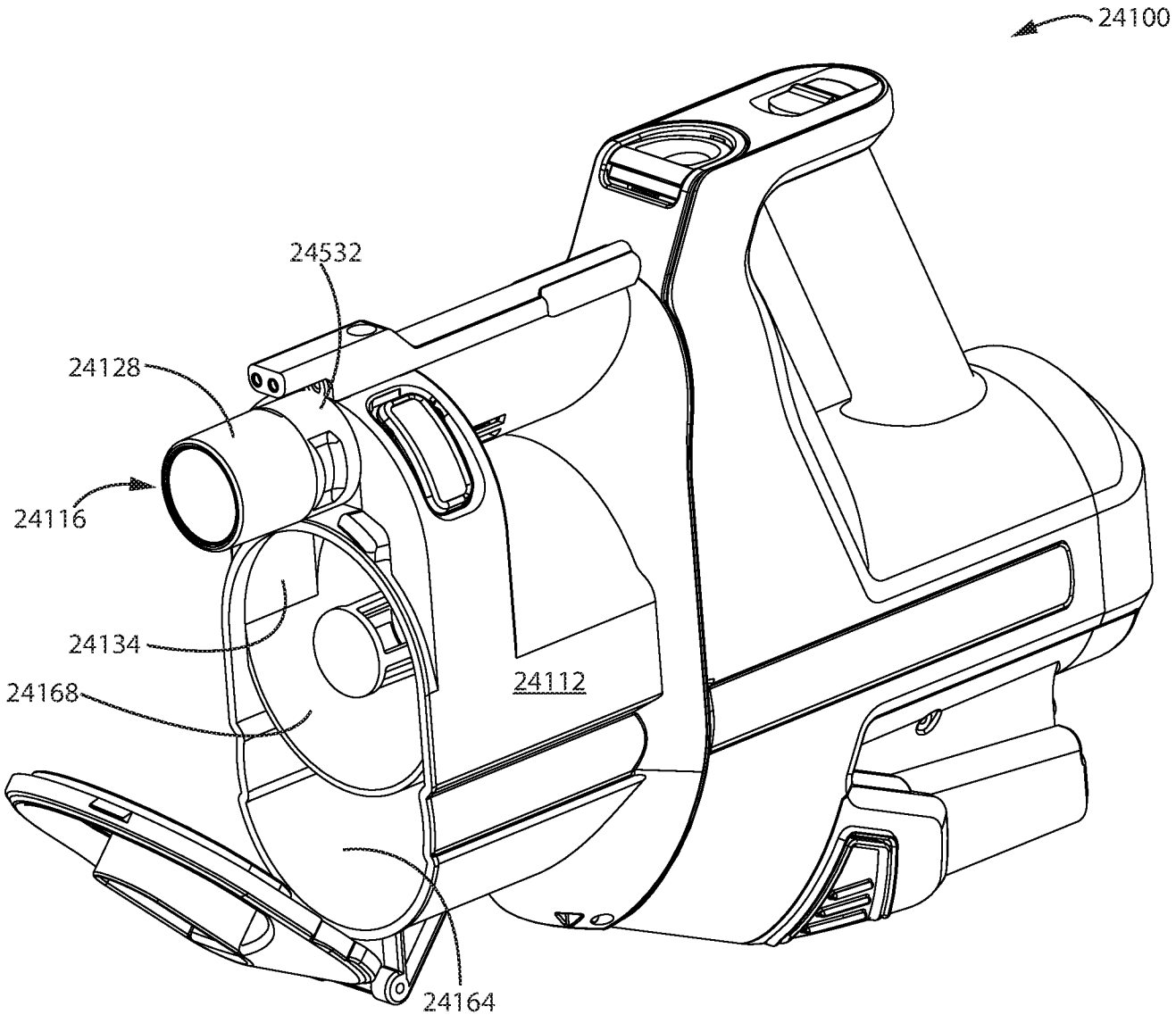
FIG. 52 is a front perspective view of the surface cleaning apparatus of FIG. 51, with a front cyclone unit wall in an open position.

As exemplified in FIG. 52, dirt collection chamber 24164 extends around approximately one-half of cyclone 24160. As exemplified, partition wall 24556 may circumscribe approximately one-half of cyclone 24160. In other embodiments, dirt collection chamber 24164 may extend around less than or greater than one-half of cyclone 24160, and partition wall 24556 may similarly circumscribe less than or greater than one-half of cyclone 24160. In alternative embodiments, dirt collection chamber 24164 may not surround cyclone 24160.

It will be appreciated that cyclone sidewall 24168 and dirt collection chamber sidewall 24548 may have any construction suitable for separating the cyclone 24160 from dirt collection chamber 24164 and allowing the passage of dis-entrained dirt therebetween. For example, cyclone sidewall 24168 and dirt collection chamber sidewall 24548 may be discrete walls that are spaced apart and connected by a dirt outlet passage. As exemplified in FIG. 53, dirt collection chamber sidewall 24548 is formed at least in part by portions of cyclone sidewall 24168 and portions of cyclone unit exterior wall 24552. Similarly, cyclone sidewall 24168 as shown is formed at least in part by portions of dirt collection chamber sidewall 24548 and cyclone unit exterior wall 24552. Accordingly, the wall portion 24556 in common between cyclone 24160 and dirt collection chamber 24164 may operate as a dividing wall. Sharing a common dividing wall may help reduce the overall size of the cyclone unit 24112, for a more compact design.

Referring to FIG. 52, dirt collection chamber 24164 may have any size and shape suitable to accommodate dirt separated by cyclone 24160 during one or more uses. A larger dirt collection chamber 24164 can store more dirt to allow apparatus 24100 to run longer before emptying dirt collection chamber 24164, but will add bulk and weight to the apparatus 24100. A smaller dirt collection chamber 24164 is smaller and lighter, but must be emptied more frequently.

FIG. 25 illustrates another example of a surface cleaning apparatus 2100 in which the dirt collection chamber 2164 only partially surrounds the cyclone chamber 2160. As shown in FIG. 25, the dirt collection chamber 2164 is positioned below cyclone chamber 2160. A dirt outlet 2188 is provided in the lower wall portion 2171 of the cyclone chamber sidewall 2168. This may help which remains in the cyclone chamber 2160 after termination of operation of the vacuum cleaner 2100 to fall into the dirt collection chamber 2164 when the vacuum cleaner 2100 is held with the cyclone 2160 extending horizontally (and possibly slightly upwardly).

As exemplified in FIG. 25, dirt may enter dirt collection chamber 2164 from cyclone chamber 2180 through dirt outlet 2188 of cyclone chamber 2180. In the illustrated embodiment, dirt outlet 2188 is at a rear end 2176 of cyclone chamber 2160. In use, handvac 2100 may be normally oriented with the nozzle 2128 at the front end oriented downwardly for cleaning a surface below. Accordingly, dirt entering dirt collection chamber 2164 from dirt outlet 2188 may fall by gravity toward front end 2165 of dirt collection chamber 2164 away from dirt outlet 2188. This may help to keep dirt outlet 2188 clear for subsequent dirt to move through dirt outlet 2188 during use.

In the illustrated embodiment, handvac 2100 may be supportable on a horizontal surface 876 by contact between dirt collection chamber 2164 and the horizontal surface 876. For example, dirt collection chamber 2164 may include a bottom wall 2157 for supporting handvac 2100 on horizontal surface 876. Preferably, as discussed previously, handvac 2100 is inclined with nozzle 2128 facing downwardly when handvac 2100 is supported on horizontal surface 876 by bottom wall 2157. In the illustrated embodiment, bottom wall 2157 is angled downwardly between front end 2165 and rear end 2166 for orienting nozzle axis 2364 downwardly to horizontal when handvac 2100 is supported on horizontal surface 876. As shown, this may provide dirt collection chamber 2164 with a wedge-like shape having a height 2179 measured between upper and lower dirt collection chamber walls 2158 and 2157 which increases from the front end 2165 to the rear end 2166.

FIG. 36 illustrates another example of a cyclone unit 11112 having a dirt collection chamber 11164 external to the cyclone chamber 11160. In cyclone unit 11112, the dirt collection chamber 11164 extends around a portion of the outer perimeter of the cyclone chamber 11160. As shown, the dirt collection chamber 11164 surrounds greater than 50% of the cyclone chamber 11160.

In the example illustrated in FIG. 36 the dirt collection chamber 11164 and cyclone chamber 11600 are not coaxial.

Rather, the cyclone chamber 11160 is eccentrically positioned with respect to the dirt collection chamber 11164.

As shown, the dirt collection chamber 11164 is positioned below the cyclone chamber 11160 with a dirt outlet 11188 formed at the second end 11176 of the cyclone chamber 11160. This may allow gravity to assist in pulling dirt from cyclone chamber 11600 to the dirt collection chamber 11164 when the cyclone unit 11112 is in use.

As mentioned above, the dirt collection chamber may be annular (see e.g. dirt collection chamber 164), semi-annular (see e.g. dirt collection chambers 1164, 2164, and 24164), or any shape suitable to accommodate dirt separated by cyclone during one or more uses. The dirt collection chamber may have a radial width of 0.01-0.75, 0.06-0.375, 0.09-0.250 inches.

It will be appreciated that, in any embodiment, the cyclone chamber need not be circular and/or the dirt collection chamber need not have a uniform radial width. For example, FIG. 37 illustrates another example of a cyclone unit 12112 having a dirt collection chamber 12164 external to the cyclone chamber 12160. Cyclone unit 12112 is generally similar to cyclone unit 11112, except that the dirt collection chamber 12164 has a non-circular outer wall 12191. In the example shown in FIG. 37, the radial outer wall 12191 of the dirt collection chamber 12164 is elliptical. As with cyclone unit 11112, the cyclone chamber 12160 is eccentrically positioned relative to the dirt collection chamber 12164.

FIG. 38 illustrates another example of a cyclone unit 13112 having a dirt collection chamber 13164 external to the cyclone chamber 13160. The cyclone unit 13112 is generally similar to cyclone unit 112 except that the dirt collection chamber 13164 does not extend around the lateral sides of the cyclone chamber 13160. Additionally, the dirt collection chamber 13164 has multiple discrete dirt collection chambers.

In cyclone unit 13112, the dirt collection chamber 13164 has two discrete dirt collection chambers 13161*a* and 13161*b*. Each of the discrete dirt collection chambers 13161 may define a separate dirt collection volume.

The cyclone chamber 13160 may have separate dirt outlets 13188*a* and 13188*b*. The first dirt collection chamber 13161*a* may be in fluid communication with the cyclone chamber 13160 via the first dirt outlet 13188*a*. The second dirt collection chamber 13161*b* may be in fluid communication with the cyclone chamber 13160 via the second dirt outlet 13188*b*. The discrete dirt collection chambers 13161 may be fluidically isolated apart from communication via the cyclone chamber 13160.

Each discrete dirt collection chamber 13161*a* and 13161*b* extends around a portion of the perimeter of the cyclone chamber 13160. A first dirt collection chamber 13161*a* is positioned above the cyclone chamber 13160. A second dirt collection chamber 13161*b* is positioned below the cyclone chamber 13160. This configuration may provide increased dirt collection capacity without increasing the width of the cyclone unit 13112 beyond the width of the cyclone chamber 13160 itself. This may promote a more compact design for the surface cleaning apparatus. In other embodiments, the dirt collection chambers may be located at different positions and they may abut (i.e., the need not be spaced apart).

In some embodiments, the discrete dirt collection chambers may be concurrently openable. For example, one or both of the first end wall 13192 and the second end wall 13196 of the cyclone chamber 13160 may be openable to provide access to both dirt collection chambers 13161*a* and 13161*b* simultaneously. Alternately, the dirt collection chambers 13161 may be separately openable.

Figures 38A, 38B, 38C:
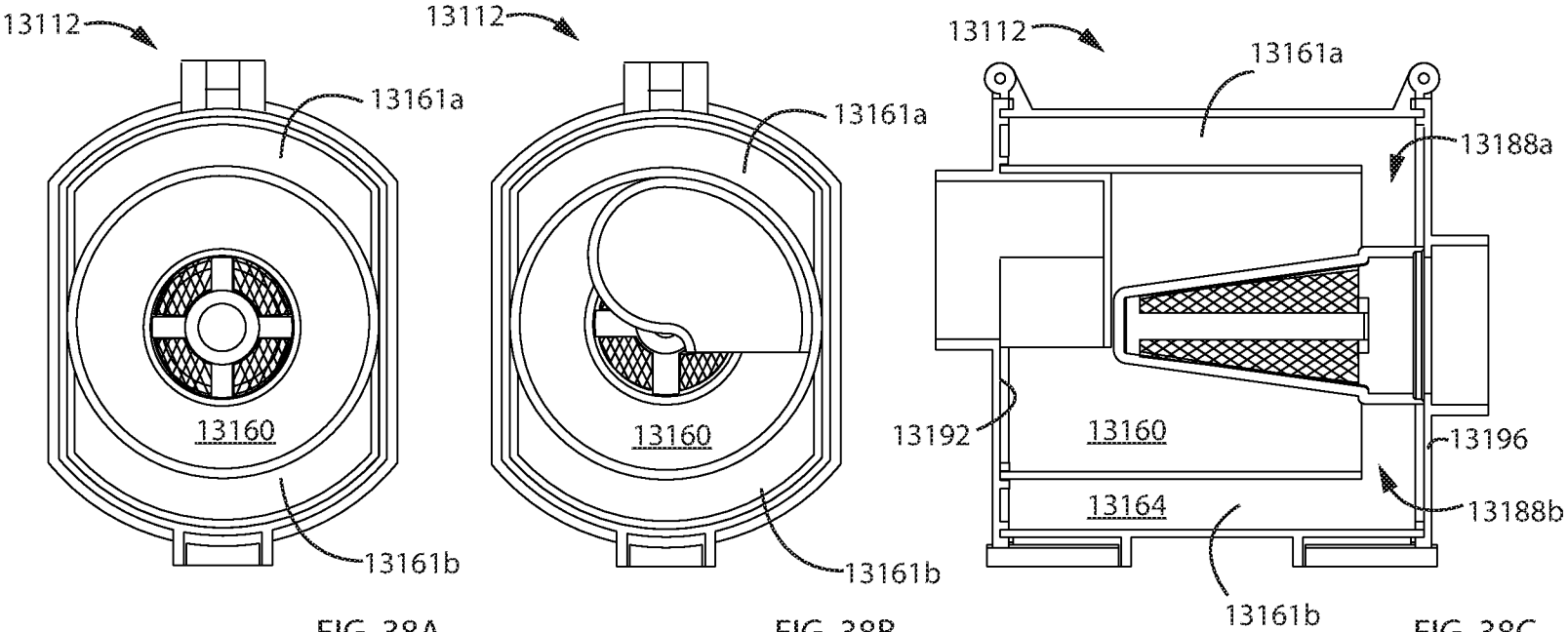
FIG. 38A is a sectional front view of another example cyclone unit in accordance with at least one embodiment.
FIG. 38B is a sectional front view of the cyclone unit of FIG. 38A including a portion of the cyclone air inlet in accordance with an embodiment.
FIG. 38C is a side sectional view of the cyclone unit of FIG. 38A.

As shown in FIG. 38C, each of the discrete dirt collection chambers 13161*a* and 13161*b* can be opened concurrently by opening either of the first end wall 13192 and the second end wall 13196. This may facilitate emptying of the discrete dirt collection chambers 13161.

Figure 39C:
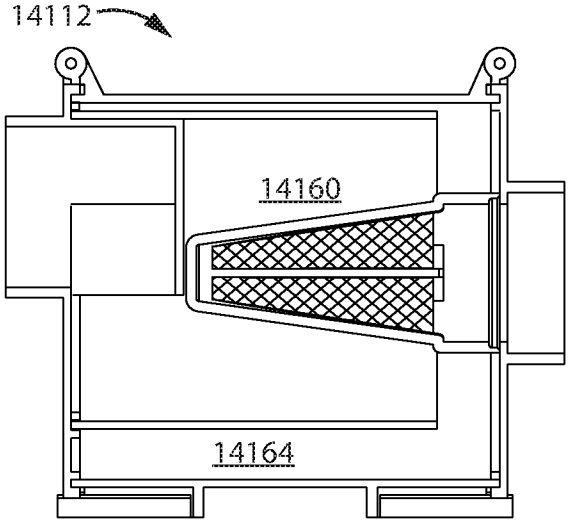
FIG. 39C is a side sectional view of the cyclone unit of FIG. 39A.
Figure 39B:
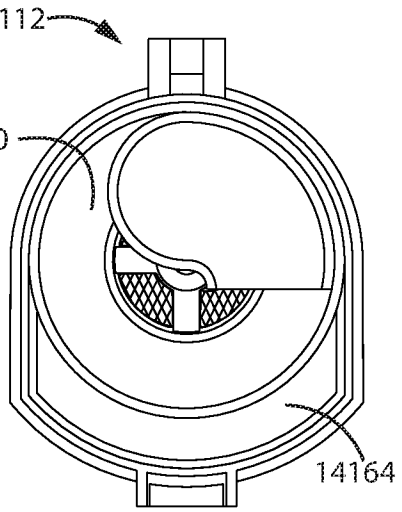
FIG. 39B is a sectional front view of the cyclone unit of FIG. 39A including a portion of the cyclone air inlet in accordance with an embodiment.
Figure 39A:
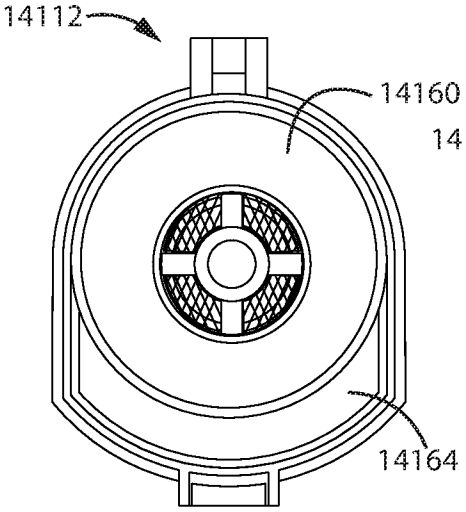
FIG. 39A is a sectional front view of another example cyclone unit in accordance with at least one embodiment.

FIG. 39 illustrates another example of a cyclone unit 14112 having a dirt collection chamber 14164 external to the cyclone chamber 14160. The cyclone unit 14112 is generally analogous to the cyclone unit 1112 shown in FIGS. 14-23. As shown in FIGS. 39A-39C, the dirt collection chamber 14164 extends around a lower portion of the perimeter of the cyclone chamber 14160.

FIG. 43 illustrates another example of a cyclone unit 18112 having a cyclone chamber 18160 and external dirt collection chamber 18164. Cyclone unit 18112 is generally similar to cyclone unit 112, except that dirt collection chamber 18164 has a non-circular radial outer wall 18191 that extends around the perimeter of the dirt collection chamber 18164. As shown in FIG. 43, the radial outer wall 18191 is generally square (or rectangular) as opposed to the generally circular outer wall of dirt collection chamber 164.

FIG. 44 illustrates another example of a cyclone unit 19112 having a cyclone chamber 19160 and external dirt collection chamber 19164. In cyclone unit 19112, dirt collection chamber 19164 has a non-circular radial outer wall 19191 that extends around the perimeter of the dirt collection chamber 19164. Additionally, the dirt collection chamber 19164 has multiple discrete dirt collection chambers.

In cyclone unit 19112, the dirt collection chamber 19164 has three discrete dirt collection chambers 19161*a*, 19161*b* and 19161*c*. Each of the discrete dirt collection chambers 19161 defines a separate dirt collection volume.

The cyclone chamber 19160 may have multiple separate dirt outlets 19188. The first dirt collection chamber 19161*a* may be in fluid communication with the cyclone chamber 19160 via a first dirt outlet 19188*a*. The second dirt collection chamber 19161*b* may be in fluid communication with the cyclone chamber 19160 via a second dirt outlet (not shown). The third dirt collection chamber 19161*c* may be in fluid communication with the cyclone chamber 19160 via a third dirt outlet (not shown). The discrete dirt collection chambers 19161 may be fluidically isolated apart from communication via the cyclone chamber 19160.

Each discrete dirt collection chamber 19161*a*, 19161*b* and 19161*c* extends around a portion of the perimeter of the cyclone chamber 19160. A first dirt collection chamber 19161*a* is positioned above the cyclone chamber 19160. A second dirt collection chamber 19161*b* is positioned below the cyclone chamber 19160. This configuration may provide increased dirt collection capacity without increasing the width of the cyclone unit 19112 beyond the width of the cyclone chamber 19160 itself. This may promote a more compact design for the surface cleaning apparatus.

FIG. 45 illustrates another example of a cyclone unit 20112 having a cyclone chamber 20160 and external dirt collection chamber 20164. In cyclone unit 20112, dirt collection chamber 20164 has a non-circular radial outer wall 20191 that extends around the perimeter of the dirt collection chamber 20164. As shown in FIG. 45, the radial outer wall 20191 is generally triangular. The cyclone unit 20112 is generally similar to cyclone unit 19112, except that the dirt collection chamber 20164 is a continuous volume that extends around the cyclone chamber 20160, rather than multiple discrete dirt collection chambers 19161.

Dirt Outlet Formed as a Gap in Cyclone Chamber Sidewall

The following is a description of a cyclone chamber dirt outlet that may be used by itself in any surface cleaning apparatus or in any combination or sub-combination with any other feature or features disclosed including the uniflow cyclone, the cyclone chamber inlet, the cyclone chamber screen member, the dirt collection chamber, the cyclone chamber sidewall, the openable cyclone unit, the second stage cyclone, the mountable surface cleaning apparatus, and the driving handle.

As discussed previously, if the cyclone is a uniflow cyclone, then the dirt outlet may be located at the air outlet end of the cyclone chamber (see for example FIGS. 51-54). Alternately, or in addition, the dirt collection chamber may be positioned below (see for example FIG. 18), or if the dirt collection chamber is not annular, at least a portion of the dirt collection chamber may be positioned below the cyclone chamber (see for example FIGS. 51-54).

It will also be appreciated that the dirt outlet 188 need not be at an axial end of the dirt collection chamber 164 but, as exemplified in FIGS. 27, 28, 29 and 34, may be located at an intermediate location between the first (front) end of the dirt collection chamber and a second (rear) end of the dirt collection chamber. In such a case, the radial inner side of the dirt collection chamber may be defined by first and second wall sections 3177, 3178 that are spaced apart by a gap defining the dirt outlet 188. It will be appreciated that, in any embodiment, the dirt outlet 188 need not be annular but may extend only part way around the cyclone chamber (e.g., it may have an angular extent of 300, 250, 180, 120 or 90 degrees). Each of the first and second wall sections may be attached to the outer wall of the dirt collection chamber or the end wall of the cyclone chamber, which end wall may be openable.

Referring to FIGS. 53 and 54, cyclone 24160 may include any dirt outlet 24188 suitable for directing dis-entrained dirt from cyclone 24160 to dirt collection chamber 24164. For example, dirt outlet 24188 may be formed in or connected to one or more (or all) of cyclone sidewall 24168 and cyclone end walls 24192 and 24196. In the illustrated embodiment, dirt outlet 24188 is formed in cyclone sidewall 24168. Dirt outlet 24188 may have any shape and size suitable for allowing dirt particles to pass into dirt collection chamber 24164. In the illustrated embodiment, dirt outlet 24188 is formed as a rectangular aperture in wall portion 24171. In alternative embodiments, dirt outlet 24188 may be circular, triangular, or another regular or irregularly shaped aperture. As exemplified, cyclone dirt outlet 24188 may be bounded in part by cyclone second end wall 24196.

In the illustrated embodiment, cyclone 24160 is a uniflow cyclone and accordingly cyclone dirt outlet 12488 is positioned at cyclone second end 24176 proximate cyclone air outlet 24184. This allows the dirt and air to travel towards the same end of the cyclone 24160 before parting ways—the air exiting through air outlet 24184 and the dirt exiting through dirt outlet 24188.

In use, the air stream inside cyclone 24160 swirls towards cyclone air outlet 24184 at cyclone second end 24176, which dis-entrains dirt particles against cyclone sidewall 24168. Under the influence of the rearward air stream, the dirt particles travel towards cyclone second end 24176 and exit through cyclone dirt outlet 24188 to dirt collection chamber 24164.

Alternately or in addition, in accordance with this aspect, the dirt outlet 24188 may be formed in a lower portion of the cyclone chamber, such as in a lower part of sidewall 24168 of the cyclone chamber. An advantage of placing the dirt outlet 24188 in a lower portion of the rear end of the cyclone chamber 24160 is that, when the handvac is in use with inlet 24116 pointed downwardly, dirt will enter the dirt collection chamber 24164 and fall forwardly due to gravity thereby preventing outlet 24188 from becoming blocked until the dirt collection chamber 24164 is full.

The cyclone chamber 24160 includes a vortex finder 24204. The vortex finder 24204 has a porous section 24201 and a non-porous section 24203. The porous section 24201 permits air to flow therethrough and out the cyclone air outlet 24184 located at the second end 24207 of the vortex finder 24204. The non-porous section 24203 is positioned at the second end 24176 of the cyclone chamber 24160. In the example shown here, the cyclone dirt outlet 24188 is radially outward of the non-porous section 24203.

It will be appreciated that in the embodiment of FIGS. 51-54 cyclone dirt outlet 24188 may be positioned anywhere at or between dirt collection chamber first end and dirt collection chamber second end and, in addition, dirt collection chamber first and second ends may be located at any position between cyclone first and second ends 24172 and 24176.

Figure 27:
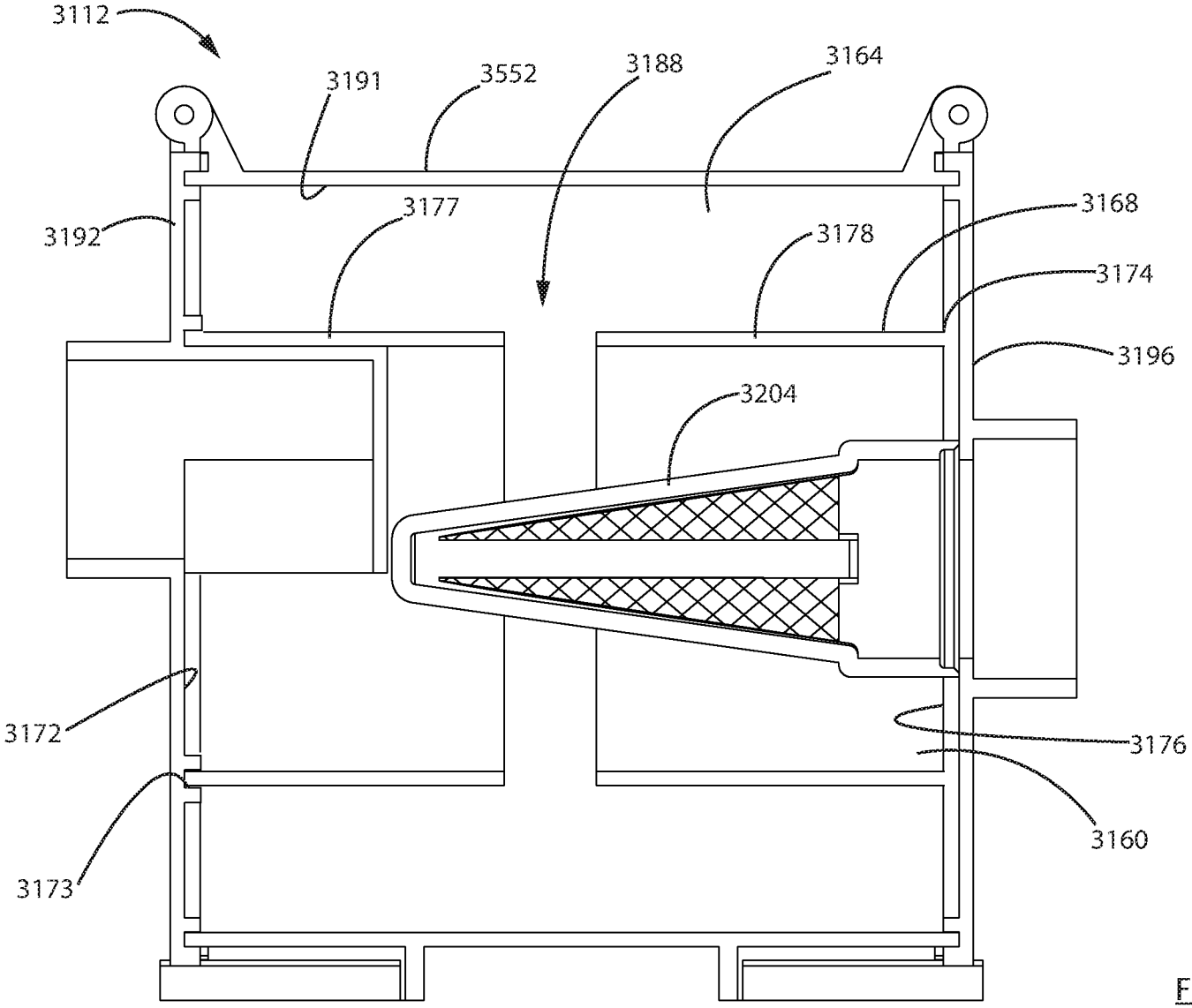
FIG. 27 is a cross-sectional view of another example cyclone unit in accordance with at least one embodiment.

FIG. 27 illustrates an example of a cyclone unit 3112 having a cyclone chamber 3160 and external dirt collection chamber 3164. The cyclone chamber 3160 has an axially extending sidewall 3168.

The cyclone chamber side wall 3168 has a first end 3173 located at the first end 3172 of the cyclone chamber 3160. The side wall 3168 has a second end 3174 that is spaced apart from the first end 3173 in a longitudinal direction of the cyclone chamber 3160. In the example shown, the second end 3174 of the cyclone chamber sidewall 3168 located at the second end 3176 of the cyclone chamber 3160.

As shown in FIG. 27, the cyclone dirt outlet 3188 is provided between the first end 3173 and the second end 3174 of the cyclone chamber sidewall 3168. In this example, the cyclone dirt outlet 3188 is formed as an annular gap extending all the way around the perimeter of the sidewall 3168.

The sidewall has a first section 3177 that extends axially rearwardly from the first end 3172 of the cyclone chamber 3160 towards the second end 3176 of the cyclone chamber 3160. As exemplified, the first section 3177 may terminate at the dirt outlet 3188.

The sidewall has a second section 3178 that extends axially forwardly from the second end 3176 of the cyclone chamber 3160 towards the first end 3172 of the cyclone chamber 3160. As exemplified, the second section 3178 may terminate at the opposite side of the dirt outlet 3188.

In the example shown in FIG. 27, the second wall section 3178 is attached to the second end wall 3196. In embodiments where the second end wall 3196 is openable, the second wall section 3178 can move with the second end wall 3196 when the second end wall 3196 is opened. This may allow the second wall section 3178 to be removed from the cyclone chamber when the second end wall 3196 is opened.

In some embodiments, the vortex finder 3204 may also be secured to the second end wall 3196. In such embodiments, the second wall section 3178 and vortex finder 3204 may both be moveable with the second end wall 3196.

In the example of FIG. 27, the first wall section 3177 is attached to the radial outer wall 3191 of the dirt collection chamber 3164. In the example illustrated, the radial outer wall 3191 can be provided by the exterior wall 3552 of the cyclone unit 3112. The first wall section 3177 can remain in place if one or both of the first end wall 3192 and second end wall 3196 is openable.

Figure 28:
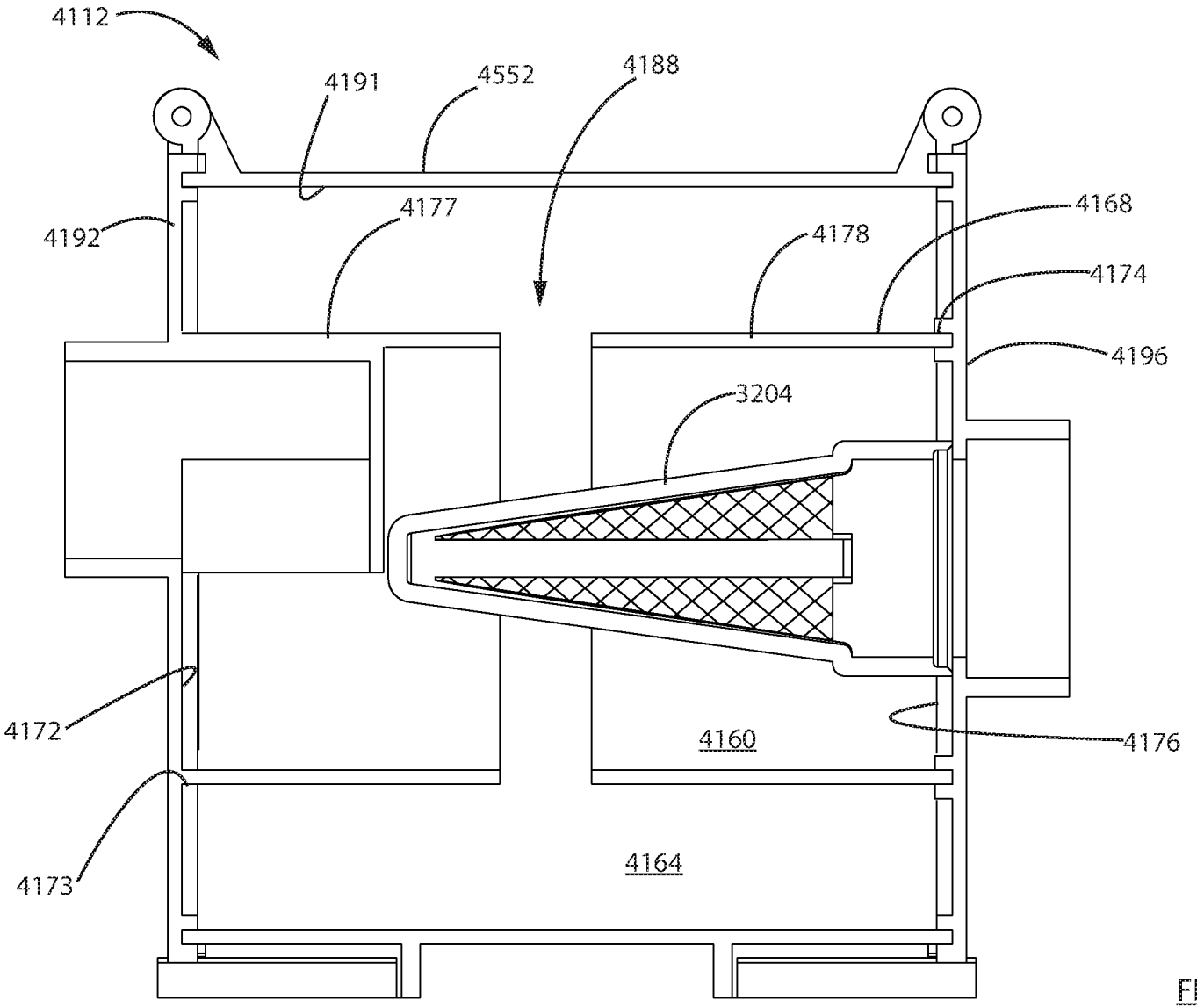
FIG. 28 is a cross-sectional view of another example cyclone unit in accordance with at least one embodiment.

FIG. 28 illustrates another example of a cyclone unit 4112 having a cyclone chamber 4160 and external dirt collection chamber 4164. Cyclone unit 4112 is generally similar to cyclone unit 3112 except that the first wall section 4177 is attached to the first end wall 4192 while the second wall section 4178 is attached to the exterior wall 4552 of the cyclone unit 4112.

As shown in FIG. 28, the cyclone chamber 4160 has an axially extending sidewall 4168. The cyclone chamber side wall 4168 has a first end 4173 located at the first end 4172 of the cyclone chamber 4160. The side wall 4168 has a second end 4174 that is spaced apart from the first end 4173 in a longitudinal direction of the cyclone chamber 4160. In the example shown, the second end 4174 of the cyclone chamber sidewall 4168 is located at the second end 4176 of the cyclone chamber 4160.

As shown in FIG. 28, the cyclone dirt outlet 4188 is provided between the first end 4173 and the second end 4174 of the cyclone chamber sidewall 4168. In this example, the cyclone dirt outlet 4188 is formed as a gap in the sidewall 4168.

The sidewall has a first section 4177 that extends axially rearwardly from the first end 4172 of the cyclone chamber 4160 towards the second end 4176 of the cyclone chamber 4160. As exemplified, the first section 4177 may terminate at the dirt outlet 4188.

The sidewall has a second section 4178 that extends axially forwardly from the second end 4176 of the cyclone chamber 4160 towards the first end 4172 of the cyclone chamber 4160. As exemplified, the second section 4178 may terminate at the opposite side of the dirt outlet 4188.

In the example shown in FIG. 28, the first wall section 4177 is attached to the first end wall 4192. In embodiments where the first end wall 4192 is openable, the first wall section 4177 can move with the first end wall 4192 when the first end wall 4192 is opened. This may allow the first wall section 4177 to be removed from the cyclone chamber when the first end wall 4192 is opened.

Optionally, as exemplified, the second wall section 4178 may be attached to the radial outer wall 4191 of the dirt collection chamber 4164 such as by radially extending ribs. The radial outer wall 4191 may be provided by the exterior wall 4552 of the cyclone unit 4112. In such an embodiment, the second wall section 4178 can remain in place if one or both of the first end wall 4192 and second end wall 4196 is openable.

Alternately, the second wall section 4178 may be attached to the second end wall 4196 and may be removed from the cyclone chamber when the second end wall 4196 is opened. Such an embodiment is exemplified in FIG. 29, which illustrates another example of a cyclone unit 5112 having a cyclone chamber 5160 and external dirt collection chamber 5164. Cyclone unit 5112 is generally similar to cyclone units 3112 and 4112 except that the first wall section 5177 is attached to the front end wall 5192 and the second wall section 5178 is attached to the second end wall 5196.

Figure 29:
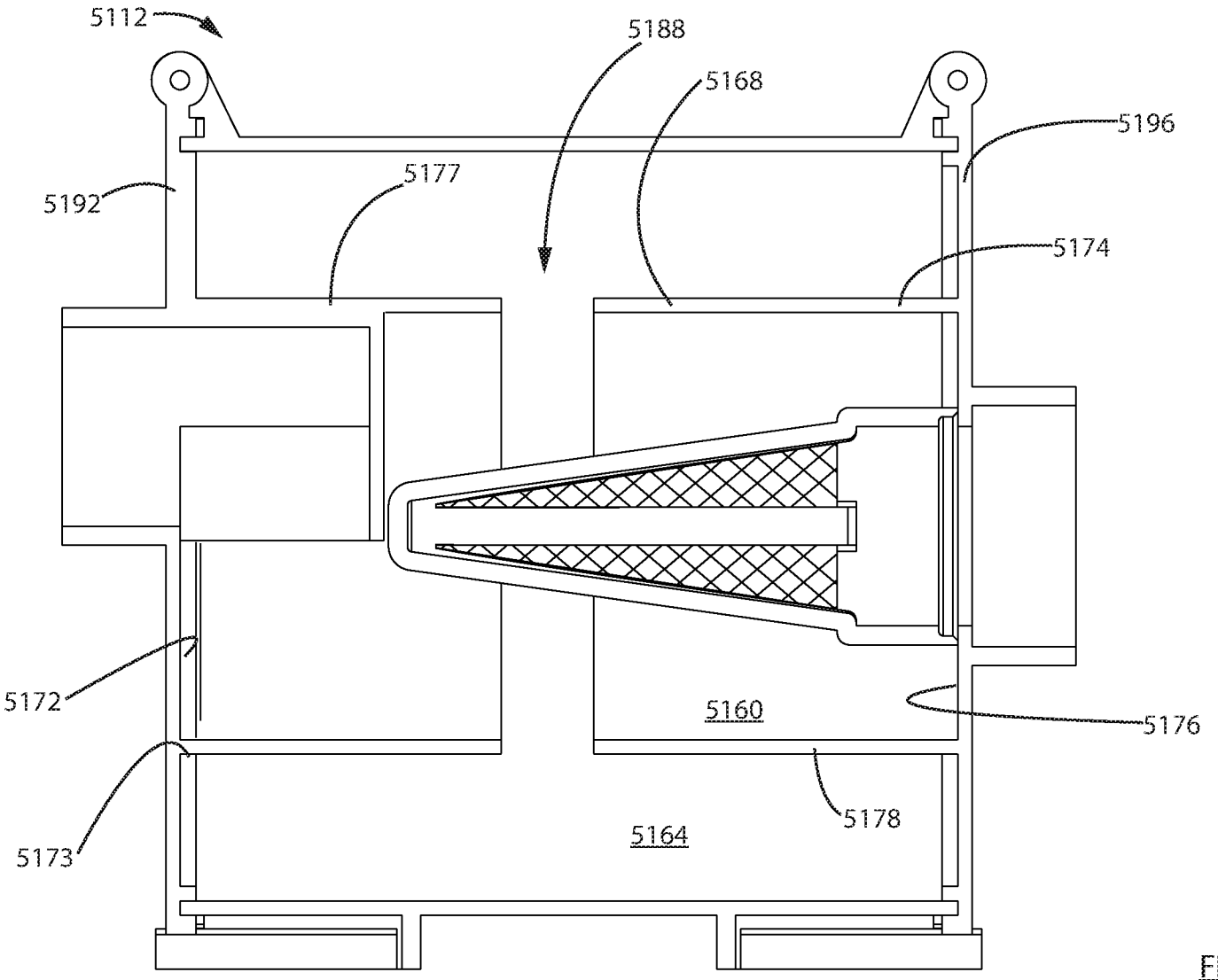
FIG. 29 is a cross-sectional view of another example cyclone unit in accordance with at least one embodiment.

As shown in FIG. 29, the cyclone chamber 5160 has an axially extending sidewall 5168. The cyclone chamber side wall 5168 has a first end 5173 located at the first end 5172 of the cyclone chamber 5160. The side wall 5168 has a second end 5174 that is spaced apart from the first end 5173 in a longitudinal direction of the cyclone chamber 5160. In the example shown, the second end 5174 of the cyclone chamber sidewall 5168 located at the second end 5176 of the cyclone chamber 5160.

As shown in FIG. 29, the cyclone dirt outlet 5188 is provided between the first end 5173 and the second end 5174 of the cyclone chamber sidewall 5168. In this example, the cyclone dirt outlet 5188 is formed as a gap in the sidewall 5168.

The sidewall has a first section 5177 that extends axially rearwardly from the first end 5172 of the cyclone chamber 5160 towards the second end 5176 of the cyclone chamber 5160. The first section 5177 terminates at the dirt outlet 5188.

The sidewall has a second section 5178 that extends axially forwardly from the second end 5176 of the cyclone chamber 5160 towards the first end 5172 of the cyclone chamber 5160. The second section 5178 terminates at the opposite side of the dirt outlet 5188.

Configuration of the Cyclone Chamber Sidewall

The following is a description of a configuration of the cyclone chamber sidewall that may be used by itself in any surface cleaning apparatus or in any combination or sub-combination with any other feature or features disclosed including the uniflow cyclone, the cyclone chamber inlet, the cyclone chamber screen member, the dirt collection chamber, the cyclone chamber dirt outlet, the openable cyclone unit, the second stage cyclone, the mountable surface cleaning apparatus, and the driving handle.

In some embodiments, the dirt collection area may be internal of the cyclone chamber, e.g., a dirt collection area may be provided at a longitudinal end of the cyclone chamber as exemplified in FIGS. 40-42. In such an embodiment, the dirt collection chamber may be defined in part by an end wall 15163 that would otherwise be an end wall of the cyclone chamber 15160 and, optionally, an extension of a sidewall 15168 of the cyclone chamber 15160.

In other embodiments, as exemplified in FIG. 3, the dirt collection chamber 164 may be positioned radially outwardly of the cyclone chamber 160 and may be annular. As exemplified in FIG. 3, cyclone sidewall 168 is discrete from the exterior wall 552 of the cyclone unit 112. As shown, the cyclone sidewall 168 is radially spaced apart from the exterior wall 552 with the dirt collection chamber 164 positioned radially between the cyclone sidewall 168 and the exterior wall 552. The cyclone sidewall 168 may be secured in place by being secured to the first or second ends of the cyclone chamber and/or by ribs extending between the cyclone chamber sidewall 168 and the exterior wall 552.

In other embodiments, as exemplified in FIGS. 33 and 40, the cyclone sidewall 168 may be formed at least in part by portions of the exterior wall 552. For example, as shown in FIG. 40, the cyclone chamber sidewall 15158 is provided by, and integral with, the cyclone unit exterior wall 15552. Alternately, as shown in FIG. 33, a first section 9177 of the cyclone chamber sidewall 9168 may be formed by a portion of the cyclone unit exterior wall 9552. The cyclone chamber sidewall 9168 also includes another portion (in this case, second section 9178 and third section 9179) that are separate from the exterior wall 9552.

It will be appreciated that the dirt collection chamber 164 may have a uniform radial width at all locations along the length of the dirt collection chamber 164. Alternately, as exemplified in FIGS. 30 and 33, the width may vary, e.g., it may continuously increase or decrease towards one of the end walls of cyclone unit.

Returning to the example of FIG. 3, the dirt collection chamber 164 has a dirt collection chamber sidewall 548 that is formed in part by portions of the cyclone sidewall 168. As shown in FIG. 3, the dirt collection chamber 164 extends between a radial inner wall 190 and a radial outer wall 191. The radial inner wall 190 is formed by an outer portion of the cyclone chamber sidewall 168. Accordingly, the wall portion 556 in common between cyclone 160 and dirt collection chamber 164 may operate as a dividing wall. Sharing a common dividing wall may help reduce the overall size of the cyclone unit 112, for a more compact design.

Alternately, the cyclone sidewall 168 and dirt collection chamber sidewall 548 may be discrete walls that are spaced apart and connected by a dirt outlet passage.

As shown in FIG. 3, the radial outer wall 191 of the dirt collection chamber 164 may be formed as a separate wall from the exterior wall 552 of the cyclone unit 112. This may allow the dirt collection chamber 164 to be removed from the cyclone unit 112, e.g. for emptying and/or cleaning.

Alternately, the radial outer wall 191 of the dirt collection chamber 164 may be provided by the exterior wall 552 of the cyclone unit 112. This may promote a more compact design for the cyclone unit 112.

Alternately or in addition, in some embodiments the radial outer wall 191 of the dirt collection chamber 164 may be provided by the cyclone chamber sidewall 168. For example, as shown in FIG. 40 the radial outer wall 15191 of the dirt collection chamber 15164 can be formed by the cyclone chamber sidewall 15168. In the example shown in FIG. 40, the radial inner wall 15190 of the dirt collection chamber 15164 can be defined by the non-porous section 15203 of the vortex finder 15204.

In accordance with this aspect of the disclosure, in some embodiments the cyclone chamber sidewall may have a radial width that narrows at an intermediate location within the cyclone chamber.

Referring to FIG. 33, as shown therein the cyclone chamber 9160 extends in a longitudinal axial direction from a first end 9172 to a second end 9176. A tangential air inlet 9180 is provided at the first end 9172 and a cyclone air outlet 9184 is provided at the second end 9176. The tangential air inlet 9180 has a second or downstream side 9182, which in this example is defined by air inlet conduit wall 9183

As shown in FIG. 33, the radial width of the cyclone chamber 9160 narrows at a location between the second side 9182 of the air inlet 9180 and the second end 9176 of the cyclone chamber 9160. This may promote a more compact design for the cyclone unit 9112 while providing a wider cyclone chamber 9160 near the tangential air inlet 9180 to reduce the volume of dirt and debris that becomes tangled with the vortex finder 9204 when near the first end 9172 of the cyclone chamber 9160. For instance, this may allow the dirt collection chamber 9164 to surround a portion of the cyclone chamber 9160 without increasing the overall width of the cyclone unit 9112.

The cyclone chamber 9160 has a cyclone chamber sidewall 9168 that extends from the first end 9172 towards the second end 9176. The cyclone chamber sidewall 9168 may include multiple wall sections, in this case a first wall section 9177, a second wall section 9178, and a third wall section 9179. The first wall section 9177 has a first radial width, the second wall section 9178 has a second radial width, and the third wall section has a third radial width.

In the example illustrated, the first radial width and the third radial width are generally constant and do not change along the length of the first wall section 9177 and third wall section 9179 respectively. The first radial width is greater than the third radial width. The second radial width changes, optionally at a continuous rate, along the longitudinal length of the second wall section 9178. The second wall section 9178 transitions gradually from the first radial width to the third radial width, thereby narrowing the width of the cyclone chamber 9160 in the process.

In the example shown in FIG. 33, the first wall section 9177, second wall section 9178 and third wall section 9179 define a continuous cyclone chamber sidewall 9168. Alternately, a gap may be provided between two or more of the sidewall sections. For example, as shown in FIG. 34 a gap (dirt outlet 188) may be provided between the second wall section 10178 and the third wall section 10179. In this example, the first wall section 10177 and second wall section 10178 define a continuous sidewall section.

Alternately, one of the sidewall sections may be omitted. For example, the third wall section may be omitted in some embodiments.

In the example illustrated in FIGS. 33 and 34, the radial width of the cyclone chamber narrows gradually. Alternately, the radial width of the cyclone chamber may narrow more abruptly at a location between the first end and the second end of the cyclone chamber. For example, the second wall section may extend radially inward along a plane transverse to the longitudinal direction of the cyclone chamber.

Alternately, the radial width of the cyclone chamber may widen between the first end and the second end of the cyclone chamber. For example, where the second end of the dirt collection chamber is spaced axially inward from the second end of the cyclone chamber, the radial width of the cyclone chamber may increase at the second end of the dirt collection chamber.

FIG. 30 illustrates an example of a cyclone chamber 6160 in which the radial width of the cyclone chamber 6160 widens at the second end 6166 of the dirt collection chamber.

The cyclone chamber 6160 has a cyclone chamber sidewall 6168 that extends from the first end 6172 towards the second end 6176. The cyclone chamber sidewall 6168 includes multiple wall sections, in this case a first wall section 6177, a second wall section 6178, and a third wall section 6179. The first wall section 6177 has a first radial width, the second wall section 6178 has a second radial width, and the third wall section has a third radial width.

In the example illustrated, the first radial width and the third radial width are generally constant and do not change along the length of the first wall section 6177 and third wall section 6179 respectively. The first radial width is narrower than the third radial width. The second radial width changes along the longitudinal length of the second wall section 6178. The second wall section 6178 transitions gradually from the first radial width to the third radial width, thereby widening the width of the cyclone chamber 6160 in the process.

In the example shown in FIG. 30, the second wall section 6178 of the cyclone chamber sidewall 6168 also forms the second end wall 6163 of the dirt collection chamber 6164. Thus, the width of the cyclone chamber 6160 gradually increases at the second end 6166 of the dirt collection chamber 6164.

Alternatively, the width of the cyclone chamber may increase more abruptly. For example, FIG. 31 illustrates an example of a cyclone chamber 7160 having a first wall section 7177 and a second wall section 7178 (see also FIG. 32). The first wall section 7177 has a narrower radial width than the second wall section 7178. Unlike cyclone chamber 6160, however, the cyclone chamber 7160 does not include an intermediate wall section that provides a gradual increase in cyclone chamber width. Rather, the width of the cyclone chamber 7160 increases abruptly at the second end 7166 of the dirt collection chamber.

In accordance with an aspect of this disclosure, the cyclone chamber sidewall may be mounted to any suitable portion of the cyclone unit.

For example, as shown in FIGS. 1-13, the cyclone chamber sidewall 168 may be mounted to the exterior wall 552 of the cyclone unit 112. This may ensure that the cyclone chamber 160 remains within the cyclone unit 112 even if one or both ends 172 and 176 of the cyclone chamber 160 are opened.

Alternately, the cyclone chamber sidewall may be mounted to an end wall of the cyclone chamber. In some embodiments, this may allow the cyclone chamber to be removed from the cyclone unit if the corresponding end wall is opened.

For example, FIG. 31 illustrates an example of a cyclone chamber 7160 in which a portion 7177 of the cyclone chamber sidewall 7168 is mounted to the first end wall 7192 of the cyclone unit 7112. The portion 7177 of the sidewall 7168 can extend from the first end 7172 of the cyclone chamber to the dirt outlet 7188. This may allow the portion 7177 to move with the first end wall 7192 in embodiments when the first end wall 7192 is openable.

In some embodiments, the portion 7177 of the sidewall 7168 attached to the first end wall 7192 may define at least a portion of the sidewall of the dirt collection chamber 7164. This may allow the dirt collection chamber 7164 to be emptied when the first portion 7177 moves with the first end wall 7192.

Alternately or in addition, a portion of the cyclone chamber sidewall may be mounted to the second end wall of the cyclone unit. For example, FIG. 34 illustrates an example of a cyclone unit 10112 in which a section 10179 of the cyclone chamber sidewall 10168 is mounted to the second end wall 10196. This may allow the portion 10179 to move with the second end wall 10196 in embodiments when the second end wall 10196 is openable.

In some embodiments, the portion 10179 of the sidewall 10168 attached to the second end wall 10196 may define at least a portion of the sidewall of the dirt collection chamber 10164. This may allow the dirt collection chamber 10164 to be emptied when the portion 10179 moves with the second end wall 10196.

As explained above with reference to FIGS. 27-29, in various embodiments in which the cyclone chamber sidewall is formed with multiple sections that are separated by a gap at a location intermediate the first and second ends of the cyclone chamber sidewall, the cyclone chamber sidewall sections may be mounted to the first end, second end, and cyclone unit exterior wall in any suitable configuration.

Openable Cyclone Unit

The following is a description of an openable cyclone unit that may be used by itself in any surface cleaning apparatus or in any combination or sub-combination with any other feature or features disclosed including the uniflow cyclone, the cyclone chamber inlet, the cyclone chamber screen member, the dirt collection chamber, the cyclone chamber dirt outlet, the cyclone chamber sidewall, the second stage cyclone, the mountable surface cleaning apparatus, and the driving handle.

In accordance with this aspect of the disclosure, the air treatment member may include one or more openable doors that provides access to empty or clean the air treatment member (e.g. to empty or clean a dirt collection region of the air treatment member).

It will be appreciated that part or all of one or more of the inlet conduit 128, the dirt collection chamber and/or the screen member may be concurrently removable with the openable door (e.g., it may be attached to the openable door, or it may be removable once the openable door is opened). See for example FIGS. 5-10, 15, 17, 20 and 48A-D Reference is now made to FIGS. 1 and 4. In some embodiments, air treatment member 112 includes an openable wall (e.g., a door) to provide access to clean or empty the air treatment member (e.g., cyclone 160 and dirt collection chamber 164). Any portion of air treatment member 112 suitable for emptying air treatment member 112 may be openable.

As exemplified, air treatment member 112 includes an openable front end 172 wherein all of the front end is openable. As exemplified, the air treatment member may be a cyclone unit comprising a cyclone and a dirt collection chamber external to the cyclone and may have a front end 172 that includes cyclone first end wall 192, and dirt collection chamber first end wall 162. It will be appreciated that, in some embodiments, only a portion of the front end 172 may be openable.

The openable door 472 may be openable in any manner suitable for providing access to clean or empty air treatment member 112, e.g., cyclone 160 and dirt collection chamber 164. For example, the door 472 may be pivotally attached to the air treatment member 112 which is exemplified in FIG. 1, slideably attached to the air treatment member 112, and/or removable altogether from the air treatment member 112.

Figure 4:
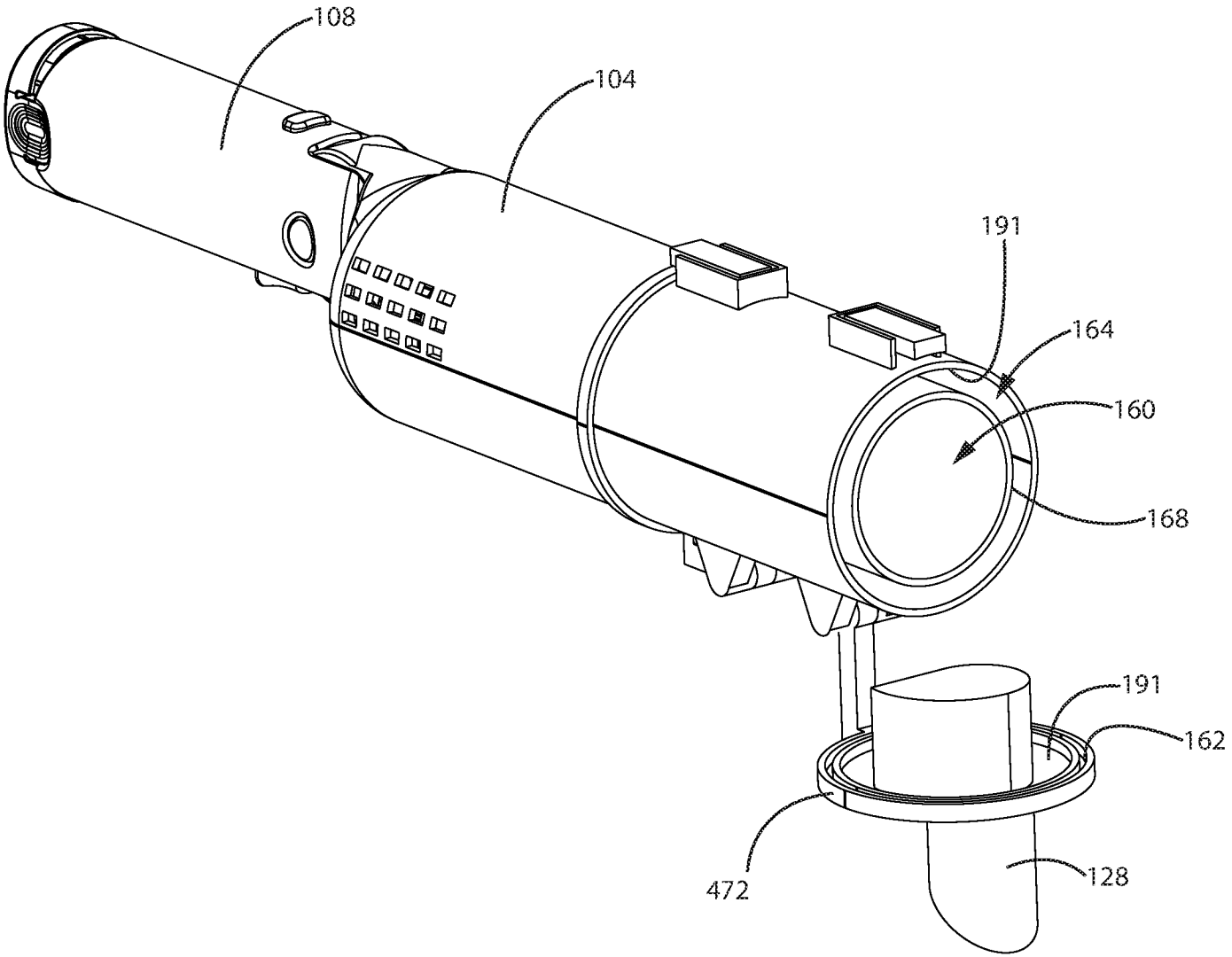
FIG. 4 is a side perspective view of the surface cleaning apparatus of FIG. 1 with the front wall of the cyclone unit in an open position.
Figure 5:
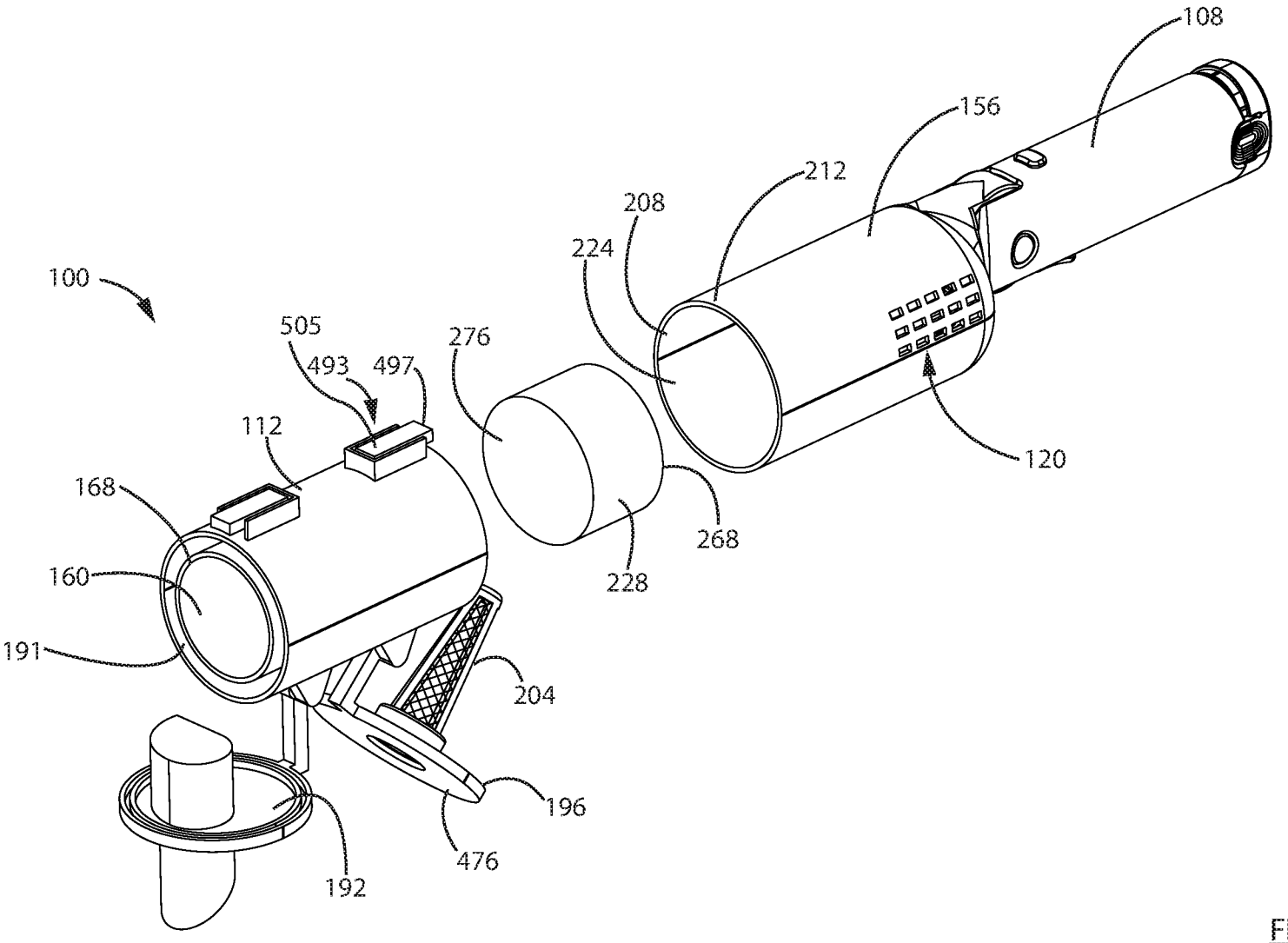
FIG. 5 is an exploded view of the surface cleaning apparatus of FIG. 1 with a front wall of the cyclone unit in an open position and a rear wall of the cyclone unit in an open position.
Figure 6:
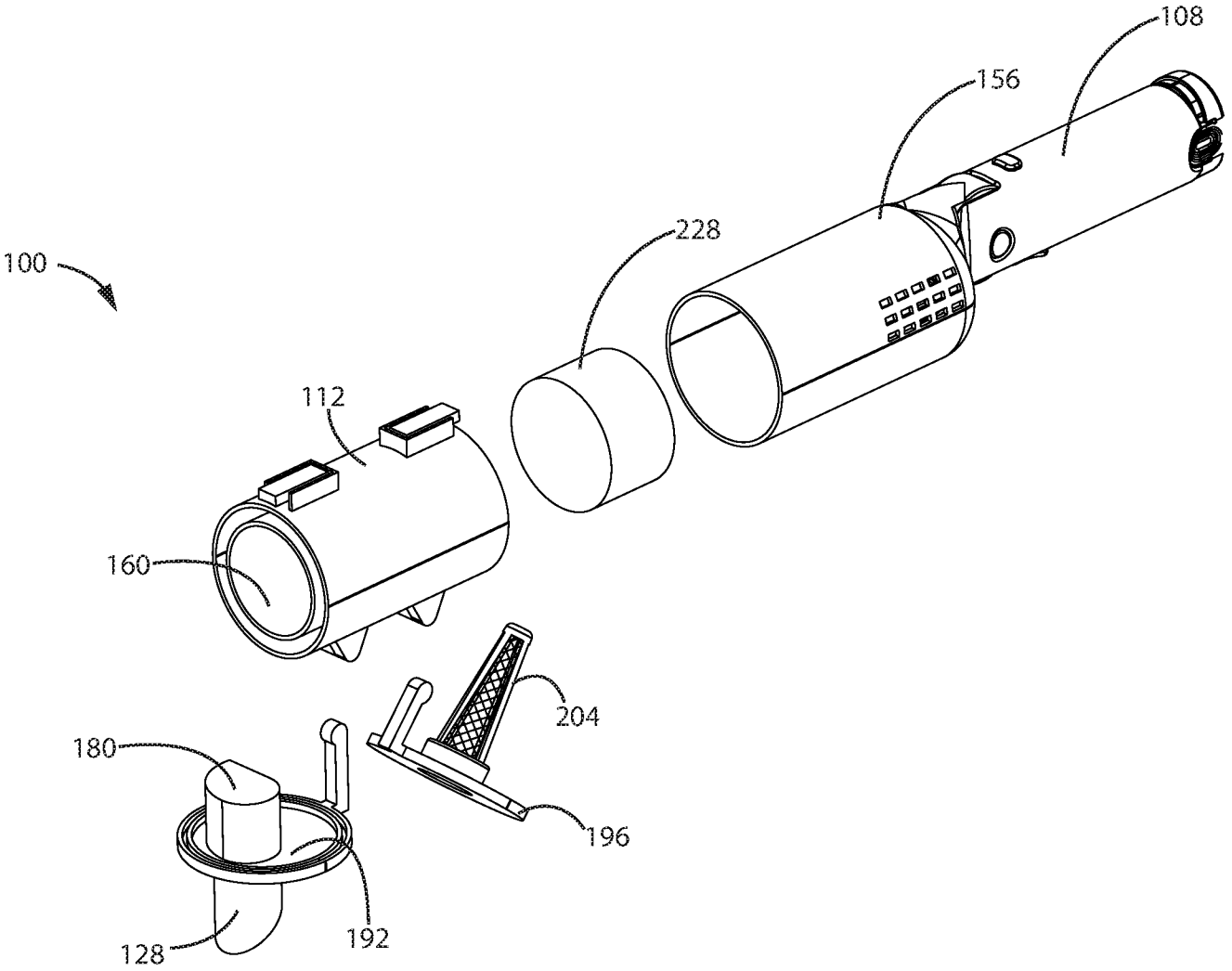
FIG. 6 is an exploded view of the surface cleaning apparatus of FIG. 1 with a front door and a rear door removed from the cyclone unit.
Figure 7:
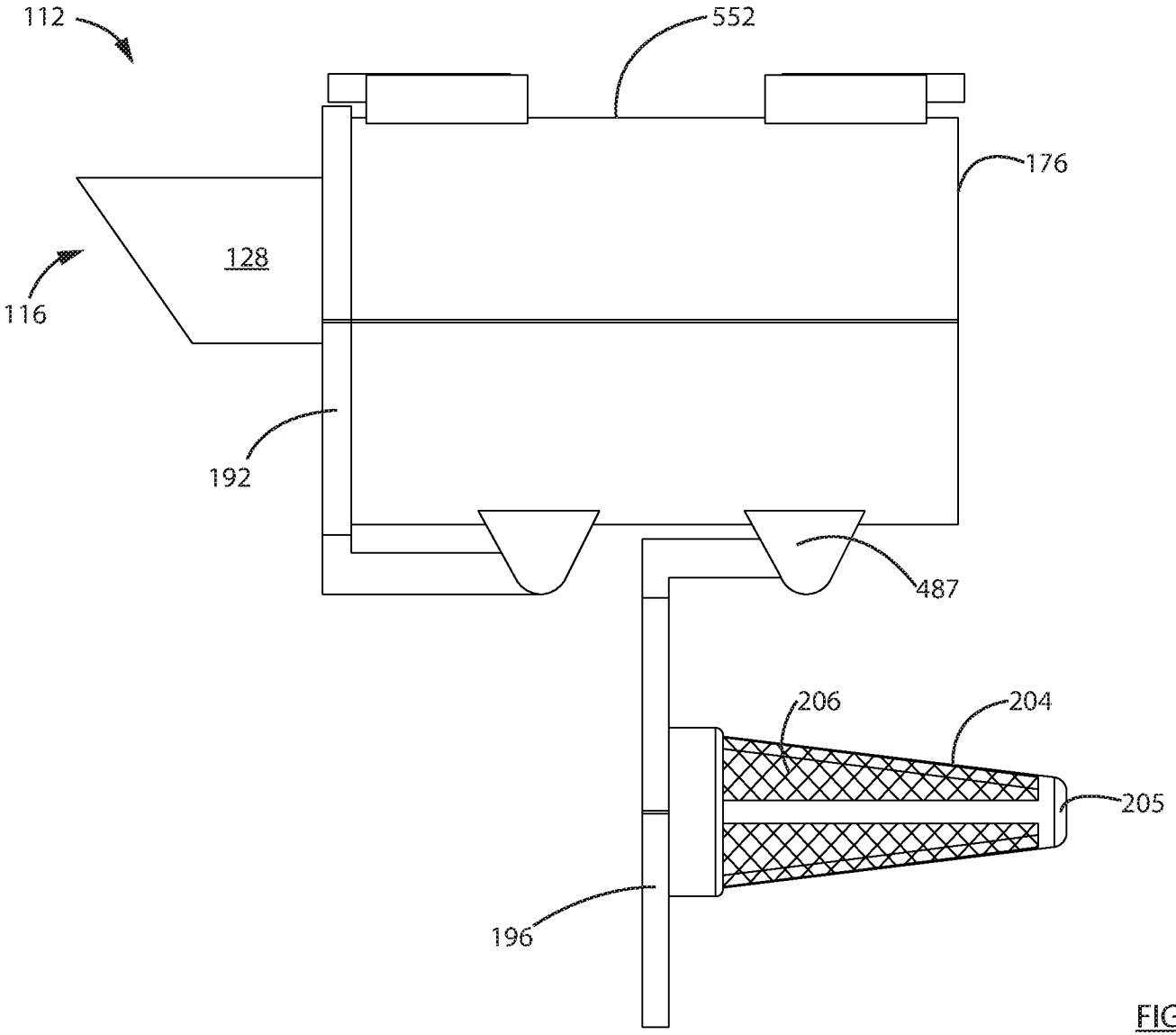
FIG. 7 is a side view of the cyclone unit of the surface cleaning apparatus of FIG. 1 with a rear door in an open position.
Figure 8:
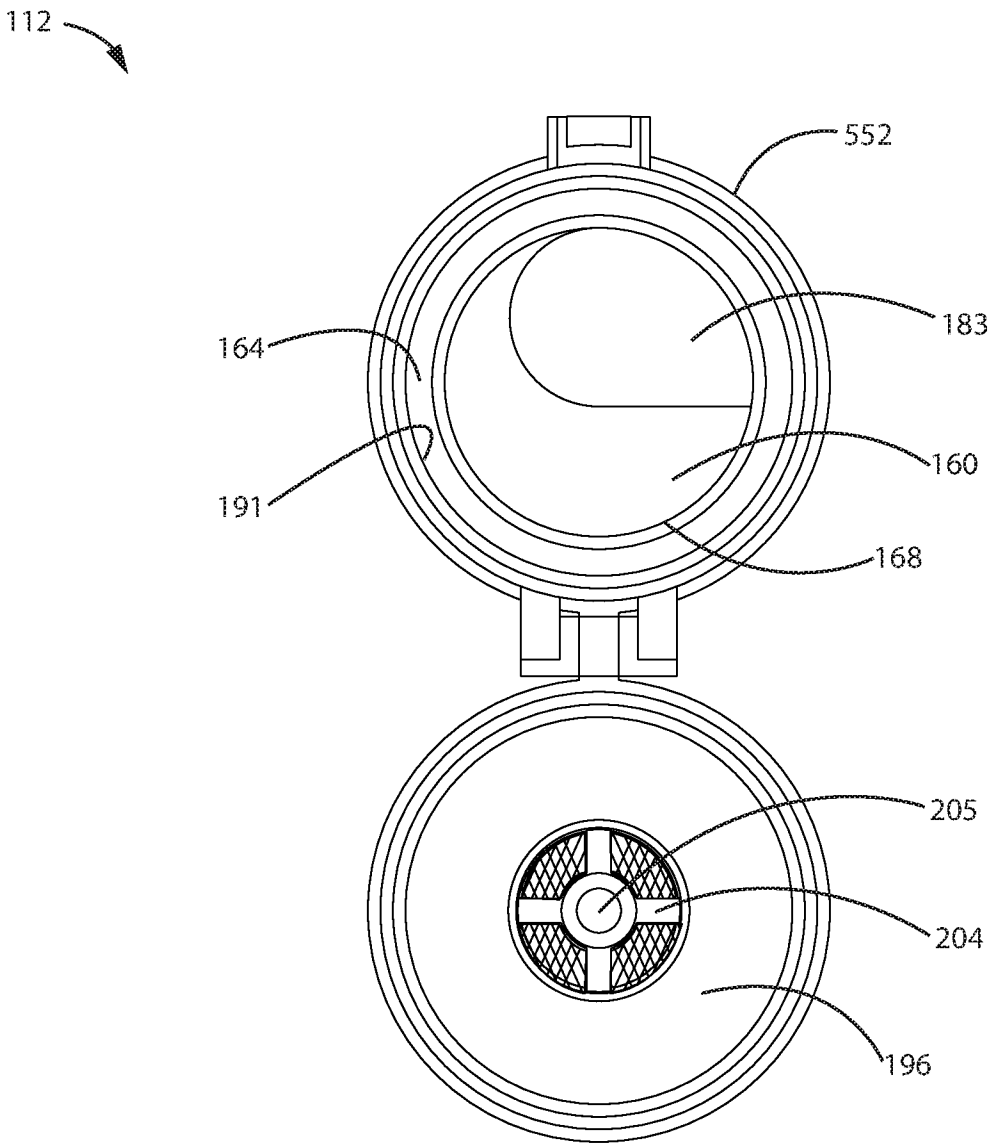
FIG. 8 is a rear view of the cyclone unit of FIG. 7 with the rear door in the open position.

As exemplified, cyclone unit front door 472 is rotatable about a cyclone unit wall pivot axis 480 (see FIG. 3) between a closed position (FIG. 1), and an open position (FIG. 4). It will be appreciated that cyclone unit front door 472 may be rotatable in any manner and direction suitable for moving cyclone unit front door 472 generally away from the cyclone unit 112 to provide access to the cyclone 160 and dirt collection chamber 164 inside. In the illustrated embodiment, cyclone unit front door 472 is downwardly rotatable about a transversely extending (e.g. horizontal) cyclone unit wall pivot axis 480 located below a lower portion 352 of the cyclone unit 112. As exemplified, the cyclone unit wall pivot axis 480 is transverse to (e.g. substantially perpendicular to) the inlet connector axis 364 and the cyclone axis of rotation 484.

In alternative embodiments, cyclone unit front door 472 may rotate in a different direction about a different axis. For example, cyclone unit front door 472 may move laterally or transversely outwardly by rotation about a substantially vertical axis positioned proximate a left or right side of the cyclone unit 112. In other embodiments, cyclone unit front door 472 may move upwardly by rotation about a substantially horizontal axis positioned proximate cyclone unit upper portion 354.

Figure 1:
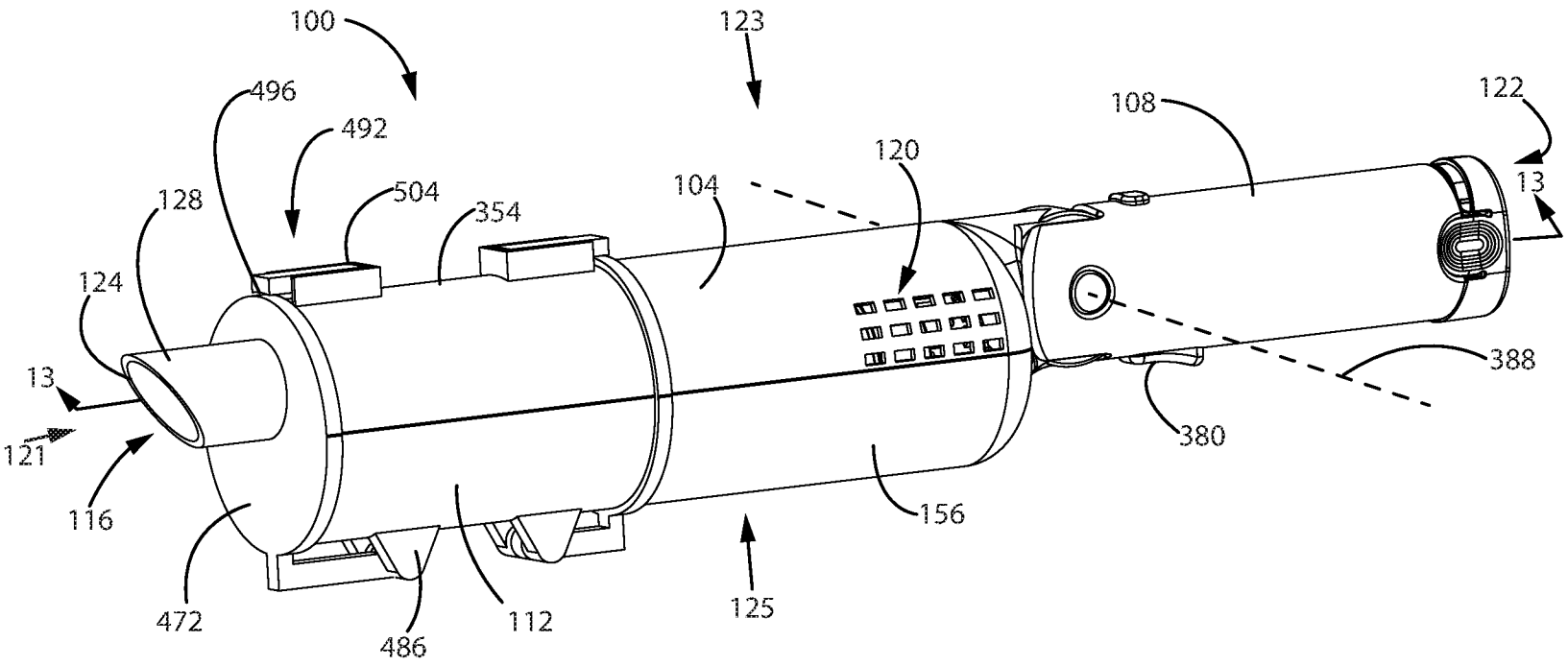
FIG. 1 is a side perspective view of an example surface cleaning apparatus in accordance with at least one embodiment.
Figure 2:
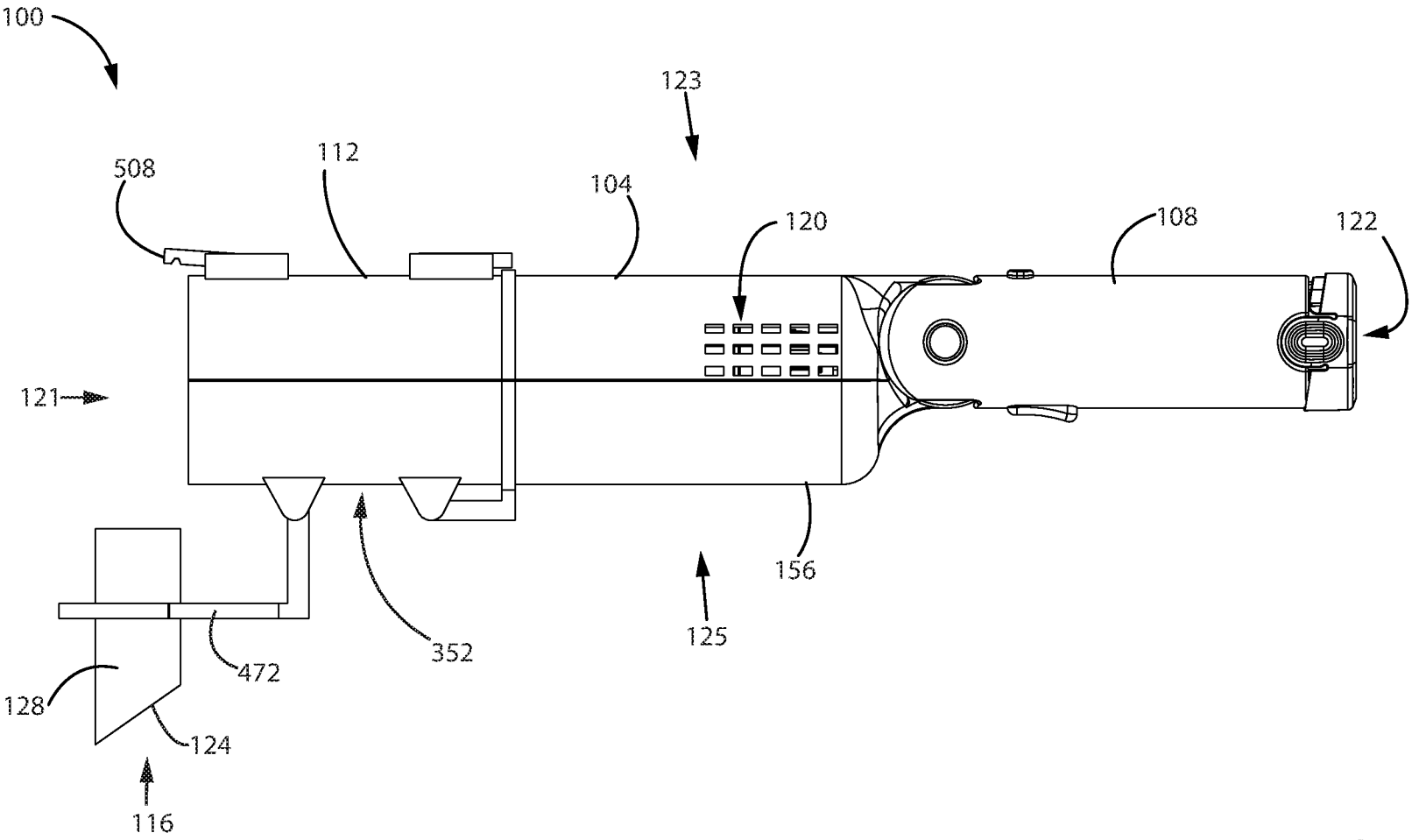
FIG. 2 is a side view of the surface cleaning apparatus of FIG. 1.

Still referring to FIGS. 1 and 4, the cyclone unit front door 472 may have any construction suitable for allowing the cyclone unit front door 472 to rotate about the cyclone unit wall pivot axis 480. For example, cyclone unit front door 472 may be connected to cyclone unit 112 by a hinge 486 of any type known in the art. In some embodiments, cyclone unit front door 472 may be resiliently bendable to connect with cyclone unit 112 by a living hinge.

The pivot axis may be located at the front end of the cyclone chamber. Alternately, as exemplified, the pivot axis may be located rearwardly and the hinge may include an axially extending arm. An advantage of this design is that it may facilitate mounting a member (e.g., the inlet conduit 128) to the openable door and enabling the inlet conduit 128 to be removed from the cyclone chamber 160 when the door is opened. See also FIGS. 13B and C and 23B-E wherein the inlet conduit 128 and the insert 175 are both moveable with the openable door (e.g., the may each be mounted to the openable door). Alternately, insert 175 may remain in position when the front wall 192 is opened. The If an end wall is openable, then a lock is provided to secure the openable end wall in a closed position. The lock may be manually releasable by a user. This allows the openable cyclone unit wall to remain closed while the apparatus 100 is operating, and allows the user to selectively open the openable cyclone unit wall to empty the cyclone 160 and dirt collection chamber 164 inside when the apparatus 100 is turned off. For example, as exemplified in FIGS. 1 and 3, cyclone unit 112 includes a door lock 492, which inhibits opening of cyclone unit front door 472 when engaged. Door lock 492 is user operable to disengage door lock 492 to thereby permit cyclone unit front door 472 to move to its open position.

Door lock 492 may be any type of lock suitable for retaining cyclone unit front door 472 in its closed position, and which may be user releasable to permit cyclone unit 112 to open. In some embodiments, door lock 492 may have a manually operable actuator for moving the lock between its engaged and disengaged positions. In the illustrated embodiment, door lock 492 includes an engaging member 496 and an actuator 504.

Optionally, the door release actuator 504 is manually user operable (i.e. by hand) to move the engaging member 496 between its engaged position (FIG. 1) and a disengaged position. As exemplified, in the engaged position (FIG. 1), door release actuator 504 may engage cyclone unit front door 472 to inhibit movement of front door 472 to its open position. This prevents front door 472 from rotating about its cyclone unit wall pivot axis 480 to its open position. In the disengaged position, door release actuator 504 releases cyclone unit front door 472 to permit front door 472 to move to its open position (for example, engaging member 496 may be raised to disengage the front door 472).

Lock engaging member 496 may be of any construction having an engaged position for retaining the openable cyclone unit wall in its closed position, and a disengaged position for releasing the openable cyclone unit to move to its open position. In the illustrated example, lock engaging member 496 is connected to an exterior of air treatment member 112.

As exemplified, lock engaging member 496 has a front end 508 which is sized and positioned to releasably hook onto an outer portion of the cyclone unit front door 472 to retain the front door 472 in its closed position.

Lock engaging member 496 may be movable in any suitable manner between its engaged and disengaged positions. For example, lock engaging member 496 may be rotatable as shown, translatable, or combinations thereof. In the illustrated embodiment, lock engaging member 496 is pivotally connected to air treatment member 112 for rotation between its engaged and disengaged positions. As exemplified, in the engaged position, lock engaging member 496 may hook onto front door 472. Lock engaging member 496 may then be rotated about its axis away from cyclone unit front door 472 to unhook from the front door. Optionally, lock engaging member 496 may be biased to the locked position. For example, a biasing member (e.g. torsional spring, not shown) may bias lock engaging member 496 to rotate toward the closed position.

Door lock 492 may have any door release actuator 504 suitable for moving the lock engaging member 496 between its engaged and disengaged positions. In the illustrated example, door release actuator 504 is formed as a button which is operable to rotate lock engaging member 496 to its unlocked position. As exemplified, door release actuator 504 and lock engaging member 496 may be provided as an integrated member configured to move lock engaging member 496 when door release actuator 504 is depressed. In this example, when door release actuator 504 is depressed, lock engaging member 496 is teetered to rotate about its lock engaging member axis to its disengaged position. It will be appreciated that door release actuator 504 may be movable in any suitable manner. For example, door release actuator 504 may be rotatable (e.g. pivotal) as shown, or translatable (e.g. slidable). In the illustrated example, door release actuator 504 is rotatably connected to cyclone unit 112 about the same rotational axis as lock engagement member 496.

As shown in FIGS. 5 and 19-21, optionally both the first end wall 192 and second end wall 196 of the cyclone unit 112 may be openable. For example, second end wall 196 may define a rear door 476 of the cyclone unit 112. The rear door 476 may operate in generally the same manner as front door 192. Accordingly, each end of the cyclone unit may have a door lock 492, Similar to cyclone unit front door 472, the cyclone unit rear door 473 may have any construction suitable for allowing the cyclone unit rear door 473 to open. For example, cyclone unit rear door 473 may be rotatably connected to cyclone unit 112 by a rear hinge 487 of any type known in the art.

The rear door 473 may also include a door lock 493 analogous to door lock 492. Door lock 493 may be any type of lock suitable for retaining cyclone unit rear door 473 in its closed position, and which is user releasable to permit cyclone unit 112 to open. In some embodiments, door lock 493 may have a manually operable actuator for moving the lock between its engaged and disengaged positions. In the illustrated embodiment, door lock 493 includes an engaging member 497 and an actuator 505.

Figure 23F:
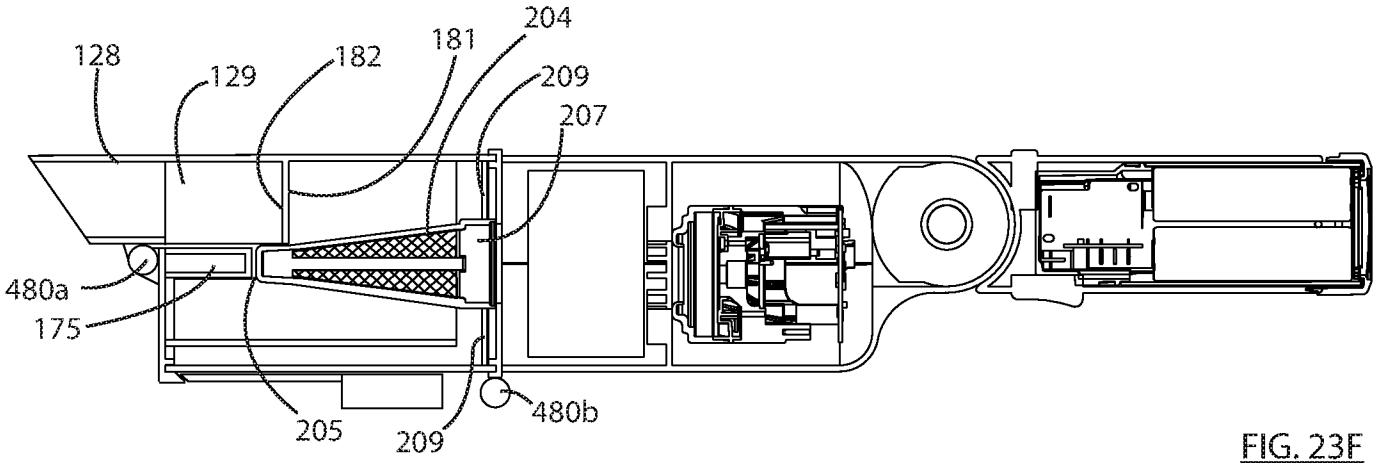
FIG. 23F is a cross-sectional view of an alternate surface cleaning apparatus with the cyclone unit in a closed position.
Figure 23G:
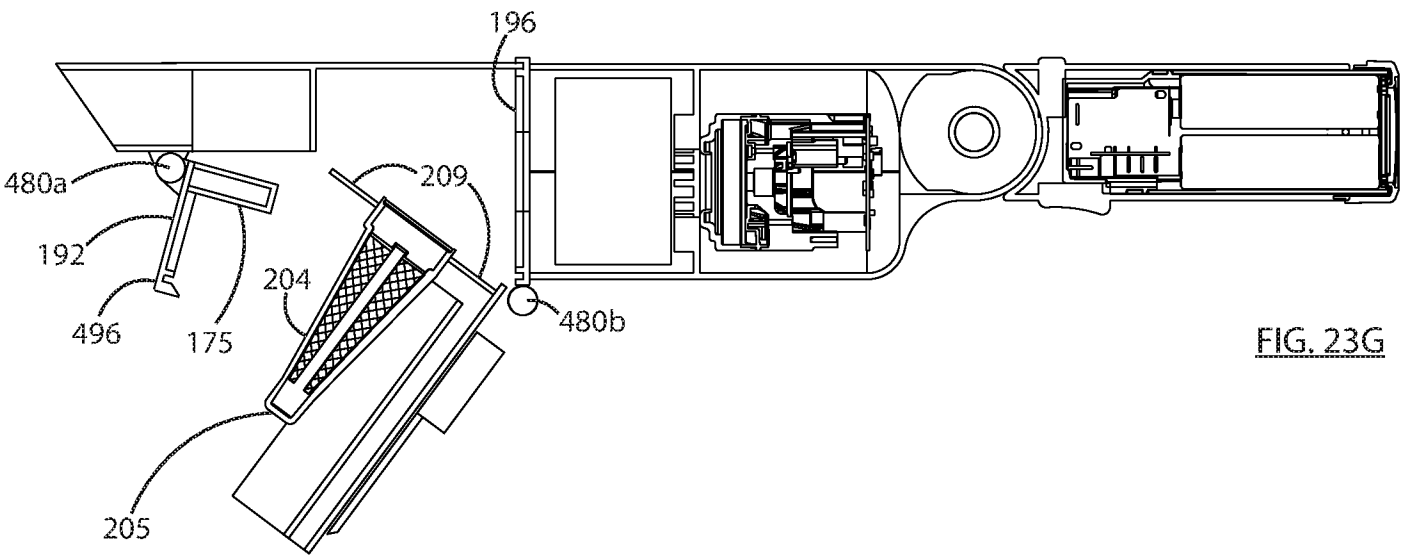
FIG. 23G is a cross-sectional view of the alternate surface cleaning apparatus of FIG. 23F with the cyclone unit in an open position.

Optionally as exemplified in FIGS. 23F and G, a front pivot 480*a* and a rear pivot 480*b* may be provided. The front wall 192 may be pivotally mounted by pivot 480*a*. As exemplified, inlet 128 may remain in position and insert 175 may mounted to front wall 192. A portion of the cyclone chamber sidewall 191 may be pivotally mounted to second (rear) wall 196 by rear pivot 480*b*. In such a case, the vortex finder 204 may be secured to the moveable portion of the sidewall 191. For example, the rearward end of the vortex finder 204 may be secured on position by a plurality of support members 209 (e.g., ribs) that may extend radially. Some of the support members 209 may be secured to the openable portion of sidewall 191 and the remainder (if any) may abut the inner surface of the sidewall when the cyclone chamber is closed. The lock engaging member 496 may be on a lower end of the front wall 192.

Figures 23H, 23I:
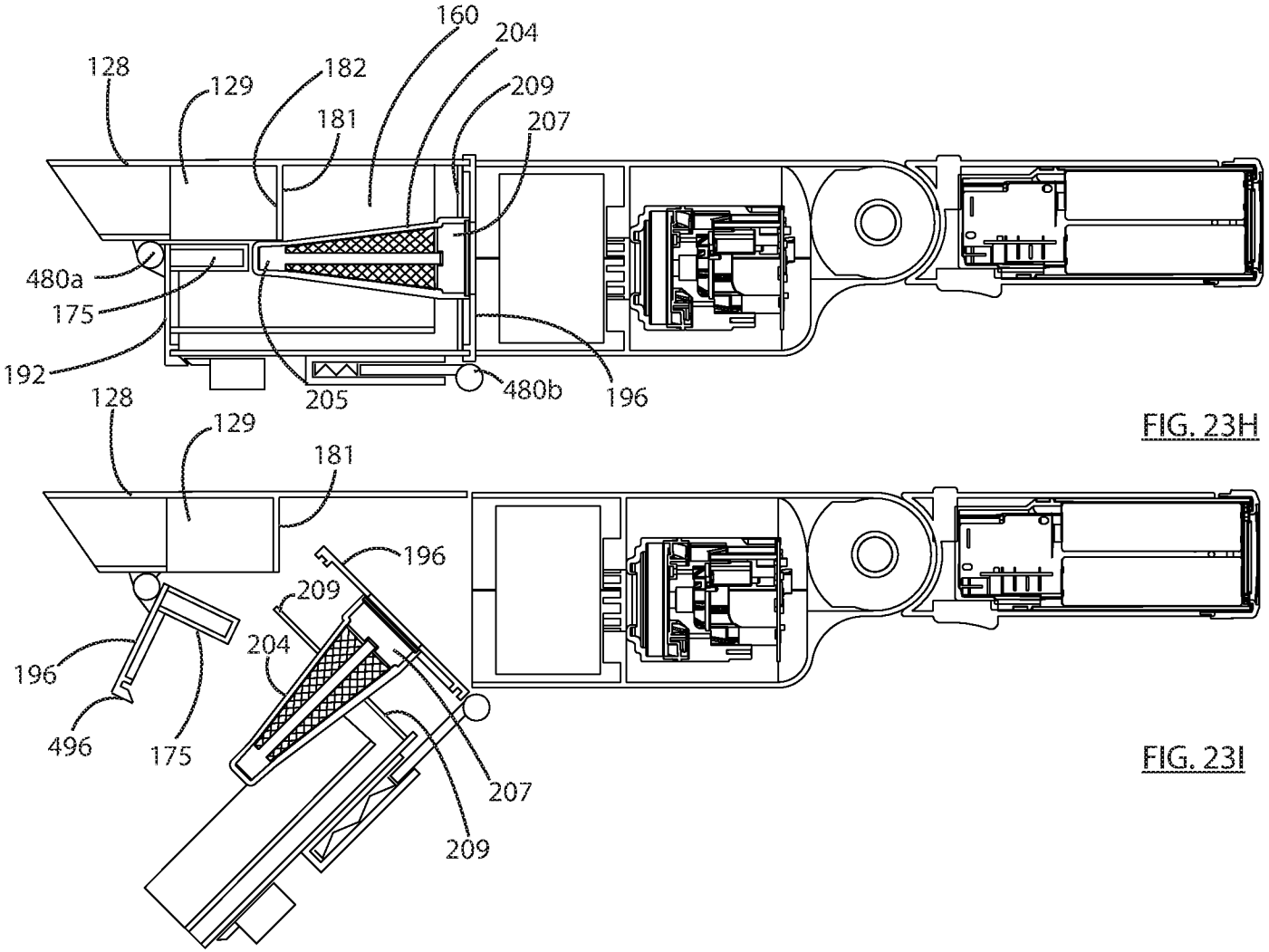
FIG. 23H is a cross-sectional view of an alternate surface cleaning apparatus with the cyclone unit in a closed position.
FIG. 23I is a cross-sectional view of the alternate surface cleaning apparatus of FIG. 23H with the cyclone unit in an open position.
Figure 24:
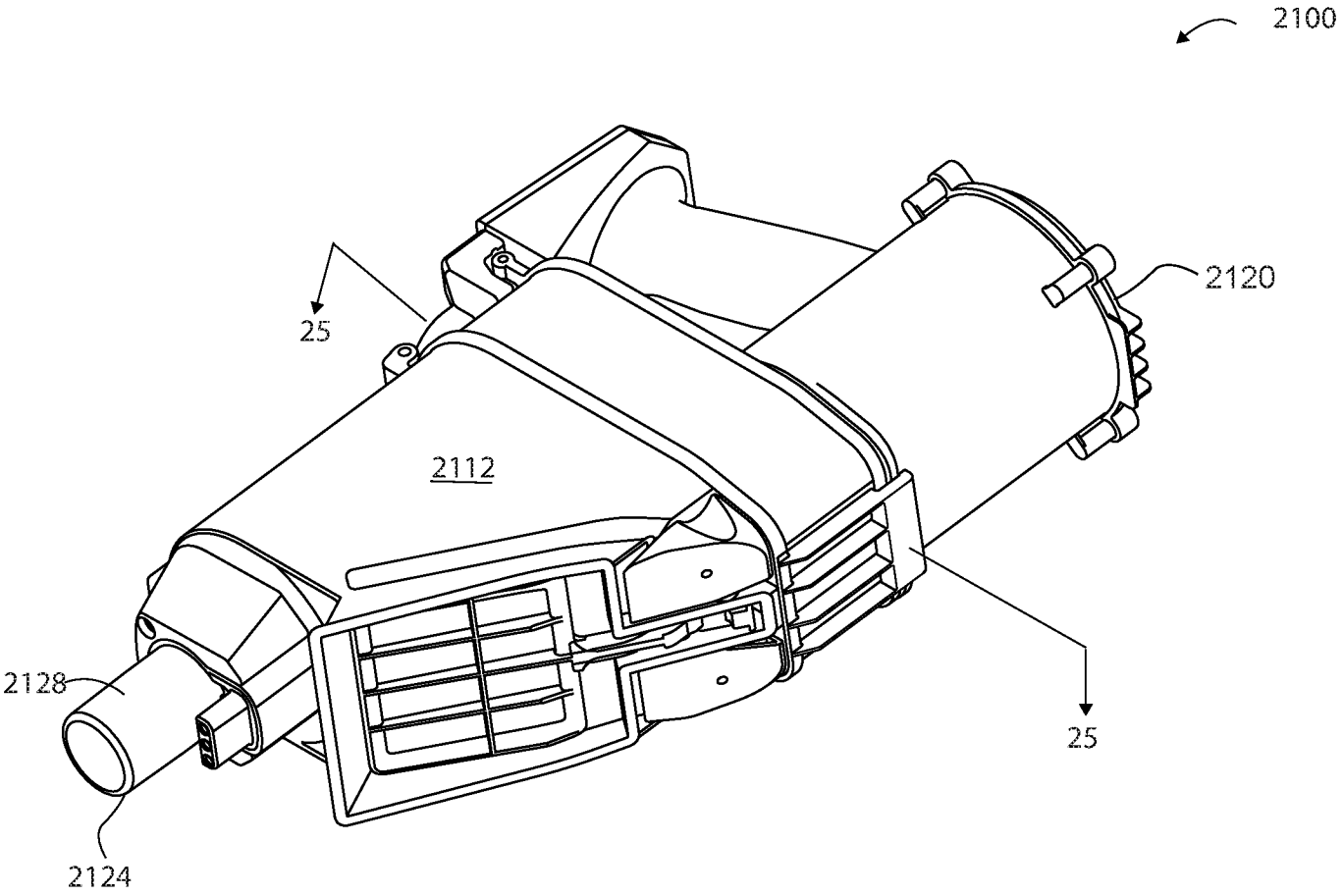
FIG. 24 is a bottom perspective view of another example surface cleaning apparatus in accordance with at least one embodiment.

FIGS. 23H and I exemplify an embodiment that is similar to the embodiment of FIGS. 23F and G except that the rear wall 196 is also pivotally mounted to rear pivot 480*b*.

Surface Cleaning Apparatus with a Second Stage Cyclone

The following is a description of a surface cleaning apparatus with a second stage cyclone that may be used by itself in any surface cleaning apparatus or in any combination or sub-combination with any other feature or features disclosed including the uniflow cyclone, the cyclone chamber inlet, the cyclone chamber screen member, the dirt collection chamber, the cyclone chamber dirt outlet, the cyclone chamber sidewall, the openable cyclone unit, the mountable surface cleaning apparatus, and the driving handle.

In accordance with this aspect, any second stage cyclone unit may be used.

Figure 76:
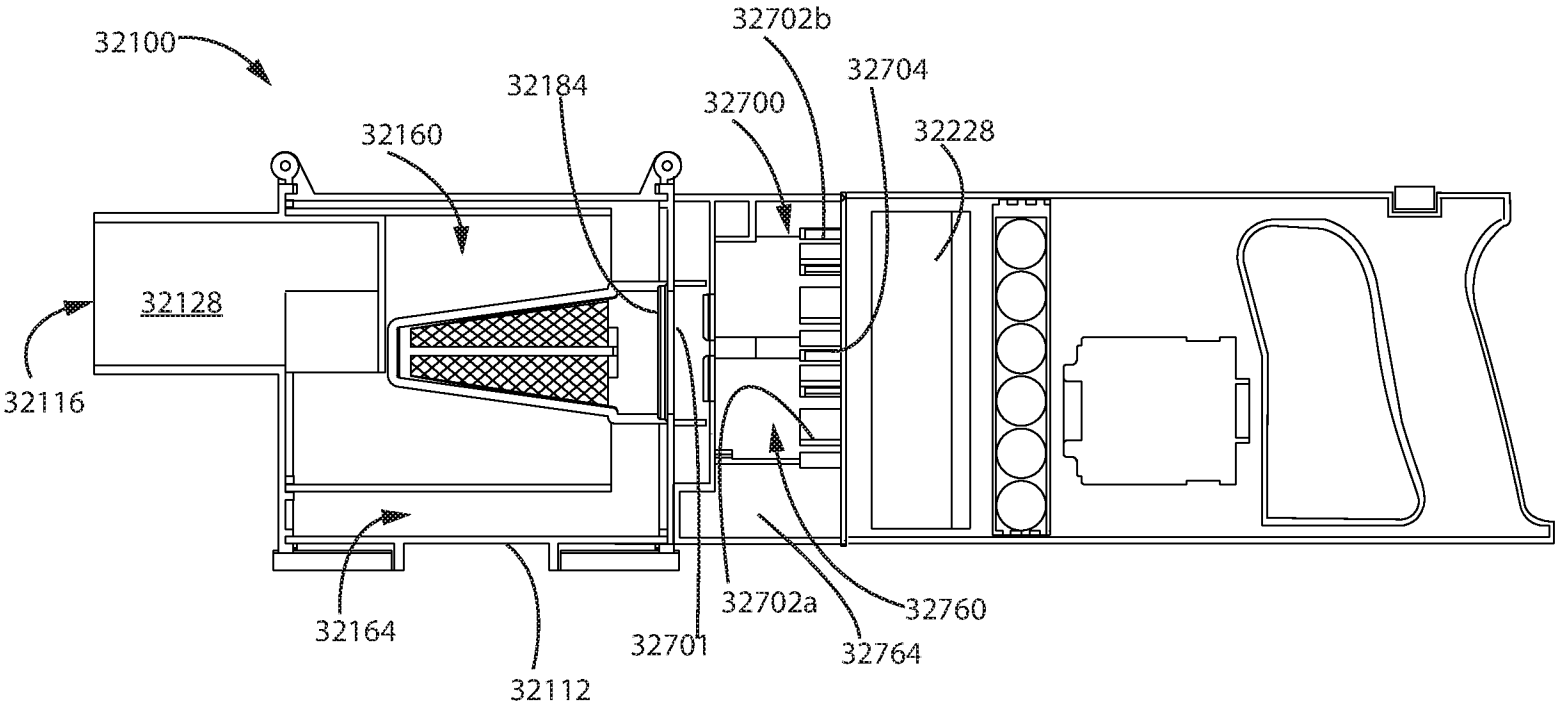
FIG. 76 is a cross-sectional view of another example surface cleaning apparatus in accordance with an embodiment.
Figure 77:
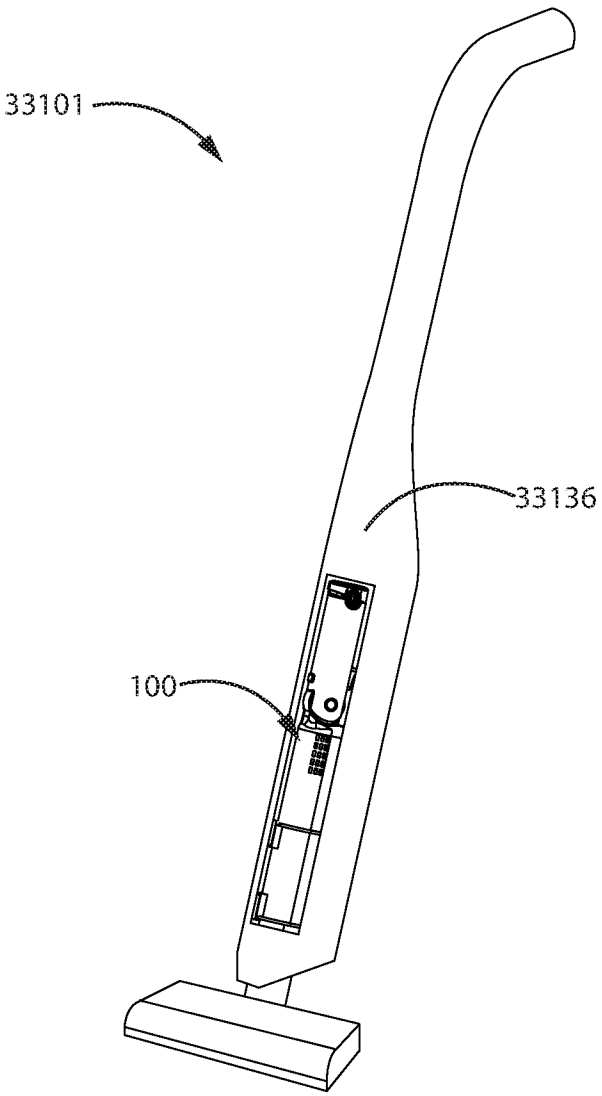
FIG. 77 is a perspective view of another example surface cleaning apparatus in accordance with at least one embodiment.

FIG. 76 illustrates an example of a surface cleaning apparatus 32100 in accordance with an embodiment. Surface cleaning apparatus 32100 is an example of a hand vacuum cleaner having a first stage cyclone unit 32112 that may comprise a single first cyclone chamber 32160 and a second stage cyclone unit 32700.

As shown in FIG. 76, the first cyclone unit 32112 is fluidly coupled to a dirty air inlet 32116 by an air inlet passage 32128. The first cyclone unit 32112, air inlet passage 32128, and dirty air inlet 32116 generally correspond to the cyclone unit 1112, air inlet passage 1128 and dirty air inlet 1116 of surface cleaning apparatus 1100. As shown, the first cyclone unit 32112 includes a cyclone chamber 32160 and an external dirt collection chamber 32164. However, unlike surface cleaning apparatus 1100, in surface cleaning apparatus 32100 the cyclone air outlet 32184 of the first cyclonic unit 32112 is in fluid flow communication with an air inlet 32701 of the second cyclone unit 32700.

Optionally, as exemplified in FIG. 76, the second cyclone unit 32700 may be a multi-inlet cyclone assembly. The cyclone air inlet 32701 includes a plurality of air inlet ports 32702*a* and 32702*b*, which may share a common airflow passage leading upstream to the first stage cyclone air outlet 32184.

Air entering the second stage cyclone air inlet 32701 passes through the common airflow passage, then to the air inlet ports 32702 before entering the cyclone chamber 32760.

The cyclone chamber 32760 that has multiple cyclone air inlets in fluid communication with (downstream of) the inlet conduit 32701, a cyclone air outlet 32704, and a dirt outlet (not shown) that is in communication with a dirt collection chamber 32764.

The second stage cyclone 32760 may optionally be a 'uniflow' cyclone chamber (i.e. where the cyclone air inlet 32701 and cyclone air outlet 32704 are at opposite ends of the cyclone chamber). Alternatively, as exemplified, a single cyclonic cleaning stage with bidirectional air flow (i.e. where the cyclone air inlet and cyclone air outlet are at the same end of the cyclone chamber) may be used as the air treatment member 32700. Optionally, the cyclone may be an inverted cyclone.

Air passing through the second stage cyclone 32760 can exit via the cyclone air outlet 32704 and impinge upon a pre-motor filter 32228.

Surface Cleaning Apparatus Mountable on a Base

The following is a description of a mountable surface cleaning apparatus that may be used by itself in any surface cleaning apparatus or in any combination or sub-combination with any other feature or features disclosed including the uniflow cyclone, the cyclone chamber inlet, the cyclone chamber screen member, the dirt collection chamber, the cyclone chamber dirt outlet, the cyclone chamber sidewall, the openable cyclone unit, the second stage cyclone, and the driving handle.

In some embodiments, surface cleaning apparatus 100 could be removably mountable on a base so as to form, for example, an upright vacuum cleaner, a canister vacuum cleaner, a stick vac, a wet-dry vacuum cleaner and the like. Power can be supplied to the surface cleaning apparatus 100 by an electrical cord (not shown) that can be connected to a standard wall electrical outlet. Alternatively, or in addition, the power source for the surface cleaning apparatus can be an onboard energy storage device, including, for example, one or more batteries.

Figure 78:
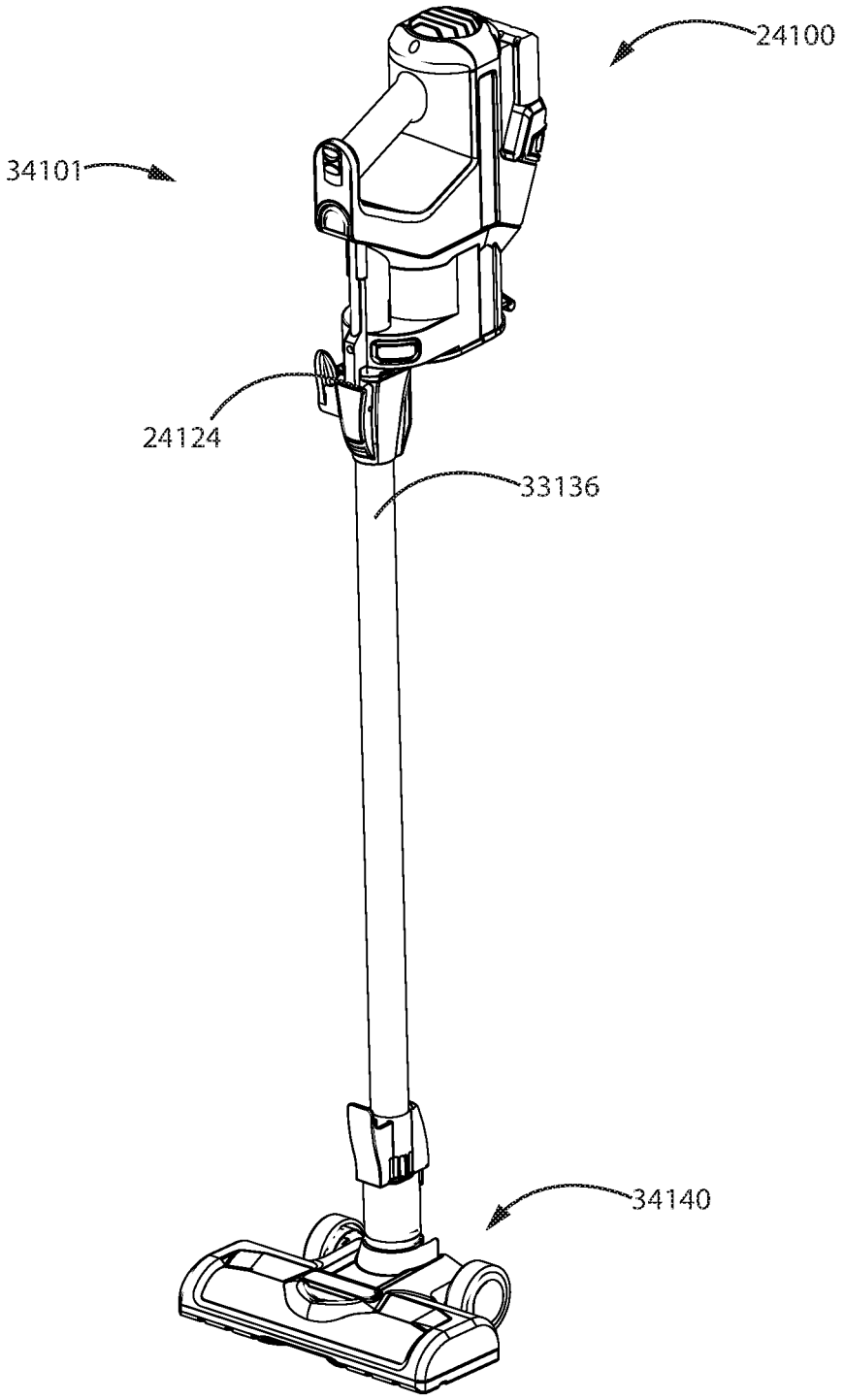
FIG. 78 is a perspective view of another example surface cleaning apparatus in accordance with at least one embodiment.
Figure 79:
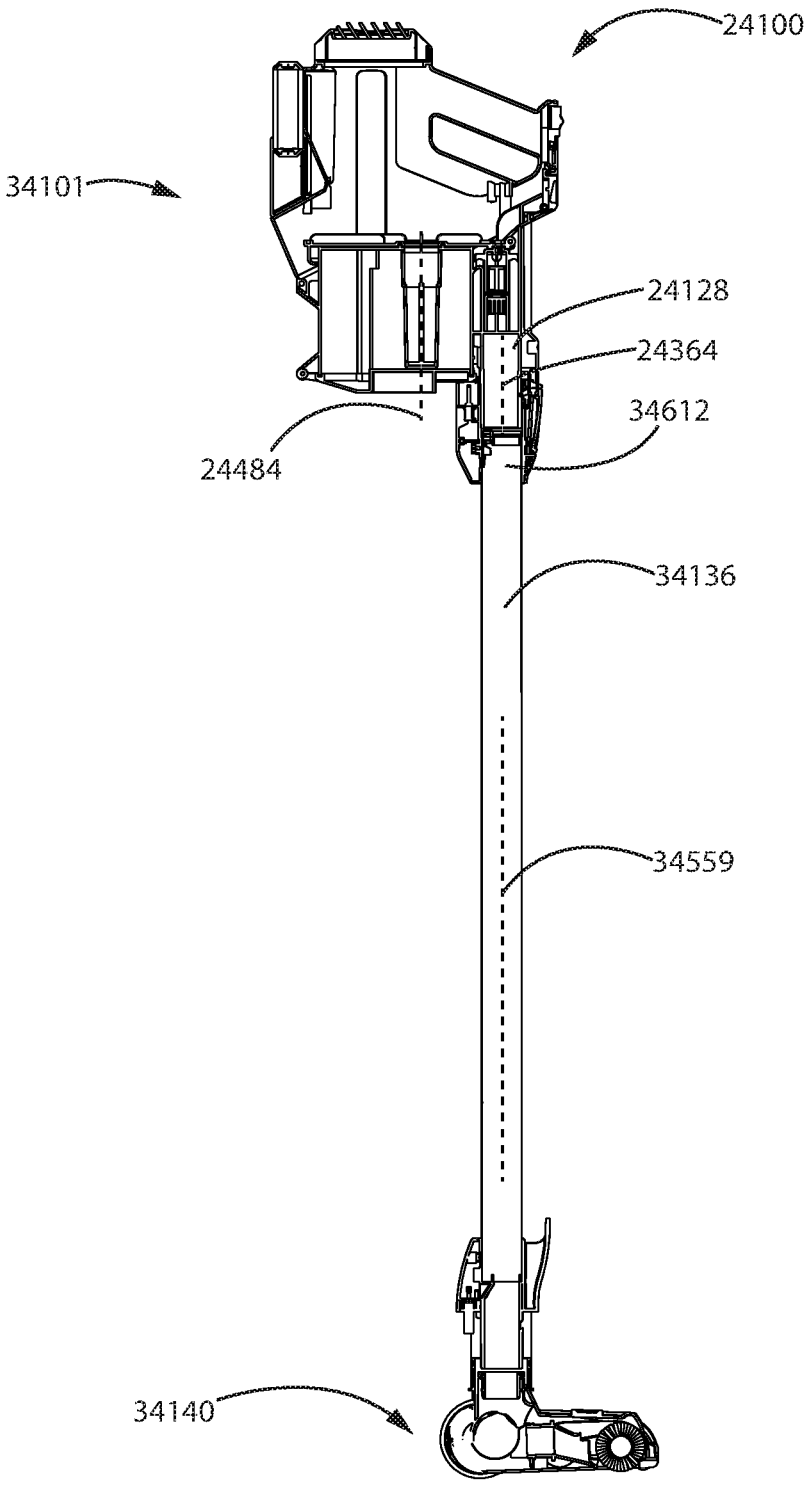
FIG. 79 is a cross-sectional view of the surface cleaning apparatus of FIG. 78.

As noted above, the inlet end 124 of the surface cleaning apparatus can be connected or directly connected to the downstream end of any suitable accessory tool such as a rigid air flow conduit (e.g. wand, crevice tool, mini brush or the like) for example. For example, FIGS. 78 and 79 show an exemplary surface cleaning apparatus 34101 (e.g. a stickvac) including surface cleaning apparatus 24100 with connector inlet end 24124 directly connected to a wand 34136 (e.g., wand outlet end 34612 may be removably connectable in air flow communication with inlet connector 24128) that is pivotally connected to a surface cleaning head 34140. Wand may be securable to connector 24128 by any means known in the art such as a locking member or a friction fit. In the illustrated configuration of FIG. 78, the surface cleaning apparatus 34100 can be used to clean a floor or other surface in a manner analogous to conventional upright-style vacuum cleaners.

As exemplified in FIG. 79, when inlet connector 24128 is mounted to a wand 34136 (i.e. a rigid air flow conduit), the wand axis 34559, the inlet connector axis 24364, and the cyclone axis of rotation 24484 may be parallel. An advantage of this embodiment is that this reduces bends in the air flow for improved air efficiency. It will be appreciated that only some of these axes may be parallel. For example, only the inlet connector axis 24364 and the cyclone axis of rotation 24484 may be parallel.

Alternately, a hand carriable surface cleaning apparatus may be mountable to a base in a non-operative configuration. This may facilitate storage of the hand carriable surface cleaning apparatus. For example, FIG. 79 illustrates an example of a surface cleaning apparatus 33101 in which a hand carriable surface cleaning apparatus 100 is mountable within an upright section 33136. This may provide a compact storage configuration for the surface cleaning apparatus 100. Additionally, this may allow a user to easily switch between use of the upright surface cleaning apparatus 33101 and hand vacuum 100.

Figure 80:
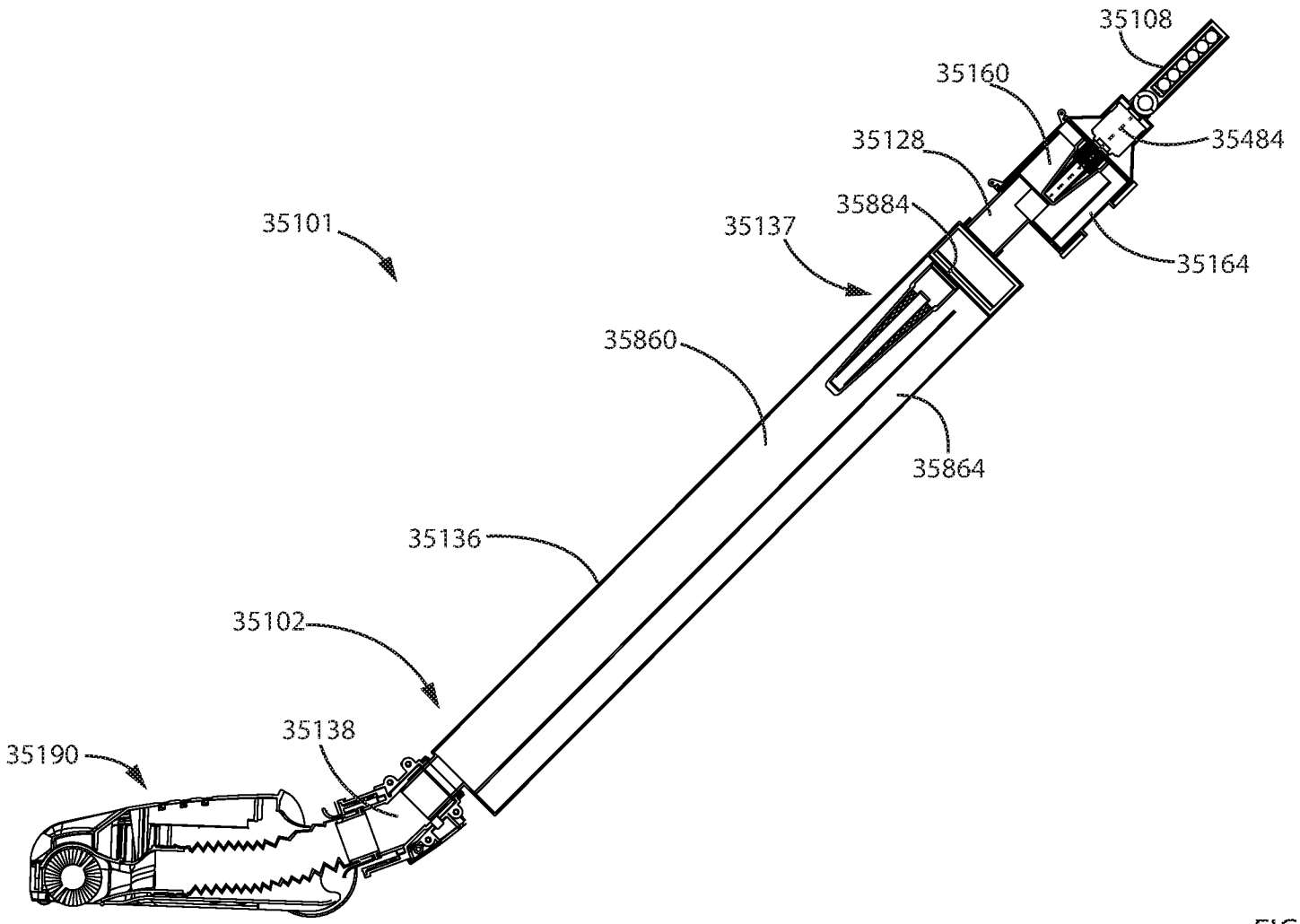
FIG. 80 is a side sectional view of another example surface cleaning apparatus in accordance with at least one embodiment.
Figure 81:
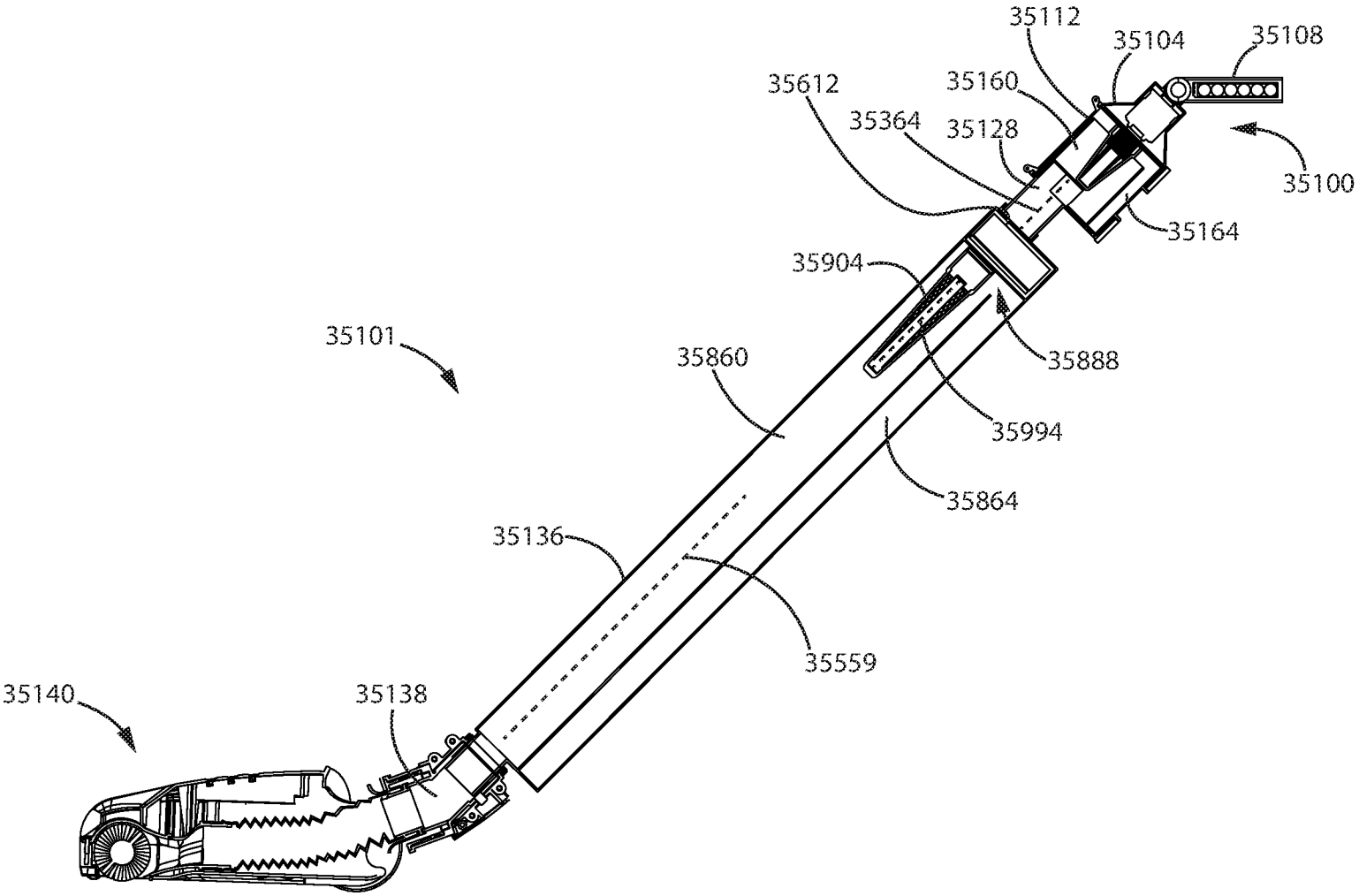
FIG. 81 is a side sectional view of the surface cleaning apparatus of FIG. 80 with the handle in a second use position in accordance with at least one embodiment.

FIGS. 80 and 81 show another exemplary surface cleaning apparatus 35101 including a hand carriable surface cleaning apparatus 35100 that is removably mountable to a base 35102 that includes a surface cleaning head 35140 and a wand 35136. The connector inlet end 35124 of the surface cleaning apparatus 35100 may be directly connected to a wand 35136 (e.g., wand outlet end 35612 may be removably connectable in air flow communication with inlet connector 35128) that is pivotally connected to a surface cleaning head 35140. Wand may be securable to connector 35128 by any means known in the art such as a locking member or a friction fit. In the illustrated configuration of FIG. 78, the surface cleaning apparatus 35100 can be used to clean a floor or other surface in a manner analogous to conventional upright-style vacuum cleaners.

As exemplified in FIGS. 80 and 81, when inlet connector 35128 is mounted to a wand 35136 (i.e. a rigid air flow conduit), the wand axis 35559, the inlet connector axis 35364, and the cyclone axis of rotation 35484 may be parallel. As shown in FIGS. 80 and 81 and as discussed subsequently, the handle 35108 may be adjusted between multiple in-use positions. For example, FIG. 80 shows handle 35108 in a first use position in which the handle extends aligned with the wand cyclone axis 35994 and secondary cyclone axis 35484. FIG. 81 illustrates handle 35108 in a second use position in which the handle is pivoted at an angle to the wand cyclone axis 35994 and cyclone axis 35484. This may facilitate a driving operation of the surface cleaning apparatus 35101, allowing a user to more easily direct the surface cleaning head in forward/rearward direction.

The hand carriable surface cleaning apparatus 35100 shown in FIGS. 80 and 81 is generally similar to the surface cleaning apparatus 1100, except that the portion of the main body 35104 rearward of the cyclone unit 35112 is narrowed and may omit a pre-motor filter. In particular, the cyclone air inlet 35128, cyclone chamber 35160, and dirt collection chamber 35164 may be configured in a manner analogous to air inlet 1128, cyclone chamber 1160, and dirt collection chamber 1164.

FIGS. 80 and 81 exemplify a stick surface cleaning apparatus comprising a surface cleaning head and an upper portion 35137. Upper portion 35137 includes an additional cyclone chamber 35860. When surface cleaning apparatus 35100 is mounted on the base 35102, the cyclone 35160 can define a secondary cyclonic stage for the surface cleaning apparatus 35101. This may provide increased dirt separation for the surface cleaning apparatus 35101.

The first cyclone 35860 has a cyclone axis 35994. When the surface cleaning apparatus 35100 is mounted on the base 35102, the cyclone axis 35994 can be parallel with the air inlet passage axis 35364 and cyclone axis 35484 of the hand vacuum cleaner 35100. Additionally, the cyclone air outlet 35884 can be parallel to, and even aligned with the air inlet passage 35128. This may reduce the number of bends in the airflow passage and provide for more efficient airflow through the surface cleaning apparatus 35101.

As exemplified in FIGS. 80 and 81, wand 35136 may comprise or consist of a cyclone chamber 35860 and a dirt collection chamber 35864. Accordingly the wand may be an air treatment member and, if a suction motor and fan assembly is provided (e.g., at an upper end of the cyclone chamber 35160), and a handle is provided at the upper end of the upright assembly, then the wand may be the sole cyclonic air treatment member of the surface cleaning apparatus. In such a case, a hand vac need not be provided downstream of the cyclone 35860. Accordingly, a stick vacuum cleaner may be defined by a surface cleaning head, a pivotally mounted upflow duct 35138 and wand 35136 that consists of a cyclone unit.

Cyclone chamber 35860 may be of any design disclosed herein. As exemplified, the longitudinally extending sidewalls of the cyclone chamber 35860 and the dirt collection chamber 35864 may define the rigid structure that drivingly connects the handle 35108 to the surface cleaning head 35190. Accordingly the longitudinally extending sidewalls of the cyclone chamber 35860 and the dirt collection chamber 35864 may define the outer walls of the upright section. As such, the cyclone chamber 35860 and the dirt collection chamber 35864 are the wand 35137.

Wand 35136 may be formed integrally with the upflow duct 35138 or removably mounted thereto.

A dirt collection chamber 35864 is fluidly connected to the cyclone chamber 35860 by dirt outlet 35888. As exemplified, the dirt collection chamber 35864 may be provided within the wand 35136. The dirt collection chamber 35864 can extend to the base of the wand 35136. This provides a substantial dirt collection volume while providing a thin wand 35136 (e.g., the wand may have a diameter of 2, 3, 4, 5 or 6 inches).

The cyclone chamber 35160 and the dirt collection chamber 35164 may be integrally formed or assembled together as a one piece assembly. Accordingly, the cyclone chamber 35160 and the dirt collection chamber 35164 may be removed as a unit from the surface cleaning head. The inlet end of the wand the is removably mounted to the upflow conduit 35138 may be removably connectable to an auxiliary cleaning tool, such as a crevice tool or a flexible hose.

Main Body Handle

The following is a description of a handle that may be used by itself in any surface cleaning apparatus or in any combination or sub-combination with any other feature or features disclosed including the uniflow cyclone, the cyclone chamber inlet, the cyclone chamber screen member, the dirt collection chamber, the cyclone chamber dirt outlet, the cyclone chamber sidewall, the openable cyclone unit, the second stage cyclone, and the mountable surface cleaning apparatus.

In accordance with this aspect, the handle for a surface cleaning apparatus may be pivotably connected to the main body of the surface cleaning apparatus. This may allow the handle to be adjusted to different use positions to provide flexibility for cleaning and/or storage.

Alternatively, or in addition, the power source for the surface cleaning apparatus can include an onboard energy storage device, including, for example, one or more batteries. The onboard energy storage device can be housed within the handle of the surface cleaning apparatus. The handle may be attached to a main body housing the suction motor of the surface cleaning apparatus. This may provide a balanced weight distribution for the surface cleaning apparatus with the weight of the onboard energy storage device balancing with the weight of the suction motor.

Figure 11:
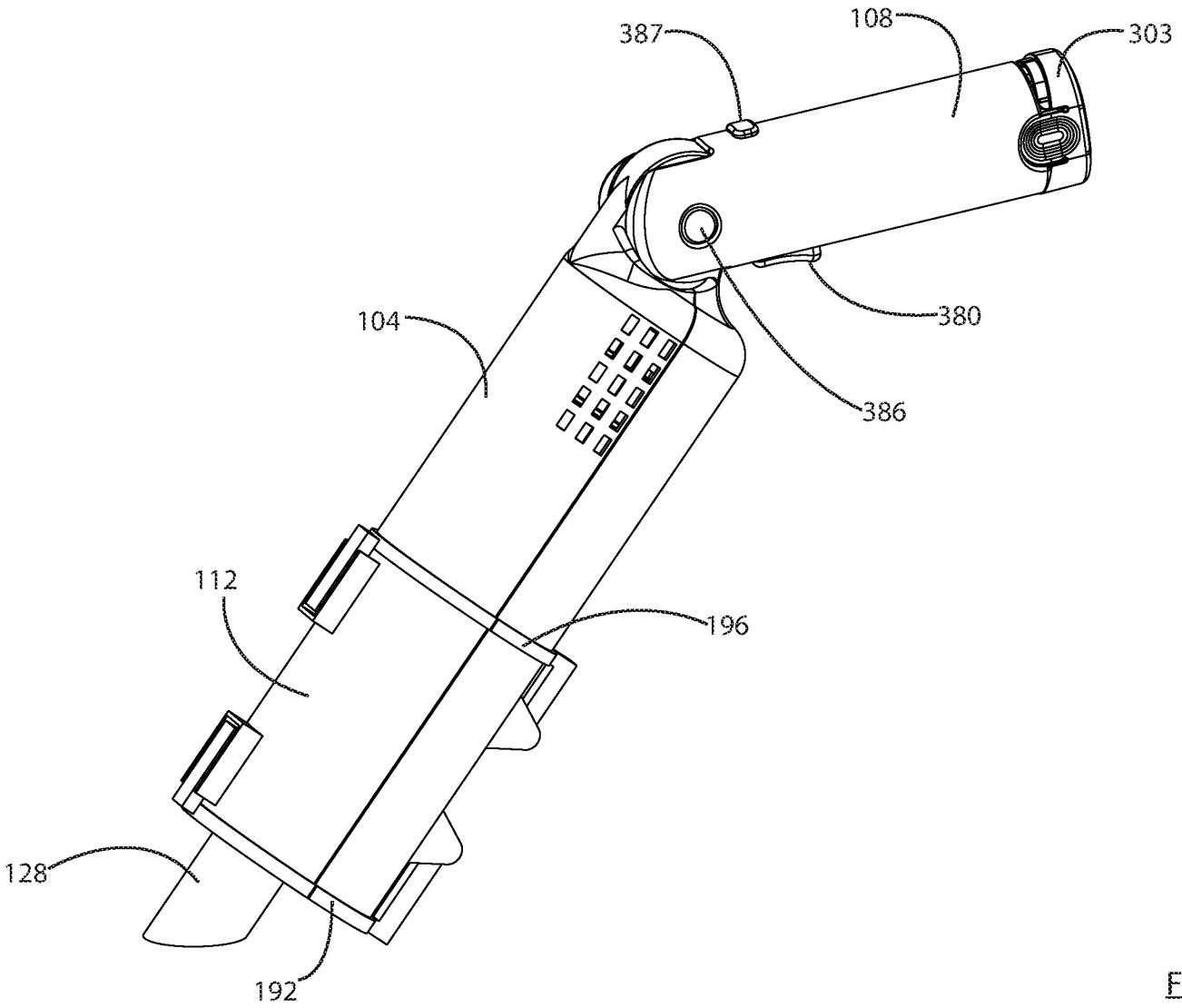
FIG. 11 is a side perspective view of the surface cleaning apparatus of FIG. 1 with the handle in a second use position.

FIGS. 1 and 11-13 illustrate an example of the configuration of a surface cleaning apparatus handle 108. As shown in FIGS. 1 and 11, the handle 108 can be adjusted between a first use position (shown in FIGS. 1 and 13) and a second use position (shown in FIGS. 11 and 12). In the first use position, the handle axis 376 may be parallel to the air inlet axis 364. This may provide the surface cleaning apparatus 100 with greater overall length from front 121 to back 122, allowing a user to more easily clean hard to reach areas.

In the second use position, the handle axis 376 can be positioned at an angle to the air inlet axis 364. For example, in the second use position the handle axis 376 may be at an angle to air inlet axis 364 of between about 10-90 degrees, 15-80 degrees, 25-65 degrees, or about 45 degrees. A user may grasp the handle 108 in a generally horizontal position with the inlet end 124 of the air inlet passage 128 aiming towards a horizontal surface. The handle may be moveable between different locking positions or it may be locked at any desired angular position.

Alternately or in addition, the handle may be adjustable to a third use position with the handle axis 376 at an angle of about 80-100 degrees, or 90 degrees to air inlet axis 364.

Returning to the example shown in FIGS. 1-13, the handle 108 may be movably mounted to the main body 104 in any suitable configuration to allow the handle to be adjusted between the various use positions. For example, the handle 108 can be pivotally attached to the main body 104, and/or removable altogether from the main body 104.

As exemplified, handle 108 is rotatable about a handle pivot axis 388 (see FIG. 1) between a first user position (FIG. 1), and a second user position (FIG. 1). It will be appreciated that handle 108 may be rotatable in any manner and direction suitable for moving handle 108 between the various use positions. In the illustrated embodiment, handle 108 is downwardly rotatable about a laterally extending (e.g. horizontal) handle pivot axis 388 located in an upper portion of the main body 104. As exemplified, the handle pivot axis 388 is transverse to (e.g. substantially perpendicular to), the handle axis 376, the inlet connector axis 364, and the cyclone axis of rotation 484.

Handle 108 may have any construction suitable for allowing the handle 108 to rotate about the handle pivot axis 388.

For example, handle 108 may be connected to main body 104 by a hinge 386 of any type known in the art.

Still referring to FIGS. 1 and 11-13, the handle 108 is secured in each use position, and manually user adjustable (e.g. by hand). This allows the handle 108 to remain in a desired use position while the apparatus 100 is operating, and allows the user to selectively adjust the user position of the handle 108 to the desired position when the apparatus 100 is turned off (or even while the apparatus 100 is still operating). In the illustrated example, handle 108 includes a handle position adjustment member 387 that is user operable to release the handle 108 from being secured in a user position to thereby permit handle 108 to move to an alternate use position.

Handle position adjustment member 387 may be any type of lock and release actuator suitable for retaining handle 108 in each use position, and which is user releasable to permit handle 108 to move between use positions. In some embodiments, Handle position adjustment member 387 may have a manually operable actuator for moving the lock between its secured and unsecured positions.

Alternately, the handle 108 may be fixed to the main body 104. This may provide a simpler construction that may reduce the potential for failure.

In the example embodiment shown in FIGS. 1-13, the handle 108 optionally houses the electronic control circuitry 300 for the surface cleaning apparatus 100. Additionally or alternatively, the handle 108 may also house an energy storage module 302 for the surface cleaning apparatus. This may ensure that the electronic control circuitry 300 and/or energy storage module 302 are maintained apart from the air flow pathway, which may prevent dirt from clogging the control circuitry and/or energy storage module 302.

As exemplified in FIGS. 12 and 13, an energy storage module 302 containing, e.g., one or more batteries or capacitors 304 can be housed within the handle 108. The handle 108 may be provided as a separate compartment from the main body 104 of the hand vacuum cleaner 100 in which the suction motor 152 is housed. By providing the energy storage module 302 in the handle 108, the weight of the batteries 304 may provide a counter-weight to the weight of the suction motor 152 and provide a more balanced weight distribution for a user manipulating the surface cleaning apparatus 100 using handle 108.

Alternately, the energy storage module may be stored external to the handle. For example, the energy storage module may be stored below the suction motor in a surface cleaning apparatus such as surface cleaning apparatus 24100 shown in FIG. 54.

Alternately, the surface cleaning apparatus may omit an energy storage module. For instance, the surface cleaning apparatus may be powered using an electrical cord that is connectable to an electrical power outlet or a dwelling.

Returning to FIG. 13, the handle 108 may include a removable base 303. The base 303 may be detachable from the handle 108 to provide access to the energy storage module 302. This may allow the batteries 304 to be removed for charging and/or replacement. In some cases, the energy storage module 302 may be removed as an enclosed container (e.g., a battery pack). Alternately, the batteries 302 may be separately removable.

Alternately or in addition, the batteries 302 may be rechargeable while contained within handle 108. For example, the surface cleaning apparatus 100 may have an electrical port that can be connected to an electrical power cord or a battery charger. The surface cleaning apparatus 100 may be connected to a power outlet in order to charge batteries 302.

The handle 108 can also include a power button 380 (see FIG. 11). The power button 380 may be used to activate and deactivate operation of the suction motor and fan assembly 152.

In some embodiments, the power button 380 may be used to activate and deactivate an output display on the surface cleaning apparatus.

The power button 380 can be manually operated by a user. The power button 380 can be positioned at a location on the handle 108 so that a user can activate the power button 380 while supporting the handle 108 with the same hand. For example, the power button 380 may be positioned on the bottom side 125 of the handle so that a user can operate the power button 380 with their index finger while supporting the handle 108 with the remaining three fingers on the same hand.

Figure 15:
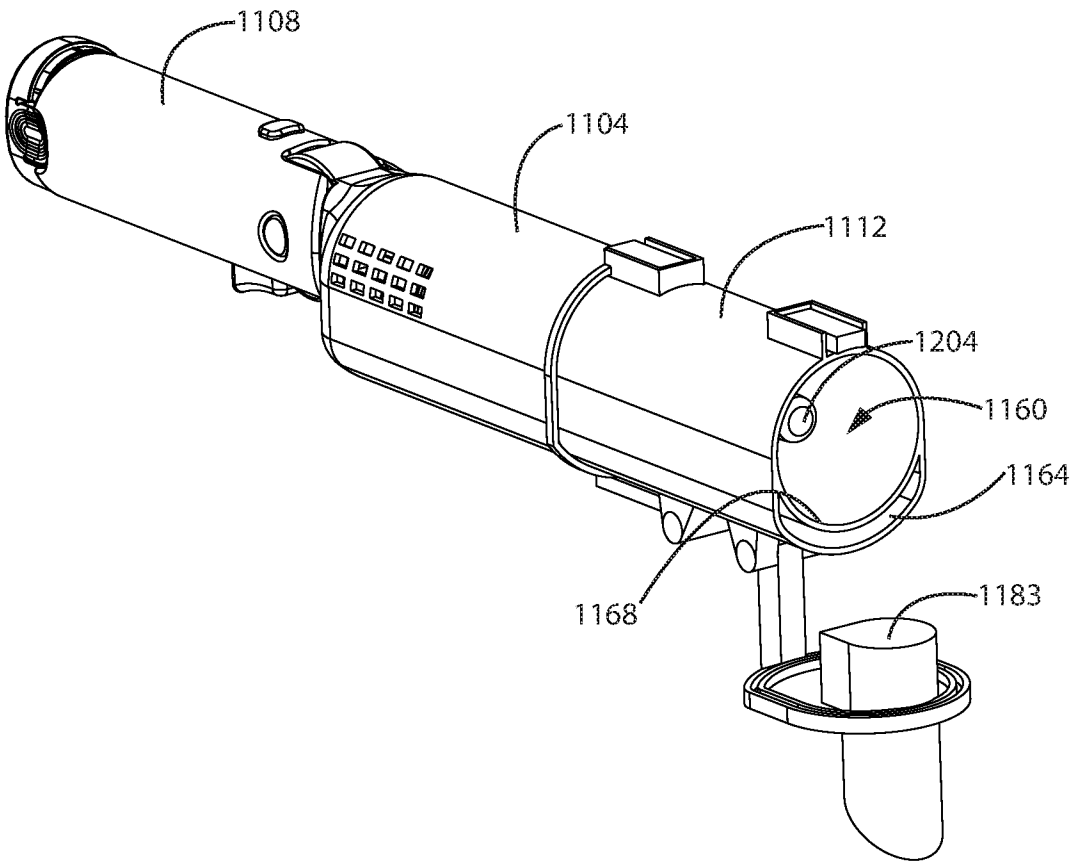
FIG. 15 is a perspective view of the surface cleaning apparatus of FIG. 14 from the front and side.
Figure 16:
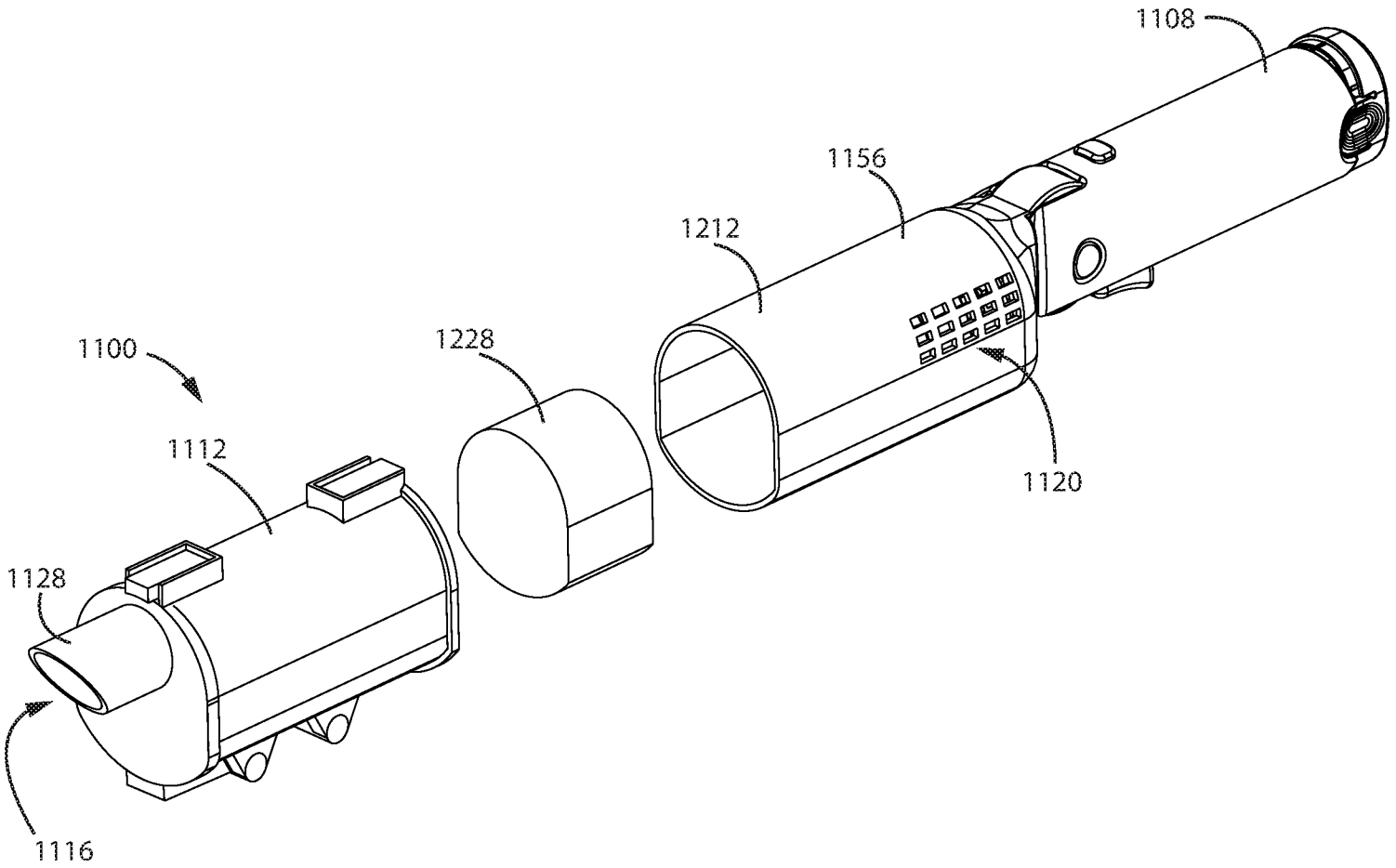
FIG. 16 is an exploded view of the surface cleaning apparatus of FIG. 14.
Figure 17:
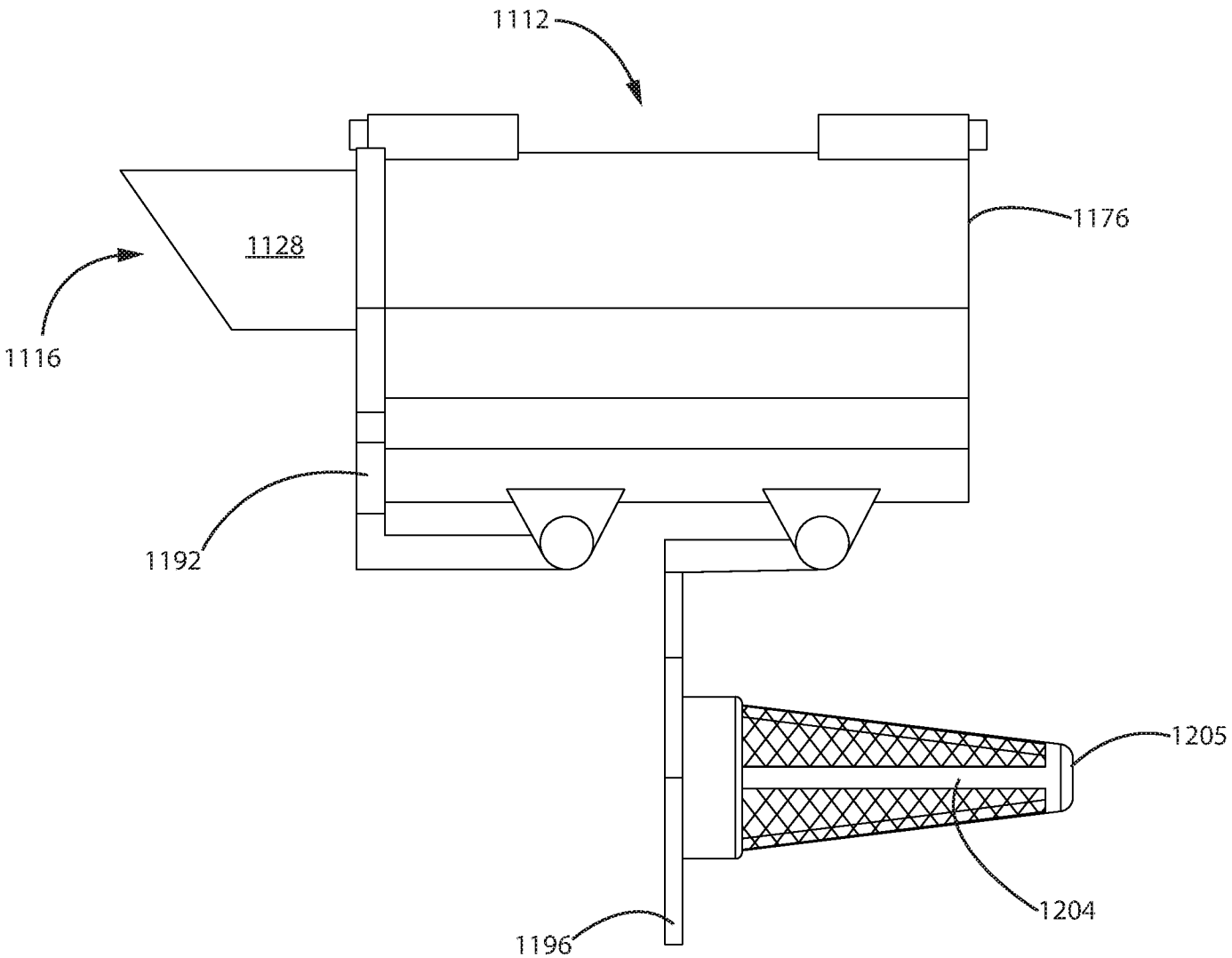
FIG. 17 is a side view of a cyclone unit of the surface cleaning apparatus of FIG. 14 with a rear door in an open position.
Figure 18:
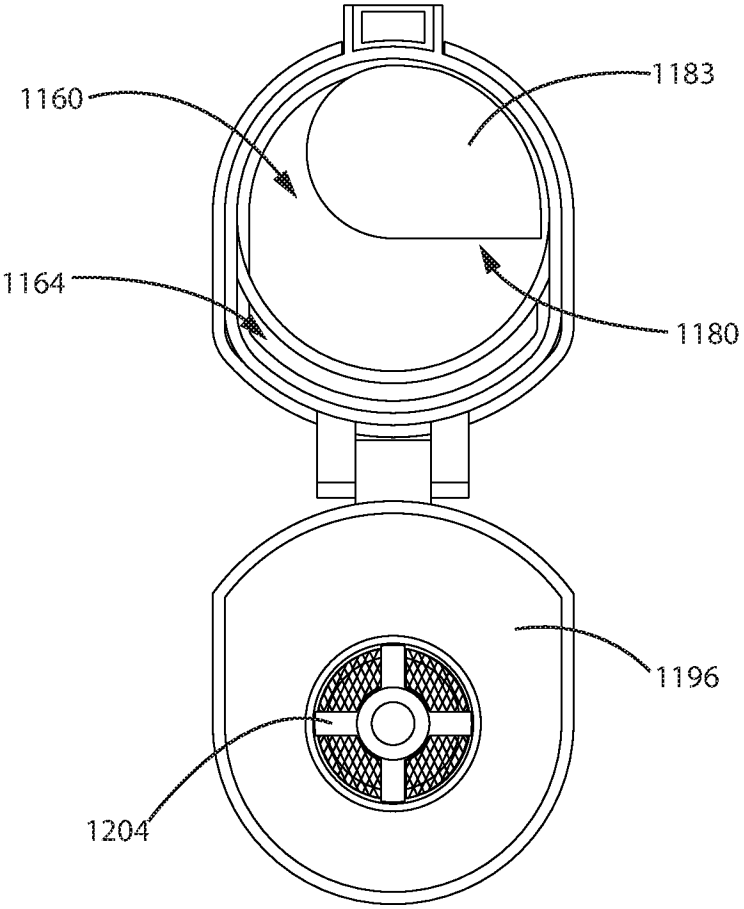
FIG. 18 is a rear view of the cyclone unit of FIG. 17 with the rear door in the open position.
Figure 21:
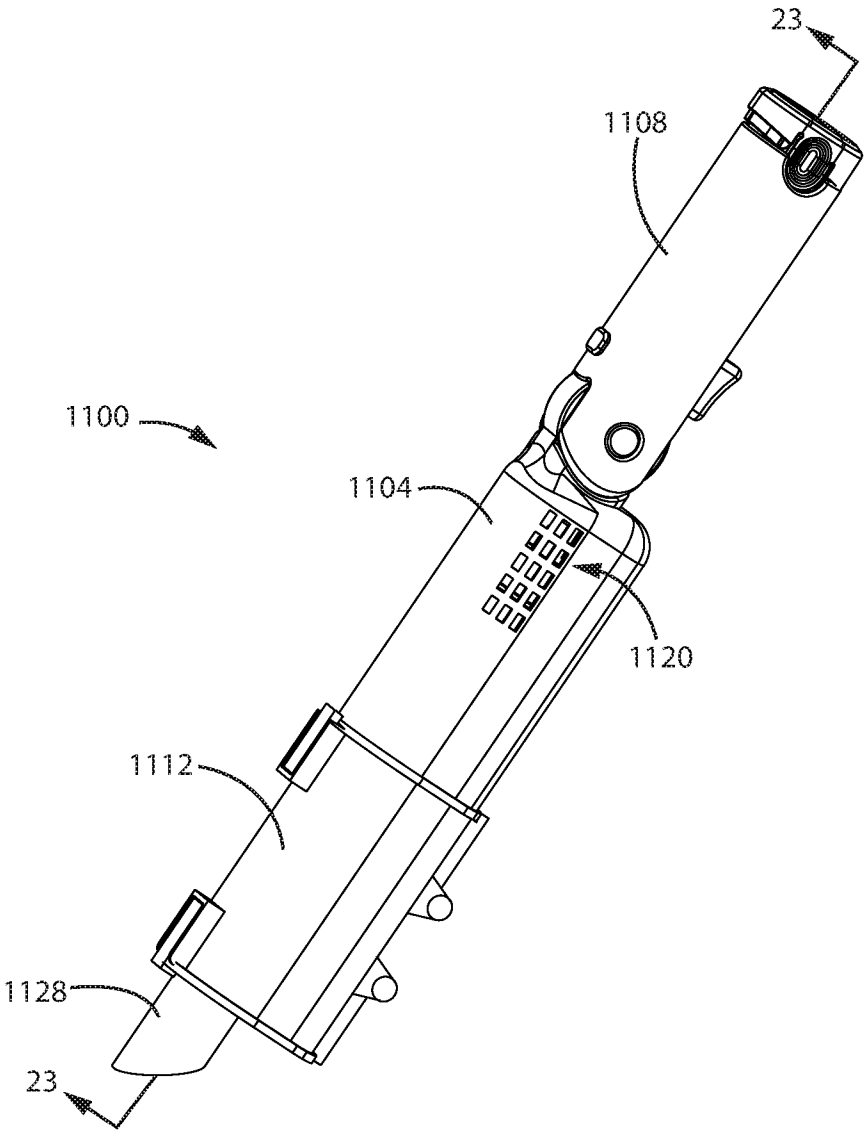
FIG. 21 is a side perspective view of the surface cleaning apparatus of FIG. 14.
Figure 22:
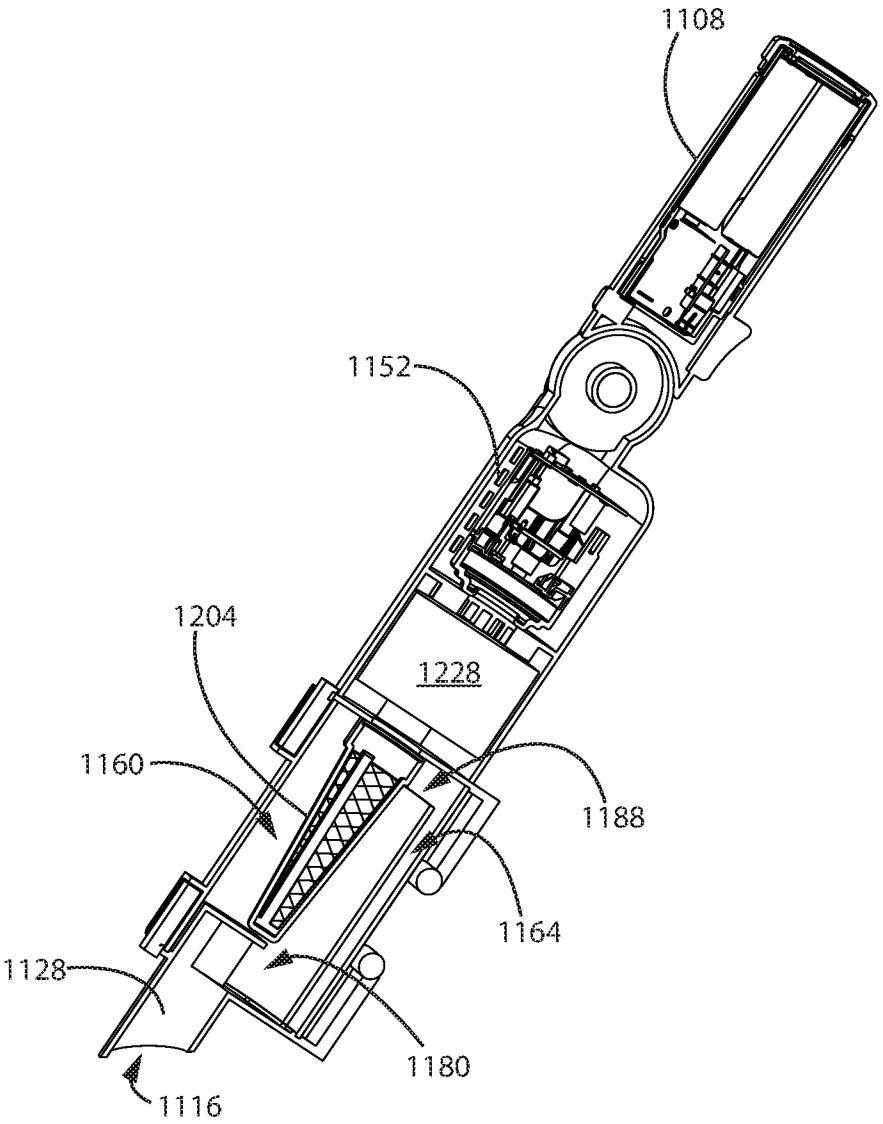
FIG. 22 is a perspective section view of the surface cleaning apparatus of FIG. 14 along line 23-23 in FIG. 21.

As shown in FIGS. 15 and 21, the handle 1108 can be configured with a power button 1380 on the bottom side 1125. This may encourage a user to operate the surface cleaning apparatus 1100 with the dirt collection chamber 1164 positioned below the cyclone chamber 1160, in particular in embodiments in which a majority of the dirt collection chamber 1164 is positioned below the cyclone chamber 1160.

Alternately or in addition, the driving handle may extend upwardly and forwardly (e.g., a pistol grip handle). As shown in FIGS. 52 and 54, driving handle 24108 may extend upwardly from the suction motor housing (e.g., an upper surface of the main body that houses the suction motor). Driving handle 24108 may terminate at or above an upper end of the handvac 24100. Accordingly, the inlet conduit axis 24364 may intersect the driving handle 24108. An advantage of this design is that the weight of the motor is below the hand grip. Further, the driving axis of the handvac when connected to a wand (the wand axis) is at an opposite end of the handle to the suction motor. This provides improved hand weight for a user.

As exemplified in FIG. 54, handle 24108 may extend from its lower end 24368 to its upper end 24372 along a handle axis 24376. When surface cleaning apparatus 24100 is positioned with bottom 24125 on a horizontal surface and the bottom 24125 extends horizontally, handle axis 24376 may extend generally upwardly and forwardly (e.g. at an angle of less than 45 degrees to vertical) to provide a comfortable natural grip during use.

In the illustrated embodiment, handle 24108 includes a portion 24377 spaced from main body 24104 whereby a finger receiving area 24379 is provided between the driving handle 24108 and the main body 24104. As exemplified, handle 24108 may be positioned at the rear end of main body 24104.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A surface cleaning apparatus comprising an air flow path extending from a dirty air inlet to a clean air outlet with a cyclone and a suction motor positioned in the air flow path, the cyclone comprising:

(a) a cyclone chamber having a longitudinally extending cyclone axis of rotation, a first end, an opposed end spaced apart in a longitudinal axial direction from the first end, a tangential air inlet located at the first end, a cyclone air outlet located at the opposed end, a dirt outlet and a tapered screen member; and, (b) a dirt collection chamber exterior to the cyclone chamber and in communication with the cyclone chamber via the dirt outlet, the dirt collection chamber extending around at least 50% of an outer perimeter of the cyclone chamber, wherein the tangential inlet has an inlet width extending in the longitudinal axial direction from a first side to a second side spaced apart in a longitudinal axial direction from the first side wherein the second side of the tangential inlet is axially inwardly closer to the opposed end than the first side of the tangential inlet is to the opposed end, and wherein the screen member has an outlet end located at the opposed end of the cyclone chamber and extends to distal screen end located adjacent the second side of the tangential inlet, the screen member tapers from the outlet end of the screen member to the distal screen end.

2. The surface cleaning apparatus of claim 1 wherein the dirt collection chamber extends around at least 75% of the outer perimeter of the cyclone chamber.

3. The surface cleaning apparatus of claim 1 wherein the dirt collection chamber is annular.

4. The surface cleaning apparatus of claim 2 wherein the dirt collection chamber comprises first and second discrete dirt collection chambers, and the cyclone chamber dirt outlet comprises first and second dirt outlets, each of the first and second discrete dirt collection chambers extends part way around the outer perimeter of the cyclone chamber, the first discrete dirt collection chamber is in communication with the cyclone chamber via the first dirt outlet and the second discrete dirt collection chamber is in communication with the cyclone chamber via the second dirt outlet.

5. The surface cleaning apparatus of claim 1 wherein the tangential air inlet comprises a conduit located interior the cyclone chamber.

6. The surface cleaning apparatus of claim 1 wherein the distal end of the screen member terminates 0.01 — 0.75 inches axially inwardly from the second side of the tangential inlet.

7. The surface cleaning apparatus of claim 6 wherein the distal end of the screen member terminates 0.05 — 0.375 inches axially inwardly from the second side of the tangential inlet.

8. The surface cleaning apparatus of claim 6 wherein the distal end of the screen member terminates axially outwardly from the second side of the tangential inlet and a portion of the screen axially outwardly of the second side of the tangential inlet is solid.

9. The surface cleaning apparatus of claim 1 wherein the screen member has a non-porous portion at the opposed end of the cyclone chamber and the dirt outlet is located radially outwardly of the non-porous portion.

10. The surface cleaning apparatus of claim 1 wherein the second side of the tangential inlet comprises a wall that is generally located in a plane that is transverse to the longitudinal axis.

11. The surface cleaning apparatus of claim 1 wherein the second side of the tangential inlet is a wall that is located in a plane that is generally transverse to the longitudinal axis.

12. The surface cleaning apparatus of claim 1 wherein the cyclone chamber has a cyclone chamber sidewall extending from the first end of the cyclone chamber to the dirt outlet and the cyclone chamber sidewall has a radial width and the radial width narrows at a location between the second side of the tangential inlet and the opposed end of the cyclone chamber.

* * * * *